US008215640B2

(12) United States Patent
Sasaki

(10) Patent No.: US 8,215,640 B2
(45) Date of Patent: Jul. 10, 2012

(54) GAMING MACHINE THAT RANDOMLY DETERMINES OSCILLATION MODE OF TABLE FOR ROLLING DICE

(75) Inventor: Yoshitomo Sasaki, Koto-ku (JP)

(73) Assignee: Aruze Gaming America, Inc., Las Vegas, NV (US)

( * ) Notice: Subject to any disclaimer, the term of this patent is extended or adjusted under 35 U.S.C. 154(b) by 437 days.

(21) Appl. No.: 12/551,122

(22) Filed: Aug. 31, 2009

(65) Prior Publication Data

US 2010/0059933 A1 Mar. 11, 2010

Related U.S. Application Data

(60) Provisional application No. 61/096,140, filed on Sep. 11, 2008, provisional application No. 61/096,173, filed on Sep. 11, 2008, provisional application No. 61/096,192, filed on Sep. 11, 2008, provisional application No. 61/095,808, filed on Sep. 10, 2008, provisional application No. 61/095,853, filed on Sep. 10, 2008.

(51) Int. Cl.
*A63F 9/04* (2006.01)

(52) U.S. Cl. ..... 273/145 D; 273/145 E; 273/145 R

(58) Field of Classification Search ..... 273/145 E, 273/145 D, 145 R
See application file for complete search history.

(56) References Cited

U.S. PATENT DOCUMENTS

| | | | | | |
|---|---|---|---|---|---|
| 483,115 | A | * | 9/1892 | Johnson | 273/145 D |
| 2,186,465 | A | * | 1/1940 | Miller | 273/145 D |
| 2,481,680 | A | * | 9/1949 | Mills | 273/145 R |
| 2,693,962 | A | * | 11/1954 | Stevens | 273/145 D |
| 2,919,921 | A | * | 1/1960 | Berger | 273/145 D |
| 3,834,713 | A | * | 9/1974 | Ito et al. | 273/145 E |
| 3,856,307 | A | * | 12/1974 | Tinman | 273/238 |
| 4,892,311 | A | * | 1/1990 | Zaitsu | 273/145 D |
| 5,413,351 | A | | 5/1995 | Franklin | |
| 5,434,572 | A | | 7/1995 | Smith | |
| 7,361,090 | B2 | * | 4/2008 | Lin | 463/22 |
| 2007/0026947 | A1 | | 2/2007 | Chun | |

FOREIGN PATENT DOCUMENTS

| | | |
|---|---|---|
| JP | 8-21875 | 1/1996 |
| WO | WO 2007/016776 A1 | 2/2007 |

* cited by examiner

*Primary Examiner* — Benjamin Layno
(74) *Attorney, Agent, or Firm* — Lexyoume IP Meister, PLLC.

(57) ABSTRACT

A gaming machine starts a unit game, extracts one set of oscillation pattern data from memory at random when the unit game is started, and performs control to oscillate a playing unit based on the one set of the oscillation pattern data thus extracted.

12 Claims, 70 Drawing Sheets

FIG. 17

INSTRUCTION IMAGE DISPLAY DETERMINATION TABLE

| DEALER'S LEVEL | BET START INSTRUCTION IMAGE | BET END INSTRUCTION IMAGE |
|---|---|---|
| HIGH LEVEL | × | × |
| INTERMEDIATE LEVEL | × | ○ |
| LOW LEVEL | ○ | ○ |

FIG. 18

BET EXISTENCE DETERMINATION TABLE

| | STATION NUMBER | | | | | | | | | |
|---|---|---|---|---|---|---|---|---|---|---|
| | 1 | 2 | 3 | 4 | 5 | 6 | 7 | 8 | 9 | 10 |
| BET | A | P | P | A | A | P | P | P | P | A |

FIG. 19

OSCILLATION MODE DATA TABLE

| OSCILLATION PATTERN | OSCILLATION MODE | | |
|---|---|---|---|
| PATTERN 1 | SMALL OSCILLATION 5 SEC. | LARGE OSCILLATION 5 SEC. | SUBTLE OSCILLATION 5 SEC. |
| PATTERN 2 | SMALL OSCILLATION 4 SEC. | LARGE OSCILLATION 5 SEC. | SUBTLE OSCILLATION 6 SEC. |
| PATTERN 3 | SMALL OSCILLATION 6 SEC. | LARGE OSCILLATION 4 SEC. | SUBTLE OSCILLATION 5 SEC. |
| PATTERN 4 | SMALL OSCILLATION 3 SEC. | LARGE OSCILLATION 8 SEC. | SUBTLE OSCILLATION 4 SEC. |
| ⋮ | ⋮ | ⋮ | ⋮ |

FIG. 17D

INSTRUCTION IMAGE DISPLAY DETERMINATION TABLE

| DEALER'S LEVEL | BET START INSTRUCTION IMAGE | BET END INSTRUCTION IMAGE |
|---|---|---|
| HIGH LEVEL | × | × |
| INTERMEDIATE LEVEL | × | ○ |
| LOW LEVEL | ○ | ○ |

FIG. 18D

BET EXISTENCE DETERMINATION TABLE

| | STATION NUMBER | | | | | | | | | |
|---|---|---|---|---|---|---|---|---|---|---|
| | 1 | 2 | 3 | 4 | 5 | 6 | 7 | 8 | 9 | 10 |
| BET | A | P | P | A | A | P | P | P | P | A |

FIG. 19D

OSCILLATION MODE DATA TABLE

| OSCILLATION PATTERN | OSCILLATION MODE | | |
|---|---|---|---|
| PATTERN 1 | SMALL OSCILLATION 5 SEC. | LARGE OSCILLATION 5 SEC. | SUBTLE OSCILLATION 5 SEC. |
| PATTERN 2 | SMALL OSCILLATION 4 SEC. | LARGE OSCILLATION 5 SEC. | SUBTLE OSCILLATION 6 SEC. |
| PATTERN 3 | SMALL OSCILLATION 6 SEC. | LARGE OSCILLATION 4 SEC. | SUBTLE OSCILLATION 5 SEC. |
| PATTERN 4 | SMALL OSCILLATION 3 SEC. | LARGE OSCILLATION 8 SEC. | SUBTLE OSCILLATION 4 SEC. |
| ⋮ | ⋮ | ⋮ | ⋮ |

FIG. 20

RENDERED EFFECT TABLE

| OSCILLATION MODE | TYPE OF SOUND |
|---|---|
| SMALL OSCILLATION | SOUND 1 |
| LARGE OSCILLATION | SOUND 2 |
| SUBTLE OSCILLATION | SOUND 3 |

FIG. 21

IC TAG DATA TABLE

| IDENTIFICATION DATA 1 | | IDENTIFICATION DATA 2 | | IDENTIFICATION DATA 3 | |
|---|---|---|---|---|---|
| TYPE | NUMBER OF DOTS | TYPE | NUMBER OF DOTS | TYPE | NUMBER OF DOTS |
| RED | 6 | WHITE | 3 | BLACK | 5 |

FIG. 22

INFRARED CAMERA CAPTURING DATA TABLE

| X | Y | 181 | 182 | 183 | 184 | 185 | 186 | 187 |
|---|---|---|---|---|---|---|---|---|
| −50 | 55 | ○ | ○ | × | ○ | × | ○ | ○ |

FIG. 20D

INFRARED CAMERA CAPTURING DATA TABLE

| X | Y | 181 | 182 | 183 | 184 | 185 | 186 | 187 |
|---|---|---|---|---|---|---|---|---|
| -50 | 55 | ○ | ○ | × | ○ | × | ○ | ○ |

FIG. 21D

DOT PATTERN DATA CLASSIFICATION TABLE

| DOT | EXISTENCE OF INFRARED ABSORPTION INK | | | | | | | |
|---|---|---|---|---|---|---|---|---|
| 181 | × | ○ | × | × | ○ | ○ | × | ○ |
| 182 | × | × | ○ | × | ○ | × | ○ | ○ |
| 183 | × | × | × | ○ | × | ○ | ○ | ○ |
| COLOR | - | - | - | - | RED | WHITE | BLACK | - |

FIG. 22D

NUMBER OF DOTS-DOT PATTERN DATA TABLE

| DOT | EXISTENCE OF INFRARED ABSORPTION INK | | | | | | | | | | | | | | | |
|---|---|---|---|---|---|---|---|---|---|---|---|---|---|---|---|---|
| 184 | × | ○ | × | × | × | ○ | ○ | ○ | × | × | × | ○ | ○ | ○ | × | ○ |
| 185 | × | × | ○ | × | × | ○ | × | × | ○ | ○ | × | ○ | ○ | × | ○ | ○ |
| 186 | × | × | × | ○ | × | × | ○ | × | ○ | × | ○ | ○ | × | ○ | ○ | ○ |
| 187 | × | × | × | × | ○ | × | × | ○ | × | ○ | ○ | × | ○ | ○ | ○ | ○ |
| NUMBER OF DOTS | - | - | - | - | - | - | - | 1 | 2 | - | - | 3 | 4 | 5 | 6 | - |

FIG. 23

DOT PATTERN DATA CLASSIFICATION TABLE

| DOT | EXISTENCE OF INFRARED ABSORPTION INK | | | | | | | |
|---|---|---|---|---|---|---|---|---|
| 181 | × | ○ | × | × | ○ | ○ | × | ○ |
| 182 | × | × | ○ | × | ○ | × | ○ | ○ |
| 183 | × | × | × | ○ | × | ○ | ○ | ○ |
| COLOR | – | – | – | – | RED | WHITE | BLACK | – |

FIG. 24

NUMBER OF DOTS-DOT PATTERN DATA TABLE

| DOT | EXISTENCE OF INFRARED ABSORPTION INK | | | | | | | | | | | | | | | |
|---|---|---|---|---|---|---|---|---|---|---|---|---|---|---|---|---|
| 184 | × | ○ | × | × | × | ○ | ○ | ○ | × | × | × | ○ | ○ | ○ | × | ○ |
| 185 | × | × | ○ | × | × | ○ | × | × | ○ | ○ | × | ○ | ○ | × | ○ | ○ |
| 186 | × | × | × | ○ | × | × | ○ | × | ○ | × | ○ | ○ | × | ○ | ○ | ○ |
| 187 | × | × | × | × | ○ | × | × | ○ | × | ○ | ○ | × | ○ | ○ | ○ | ○ |
| NUMBER OF DOTS | – | – | – | – | – | – | – | 1 | 2 | – | – | 3 | 4 | 5 | 6 | – |

GAMING MACHINE THAT RANDOMLY DETERMINES OSCILLATION MODE OF TABLE FOR ROLLING DICE

CROSS REFERENCE TO RELATED APPLICATIONS

This application claims benefit of U.S. Provisional Application Nos. 61/095,853, filed Sep. 10, 2008, 61/096,192, filed Sep. 11, 2008, 61/096,173, filed Sep. 11, 2008, 61/096,140, filed Sep. 11, 2008, and 61/095,808, filed Sep. 10, 2008, the entire contents of which are incorporated herein by reference.

BACKGROUND OF THE INVENTION

1. Field of the Invention

The present invention relates to a gaming machine that randomly determines an oscillation mode of a table for rolling dice.

2. Related Art

Conventionally, various table games are well known and, for example, among table games, there exists a game genre of so-called dice games, as disclosed in WO 07/016776, U.S. Patent Application Publication No. 2007/0026947, and U.S. Pat. No. 5,413,351.

Among dice games, for example, as disclosed in U.S. Pat. No. 5,413,351, a game method is disclosed in which, upon a player placing a bet, a dealer throws dice and, in a case where a result thereof becomes a predetermined combination, the player is entitled to throw the dice, and has a chance to win a payout of a large amount. In addition, Sic Bo is known as an old and familiar dice game in Asia in which a player places a bet on predicted numbers of dots to appear on three thrown dice.

Sic Bo is well known as a dice game of ancient China, and is a dice game in which a player places a bet on predicted numbers of dots or a combination thereof to appear on three thrown dice. Ways of betting and odds are displayed on a player's table (these may be displayed using an image display unit). On the table are provided an area for placing a bet on a predicted number of dots to appear on a single die, an area for placing a bet on the same predicted number of dots to appear on two dice, an area for placing a bet on the same predicted number of dots to appear on three dice, an area for placing a bet on a predicted combination to appear on two dice, an area for placing a bet on a predicted total number of dots to appear on three dice, and the like. Odds cannot be uniformly determined due to regional or national conditions; however, these are typically set within a range from 1:1 to approximately 1:180 according to occurrence probabilities.

In dice games, for example, there has been a problem in that, when dice are rolled by oscillating a table up and down, patterns of oscillation are monotonous, whereby players may easily lose interest.

It is an object of the present invention to provide a gaming machine that randomly determines an oscillation mode of a table for a rolling die, thereby enabling monotonousness of the game to be avoided and provide a more amusing gaming machine.

SUMMARY OF THE INVENTION

According to a first aspect of the present invention, a gaming machine includes: a table on which a die is placed on an upper surface; a shaft installed to be upright at a lower surface of the table; and a control device that controls driving of the shaft in a vertical direction so as to move the table up and down to cause the die to roll on the table, and then cease vertical movement of the table.

According to a second aspect of the present invention, a gaming machine includes a playing unit in which a plurality of dice rolls and comes to rest; an oscillation device that oscillates the playing unit; memory that stores a plurality of sets of oscillation pattern data corresponding to each of a plurality of oscillation patterns based on which the playing unit is oscillated by the oscillation device; and a controller that executes processing for: (a) starting a unit game; (b) extracting one set of the oscillation pattern data from the memory at random when the unit game is started; and (c) performing control to oscillate the playing unit based on the one set of the oscillation pattern data thus extracted.

According to the second aspect of the present invention, since the controller extracts one set of the oscillation pattern data from the memory at random, and oscillates the oscillation device based on the one set of the oscillation pattern data thus extracted, the game does not become monotonous, whereby a more amusing gaming machine can be provided.

According to a third aspect of the present invention, in the gaming machine according to the second aspect of the present invention, the oscillation pattern is configured with a combination of types of oscillation modes.

According to the third aspect of the present invention, since a plurality of types of oscillation modes is performed in a unit game, the game does not become monotonous, whereby a more amusing gaming machine can be provided.

According to a fourth aspect of the present invention, in the gaming machine according to the third aspect of the present invention, the playing unit is formed to be substantially planar, and the combination of types of oscillation modes are a combination of various amplitudes of oscillation at which the playing unit oscillates substantially in the vertical direction with respect to the playing unit.

According to the fourth aspect of the present invention, since the playing unit is oscillated based on the combination of types of oscillation, the game does not become monotonous, whereby a more amusing gaming machine can be provided.

According to a fifth aspect of the present invention, a gaming machine is provided which includes a table on which a die is placed on an upper surface; a shaft installed to be upright at a lower surface of the table; a linear actuator that drives the shaft in a vertical direction; a base, provided below the table, for supporting the linear actuator; and a control device to control the linear actuator so as to move the table vertically, to roll the dice on the table, and to cease the vertical movement of the table, in which a spring member for biasing the table to an upper side is provided between the table and the base.

According to the fifth aspect of the present invention, since the spring member is provided between the base and the table for rolling the dice, the table is biased to an upper side, a result of which a load applied to the linear actuator through the shaft from the table is reduced. Furthermore, since the spring member is provided, when the table is moved up and down, a certain level of biasing force from the spring member is added with respect to the vertical movement of the table, whereby the linear actuator allows the shaft to be moved quickly as well as efficiently, and results in it being possible to reduce the electric power consumption of the linear actuator. Thus, it is possible to provide a gaming machine having a function of rolling and making dice come to rest by moving a table up and down efficiently as well as quickly.

According to a ninth aspect of the present invention, a gaming machine is provided which includes: a table on which a die is placed; a shaft installed to be upright to the table in a vertical direction; a cylindrical linear actuator that is fixed below the table, has an opening into which the shaft is inserted, and applies a thrust force to drive the shaft in a vertical direction; and a control device to control the linear actuator so as to move the table up and down, to roll the dice on the table, and to cease the vertical movement of the table, in which a groove in a vertical direction is formed in one of the linear actuator or the shaft, a convex portion is formed in the other, and the convex portion is positioned inside the groove when the shaft is inserted into the opening.

According to the ninth aspect of the present invention, for example, since the convex portion is formed at the shaft, the groove in a vertical direction is formed inside the cylindrical linear actuator, and the convex portion is inserted into the groove when the shaft is inserted into the linear actuator, the movement of the shaft in a rotating direction is regulated and the shaft is guided in a vertical direction. Thus, since the rotation of the circular table during a stopped time is regulated, a change in the number of the dots appearing on the dice caused by rotation of the circular table can be prevented. Thus, it is possible to provide a gaming machine having a function of rolling the dice by the vertical movement of the table and then ceasing the table and reliably making the dice come to rest.

According to a thirteenth aspect of the present invention, a gaming machine is provided which includes: a table on which a die is placed; a shaft installed upright to the table in a vertical direction; a cylindrical linear actuator that is fixed below the table, has an opening into which the shaft is inserted, and applies a thrust force to drive the shaft in a vertical direction; and a control device that controls the linear actuator so as to move the table up and down, roll the dice on the table, and cease the vertical movement of the table, in which the shaft includes magnetizing regions that are formed to be aligned in a vertical direction on a surface thereof and are magnetized so that adjacent magnetic poles are different from each other, the linear actuator includes coils that are arranged side by side in an vertical direction, when the shaft is inserted into the opening, the coils and the magnetizing regions are facing, and a thrust force is generated on the shaft according to attraction and repulsion by magnetic force of the coil and magnetic force of the magnetizing regions, which is generated by applying electrical current to the coils to excite the coils, and the control device controls a vertical position of the table.

According to the thirteenth aspect of the present invention, it is easily possible to control a position of the shaft such as by moving the shaft greatly or subtly by way of controlling electric current applied to the coil. Accordingly, by moving the table up and down with large oscillation initially, the dice on the table are greatly rolled, then by gradually decreasing the movement, the height at which the dice hop is decreased and then the dice come to rest, and even if the dice 70 are temporarily overlapping on the circular table 3*a*, a state in which the dice are overlapping is broken up by subtle vertical movement. Thus, it is possible to provide a gaming machine having a function of causing dice to roll and come to rest so that the dice are not overlapping each other.

According to a sixteenth aspect of the present invention, a gaming machine includes a playing unit that is substantially horizontal and on which a plurality of dice rolls and comes to rest; an oscillation device that causes the playing unit to oscillate substantially in a vertical direction with respect to the playing unit; and a controller that executes processing of: (a) starting a unit game; (b) when the unit game is started, performing control that causes the playing unit to oscillate for a predetermined time with a combination of oscillations larger than a predetermined oscillation and oscillations smaller than the predetermined oscillation; (c) after elapse of the predetermined time, performs control that causes the playing unit to oscillate with oscillations smaller than the predetermined oscillation; and (d) performs control to cease the oscillation of the playing unit.

According to the sixteenth aspect of the present invention, since the controller performs control that causes the playing unit to oscillate with oscillations smaller than the predetermined oscillation after elapse of the predetermined time, and then performs control to cease the oscillation of the playing unit, for example, it is possible to prevent the dice coming to rest leaning on a side wall or a plurality of dice coming to rest superimposing each other.

According to a seventeenth aspect of the present invention, a gaming machine includes a playing unit that is substantially horizontal and on which a plurality of dice rolls and comes to rest; an oscillation device that causes the playing unit to oscillate substantially in a vertical direction with respect to the playing unit; a sensor that recognizes and converts a numbers of dots of each of the plurality of dice into a plurality of identification data corresponding to each of the plurality of dice; and a controller that executes processing of: (a) starting a unit game; (b) when the unit game is started, performing control that causes the playing unit to oscillate for a first predetermined time with a combination of oscillations larger than a predetermined oscillation and oscillations smaller than a predetermined oscillation; (c) after elapse of the first predetermined time, performing control to cease the oscillation of the playing unit; (d) driving the sensor and receiving from the sensor the identification data converted by the sensor; and (e) in a case in which all of the numbers of dots of the plurality of dice cannot be identified from analyzing the identification data thus received, performing control that causes the playing unit to oscillate for a second predetermined time with oscillations smaller than the predetermined oscillation.

According to the seventeenth aspect of the present invention, after the playing unit is ceased, the controller drives the sensor and performs control that causes the playing unit to oscillate for the second predetermined time with oscillations smaller than a predetermined oscillation in a case in which all of the numbers of dots of the plurality of dice cannot be identified. Accordingly, in a case in which all of the number of dots of the three dice cannot be identified after the playing unit is ceased, for example, because of dice coming to rest leaning on a side wall, a plurality of dice coming to rest superimposing each other, and the like, it is possible to correct the leaning and superimposing of dice.

According to a eighteenth aspect of the present invention, a gaming machine includes a playing unit that is substantially horizontal and on which a plurality of dice rolls and comes to rest; an oscillation device that causes the playing unit to oscillate substantially in a vertical direction with respect to the playing unit; a sensor that recognizes and converts a number of dots of each of the plurality of dice into a plurality of identification data corresponding to each of the plurality of dice; and a controller that executes processing of: (a) starting a unit game; (b) when the unit game is started, performing control that causes the playing unit to oscillate for a first predetermined time with a combination of oscillations larger than a predetermined oscillation and oscillations smaller than a predetermined oscillation; (c) after an elapse of the first predetermined time, performing control to cease the oscillation of the playing unit; (d) driving the sensor and receiving from the sensor the identification data converted by the sensor; (e) in a case in which all of the numbers of dots of the plurality of dice cannot be identified from analyzing the identification data thus received, performing control that causes the playing unit to oscillate for a second predetermined time with oscillations smaller than the predetermined oscillation; (f) after elapse of the second predetermined time, performing control to cease the oscillation of the playing unit; (g) driving the sensor and receiving from the sensor the identification data converted by the sensor; and (h) in a case in which all of the numbers of dots of the plurality of dice cannot be identified from analyzing the identification data thus received, performing control that causes the playing unit to oscillate for a third predetermined time with oscillations larger than the oscillation in the processing (e).

According to the eighteenth aspect of the present invention, after the playing unit is ceased, the controller performs control that causes the playing unit to oscillate for a second predetermined time with oscillations smaller than the predetermined oscillation, in a case in which all of the numbers of dots of the plurality of dice cannot be identified, and after the playing unit is ceased again, the controller performs control that causes the playing unit to oscillate for a third predetermined time with oscillations larger than the oscillation in the processing (e) in a case in which all of the numbers of dots of the plurality of dice cannot be identified. Accordingly, in a case in which all of the number of dots of the three dice cannot be identified after the playing unit is ceased, for example because of a plurality of dice coming to rest superimposing each other, it is possible to correct superimposing of the dice.

BRIEF DESCRIPTION OF THE DRAWINGS

FIG. 17 is a diagram showing an instruction image display determination table according to the embodiment of the present invention;

FIG. 18 is a diagram showing a bet existence determination table according to the embodiment of the present invention;

FIG. 19 is a diagram showing an oscillation mode data table according to the embodiment of the present invention;

FIG. 20 is a diagram showing a rendered effect table according to the embodiment of the present invention;

FIG. 21 is a diagram showing an IC tag data table according to the embodiment of the present invention;

FIG. 22 is an infrared camera capturing data table according to the embodiment of the present invention;

FIG. 23 is a dot pattern data classification table according to the embodiment of the present invention;

FIGS. 6D to 9D show IC tag readable areas by IC tag readers according to the embodiment of the present invention;

FIG. 17D is a diagram showing an instruction image display determination table according to the embodiment of the present invention;

FIG. 18D is a diagram showing a bet existence determination table according to the embodiment of the present invention;

FIG. 19D is a diagram showing an IC tag data table according to the embodiment of the present invention;

FIG. 20D is an infrared camera capturing data table according to the embodiment of the present invention;

FIG. 21D is a dot pattern data classification table according to the embodiment of the present invention;

FIG. 22D is a number of dots-dot pattern data table according to the embodiment of the present invention;

FIGS. 23D to 27D show examples of display screens according to the embodiment of the present invention;

DETAILED DESCRIPTION OF THE INVENTION

Embodiments of the present invention will be described below with reference to the accompanying drawings.

Figure 1:
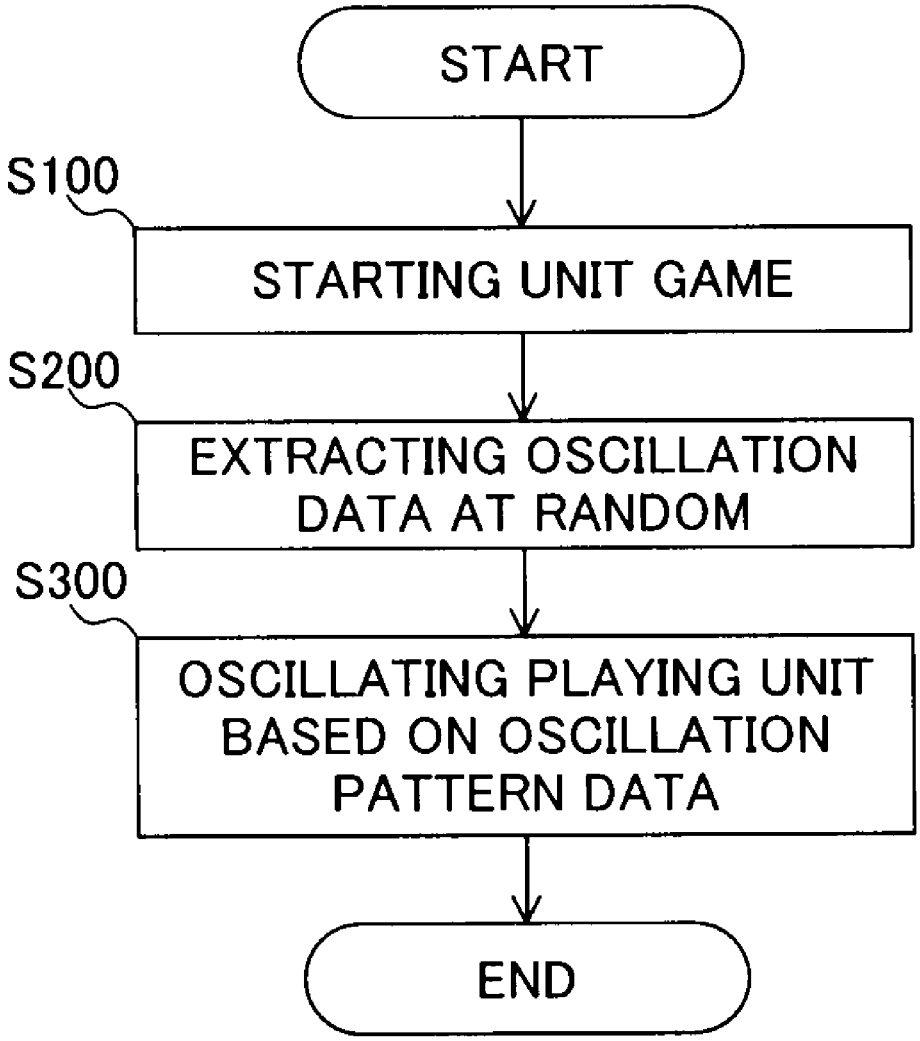
FIG. 1 is a flowchart schematically showing a processing sequence of a gaming machine according to an embodiment of the present invention.

As shown in FIG. 1, a CPU 81 starts a unit game (Step S100), extracts one set of oscillation pattern data from ROM 82 at random when the unit game is started (Step S200), and controls to oscillate a playing board 3*a* based on the one set of the oscillation pattern data thus extracted (Step S300).

Figure 2:
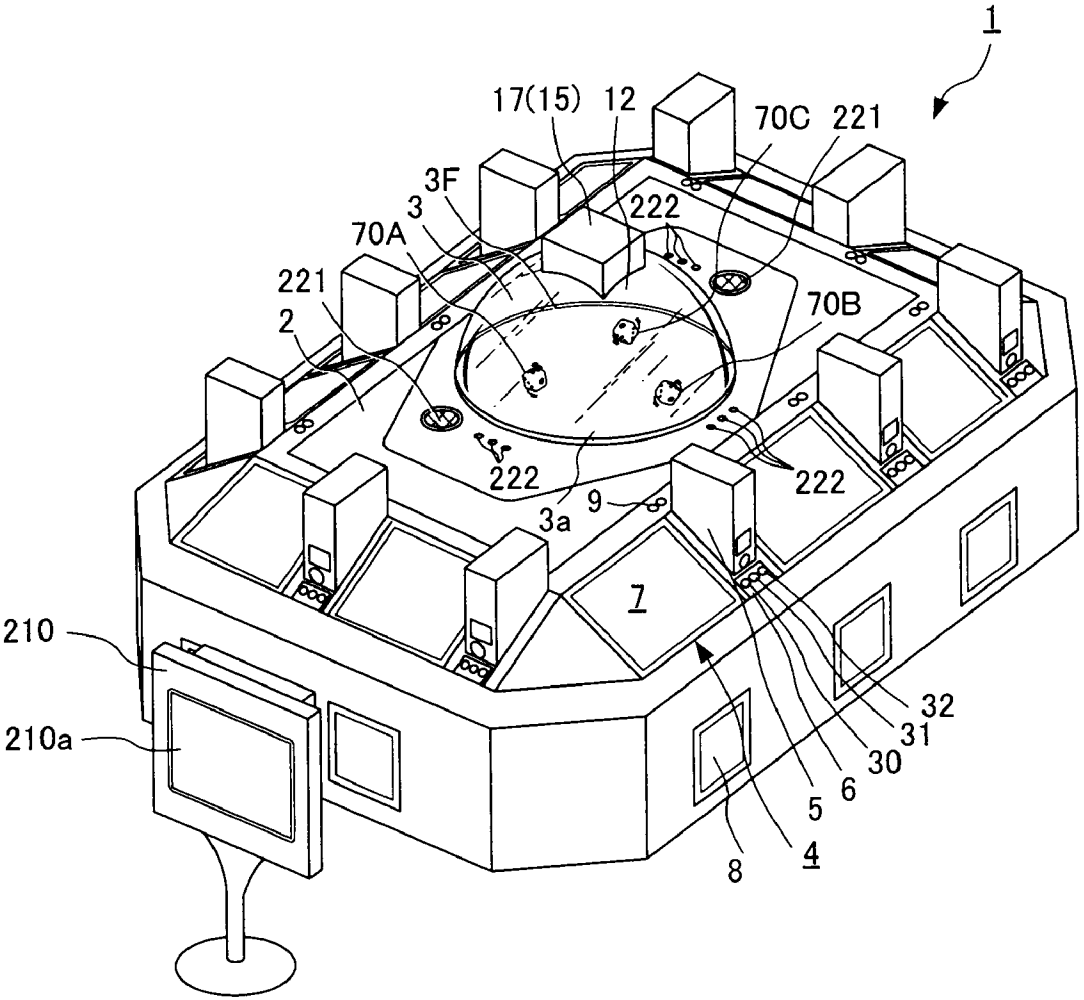
FIG. 2 is a perspective view of a gaming machine according to the embodiment of the present invention.
Figure 3:
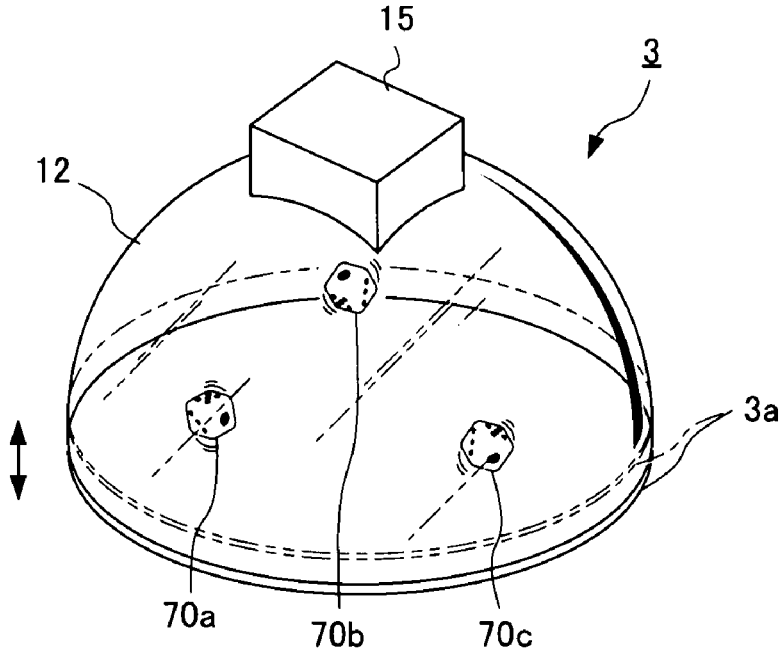
FIG. 3 is an enlarged view of a playing unit of the gaming machine shown in FIG. 2.

FIG. 2 is a perspective view schematically showing an example of a gaming machine according to the embodiment of this invention. FIG. 3 is an enlarged view of a playing unit of the gaming machine shown in FIG. 2. As shown in FIG. 2, a gaming machine 1 according to the present embodiment includes a housing 2 as a main body portion, a playing unit 3 that is provided substantially at the center of the top face of the housing 2 and in which a plurality of dice 70 are rolled and stopped, a plurality of stations 4 disposed so as to surround the playing unit 3, and a dealer used display 210 that is positioned so as not to be visually recognizable by a player seated at each station 4. The station 4 includes an image display unit 7. The player seated at each station 4 can participate in a game by predicting numbers of dots on the dice 70 and performing a normal bet input and a side bet input.

The gaming machine 1 includes a housing 2 as a main body portion, a playing unit 3 that is provided substantially at the center of the top face of the housing 2 and in which a plurality of dice 70 are rolled and stopped, and a plurality of stations 4 (ten in this embodiment) disposed so as to surround the playing unit 3.

The station 4 include a game media receiving device 5 into which game media such as medals to be used for playing the game are inserted, a control unit 6, which is configured with multiple control buttons by which a player enters predetermined instructions, and an image display unit 7, which displays images relating to a bet table. The player may participate in a game by operating the control unit 6 or the like while viewing the image displayed on the image display unit 7.

A payout opening 8, from which a player's game media are paid out, are provided on the sides of the housing 2 on which each station 4 is provided. In addition, a speaker 9, which can output sound, is disposed on the upper right of the image display unit 7 on each of the stations 4.

A control unit 6 is provided on the side part of the image display unit 7 on each of the stations 4. As viewed from a position facing the station 4, in order from the left side are provided a select button 30, a payout (cash-out) button 31, and a help button 32.

The select button 30 is a button that is pressed when confirming a bet operation after the bet operation is complete. Furthermore, in a case other than the bet operation, the button is pressed when a player confirms an input performed.

The payout button 31 is a button which is usually pressed at the end of a game, and when the payout button 31 is pressed, game media corresponding to credits that the player has acquired is paid out from the payout opening 8.

The help button 32 is a button that is pressed in a case where a method of operating the game is unclear, and upon the help button 32 being pressed, a help screen showing various kinds of operation information is displayed immediately thereafter on the image display unit 7.

The playing unit 3 is configured so as to allow a plurality of dice to roll and stop. The present embodiment is configured to use three dice 70 (dice 70*a*, 70*b*, and 70*c*) at the playing unit 3.

A speaker 221 and a lamp 222 are disposed around the playing unit 3. The speaker 221 performs rendered effects by outputting sounds while the dice 70 are being rolled. The lamp 222 performs rendered effects by emitting lights while the dice 70 are being rolled.

The playing unit 3 includes a playing board 3*a*, which is formed to be a circular shape, to roll and then stop the dice 70. An IC tag reader 16, which is described later in FIGS. 6 to 9, are provided below the playing board 3*a*.

Since the playing board 3*a* is formed to be substantially planar, as shown in FIG. 3, the dice 70 are rolled by oscillating the playing board 3*a* substantially in the vertical direction with respect to the horizontal direction of the playing board 3*a*. Then, the dice 70 are stopped after the oscillation of the playing board 3*a* ceases. The playing board 3*a* is oscillated by a CPU 81 (described later) driving an oscillating motor 300.

Furthermore, as shown in FIG. 3, the playing unit 3 is covered with a cover member 12 of which the entire upper area is made of a transparent acrylic material formed in a hemispherical shape, and regulates the rolling area of the dice 70. In the present embodiment, an infrared camera 15 is provided at the top of the cover member 12 to detect numbers of dots and the like (such as positions of the dice 70 on the playing board 3*a*, types of the dice 70, and numbers of dots of the dice 70) of the dice 70. Furthermore, the cover member 12 is covered with a special film (not shown) which blocks infrared radiation. In this way when the numbers of dots of the dice 70 on which an infrared absorption ink has been applied is detected with the infrared camera 15, false detection can be prevented that arises, for example, in a case where a blink rate of a light irradiated from a circumference of the playing unit 3 is fast.

Figure 4:
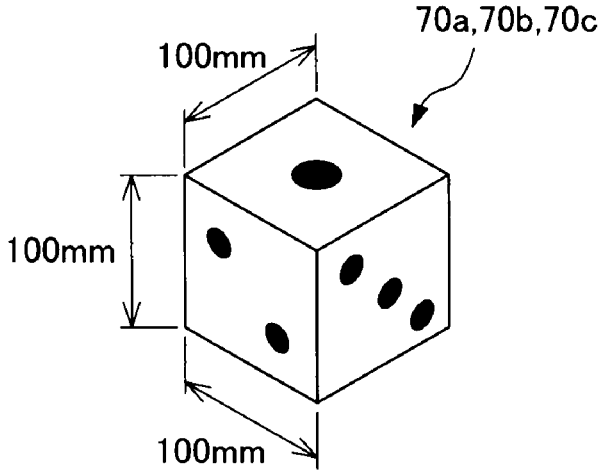
FIG. 4 is an external perspective view of a die according to the embodiment of the present invention.

FIG. 4 is an external perspective view of a die 70. As shown in FIG. 4, the die 70 is a cube of which the length of a side is 100 mm.

Figure 5:
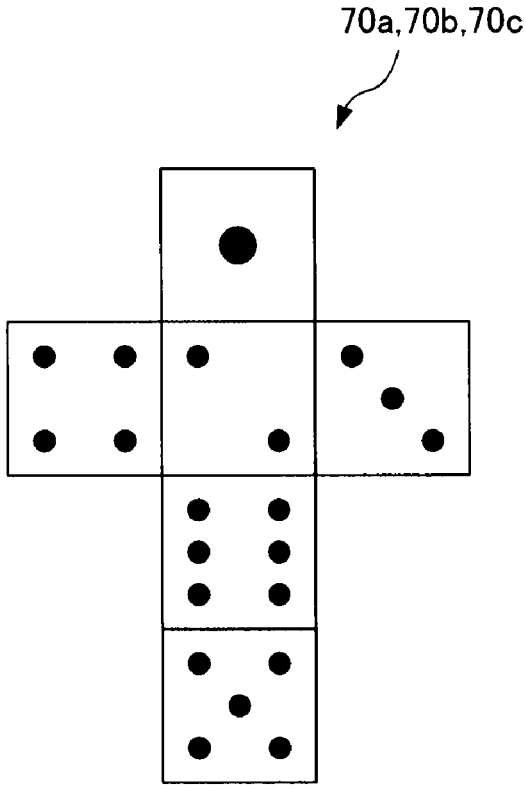
FIG. 5 is a development view of a die according to the embodiment of the present invention.

FIG. 5 is a development view of the die 70. As shown in FIG.5, the combinations of two faces opposing each other are "1 and 6", "2 and 5", and "3 and 4".

FIGS. 6 to 9 show IC tag readable areas by an IC tag reader 16 disposed below the playing board 3*a*.

Here, a way of reading information stored in the IC tag by the IC tag reader 16 is described below.

The IC tag reader 16 is a non-contact type IC tag reader. For example, it is possible to read information stored in the IC tag by RFID (Radio Frequency Identification). The RFID system performs near field communication that reads and writes data stored in semi-conductor devices by an induction field or radio waves in a non-contact manner. In addition, since this technology is known conventionally and is described in Japanese Unexamined Patent Application Publication No. H8-21875, an explanation thereof is abbreviated.

In the present embodiment, a plurality of IC tags is read by a single IC tag reader 16. Under the abovementioned RFID system, an anti-collision function can be employed which can read a plurality of IC tags by a single reader. The anti-collision function includes FIFO (first in first out) type, multi-access type, and selective type, and communicates with a plurality of the IC tags sequentially. The FIFO type is a mode to communicate with a plurality of the IC tags sequentially in the order that each IC tag enters an area in which an antenna can communicate therewith. The multi-access type is a mode that is able to communicate with all the IC tags, even if there is a plurality of the IC tags simultaneously in the area in which an antenna can communicate with the IC tags. The selective type is a mode that is able to communicate with a specific IC tag among a plurality of the IC tags in the area in which an antenna can communicate therewith. By employing the abovementioned modes, it is possible to read a plurality of the IC tags with a single IC tag reader. In addition, reading the IC tags may not only be done by the non-contact type, but also a contact type. In addition, the IC tag reader is not limited thereto, and anything that is appropriately designed with the object of being read may be employed.

In the present embodiment, a readable area of the IC tag reader 16 is 10 mm in substantially a vertical direction from substantially an entire horizontal face on the playing board 3*a*.

Figure 6:
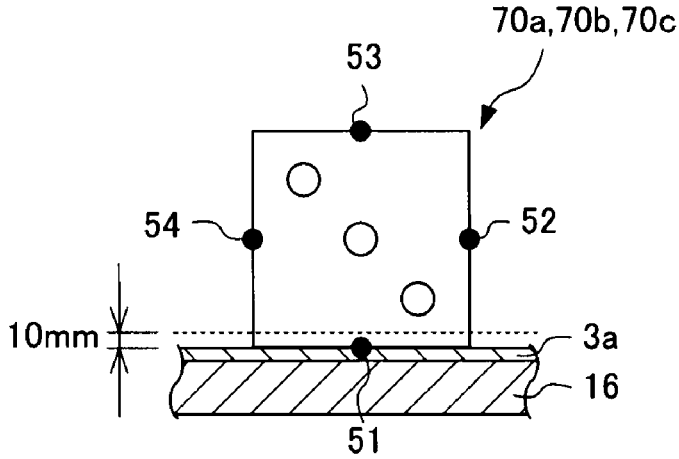
FIGS. 6 to 9 show IC tag readable areas by IC tag readers according to the embodiment of the present invention.

With reference to FIG. 6, a face of the die 70 (for example, a face of which the number of dots is six) is in contact with the playing board 3*a*. Furthermore, the IC tag is embedded substantially at the center of each face of the die 70 (the IC tags for the faces on which the numbers of dots are "3" and "4" are not shown). An IC tag 51 is embedded substantially at the center of a face on which the number of dots is six. An IC tag 52 is embedded substantially at the center of a face on which the number of dots are five. An IC tag 53 is embedded substantially at the center of a face on which the number of dots is one. An IC tag 54 is embedded substantially at the center of a face on which the number of dots is two.

Here, only the IC tag 51 exists in the readable area of the IC tag reader 16. Therefore, the number of dots (in this case, "one") of a face, opposing the face on which the IC tag 51 is embedded, is determined as the number of dots of the die 70.

Furthermore, since the number of dots of a face, opposing a face on which an IC tag is embedded, is determined as the number of dots of the die 70, "one" is stored, as data of the number of dots, in the IC tag 51 on the face of which the number of dots is "six". "Two" is stored, as data of the number of dots, in the IC tag 52 on the face of which the number of dots is "five". "Six" is stored, as data of the number of dots, in the IC tag 53 on the face of which the number of dots is "one". "Five" is stored, as data of the number of dots, in the IC tag 54 on the face of which the number of dots is "two". "Three" is stored, as data of the number of dots, in the IC tag (not shown) on the face of which the number of dots is "four". Finally, "four" is stored, as data of the number of dots, in the IC tag (not shown) on the face of which the number of dots is "three".

Furthermore, as described above, since a side of the die 70 is 10 mm, it is not physically possible for an IC tag reader 16 to detect more than one IC tag with respect to one die.

Figure 7:
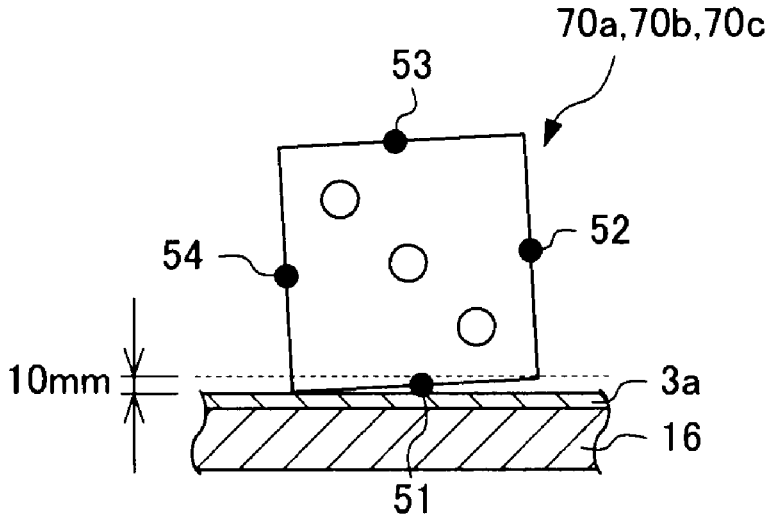

With reference to FIG. 7, a die 70 is inclined. However, since the IC tag 51 still exists in the readable area of the IC tag reader 16, the number of dots of the die 70 is determined as "one".

Figure 8:
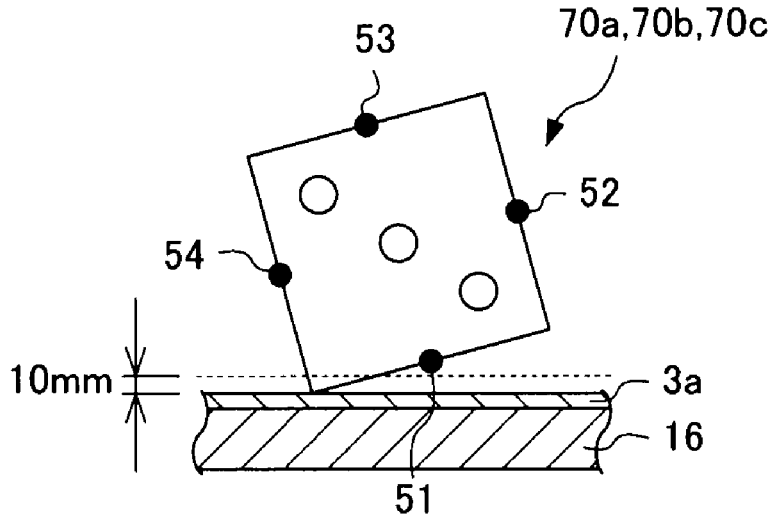

With respect to FIG. 8, the die 70 is inclined at a greater angle than the case shown in FIG. 7. Then, since there is no IC tag which exists in the readable area of the IC tag reader 16, the IC tag reader 16 cannot detect the number of dots of the die 70.

Figure 9:
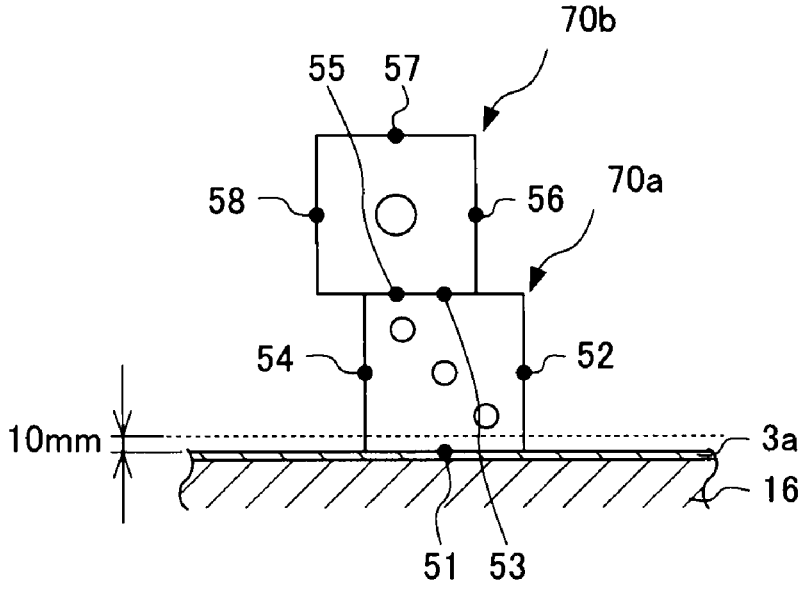

With reference to FIG. 9, the die 70*b* is superimposed on the die 70*a*. In this case, neither of the IC tags 55, 56, 57, and 58, which are embedded in the die 70*b*, exists in the readable area of the IC tag reader 16. Therefore, in this case, the IC tag reader 16 cannot detect the number of dots of the die 70*b*.

Figure 10:
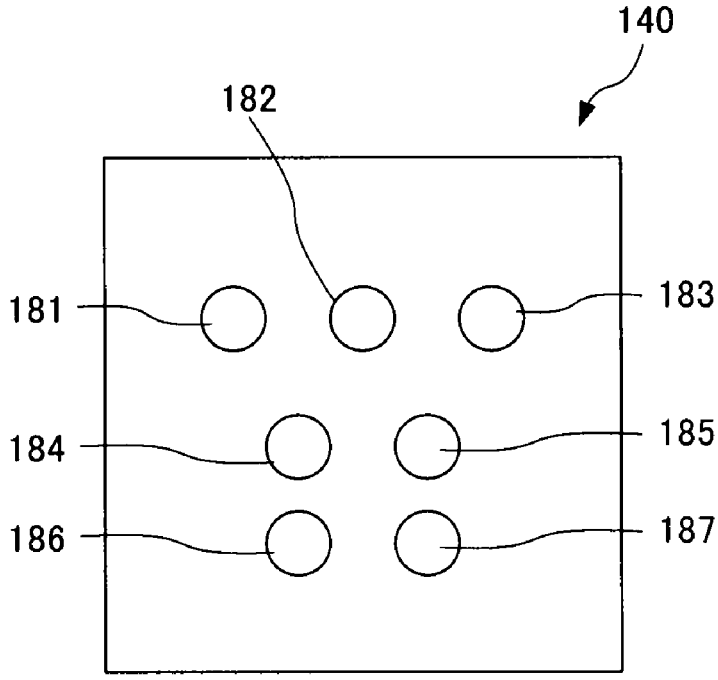
FIG. 10 shows a sheet attached to each face of a die according the embodiment of the present invention.

FIG. 10 shows a sheet 140 attached to each face of the die 70.

As shown in FIG. 10, on each face of the die 70, the sheet 140, to which infrared absorption ink is applied to identify the number of dots and the type of the die 70, is provided so as to be covered by a sheet on which the number of dots is printed. According to FIG. 10, the infrared absorption ink can be applied to dots 181, 182, 183, 184, 185, 186, and 187.

The number of dots of the die 70 can be identified by a combination of the dots to which the infrared absorption ink is applied among the dots 184, 185, 186, and 187. In addition, the type of the die 70 can be identified by a combination of the dots to which the infrared absorption ink is applied among the dots 181, 182, and 183.

Figure 11:
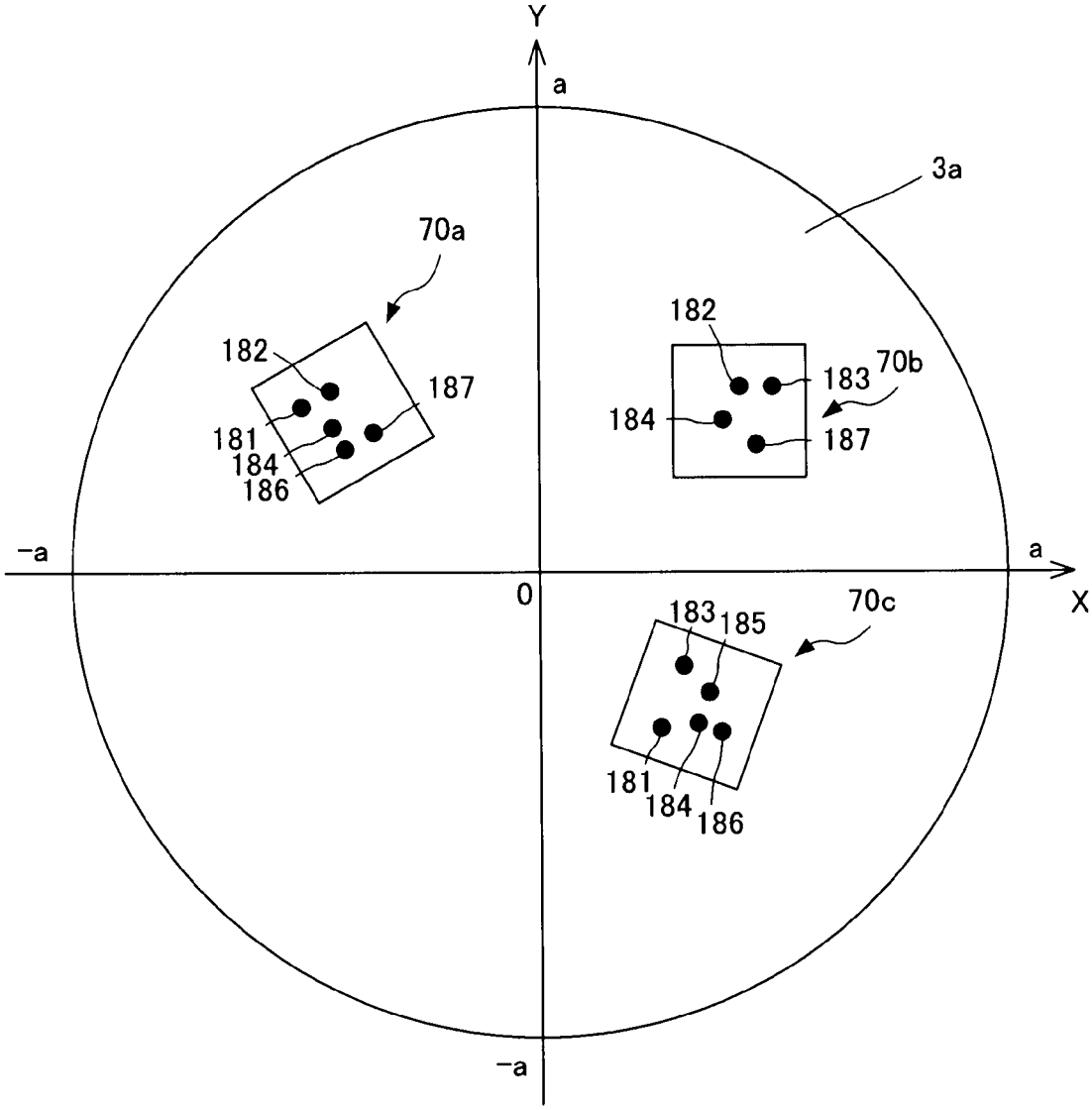
FIG. 11 is an image showing a state in which a die according to the embodiment of the present invention is captured substantially in the vertically upward direction by an infrared camera.

FIG. 11 shows an image in which the dice 70, which comes to rest on the playing board 3*a*, are captured substantially in the vertically upward direction using an infrared camera 15.

With reference to FIG. 11, dots to which the infrared absorption ink is applied on each of the dice 70*a*, 70*b*, and 70*c* are captured in black. The type and the number of dots for each of the dice 70*a*, 70*b*, and 70*c* are determined based on a combination of the dots to which the ink is applied. In addition, the playing board 3*a* is formed in a disc shape having a radius a, and each position of the dice 70*a*, 70*b*, and 70*c* is detected as an x component and y component on an x-y coordinate.

Figure 12:
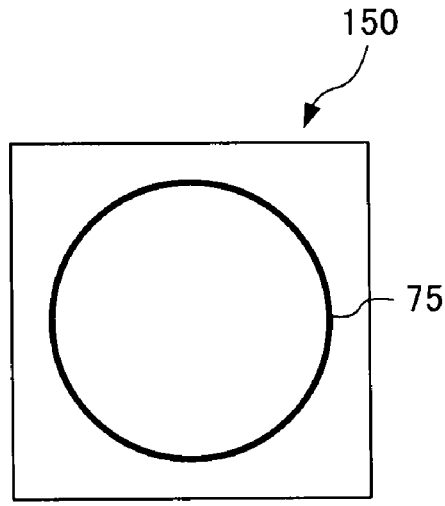
FIG. 12 shows a sheet attached to each face of a die according the embodiment of the present invention.

FIG. 12 shows a sheet 150 which is attached to each face of the dice 70.

As shown in FIG. 12, a circular profile 75 having a certain area on each face of the dice 70 in common is depicted by way of applying the infrared absorption ink on each face of the dice 70. The sheet 150 on which the circular profile 75 is depicted is provided so as to be covered by the abovementioned sheet 140.

Figure 13:
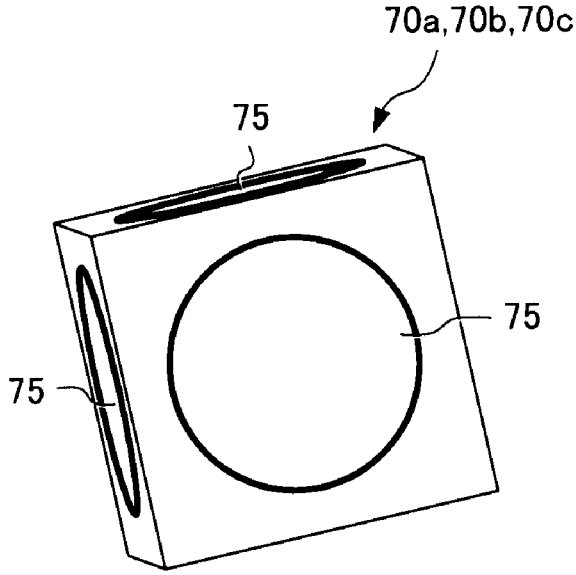
FIG. 13 shows an image in which a die according to the embodiment of the present invention that has come to rest at a tilt on a playing board, is captured substantially in the vertically upward direction by an infrared camera.

FIG. 13 shows an image in which the die 70, which comes to rest at a tilt on a playing board 3*a*, is captured substantially in the vertically upward direction using the infrared camera 15.

With reference to FIG. 13, three faces of the die 70 are captured. Therefore, it is necessary to distinguish the number of dots of which face is correct. Consequently, the number of dots having the largest area among the three faces is determined as the face that should be read. In a case of this distinction, the CPU (not shown) in the infrared camera 15 calculates the areas of the circular profiles 75 thus captured, and distinguishes the number of dots of the face on which the circular profile 75 having the largest area among the areas thus calculated is printed as the correct number of dots.

Figure 14:
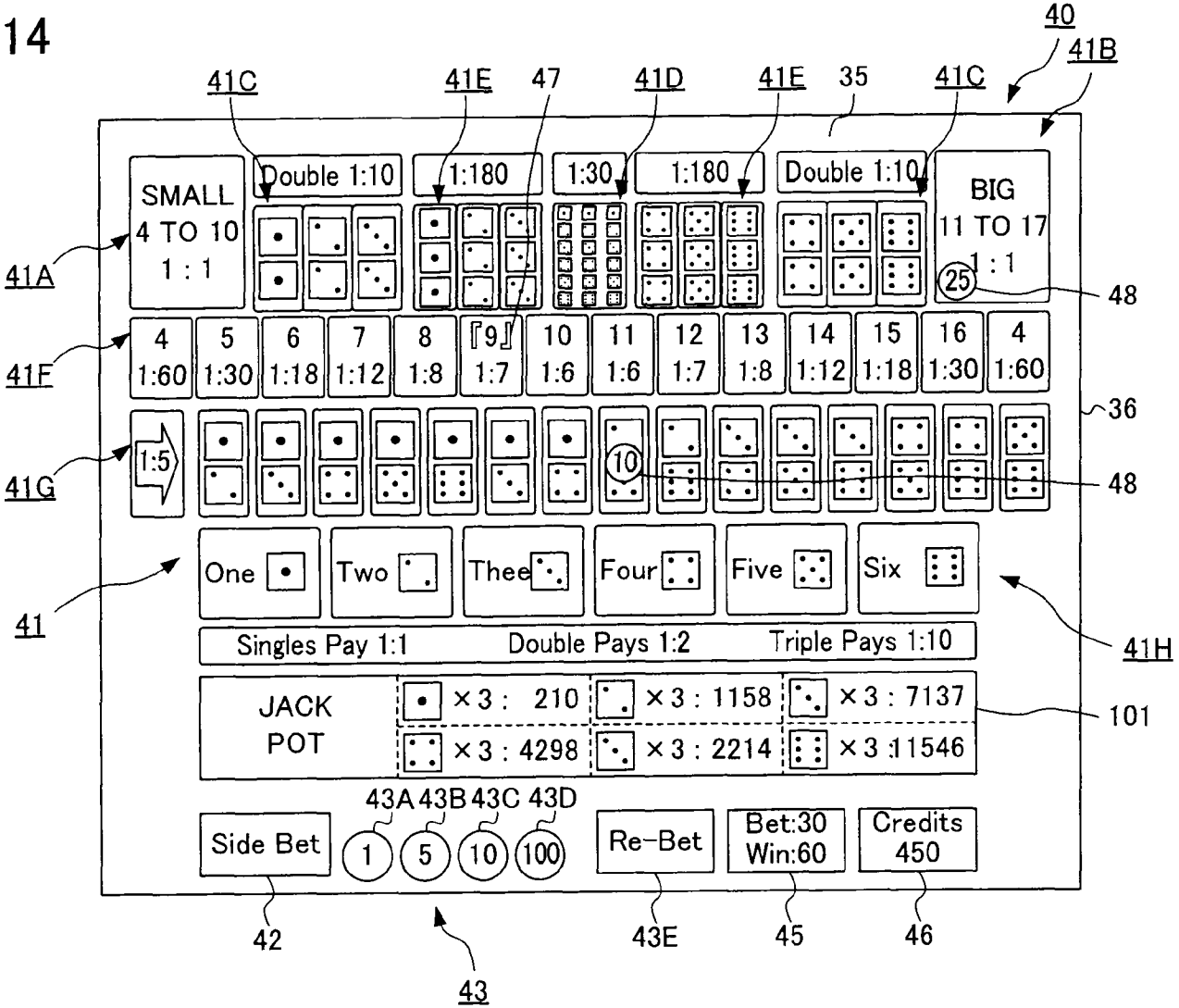
FIG. 14 shows an example of a display screen according to the embodiment of the present invention.

FIG. 14 shows an example of a display screen displayed on an image display unit. As shown in FIG. 14, an image display unit 7 is a touch-panel type of liquid crystal display, on the front surface of which a touch panel 35 is attached, allowing a player to perform selection such as of icons displayed on a liquid crystal screen 36 by contacting the touch panel 35, e.g., with a finger.

A table-type betting board (a bet screen) 40 for predicting the number of dots of the dice 70 is displayed in a game at a predetermined timing on the image display unit 7.

A detailed description is now provided regarding the bet screen 40. On the bet screen 40 are displayed a plurality of normal bet areas 41 and a side bet area 42. The plurality of normal bet areas 41 includes a normal bet area 41A, a normal bet area 41B, a normal bet area 41C, a normal bet area 41D, a normal bet area 41E, a normal bet area 41F, a normal bet area 41G, and a normal bet area 41H. By contacting the touch panel 35, e.g., with a finger, the normal bet area 41 is designated, and by displaying chips in the normal bet area 41 thus designated, a normal bet operation is performed. Furthermore, by contacting the touch panel 35, e.g., with a finger, the side bet area 42 is designated, and by displaying chips in the side bet area 42 thus designated, a side bet operation is performed.

A unit bet button 43, a re-bet button 43E, a payout result display unit 45, and a credit amount display unit 46 are displayed at the right side of the side bet area 42 in order from the left side.

The unit bet button unit 43 is a group of buttons that are used by a player to bet chips on the normal bet area 41 and the side bet area 42 designated by the player. The unit bet button unit 43 is configured with four types of buttons including a 1 bet button 43A, a 5 bet button 43B, a 10 bet button 43C, and a 100 bet button 43D. It should be noted that in the case of an incorrect bet operation, the player can start a bet operation again by touching a re-bet button 43E.

Firstly, the player designates the normal bet area 41 or the side bet area 42 using a cursor 47 by way of contacting the touch panel 35, e.g., with a finger. At this time, contacting the 1 bet button 43A, e.g., with a finger, allows for betting one chip at a time (number of chips to be bet increases one by one in the order of 1, 2, 3, every time the 1 bet button 43A is contacted, e.g., by a finger). Similarly, when contacting the 5 bet button 43B, e.g., with a finger, five chips at a time can be bet (number of chips to be bet increases five by five in the order of 5, 10, 15, every time the 5 bet button 43B is contacted, e.g., by a finger). Similarly, when contacting the 10 bet button 43C, e.g., with a finger, ten chips at a time can be bet (number of chips to be bet increases ten by ten in the order of 10, 20, 30, every time the 10 bet button 43C is contacted, e.g., by a finger). Similarly, when contacting the 100 bet button 43D, e.g., with a finger, a hundred chips at a time can be bet (number of chips to be bet increases hundred by hundred in the order of 100, 200, 300, . . . every time the 100 bet button 43D is contacted, e.g. by a finger). The number of chips bet up to the current time is displayed as a chip mark 48, and the number displayed on the chip mark 48 indicates the number of bet chips.

The number of bet chips and payout credit amount for a player in a previous game are displayed in the payout result display unit 45. The number calculated by subtracting the number of bet chips from the payout credit amount is a newly acquired credit amount for the player in the previous game.

The credit amount display unit 46 displays the credit amount which the player possesses. The credit amount decreases according to the number of bet chips (1 credit amount for 1 chip) when the player bets chips. If the bet chips are entitled to an award and credits are paid out, the credit amount increases in accordance with the number of paid out chips. It should be noted that the game is over when the player's credit amount becomes zero.

The normal bet area 41 in the bet screen 40 is described next. The normal bet areas 41A and 41B are portions where the player places a bet on a predicted sum of dots to appear on the dice 70A to 70C. In other words, the player selects the normal bet area 41A if the predicted sum falls in a range of 4 to 10, or the normal bet area 41B if the predicted sum falls in a range of 11 to 17. Odds are set to 1:1 (2 chips are paid out for 1 chip bet).

The normal bet area 41C is a portion where the player places a bet, predicting that two dice 70 have the same number of dots. In other words, the player wins an award if one of the combinations occurs, such as (1, 1), (2, 2), (3, 3), (4, 4), (5, 5), and (6, 6), and the odds are set to 1:10.

The normal bet area 41D is a portion where the player places a bet, predicting that all three dice have the same number of dots. In other words, the player wins an award if one of the combinations occurs, such as (1, 1, 1), (2, 2, 2), (3, 3, 3), (4, 4, 4), (5, 5, 5), and (6, 6, 6), and the odds are set to 1:30.

The bet area 41E is a portion where the player places a bet on a predicted number of dots to appear commonly on all three dice. In other words, the player places a bet on one of the combinations of (1, 1, 1), (2, 2, 2), (3, 3, 3), (4, 4, 4), (5, 5, 5), or (6, 6, 6), and the odds are set to 1:180.

The normal bet area 41F is where the player places a bet, predicting a total, a summation of dots to appear on the three dice. Odds are set according to the occurrence frequency of the total. For example, if the total is 4 or 17, odds are set to 1:60; if the total is 5 or 16, odds are set to 1:30; if the total is 6 or 15, odds are set to 1:18; if the total is 7 or 14, odds are set to 1:12; if the total is 8 or 13, odds are set to 1:8; if the total is 9 or 12, odds are set to 1:7; and if the total is 10 or 11, odds are set to 1:6.

The bet area 41G is a portion where the player places a bet on predicted dots to appear on the two dice selected from the three, and the odds are set to 1:5.

The normal bet area 41H is a region where the player places a bet on the number of dots to appear on the dice 70, and the odds are set according to the number of dots of the dice 70 matching the predicted number of dots.

Figure 15:
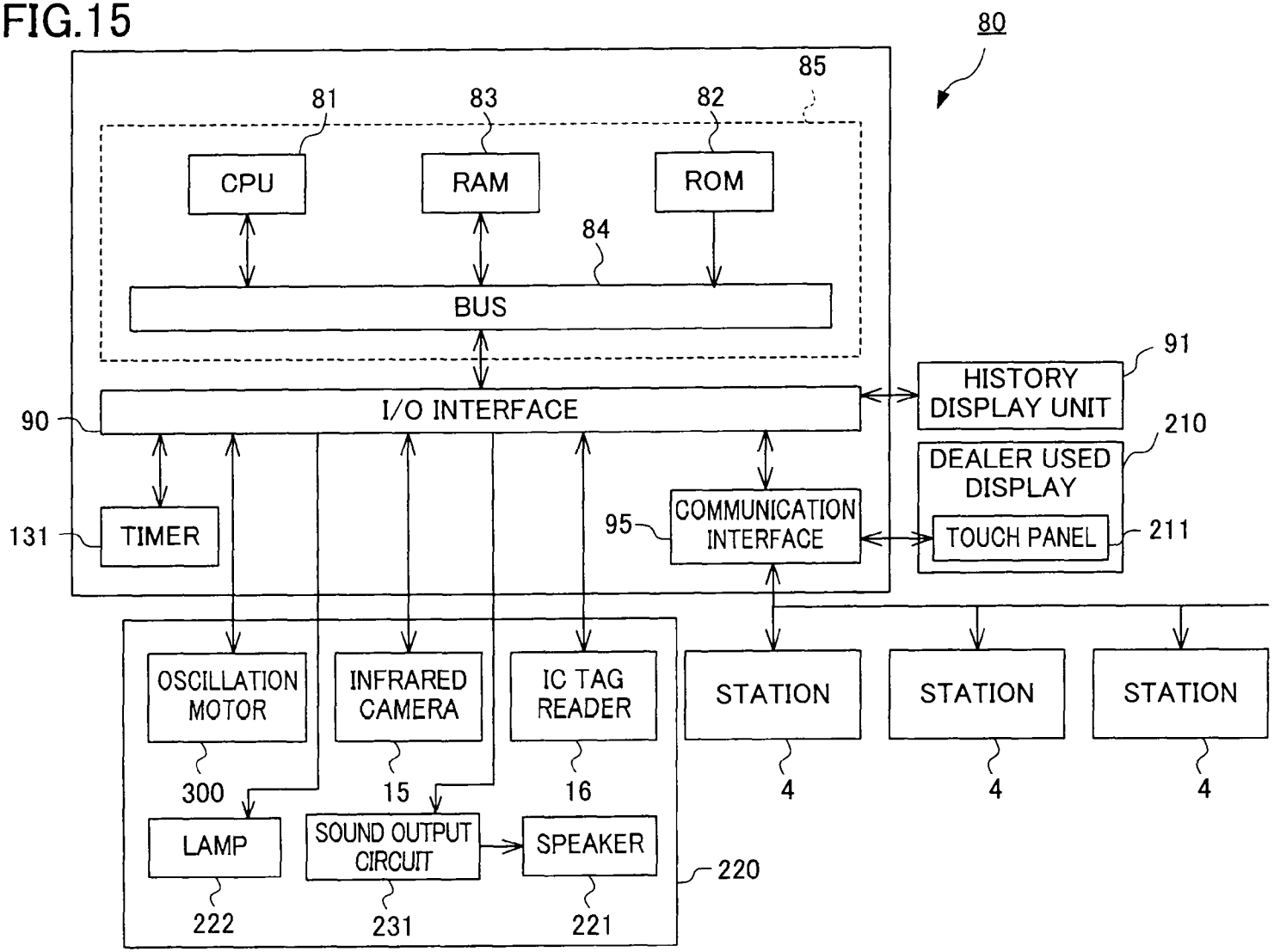
FIG. 15 is a block diagram showing an internal configuration of the gaming machine shown in FIG. 2.

FIG. 15 is a block diagram showing the internal configuration of the gaming machine shown in FIG. 2. A main control unit 80 of the gaming machine 1 includes a microcomputer 85, which is configured with a CPU 81, ROM 82, RAM 83, and a bus 84 that transfers data therebetween.

The CPU 81 is connected with an oscillating motor 300 via an I/O interface 90. Furthermore, the CPU 81 is connected with a timer 131, which can measure time via the I/O interface 90. In addition, the CPU 81 is connected with a lamp 222 via the I/O interface 90. The lamp 222 emits various colors of light for performing various types of rendered effects, based on output signals from the CPU 81. Furthermore, the CPU 81 is connected with a speaker 221 via the I/O interface 90 and a sound output circuit 231. The speaker 221 emits various sound effects for performing various types of rendered effects, based on output signals from the sound output circuit 231. Furthermore, the I/O interface 90 is connected with the abovementioned infrared camera 15 and/or the IC tag reader 16, thereby transmitting and receiving information in relation to the number of dots of the three dice 70, which comes to rest on the playing board 3*a*, between the infrared camera 15 and/or the IC tag reader 16.

Here, the oscillating motor 300, the infrared camera 15, the IC tag reader 16, the lamp 222, the sound output circuit 231, and the speaker 221 are provided within a single composite unit 220.

In addition, via a communication interface 95 connected to the I/O interface 90, the main control unit 80 transmits and receives data such as bet information, payout information, and the like to and from each station 4, as well as data such as bet start instruction images, bet start instruction signals, and the like to and from the dealer used display 210.

Furthermore, the I/O interface 90 is connected with a history display unit 91, and the main control unit 80 transmits and receives information in relation to the number of dots on the die, to and from the history display unit 90.

ROM 82 in the main control unit 80 is configured to store a program for implementing basic functions of the gaming machine 1; more specifically, a program for controlling various devices which drive the playing unit 3, a program for controlling each station 4, and the like, as well as a payout table, data indicating a predetermined time T, data indicating a specific value TT, and the like.

RAM 83 is memory, which temporarily stores various types of data calculated by CPU 81, and, for example, temporarily stores data bet information transmitted from each station 4, information on respective number of dots that appear on the dice 70 transmitted from the infrared camera 15 and/or the IC tag reader 16, data relating to the results of processing executed by CPU 81, and the like. A jackpot storage area is provided in the RAM 83. In the jackpot storage area, the data indicating the number of playing media stored cumulatively is stored so as to correspond to each number of dots of matching dice. The data is provided to the station 4 at a predetermined timing, and a jackpot image is displayed.

The CPU 81 controls the oscillating motor 300, which oscillates the playing unit 3, based on data and a program stored in the ROM 82 and the RAM 83, and oscillates the playing board 3*a* of the playing unit 3. Furthermore, after oscillation of the playing board 3*a* ceases, a control processing associated with game progression, such as confirmation processing for confirming the number of dots on each of the dice 70 resting on the playing board 3*a*.

In addition to the control processing described above, the CPU 81 has a function of executing a game by transmitting and receiving data to and from each station 4 so as to control each station 4. More specifically, the CPU 81 accepts bet information transmitted from each station 4. Furthermore, the CPU 81 performs win determination processing based on the number of dots on the dice 70 and the bet information transmitted from each station 4, and calculates the amount of an award paid out in each station 4 with reference to the payout table stored in the ROM 82.

Figure 16:
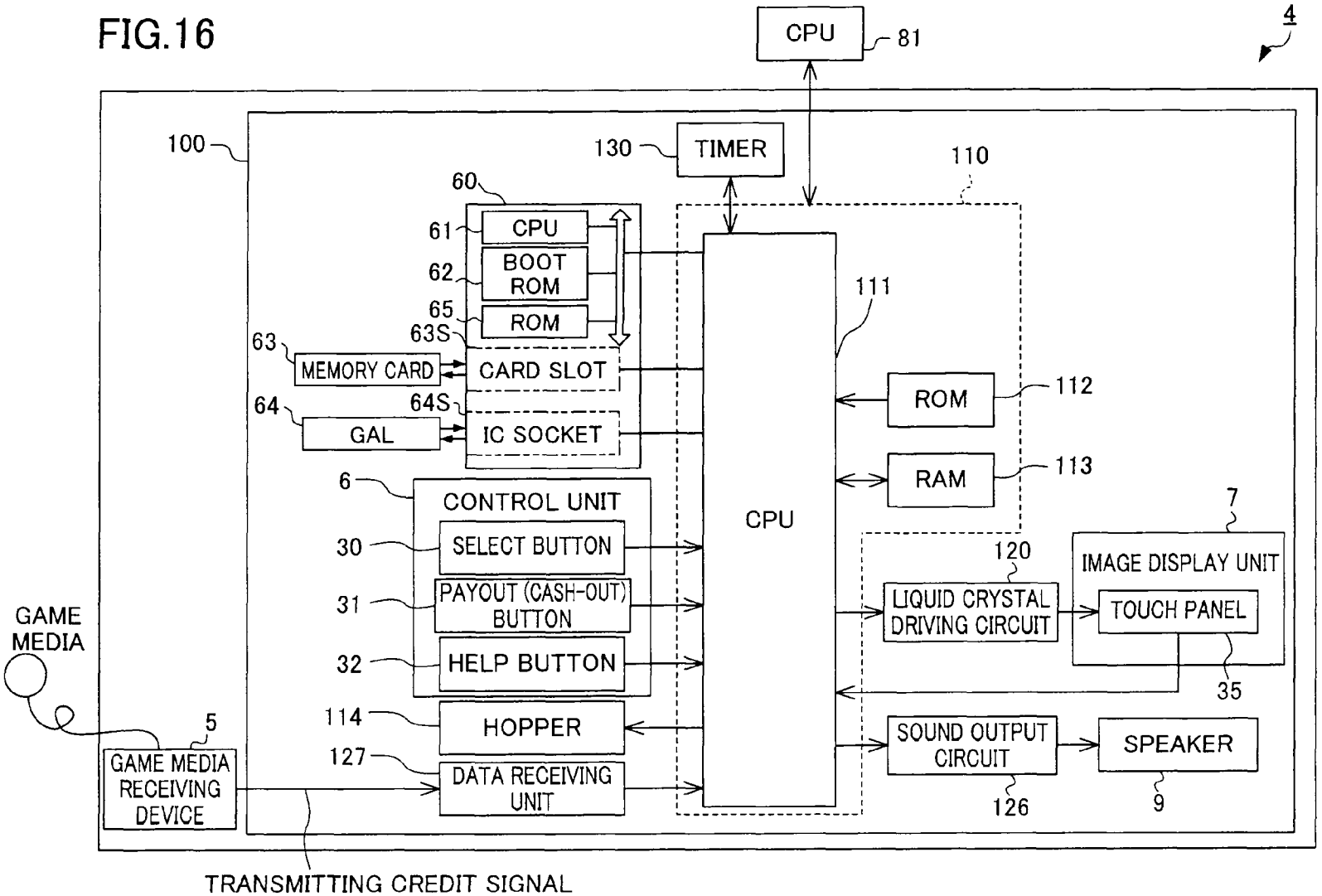
FIG. 16 is a block diagram showing an internal configuration of a station shown in FIG. 2.

FIG. 16 is a block diagram showing the internal configuration of the station shown in FIG. 2. The station 4 includes a main body 100 in which an image display unit 7 and the like are provided, and a game media receiving device 5, which is attached to the main body 100. The main body 100 further includes a station control unit 110 and several peripheral devices.

The station control unit 110 includes a CPU 111, ROM 112, and RAM 113.

ROM 112 stores a program for implementing basic functions of the station 4, other various programs needed to control the station 4, a data table, and the like.

Moreover, a decision button 30, a payout button 31, and a help button 32 provided in the control unit 6 are connected to the CPU 111, respectively. The CPU 111 controls the execution of various corresponding operations in accordance with manipulation signals, which are generated in response to each button pressed by a player. More specifically, the CPU 111 executes various processing, based on input signals transmitted from the control unit 6 in response to a player's operation which has been inputted, and the data and programs stored in the ROM 112 and RAM 113. Subsequently, the CPU 111 transmits the results to the CPU 81 in the main control unit 80.

In addition, the CPU 111 in the main control unit 80 receives instruction signals from the CPU 81, and controls peripheral devices which configure the station 4. The CPU 111 performs various kinds of processing based upon the input signals supplied from the control unit 6 and the touch panel 35, and the data and the programs stored in the ROM 112 and the RAM 113. Then, the CPU 111 controls the peripheral devices which configure the station 4 based on the results of the processing. It should be noted that the mode whereby processing is performed is set for each processing depending on the content of the processing. For example, the former approach is applied to payout processing of game media for respective numbers of dots to appear on the dice, and the latter approach is applied to bet operation processing by a player.

Furthermore, a hopper 114, which is connected to the CPU 111, pays out a predetermined amount of game media through the payout opening 8, receiving the instruction signals from the CPU 111.

Moreover, the image display unit 7 is connected to the CPU 111 via a liquid crystal driving circuit 120. The liquid crystal driving circuit 120 includes program ROM, image ROM, an image control CPU, work RAM, a video display processor (VDP), video RAM, and the like. Here, the program ROM stores an image control program with respect to the display functions of the image display unit 7, and various kinds of selection tables. The image ROM stores dot data for creating an image to be displayed on the image display unit 7, and dot data for displaying a jackpot image, for example. In addition, the image control CPU determines an image to be displayed on the image display unit 7, selected from the dot data previously stored in the image ROM according to the image control program previously stored in the program ROM based on parameters specified by the CPU 111. The work RAM is configured as a temporary storage means when executing the image control program by the image control CPU. The VDP forms an image corresponding to the display contents determined by the image control CPU and outputs the resulting image on the image display unit 7. It should be noted that the video RAM is configured as a temporary storage device used by the VDP for creating an image.

As mentioned above, the touch panel 35 is attached to the front side of the image display unit 7, and the information related to operation on the touch panel 35 is transmitted to the CPU 111. The touch panel 35 detects an input operation by the player on a bet screen 40 and the like. More specifically, selection of the normal bet area 41 and the side bet area 42 in the bet screen 40, manipulation of the bet button unit 43 and the like, are performed by touching the touch panel 35, and the information thereof is transmitted to the CPU 111. Then, a player's bet information is stored in the RAM 113 based on the information stored. Furthermore, the bet information is transmitted to the CPU 81 in the main control unit 80, and stored in a bet information storage area in the RAM 83.

Moreover, a sound output circuit 126 and a speaker 9 are connected to the CPU 111. The speaker 9 emits various sound effects for performing various kinds of rendered effects, based on output signals from the sound output circuit 126. In addition, the game media receiving device 5, into which game media such as coins or medals are inserted, is connected to the CPU 111 via a data receiving unit 127. The data receiving unit 127 receives credit signals transmitted from the game media receiving device 5, and the CPU 111 increases a player's credit amount stored in the RAM 113 based on the credit signals transmitted.

A timer 130, which can measure time, is connected to the CPU 111.

A gaming board 60 includes a CPU (Central Processing Unit) 61, ROM 65 and boot ROM 62, a card slot 63S compatible with a memory card 63, and an IC socket 64S compatible with a GAL (Generic Array Logic) 64, which are connected to one another via an internal bus.

The memory card 63 comprises nonvolatile memory such as compact flash (trademark) or the like, which stores a game program and a game system program.

Furthermore, the card slot 63S has a configuration that allows the memory card 63 to be detachably inserted, and is connected to the CPU 111 via an IDE bus. Such an arrangement allows the kinds or content of the game provided by the station 4 to be changed by performing the following operation. More specifically, the memory card 63 is first extracted from the card slot 63S, and another game program and another game system program are written to the memory card 63. Then, the memory card 63 thus rewritten is inserted into the card slot 63S. In addition, the kinds or content of the games provided by the station 4 can be changed by replacing the memory card 63 storing a game program and a game system program with another memory card 63 storing another game program and game system program. The game program includes a program for advancing a game and the like. The game program also includes a program related to image data and sound data outputted during a game.

The GAL 64 is one type of PLD that has a fixed OR array structure. The GAL 64 includes multiple input ports and output ports and, upon receiving predetermined data via each input port, outputs output data that corresponds to the input data via the corresponding output port. In addition, an IC socket 64S has a structure that allows the GAL 64 to be detachably mounted, and is connected to the CPU 111 via the PCI bus.

The CPU 61, the ROM 65, and the boot ROM 62, which are connected to one another via the internal bus, are connected to the CPU 111 via the PCI bus. The PCI bus performs signal transmission between the CPU 111 and the gaming board 60, as well as supplying electric power from the CPU 111 to the gaming board 60. The ROM 65 stores country identification information and an authentication program. The boot ROM 62 stores a preliminary authentication program, a program (boot code) which instructs the CPU 61 to start up the preliminary authentication program, etc.

The authentication program is a program (forgery check program) for authenticating the game program and the game system program. The authentication program is defined to follow the procedure (authentication procedure) for confirming and authenticating that the game program and the game system program, which are to be acquired after the authentication, have not been forged, i.e. the procedure for authenticating the game program and the game system program. The preliminary authentication program is a program for authenticating the aforementioned authentication program. The preliminary authentication program is defined to follow the procedure for verifying that the authentication program has not been forged, i.e. the procedure for authenticating the authentication program (authentication procedure).

An instruction image display determination table is described with reference to FIG. 17.

Figure 31:
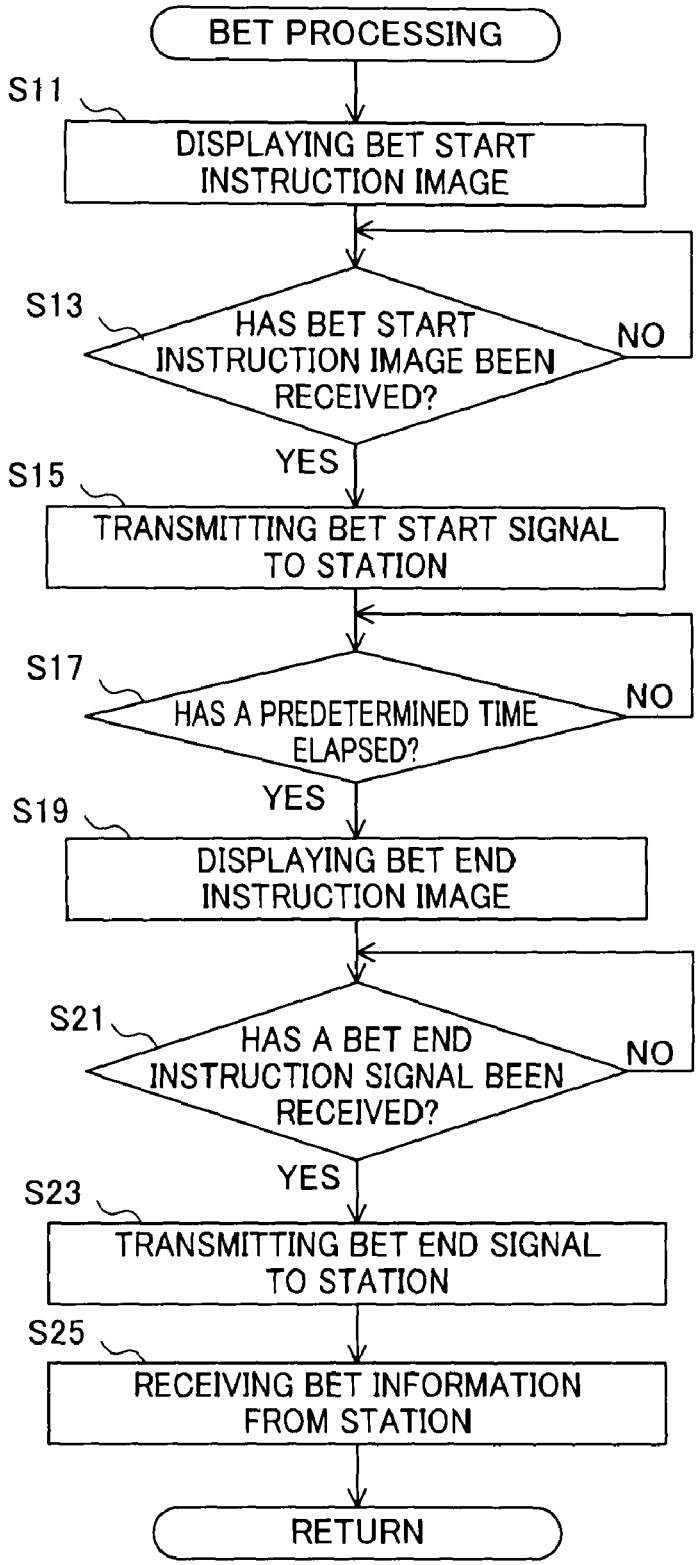
FIG. 31 is a flowchart showing bet processing executed in a gaming machine according to the embodiment of the present invention.

In Steps S11 and S19 of FIG. 31, the instruction image display determination table is referred to by the CPU 81 upon determining whether a bet start instruction image or a bet end instruction image is displayed on the display screen 210*a* of the dealer used display 210.

According to this table, "X" is data for indicating that the bet start instruction image and the like is not displayed on the display screen 210*a*, and "O" is data for indicating that the bet start instruction image and the like is displayed on the display screen 210*a*. For example, in a case in which a dealer belongs to an intermediate level, the bet start instruction image is not displayed on the display screen 210*a*, but the bet end instruction image is displayed on the display screen 210*a*. This table is stored in the ROM 82.

The bet existence determination table is described with reference to FIG. 18.

Figure 32:
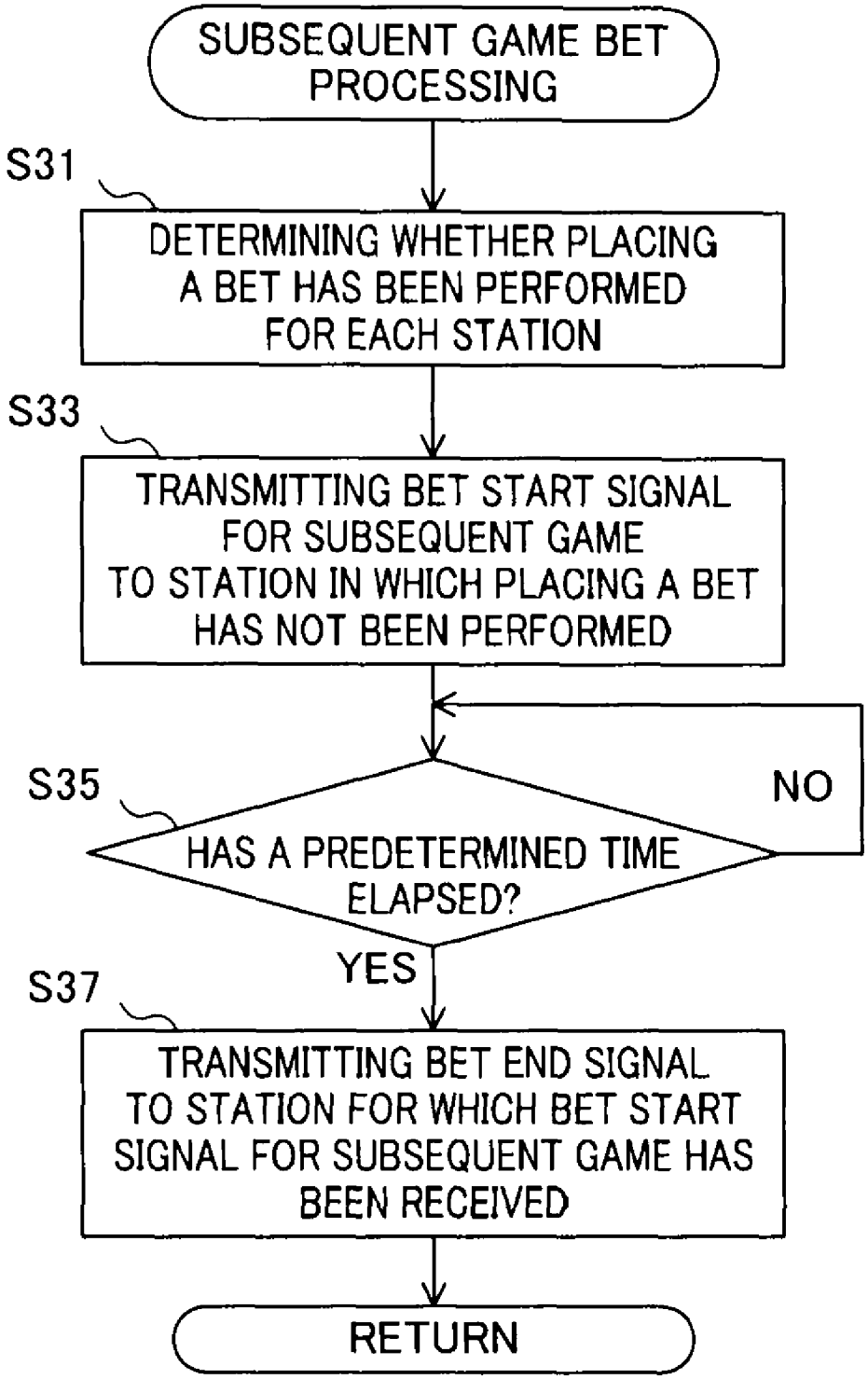
FIG. 32 is a flowchart showing subsequent game bet processing executed in a gaming machine according to the embodiment of the present invention.

The CPU 81 refers to this bet existence determination table upon determining for each station 4 whether a bet operation is performed at each station 4 in Step S31 of FIG. 32.

Data indicating whether the bet operation has been performed or not at each station number is stored in this table. "P" is data indicating that a bet operation was performed, and "A" is data indicating that a bet operation was not performed. In addition, this table is updated in every game, and stored in the RAM 83.

An oscillation mode data table is described with reference to FIG. 19.

Figure 33:
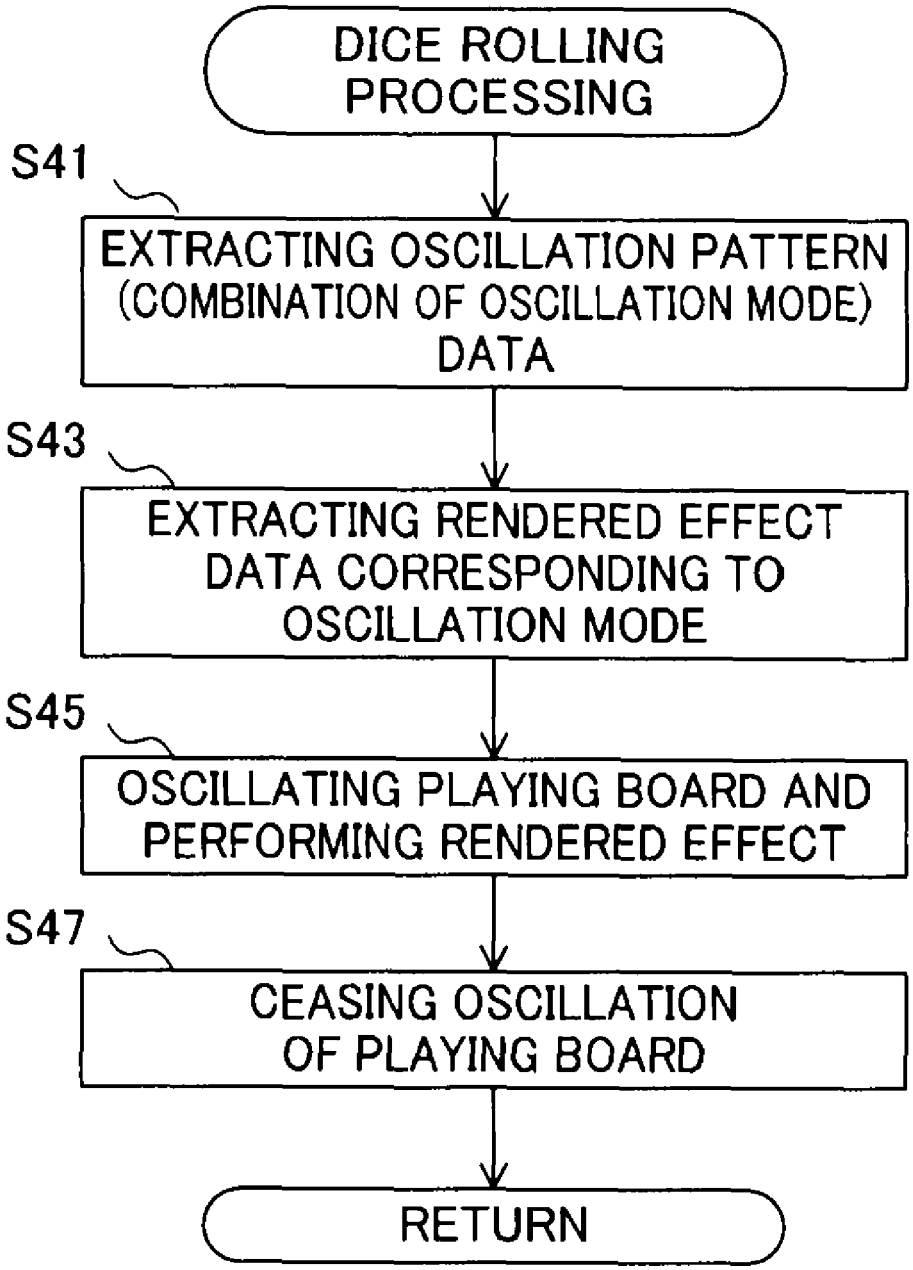
FIG. 33 is a flowchart showing dice rolling processing executed in a gaming machine according to the embodiment of the present invention.

The CPU 81 refers to this oscillation mode data table upon determining combination patterns of the oscillation modes of the playing board 3*a* in Step S41 of FIG. 33. In addition, this table is stored in the ROM 82.

According to this table, in a case of a pattern 3, the roll of dice 70 is performed in the order of a small oscillation for six seconds, a large oscillation for four seconds, and a subtle oscillation for five seconds. Here, the order of oscillation amplitude of the playing board 3*a* is equal to large oscillation>small oscillation>subtle oscillation. It should be noted that the oscillation speed for the large oscillation, the small oscillation, and the subtle oscillation are all the same speed. Furthermore, the small oscillation is enough to be able to roll a die, the large oscillation is enough to jump a die, and the subtle oscillation is enough to level off a die that comes to rest at a tilt.

A rendered effect table is described with reference to FIG. 20.

The CPU 81 refers to this rendered effect table upon determining rendered effect data in response to an oscillation pattern of the playing board 3*a* in Step S43 of FIG. 33. In addition, this table is stored in the ROM 82.

According to this table, oscillation modes correspond to sound types and, for example, in the case of a large oscillation, "sound 2" is determined. For example, in the case of "sound 2", the sound indicating that a die jumps is outputted from the speaker 221.

It should be noted that, by way of associating an oscillation mode with a certain type of emitted light, rendered effects with a light emitting mode associated with an oscillation mode may be performed by lighting or flashing of the lamp 222.

An IC tag data table is described with reference to FIG. 21.

The IC tag data table is a table showing data as identification data 1 to 3 which is created by the CPU 81 based on the results of the type of dice and the number of dots on the dice, when information stored in IC tags embedded in the dice 70*a*, 70*b*, and 70*c* is detected by the IC tag reader 16.

According to this table, for example, when an IC tag embedded in each die is detected in the order of 70*c*, 70*a*, and 70*b*, by the IC tag reader 16, the die 70*c* is associated with identification data 1 of which the type is "red" and the number of dots is "six", the die 70*a* is associated with identification data 2 of which the type is "white" and the number of dots is "three", and the die 70*b* is associated with identification data 3 of which the type is "black" and the number of dots is "five".

On the other hand, when three dice are not detected, for example, in a case where only two dice are detected, identification data is created for only 2 sets, identification data 1 and 2.

In addition, the data table is transmitted from the IC tag reader 16 to the CPU 81, and then the CPU 81 receives it to analyze the number of dots on a die and the like.

An infrared camera capturing data table is described with reference to FIG. 22.

The infrared camera capturing data table is a data table showing dot patterns of the infrared absorption inks applied to the dice 70 and location data of the dice 70 on the playing board 3*a*.

For example, regarding the die 70*a* shown in FIG. 11, in the infrared camera capturing data table, the CPU (not shown) inside the infrared camera 15 stores −50 for X and 55 for Y as location data, stores "O" for 181, 182, 184, 186, and 187, to which the infrared absorption inks are being applied, and stores "X" for 183 and 185, which are not being applied. The same is true of the dice 70*b* and 70*c*.

On the other hand, as shown in FIG. 13, in a case where a plurality of faces of the dice 70 is captured, the number of dots cannot be specified uniquely. In this case, the CPU (not shown) inside the infrared camera 15 calculates the area of the profiles 75 on the plurality of faces thus captured, and generates the infrared camera capturing data table based on the dot patterns on the face that has a maximum area.

Therefore, even if the dice 70 come to rest at a tilt and a plurality of faces of the dice 70 is captured, the number of dots can be specified uniquely.

In addition, this data table is transmitted from the infrared camera 15 to the CPU 81, and then the CPU 81 receives it to analyze the number of dots on a die and the like.

A dot pattern data classification table is described with reference to FIG. 23.

According to this table, colors as the classification for the dice 70 are set so as to correspond to dot combinations to which the infrared absorption ink is applied, among the abovementioned dots 181 to 183 in FIG. 10. "O" indicates that the infrared absorption ink is applied to the dot, and "X" indicates that the infrared absorption ink is not applied to the dot.

For example, in a case where the infrared camera capturing data table described in FIG. 22 is transmitted to the CPU 81, the CPU 81 determines the classification of the dice 70 as "red" by comparing the infrared camera capturing data table with the dot pattern data classification table.

A number of dots-dot pattern data table is described with reference to FIG. 24.

According to this table, numbers as the number of dots on the dice 70 are set so as to correspond to dot combinations to which the infrared absorption ink is applied, among the abovementioned dots 184 to 187 in FIG. 10. "O" indicates that the infrared absorption ink is applied to the dot, and "X" indicates that the infrared absorption ink is not applied to the dot.

For example, in a case where the infrared camera capturing data table shown in FIG. 22 is transmitted from the infrared camera 15 to the CPU 81, the CPU 81 determines the number of dots on the dice 70 as "five" by comparing the infrared camera capturing data table thus received with the dot pattern data classification table.

Figure 25:
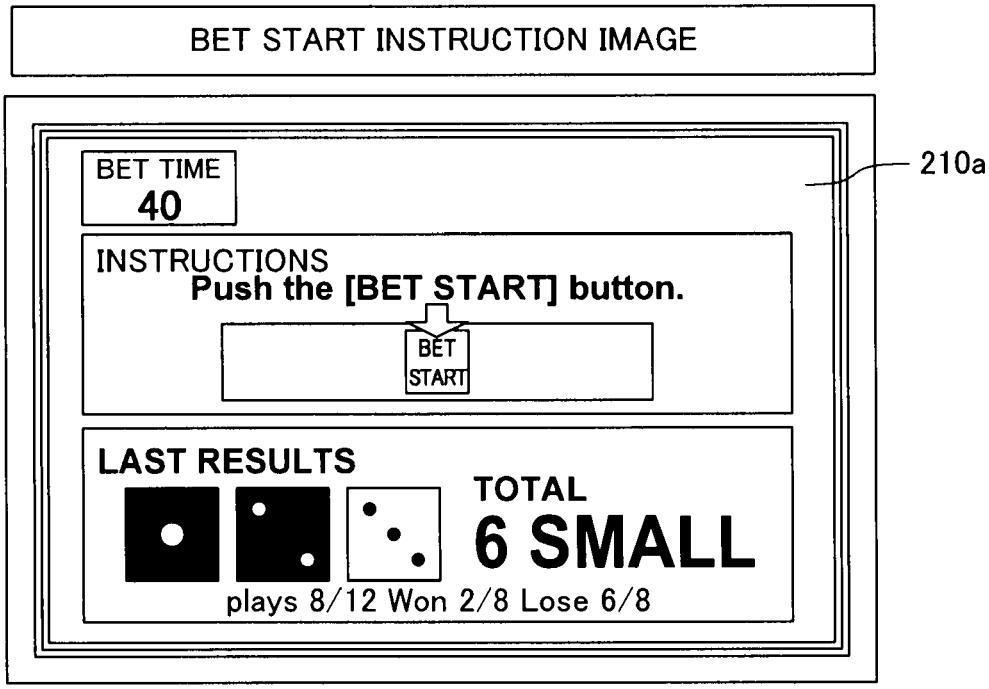
FIGS. 25 to 29 show examples of display screens according to the embodiment of the present invention.

A bet start instruction image is described with reference to FIG. 25.

The bet start instruction image is displayed by the CPU 81 on the display screen 210*a* of the dealer used display 210 before the CPU 81 accepts a bet from each station 4.

This bet start instruction image instructs a dealer to touch a "bet start" button. When a touch panel 211 detects that the dealer has touched the "bet start" button, the touch panel 211 transmits a bet start instruction signal to the CPU 81 via a communication interface 95.

Figure 26:
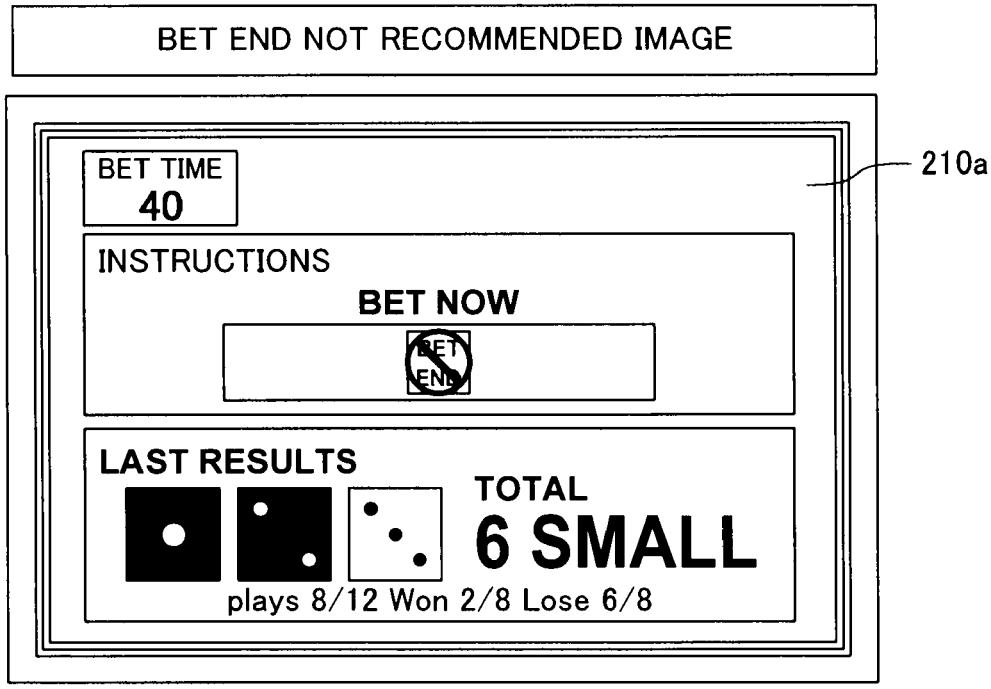

A bet end not recommended image is described with reference to FIG. 26.

This bet end not recommended image is displayed by the CPU 81 on the display screen 210*a* of the dealer used display 210 while the CPU 81 accepts a bet from each station 4.

This bet end not recommended image instructs the dealer not to touch a "bet end" button.

Figure 27:
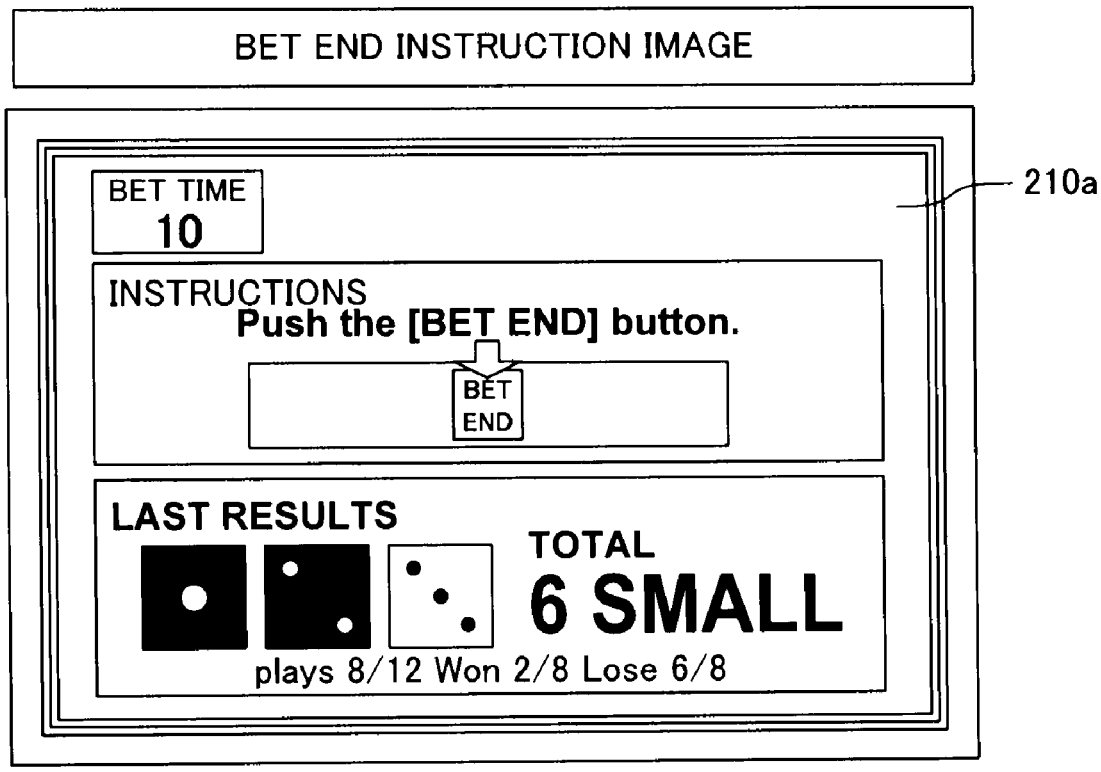

A bet end instruction image is described with reference to FIG. 27.

The bet end instruction image is displayed by the CPU 81 on the display screen 210*a* of the dealer used display 210 after elapse of a predetermined time from when the CPU 81 starts accepting a bet from each station 4.

This bet end instruction image instructs the dealer to touch the "bet end" button. When the touch panel 211 detects that the dealer has touched the "bet end" button, the touch panel 211 transmits a bet end instruction signal to the CPU 81 via the communication interface 95.

A display example on the image display unit 7 of each station 4 is described with reference to FIG. 28.

Figure 28:
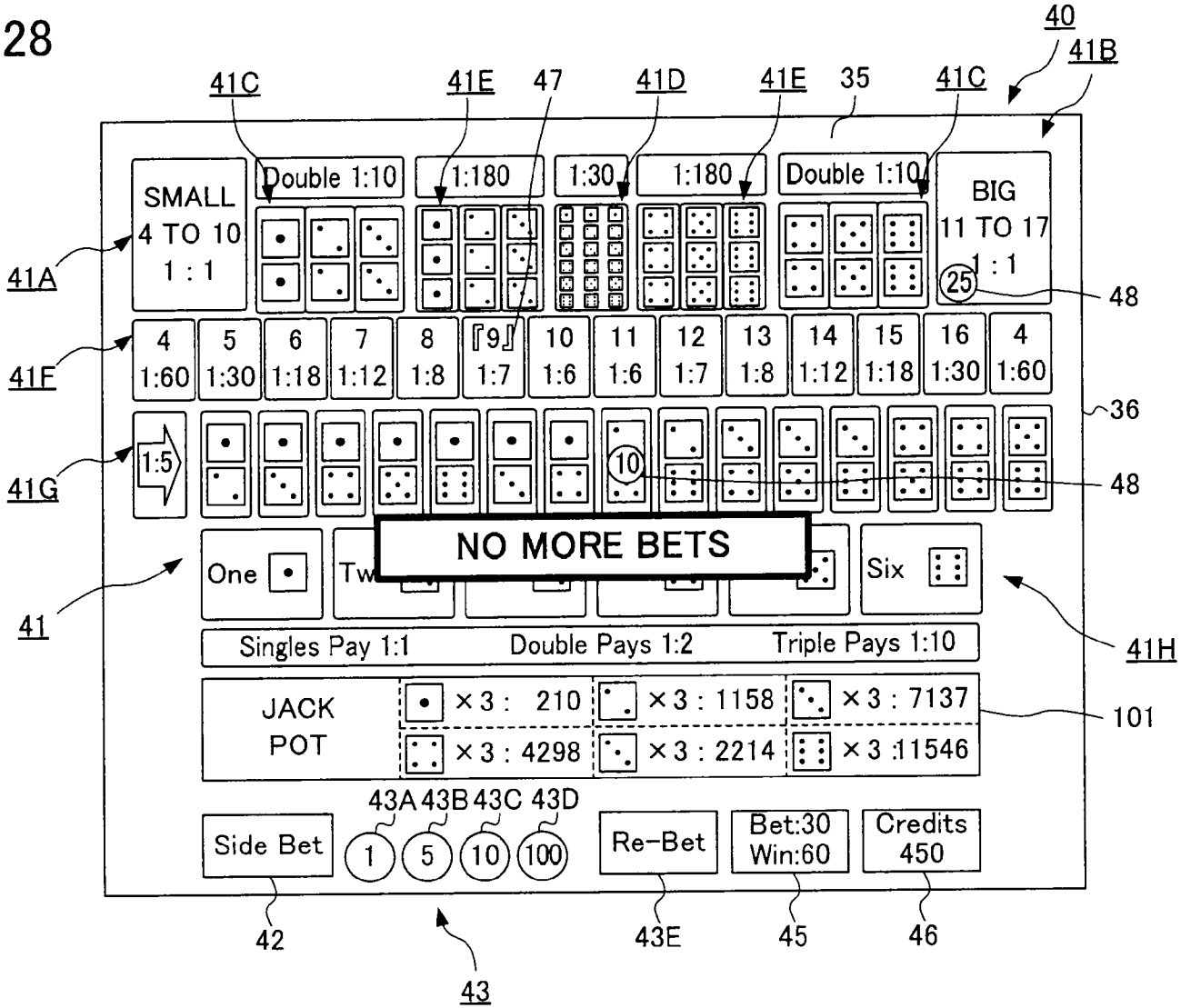

An image shown in FIG. 28 is configured to report to each station 4 that accepting of bets has ended. A player can recognize that the accepting of bets has ended by confirming that a message "NO MORE BETS" is displayed.

A display example on the image display unit 7 of each station 4 is described with reference to FIG. 29.

Figure 29:
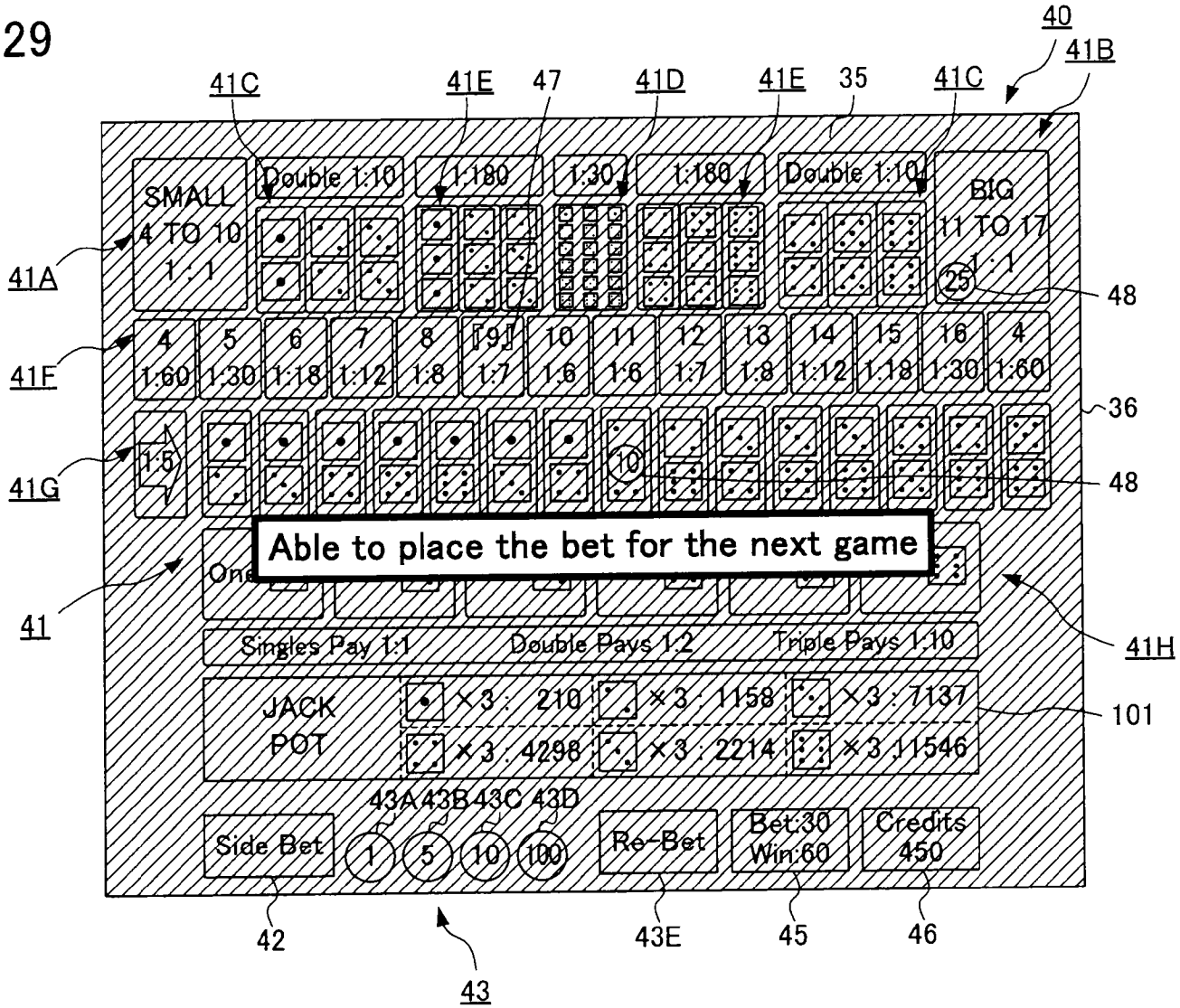

The image shown in FIG. 29 is configured to report to the station 4 in which a bet was not placed that a bet can be placed on a subsequent game. A player can recognize that a bet on the subsequent game is possible by confirming that a message "ABLE TO PLACE THE BET FOR THE NEXT GAME" is displayed.

Subsequently, with reference to FIGS. 30 to 34, processing performed in the main control unit of a gaming machine according to the present embodiment is described.

Figure 30:
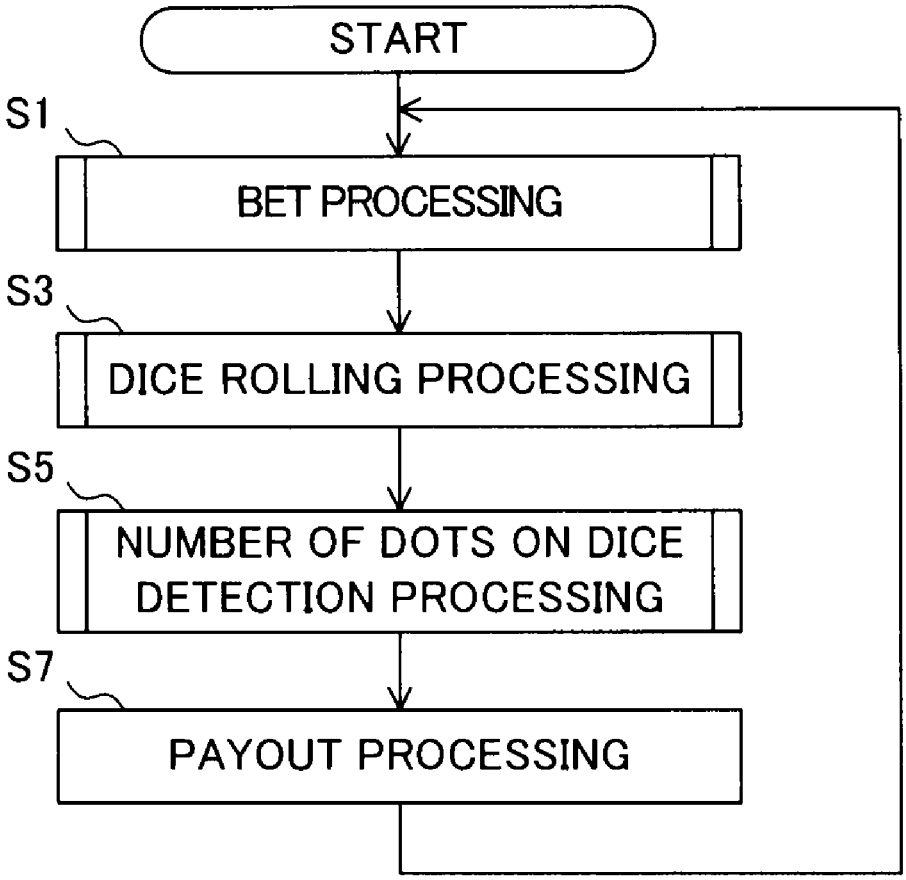
FIG. 30 is a flowchart showing dice game processing executed in a gaming machine according to the embodiment of the present invention.

FIG. 30 is a flowchart showing dice game execution processing. Initially, in Step S1, the CPU 81 executes bet processing, which is described later in FIG. 31, and in Step S3, the CPU 81 executes dice rolling processing, which is described later in FIG. 33. In Step S5, the CPU 81 executes number of dots on dice detection processing, which is described later in FIG. 34 and, in Step 7, executes payout processing corresponding to the number of dots, and then the flow returns to Step 1.

FIG. 31 is a flowchart showing bet processing.

In Step S11, the CPU 81 displays the bet start instruction image (see FIG. 25) on the display screen 210*a* of the dealer used display 210. It should be noted that, whether or not the bet start instruction image is displayed may be determined according to a dealer's level with reference to the instruction image display determination (see FIG. 17).

Thus, according to the dealer's level, it becomes possible to determine whether the bet start instruction image is displayed on the display screen 210*a* of the dealer used display 210.

In Step S13, the CPU 81 determines whether the bet start instruction signal has been received from the touch panel 211 disposed on the dealer used display 210. In the case of a NO determination, the CPU 81 returns the processing to Step S13, and in the case of a YES determination, the CPU 81 advances the processing to Step S15.

In Step S15, the CPU 81 transmits the bet start signal to each of the stations 4. When the bet start signal is received, bet placement can be performed at each station 4.

In Step S17, the CPU 106 determines whether or not a predetermined time has elapsed. More specifically, the CPU 81 starts to measure a predetermined lapse of time t by the timer 131, compares the predetermined lapse of time t with a predetermined time T1 stored in the ROM 82, and determines whether the predetermined lapse of time t measured by the timer 131 has reached the predetermined time T1. In the case of a NO determination, the CPU 81 returns the processing to Step S17, and in the case of a YES determination, the CPU 81 advances the processing to Step S19.

In Step S19, the CPU 81 displays the bet end instruction image (see FIG. 27) on the display screen 210*a* of the dealer used display 210. It should be noted that, whether or not the bet end instruction image is displayed may be determined according to a dealer's level with reference to the instruction image display determination (see FIG. 17).

In Step S21, the CPU 81 determines whether the bet end instruction signal has been received from the touch panel 211 disposed on the dealer used display 210. In the case of a NO determination, the CPU 81 returns the processing to Step S21, and in the case of a YES determination, the CPU 81 advances the processing to Step S23.

In Step S23, the CPU 81 transmits the bet end signal to each station 4. When the bet end signal is received, bet placement cannot be accepted at each station 4, and then the CPU 111 inside the station control unit 110 displays an image which reports on the image display unit 7that an accepting of bet placement has been terminated (FIG. 28).

In Step S25, the CPU 81 receives bet information from each station 4. The bet information relates to a normal bet input and a side bet input performed at each station 4. In addition, the bet information includes information indicating whether bet placement has been performed or not which is included in the bet existence determination table (FIG. 18). Upon terminating the processing of Step S25, the CPU 81 terminates the bet processing.

With the bet processing of the present embodiment, even an inexperienced dealer can perform start operations for bet placement and end operations according to instructional images.

FIG. 32 is a flowchart showing subsequent game bet processing.

The subsequent game bet processing is started by the CPU 81 and executed parallel to the dice rolling processing in FIG. 30 when the bet processing described in FIG. 31 is terminated. Therefore, placing a bet on the subsequent game becomes possible even during the dice rolling after termination of the bet processing.

In Step S31, the CPU 81 determines whether bet placement has been performed for each station 4. More specifically, the CPU 81 distinguishes stations at which bet placement has been performed from stations at which bet placement has not been performed with reference to the bet existence determination table (FIG. 18).

In Step S33, the CPU 81 transmits a bet start signal for a subsequent game to the stations 4 at which bet placement has not been performed. When the station 4 receives the bet start signal for a subsequent game, the CPU 111 inside the station control unit 110 displays an image which reports that bet placement for a subsequent game is possible (FIG. 29) on the image display unit 7.

Thus, even during a game, a player who has not participated in the game can place a bet on a subsequent game.

In Step S35, the CPU 81 determines whether or not a predetermined time has elapsed. More specifically, the CPU 81 starts to measure a predetermined lapse of time t by the timer 131, compares the predetermined lapse of time t with a predetermined time T2 stored in the ROM 82, and determines whether the predetermined lapse of time t measured by the timer 131 has reached the predetermined time T2. In the case of a NO determination, the CPU 81 returns the processing to Step S35, and in the case of a YES determination, the CPU 81 advances the processing to Step S37.

In Step S37, the CPU 81 transmits a bet end signal to the station 4 at which the bet start signal for a subsequent game has been received. When the station 4 receives the bet end signal, the player cannot place a bet on a subsequent game, and the CPU 81 terminates acceptance of bet placement for a subsequent game. Upon terminating the process in Step S37, the CPU 81 terminates the subsequent game bet processing.

FIG. 33 is a flowchart showing dice rolling processing.

In Step S41, the CPU 81 extracts an oscillation pattern (combinations of oscillation modes) data from the ROM 82. More specifically, the CPU 81 refers to an oscillation mode data table (see FIG. 19) and extracts the oscillation pattern data at random.

In Step S43, the CPU 81 extracts a rendered effect corresponding to an oscillation mode from the ROM 82. More specifically, the CPU 81 refers to the rendered effect table (see FIG. 20) and extracts rendered effect data corresponding to an oscillation mode based on an oscillation pattern data thus extracted in Step S41.

In Step S45, the CPU 81 oscillates the playing board 3*a* and performs a rendered effect. More specifically, the CPU 81 oscillates the playing board 3*a* by controlling the oscillation motor 300 based on the oscillation pattern data thus extracted in Step S41, and performs a rendered effect with sounds and/or lights based on rendered effect data corresponding to an oscillation mode.

Thus, since a rendered effect corresponding to an oscillation mode of the playing board 3*a* is performed, games do not become monotonous and interest therein can be improved. Furthermore, since an oscillation pattern is randomly determined, games do not become monotonous and interest therein can be improved.

In Step S47, the CPU 81 ceases oscillation of the playing board 3*a*. More specifically, the CPU 81 ceases the oscillation of the playing board 3*a* by stopping the oscillation motor 300. Upon terminating the processing in Step S47, the CPU 81 terminates the dice rolling processing.

Figure 34:
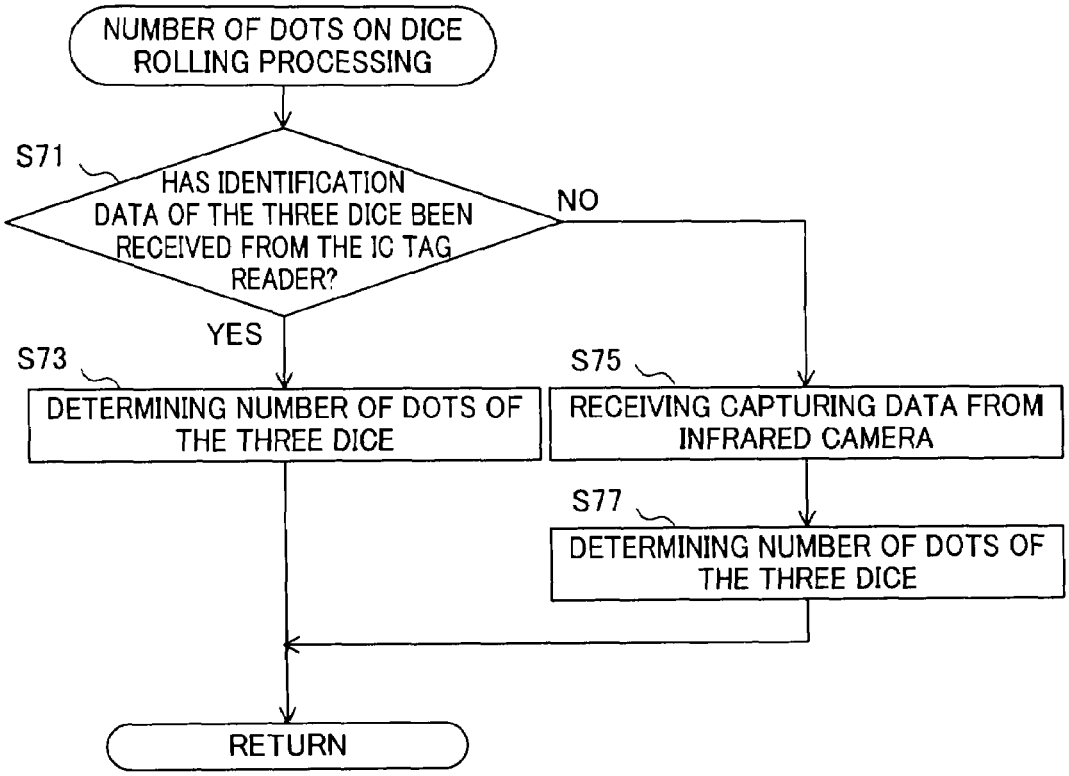
FIG. 34 is a flowchart showing dot detection processing executed in a gaming machine according to the embodiment of the present invention.

FIG. 34 is a flowchart showing number of dots on dice detection processing.

In Step S71, the CPU 81 determines whether identification data of the three dice has been received from the IC tag reader 16. In the case of a YES determination, the CPU 81 advances the processing to Step S73, and in the case of a NO determination, the CPU 81 advances the processing to Step S75. More specifically, the CPU 81 determines whether there are three sets of identification data, which are identification data 1 to 3, in the IC tag data table (see FIG. 21) received from the IC tag reader 16.

In Step S73, the CPU 81 determines the number of dots on the three dice. More specifically, the CPU 81 determines the number of dots of the three dice by analyzing the identification data 1 to 3. For example, in a case where the identification data is data as shown in FIG. 21, the number of dice of which type is red is "six", the number of dice of which type is white is "three", and the number of dice of which type is black is "five". Upon finishing the processing in Step S73, the CPU 81 terminates the number of dots detection processing.

In Step S75, the CPU 81 receives capturing data from the infrared camera. More specifically, the CPU 81 receives the infrared camera capturing data table (see FIG. 22) for each of the dice 70*a*, 70*b*, and 70*c*, from the infrared camera 15 In Step S77, the CPU 81 determines numbers of dots on the dice. More specifically, the CPU 81 determines positions of the dice on the playing board 3*a* based on the infrared camera capturing data table (see FIG. 22), determines types (colors) of the dice based on the infrared camera capturing data table (see FIG. 22) and the dot pattern data classification table (see FIG. 23), and determines numbers of the dice based on the infrared camera capturing data table (see FIG. 22) and the number of dots-dot pattern data table (see FIG. 24). This processing is executed for the three dice 70*a*, 70*b*, and 70*c*. Upon terminating the processing in Step S77, the CPU 81 terminates the number of dots detection processing.

Thus, even in a case where, for example, a die is inclined and the number of dots thereof cannot be identified by the IC tag reader 16, since the number of dots can be determined using the infrared camera 15, the accuracy of detection and identification of numbers of dots can be improved. Descriptions regarding the present embodiment have been provided above. Although a case has been described in which the number of dice 70 is three according to the present embodiment, the number of in the present invention is not limited to three and, for example, the number of the dice may be five. In the present embodiment, although the controller of the present invention is described for a case of being configured from a CPU 81 which the main controller 80 includes and a CPU 111 which the station 4 includes, the controller of the present invention may be configured by only a single CPU. Although embodiments of the present invention are described above, they are merely exemplified specific examples, and the present invention is not particularly limited thereto. Specific configurations such as each means can modified appropriately. Moreover, it should be understood that the advantages described in association with the embodiments of the present invention are merely a listing of most preferred advantages generated by the present invention, and that the advantages of the present invention are by no means restricted to those described in connection with the embodiments.

Figure 1A:
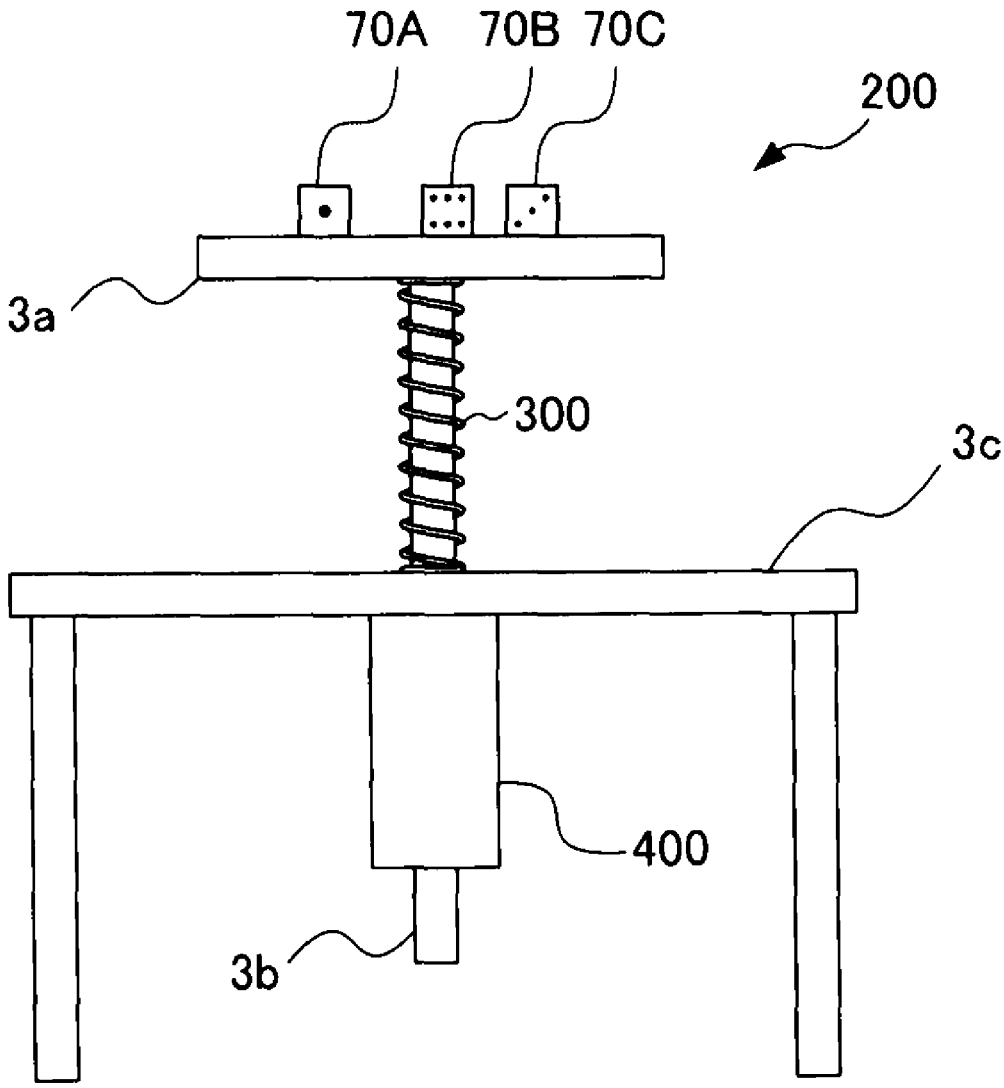
FIG. 1A is a schematic view illustrating a substantial part of a rolling unit according to an embodiment.

First, a general outline of the present embodiment is explained using FIG. 1A. FIG. 1A is a diagram showing a substantial part of a rolling unit 200 that rolls dice. In a gaming machine 1 (see FIG. 2A) according to the present embodiment, a dice game (SIC BO) is performed using three dice. A player predicts a number of dots appearing on a die and can place a bet on it (see FIG. 7A). Then, the rolling unit 200 is driven and dice are rolled after a bet is performed, and gaming media may be paid out according to the number of dots on the dice coming to rest.

As shown in FIG. 1A, the rolling unit 200 includes a circular table 3*a* on which three dice 70 (die 70*a*, die 70*b*, and die 70*c*) are placed and a linear cylinder 400 for oscillating the circular table 3*a*. A shaft 3*b* is installed upright at the center of the circular table 3*a*, and this shaft 3*b* is inserted into the linear cylinder 400 which is fixed on a base 3*c*. Furthermore, a coil-shaped spring 300 is loosely fit with the shaft 3*b*, and the spring 300 is disposed between the circular table 3*a* and the base 3*c*. Then, in a state in which the linear cylinder 400 is not energized, the weight of the circular table 3*a* itself is proportional to biasing of the spring 300, as a result of which the circular table 3*a* is maintained at a predetermined location above the base 3*c*.

The linear cylinder 400 moves the shaft 3*b* back and forth in a vertical direction by applying thrust in a vertical direction to the shaft 3*b*. When the linear cylinder 400 moves the shaft 3*b* up and down in a state in which the weight of the circular table 3*a* itself is proportional to biasing of the spring 300, the circular table 3*a* along with the shaft 3*b* moves in a vertical direction. Consequently, dice are rolled on the circular table 3*a*, and furthermore, the circular table 3*a* is ceased by turning off electricity to the linear cylinder 400, a result of which the dice come to rest on the circular table 3*a* in a state in which a certain number of dots appear thereon. The abovementioned is a general outline of the present embodiment. Further explanation is provided in the following.

Figure 2A:
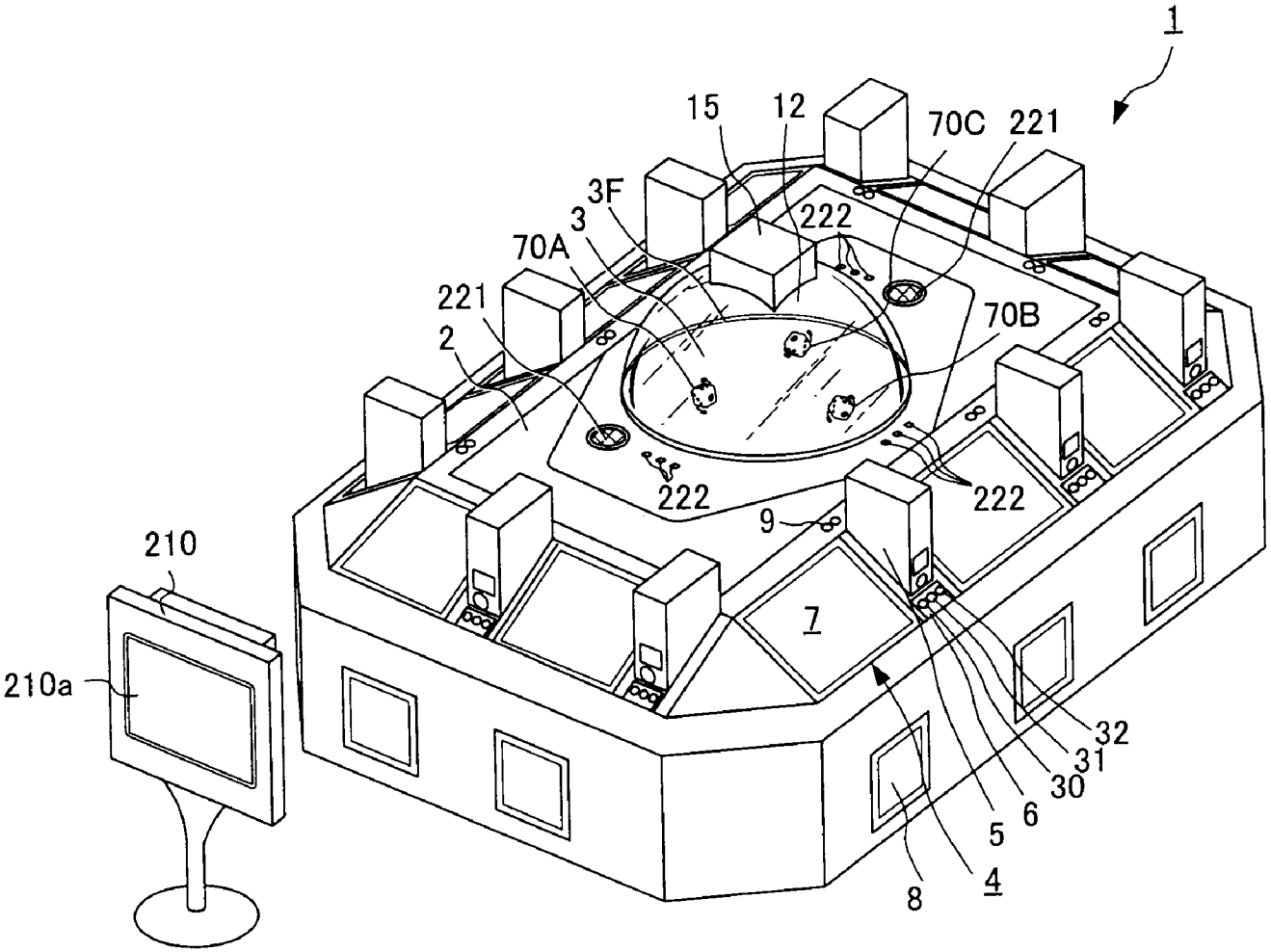
FIG. 2A is a perspective view schematically showing an example of a gaming machine according to the embodiment.

FIG. 2A is a perspective view schematically showing an example of a gaming machine according to the embodiment of this invention.

Figure 3A:
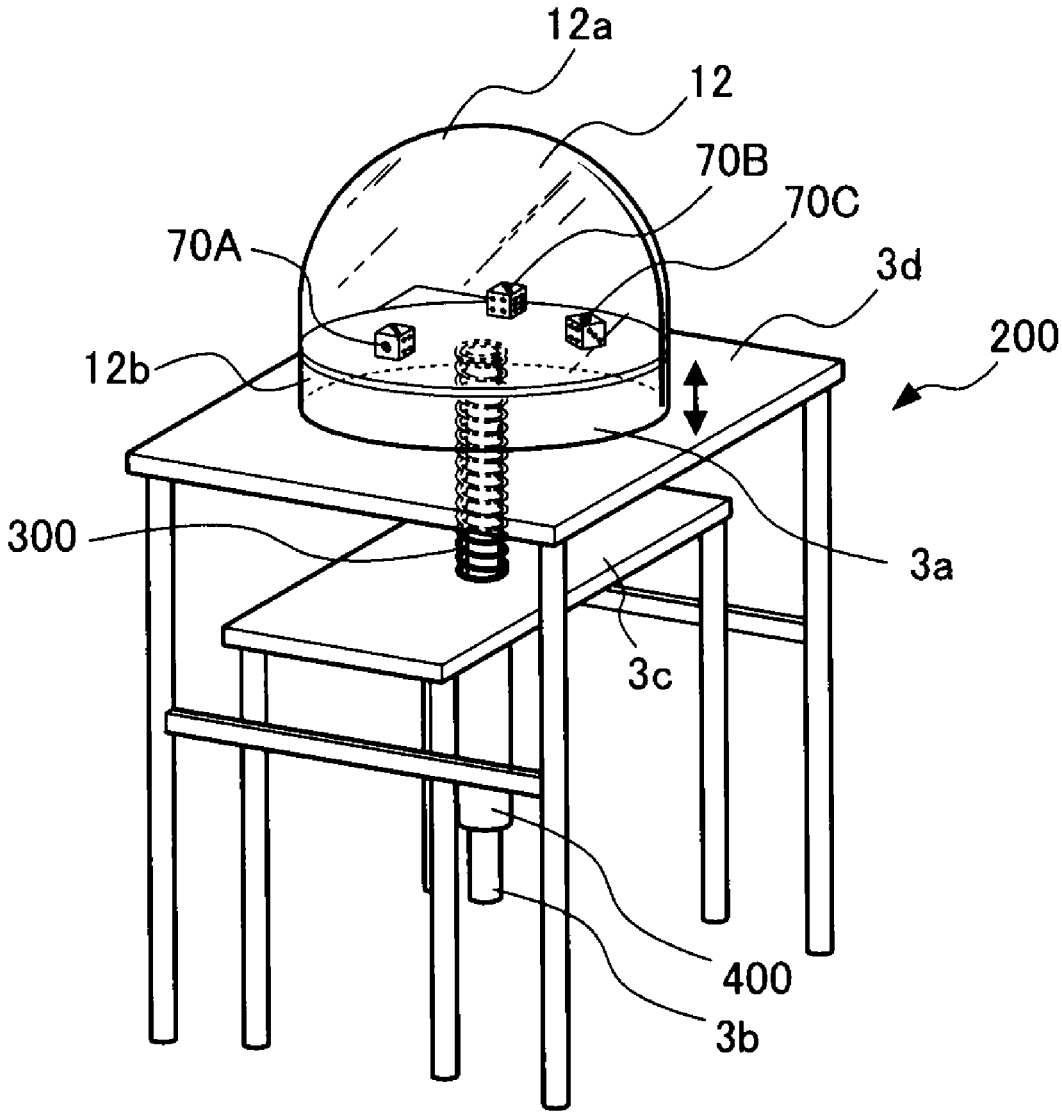
FIG. 3A is a perspective view schematically showing an example of a rolling unit provided at a gaming machine according to the embodiment.

FIG. 3A is a view schematically showing a configuration of a rolling unit for rolling dice, and constitutes a playing unit of the gaming machine shown in FIG. 2A.

Figure 4D:
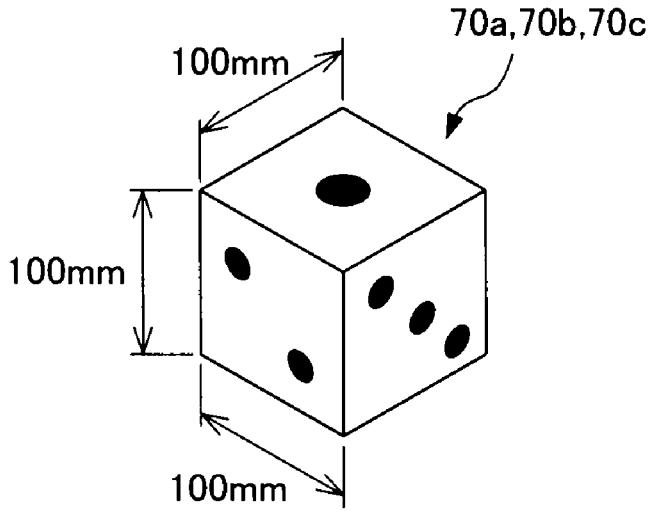
FIG. 4D is an external perspective view of a die according to the embodiment of the present invention.
Figure 4A:
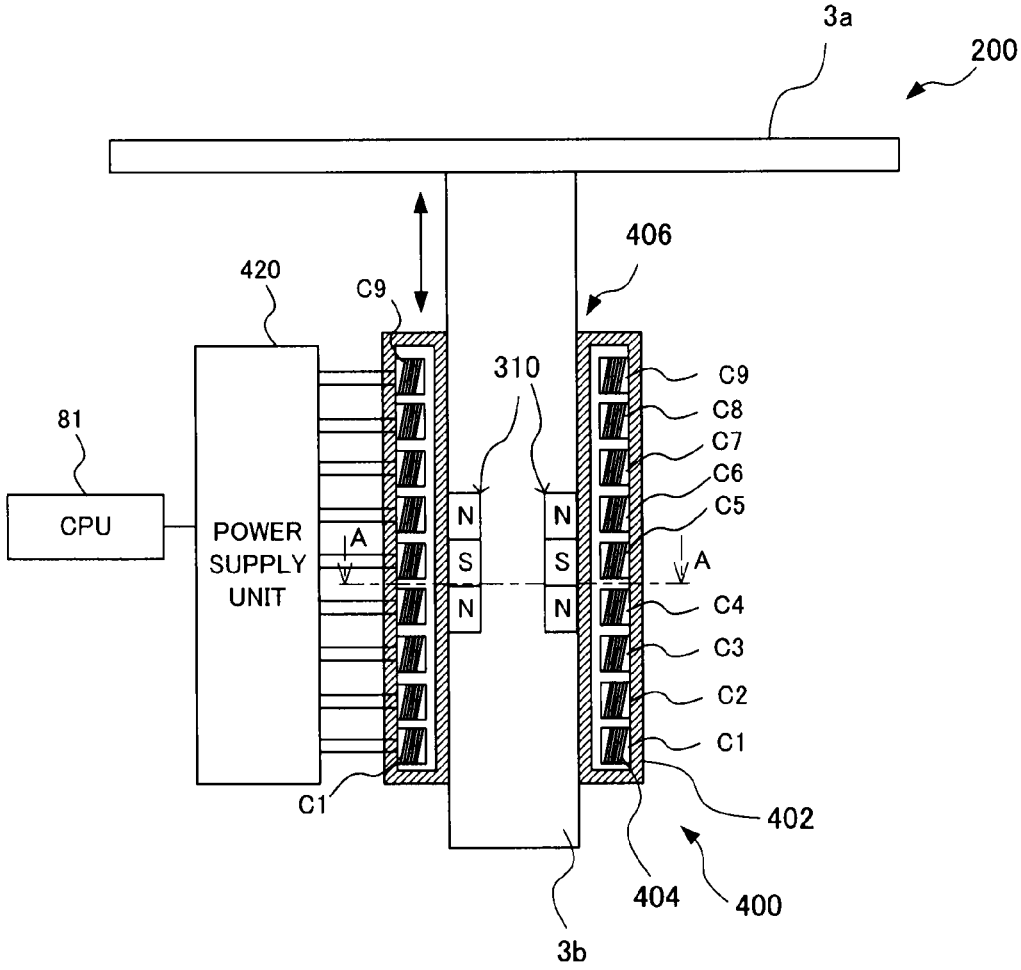
FIG. 4A is a perspective view schematically showing a driving mechanism of a rolling unit provided in a gaming machine according to the embodiment.

FIG. 4A is a diagram showing a driving mechanism of a rolling unit for rolling dice.

Figure 5A:
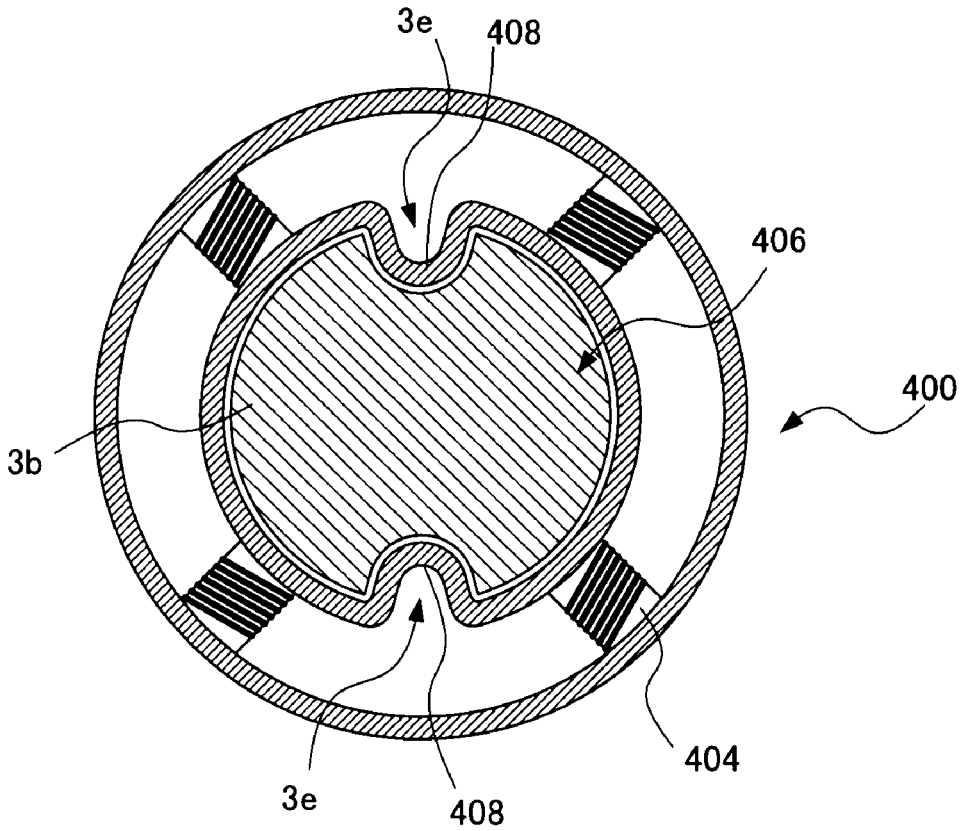
FIG. 5A is a diagram illustrating A-A cross-section of FIG. 4A.

FIG. 5A is a diagram illustrating a cross-section of the line A-A of FIG. 4A.

As shown in FIG. 2A, the gaming machine 1 according to the present embodiment includes a housing 2 as a main body portion, a playing unit 3 that is provided substantially at the center of the top face of the housing 2 and in which a plurality of dice 70 (70A, 70B, 70C) are rolled and come to rest, and a plurality of stations 4 disposed so as to surround the playing unit 3. The station 4 includes an image display unit 7. The player seated at each station 4 can participate in a game by predicting numbers of dots on the dice 70 and performing a normal bet input and a side bet input.

The gaming machine 1 includes a housing 2 as a main body portion, a playing unit 3 that is provided substantially at the center of the top face of the housing 2 and in which a plurality of dice 70 are rolled and come to rest, a plurality of stations 4 (ten in the present embodiment) disposed so as to surround the playing unit 3, and a dealer used display 210 that is positioned so as not to be visually recognizable by a player seated at each station 4.

The station 4 include a game media receiving device 5 into which game media such as medals to be used for playing the game are inserted, a control unit 6, which is configured with multiple control buttons by which a player enters predetermined instructions, and an image display unit 7, which displays images relating to a bet table. The player may participate in a game by operating the control unit 6 or the like while viewing the image displayed on the image display unit 7.

A payout opening 8, from which a player's game media are paid out, are provided on the sides of the housing 2 on which each station 4 is provided. In addition, a speaker 9, which can output sound, is disposed on the upper right of the image display unit 7 on each of the stations 4.

A control unit 6 is provided on the side part of the image display unit 7 on each of the stations 4. As viewed from a position facing the station 4, in order from the left side are provided a select button 30, a payout (cash-out) button 31, and a help button 32.

The select button 30 is a button that is pressed when confirming a bet operation after the bet operation is complete. Furthermore, in a case other than the bet operation, the button is pressed when a player confirms an input performed.

The payout button 31 is a button which is usually pressed at the end of a game, and when the payout button 31 is pressed, game media corresponding to credits that the player has acquired is paid out from the payout opening 8.

The help button 32 is a button that is pressed in a case where a method of operating the game is unclear, and upon the help button 32 being pressed, a help screen showing various kinds of operation information is displayed immediately thereafter on the image display unit 7.

The top of the game unit 3 is entirely covered with a cover member 12 of hemispheric transparent acryl to control the rolling range of dice. In the present embodiment, a dot detecting unit 15, which detects a number of dots on the dice 70, is provided at the top of the cover member 12. The rolling unit 200 is provided below the cover member 12, and a plurality of the dice 70 is rolled and come to rest by way of the rolling unit 200. The present embodiment is configured to use three dice 70 (die 70A, 70B, and 70C) in the playing unit 3.

The rolling unit 200 includes the circular table 3*a* on the top surface of which three dice 70 (die 70A, die 70B, and die 70C) are placed. The circular table 3*a* is provided in the cover member 12. Here, as shown in FIG. 3A, the cover member 12 is fixed with a supporting table 3*d* having a circular opening to which a cylindrical portion 12*b* is adapted. The circular table 3*a* is loosely fit internally with the cylindrical portion 12*b* of the cover member 12. At this time, the cylindrical portion 12*b* functions as a guiding member in that the circular table 3*a* can be moved in a vertical direction but is restricted to move in a horizontal direction. Thus, the circular table 3*a* is an example of a table on which the dice (die 70A, die 70B, and die 70C) are placed on the top surface.

A cylindrical shaft 3*b* made of an iron core is installed upright at the center of the lower surface of the circular table 3*a*. A coil-shaped spring 300 is loosely inserted to the shaft 3*b*. The base 3*c* supporting the shaft 3*b* is provided below the circular table 3*a*. An opening is formed in the base 3*c* so as to loosely accommodate the shaft 3*b*. Furthermore, the linear cylinder 400 is fixed at the lower surface of the base 3*c*. The linear cylinder 400 includes a cylindrical opening 406, and the linear cylinder 400 is disposed at the lower surface of the base 3*c* so that the opening 406 of the linear cylinder 400 is in communication with an opening of the base 3*c*. As a result, based on a biasing force of the spring 300 disposed between the circular table 3*a* and the base 3*c* by loosely accommodating the shaft 3*b* to the opening of the base 3*c*, the circular table 3*a* is positioned in place and the state thereof in which the shaft 3*b* is inserted to the linear cylinder 400 is maintained. Thus, the shaft 3*b* is an example of a shaft installed upright at the lower surface of a table (the circular table 3*a*). Furthermore, the linear cylinder 400 is an example of a linear actuator that drives a shaft (the shaft 3*b*) in a vertical direction. In addition, the base 3*c* is an example of a base that is provided below a table (the circular table 3*a*) and supports a linear actuator (the linear cylinder 400). In addition, the spring 300 is an example of a spring member that is disposed between a table (the circular table 3*a*) and a base (the base 3*c*) and biases a table (the circular table 3*a*) above.

Then, when the linear cylinder 400 applies thrust in a vertical direction to the shaft 3*b*, the shaft 3*b* moves in a vertical direction, and the circular table 3*a*, which is communicatively connected with the shaft 3*b*, moves up and down in the cover member 12.

FIG. 4A is a diagram illustrating a structure of the linear cylinder 400, and FIG. 5A is a view illustrating a cross-section A-A of FIG. 4A. The linear cylinder 400 includes a configuration in which a plurality of coils 404 is arranged side by side in a vertical direction in a cylindrical case 402, the inside of which is hollow. In FIG. 4A, although nine coils 404 (coils C1 to C9) are arranged in parallel, this arrangement is merely an example for illustrating a principle for driving a shaft and, regarding the number or size of the coils 404, it is possible to be set appropriately according to the weight of the circular table 3*a* and the shaft 3*b*. Thus, the coils 404 (coils C1 to C9) are an example of coils arranged side by side in a vertical direction.

Furthermore, as shown in FIG. 4A, since a plurality of the coils 404 forms a plurality of columns of the coils 404 in the case 402, and each column of the coils 404 adjacent each other with respect to a central axis of the case 402 is arranged equiangularly. In the present embodiment, as shown in FIG. 5A, four columns are arranged at 90-degree intervals each other. Furthermore, each of the coils 404 is arranged so that a central axis of the coil 404 directs to a central axis of the case 402. Each of the coils 404 is connected to a power supply unit 420 and is wired so that four coils 404 positioned at the identical circumference of a circle as a single set are energized. Therefore, in a case in which a set of the coils 404 is energized, the coils 404 are excited so that a set of the coils 404 becomes identical magnetic poles.

Figure 6A:
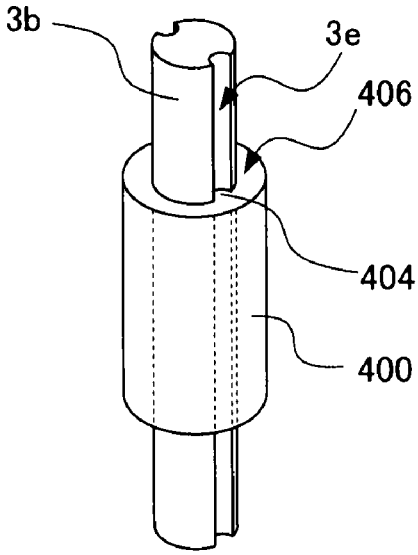
FIG. 6A is a perspective view showing an outer appearance proximal to a linear cylinder.

As shown in FIG. 5A, two convex portions 408 extending in a vertical direction are formed at an inner side face of the case 402 and disposed at a symmetrical position to each other with respect to the central axis of the case 402. Furthermore, concave portions 3*e* extending in a vertical direction are formed at a side face of the shaft 3*b*. The two concave portions 3*e* are disposed at symmetrical positions to each other with respect to the central axis of the shaft 3*b*. Thus, the shaft 3*b* can be loosely fitted into the opening of the base 3*c* by adapting the concave portion 3*e* to the convex portion 408. Then, in a case in which the shaft 3*b* is inserted into the linear cylinder 400, as shown in FIG. 6A, the shaft 3*b* can be moved in a vertical direction, but the rotation thereof is regulated. Therefore, the circular table 3*a* can be moved up and down, but cannot be rotated.

Furthermore, in some regions facing some coils 404 around the shaft 3*b*, a magnetizing region 310 is formed so that adjacent magnetic poles are different from each other. In the present embodiment, in a state in which the circular table 3*a* is positioned in place, a region facing the coil C4 is magnetized as a N pole, a region facing the coil C5 is magnetized as a S pole, and a region facing the coil C6 is magnetized as a N pole. That is, in the present embodiment, four magnetizing regions 310 are formed on the side surface of the shaft 3*b*. Then, by energizing the coil 404 and then generating attracting and repelling force based on the magnetic force between the magnetic pole of the coil 404 and the magnetic pole of the magnetizing region 310 of the shaft 3*b*, a thrust force is applied to the shaft 3*b*. Furthermore, by changing the magnetic poles of each of the coils 404 excited in each of the columns of the coils 404, the shaft 3*b* can be driven in a vertical direction. At this time, since the attracting and repelling force of the magnetic force acts on the shaft 3*b* from four directions, the shaft 3*b* is moved up and down while the shaft 3*b* and the linear cylinder 400 are maintained in a state which is as non-contacting as possible. Thus, the magnetizing region 310 is an example of a magnetizing region which is formed to be arranged in a vertical direction on the surface of a shaft (the shaft 3*b*) and adjacent magnetic poles are magnetized so as to be different from each other.

More specifically, in a state in which each of the coils 404 is not energized, the biasing force by the spring 300 is proportional to the table 3*a*'s own weight, which makes the shaft 3*b* to be in a resting state. In this state, by making the coils C4, C5, and C6 to be a S pole, N pole, and S pole in this order by energizing them only, subsequently making the coils C5, C6, and C7 to be a S pole, N pole, and S pole in this order, and subsequently making the coils C6, C7, and C8 to be a S pole, N pole, and S pole in this order, the shaft 3*b* is moved toward an upper side. Conversely, by making the coils C4, C5, and C6 to be a S pole, N pole, and S pole in this order, subsequently making the coils C3, C4, and C5 to be a S pole, N pole, and S pole in this order, and subsequently making the coils C2, C3, and C4 to be a S pole, N pole, and S pole in this order, the shaft 3*b* is moved toward a lower side. Thus, the linear cylinder 400 is an example of a linear actuator in that, when a shaft (the shaft 3*b*) is inserted into an opening (the opening 406), a linear actuator (the linear cylinder 400) allows a coil (the coil 404) and a magnetizing region (the magnetizing region 310) to face each other, and then, by applying current to a coil (the coil 404) to excite thereof and then generating an attracting and repelling force based on a magnetic force between a coil (the coil 404) and a magnetizing region (the magnetizing region 310), a thrust force is generated on a shaft (the shaft 3*b*).

Control of the supply of power applied to the coils C1 to C9 is performed by the CPU 81 controlling the power supply unit 420. That is, by the CPU 81 switching the coils 404 to be excited, vertical movement of the shaft 3*b* can be achieved, as a result of which, dice on the table 3*a* can be rolled by moving the table 3*a* up and down in conjunction with the shaft 3*b*.

At this time, an amplitude of the vertical movement of the shaft 3*b* is determined by determining a range in a vertical direction of the coil 404 to be excited. In the present embodiment, for example, with the coils C4 to C6 as a basis, it is possible to render oscillation of the table 3*a* to be a large oscillation by performing power switching periodically in the order of the coils C5 to C7, C6 to C8, C7 to C9, C6 to C8, C5 to C7, C4 to C6, C3 to C5, C2 to C4, C1 to C3, C2 to C4, C3 to C5, and C4 to C6. Similarly, with the coils C4 to C6 as a basis, it is possible to make oscillation of the table 3*a* to be an intermediate oscillation by performing power switching periodically in the order of the coils C5 to C7, C6 to C8, C5 to C7, C4 to C6, C3 to C5, C2 to C4, C3 to C5, and C4 to C6. Furthermore, with the coils C4 to C6 as a basis, it is possible to make oscillation of the table 3*a* to be a subtle oscillation by performing power switching periodically in the order of the coils C5 to C7, C4 to C6, C3 to C5, and C4 to C6. In other words, it is possible to switch the amplitude of oscillation of the table 3*a* in three steps (large oscillation, intermediate oscillation, and subtle oscillation). Thus, the CPU 81 is an example of a control device which controls a linear actuator (the linear cylinder 400) so as to move a table up and down (the circular table 3*a*), to roll dice (the dice 70) on a table (the circular table 3*a*), and to cease vertical movement of a table (the circular table 3*a*). Furthermore, the CPU 81 is an example of a control device which controls a linear actuator (the linear cylinder 400) to switch the amplitude of a vertical movement of a table (the circular table 3*a*) in a stepwise manner. Furthermore, the CPU 81 is an example of a control device which controls a linear actuator (the linear cylinder 400) to minimize the amplitude of a vertical movement of a table (the circular table 3*a*), and then to cease oscillation thereof.

In the present embodiment, a number of dots appearing on the dice 70 on the table 3*a* is determined by setting the intermediate oscillation to lightly roll the dice on the table initially, setting the large oscillation to greatly roll the dice on the table secondly, and setting the subtle oscillation and then ceasing the table 3*a* finally.

The dot detection unit 15 in the present embodiment includes an imaging device (CCD camera) for shooting the dice 70 as an object of shooting, and detects the number of dots appearing on the dice 70 based on an imaging signal from the imaging device. Therefore, it is not possible to detect the number of dots appearing on the dice 70 accurately in a state in which a plurality of the dice 70 are overlapping each other. However, in the present embodiment, by moving the table 3*a* with subtle oscillation and then ceasing the table 3*a*, even if a plurality of the dice 70 is overlapping each other, it is possible to make the dice come to rest after breaking up the overlapping state of the dice. As a result of this, it is possible to detect the number of dots appearing on the dice 70 accurately.

Furthermore, an IC tag is embedded on each face of the dice 70. Therefore, the number of dots on the dice 70 is detected by reading information stored in the IC tag using an IC tag reader 16 (see FIG. 8A) provided at the lower surface of the table.

The IC tag reader 16 is a non-contact type IC tag reader. For example, it is possible to read information stored in the IC tag by RFID (Radio Frequency Identification). The RFID system performs near field communication that reads and writes data stored in semi-conductor devices by an induction field or radio waves in a non-contact manner. In addition, since this technology is known conventionally and is described in Japanese Unexamined Patent Application Publication No. H8-21875, an explanation thereof is abbreviated.

In the present embodiment, a plurality of IC tags is read by a single IC tag reader 16. Under the abovementioned RFID system, an anti-collision function can be employed which can read a plurality of IC tags by a single reader. The anti-collision function includes FIFO (first in first out) type, multi-access type, and selective type, and communicates with a plurality of the IC tags sequentially. The FIFO type is a mode to communicate with a plurality of the IC tags sequentially in the order that each IC tag enters an area in which an antenna can communicate therewith. The multi-access type is a mode that is able to communicate with all the IC tags, even if there is a plurality of the IC tags simultaneously in the area in which an antenna can communicate with the IC tags. The selective type is a mode that is able to communicate with a specific IC tag among a plurality of the IC tags in the area in which an antenna can communicate therewith. By employing the abovementioned modes, it is possible to read a plurality of the IC tags with a single IC tag reader. Thus, in the present embodiment, accurate detection of a number of the dots can be achieved by using both the dot detection unit 15 and the IC tag reader 16.

Figure 7A:
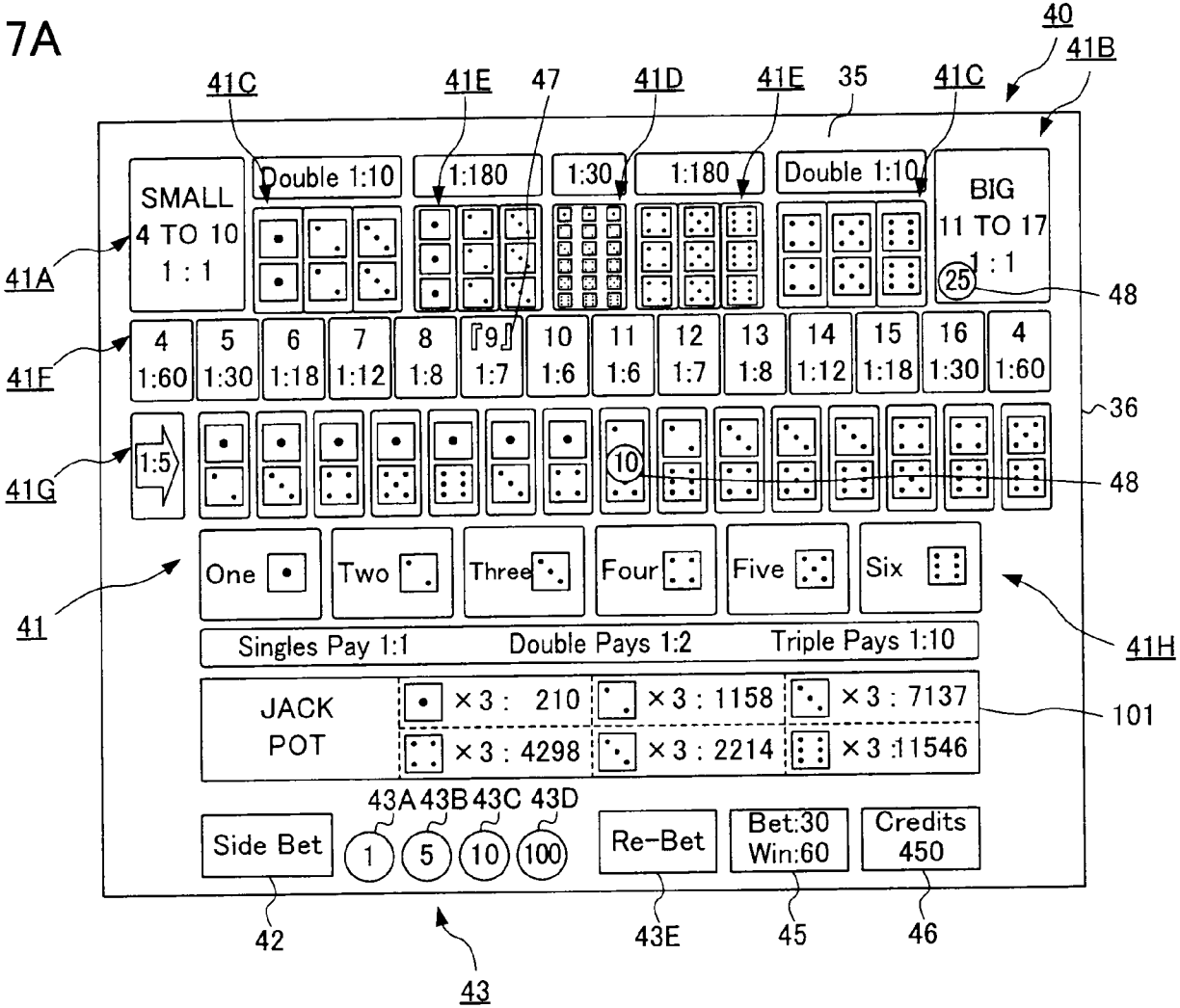
FIG. 7A shows an example of a display screen displayed on an image display unit.

FIG. 7A shows an example of a display screen displayed on an image display unit. As shown in FIG. 7A, an image display unit 7 is a touch-panel type of liquid crystal display, on the front surface of which a touch panel 35 is attached, allowing a player to perform selection such as of icons displayed on a liquid crystal screen 36 by contacting the touch panel 35, e.g., with a finger.

A table-type betting board (a bet screen) 40 for predicting the number of dots of the dice 70 is displayed in a game at a predetermined timing on the image display unit 7.

A detailed description is now provided regarding the bet screen 40. On the bet screen 40 are displayed a plurality of normal bet areas 41 and a side bet area 42. The plurality of normal bet areas 41 includes a normal bet area 41A, a normal bet area 41B, a normal bet area 41C, a normal bet area 41D, a normal bet area 41E, a normal bet area 41F, a normal bet area 41G, and a normal bet area 41H. By contacting the touch panel 35, e.g., with a finger, the normal bet area 41 is designated, and by displaying chips in the normal bet area 41 thus designated, a normal bet operation is performed. Furthermore, by contacting the touch panel 35, e.g., with a finger, the side bet area 42 is designated, and by displaying chips in the side bet area 42 thus designated, a side bet operation is performed.

A unit bet button 43, a re-bet button 43E, a payout result display unit 45, and a credit amount display unit 46 are displayed at the right side of the side bet area 42 in order from the left side.

The unit bet button unit 43 is a group of buttons that are used by a player to bet chips on the normal bet area 41 and the side bet area 42 designated by the player. The unit bet button unit 43 is configured with four types of buttons including a 1 bet button 43A, a 5 bet button 43B, a 10 bet button 43C, and a 100 bet button 43D. It should be noted that in the case of an incorrect bet operation, the player can start a bet operation again by touching a re-bet button 43E.

Firstly, the player designates the normal bet area 41 or the side bet area 42 using a cursor 47 by way of contacting the touch panel 35, e.g., with a finger. At this time, contacting the 1 bet button 43A, e.g., with a finger, allows for betting one chip at a time (number of chips to be bet increases one by one in the order of 1, 2, 3, every time the 1 bet button 43A is contacted, e.g., by a finger). Similarly, when contacting the 5 bet button 43B, e.g., with a finger, five chips at a time can be bet (number of chips to be bet increases five by five in the order of 5, 10, 15, every time the 5 bet button 43B is contacted, e.g., by a finger). Similarly, when contacting the 10 bet button 43C, e.g., with a finger, ten chips at a time can be bet (number of chips to be bet increases ten by ten in the order of 10, 20, 30, every time the 10 bet button 43C is contacted, e.g., by a finger). Similarly, when contacting the 100 bet button 43D, e.g., with a finger, a hundred chips at a time can be bet (number of chips to be bet increases hundred by hundred in the order of 100, 200, 300, . . . every time the 100 bet button 43D is contacted, e.g. by a finger). The number of chips bet up to the current time is displayed as a chip mark 48, and the number displayed on the chip mark 48 indicates the number of bet chips.

The number of bet chips and payout credit amount for a player in a previous game are displayed in the payout result display unit 45. The number calculated by subtracting the number of bet chips from the payout credit amount is a newly acquired credit amount for the player in the previous game.

The credit amount display unit 46 displays the credit amount which the player possesses. The credit amount decreases according to the number of bet chips (1 credit amount for 1 chip) when the player bets chips. If the bet chips are entitled to an award and credits are paid out, the credit amount increases in accordance with the number of paid out chips. It should be noted that the game is over when the player's credit amount becomes zero.

The normal bet area 41 in the bet screen 40 is described next. The normal bet areas 41A and 41B are portions where the player places a bet on a predicted sum of dots appearing on the dice 70A to 70C. In other words, the player selects the normal bet area 41A if the predicted sum falls in a range of 4 to 10, or the normal bet area 41B if the predicted sum falls in a range of 11 to 17. Odds are set to 1:1 (2 chips are paid out for 1 chip bet).

The normal bet area 41C is a portion where the player places a bet, predicting that two dice 70 have the same number of dots. In other words, the player wins an award if one of the combinations occurs, such as (1, 1), (2, 2), (3, 3), (4, 4), (5, 5), and (6, 6), and the odds are set to 1:10.

The normal bet area 41D is a portion where the player places a bet, predicting that all three dice have the same number of dots. In other words, the player wins an award if one of the combinations occurs, such as (1, 1, 1), (2, 2, 2), (3, 3, 3), (4, 4, 4), (5, 5, 5), and (6, 6, 6), and the odds are set to 1:30.

The bet area 41E is a portion where the player places a bet on a predicted number of dots appearing commonly on all three dice. In other words, the player places a bet on one of the combinations of (1, 1, 1), (2, 2, 2), (3, 3, 3), (4, 4, 4), (5, 5, 5), or (6, 6, 6), and the odds are set to 1:180.

The normal bet area 41F is where the player places a bet, predicting a total, a summation of dots appearing on the three dice. Odds are set according to the occurrence frequency of the total. For example, if the total is 4 or 17, odds are set to 1:60; if the total is 5 or 16, odds are set to 1:30; if the total is 6 or 15, odds are set to 1:18; if the total is 7 or 14, odds are set to 1:12; if the total is 8 or 13, odds are set to 1:8; if the total is 9 or 12, odds are set to 1:7; and if the total is 10 or 11, odds are set to 1:6.

The bet area 41G is a portion where the player places a bet on predicted dots appearing on the two dice selected from the three, and the odds are set to 1:5. The normal bet area 41H is a region where the player places a bet on the number of dots appearing on the dice 70, and the odds are set according to the number of dots of the dice 70 matching the predicted number of dots.

Figure 8D:
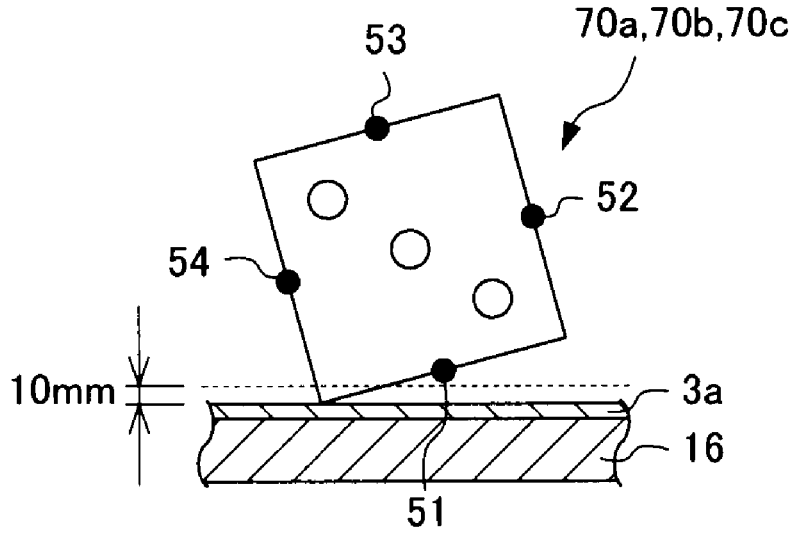
FIG. 8A is a block diagram showing an internal configuration of the gaming machine shown in FIG. 2A.
FIG. 8B is a block diagram showing an internal configuration of the gaming machine shown in FIG. 2B.
FIG. 8C is a block diagram showing an internal configuration of the gaming machine shown in FIG. 2C.
Figure 8A:
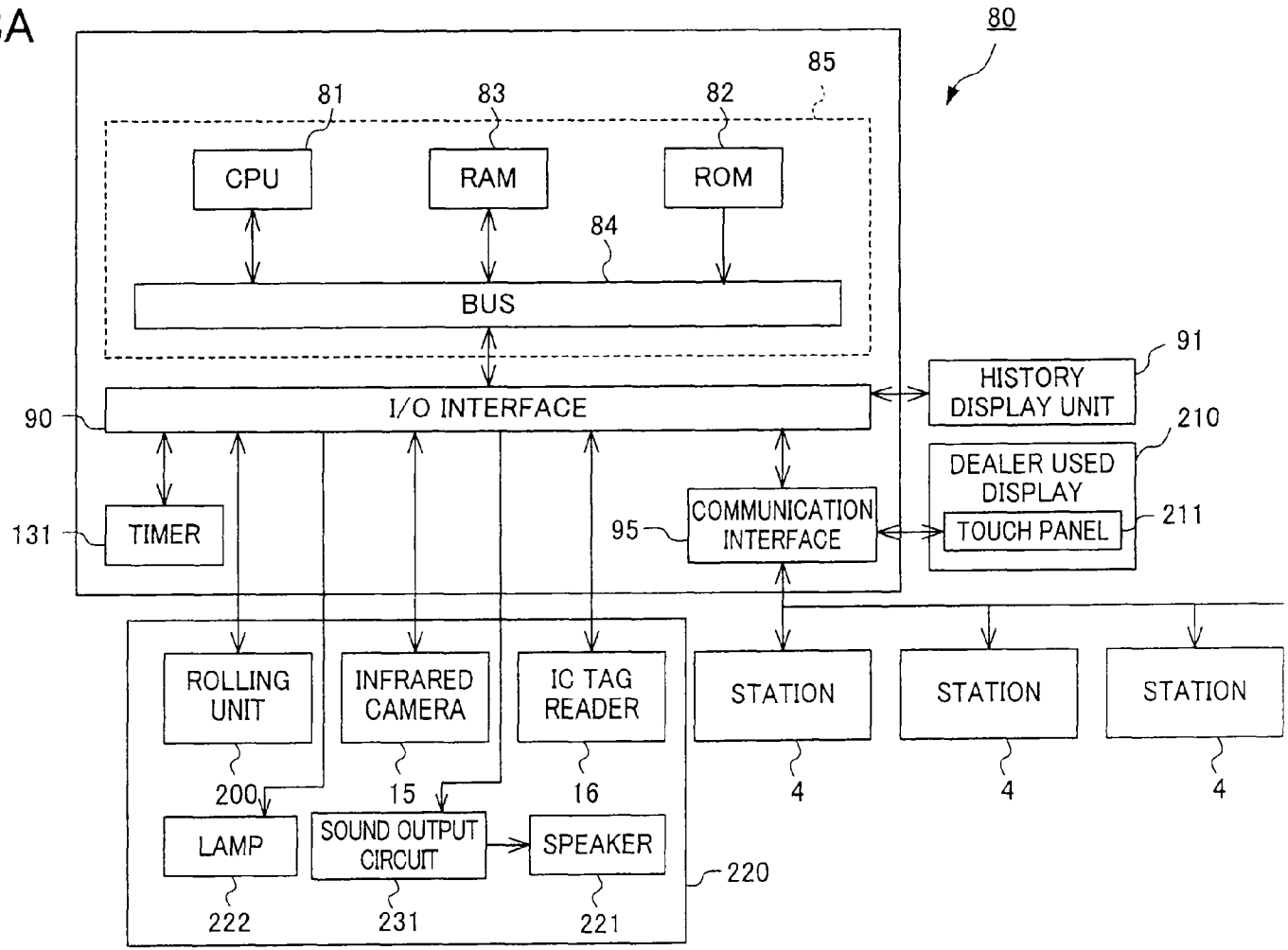

FIG. 8A is a block diagram showing an internal configuration of the gaming machine shown in FIG. 2A. A main control unit 80 of the gaming machine 1 includes a microcomputer 85, which is configured with a CPU 81, ROM 82, RAM 83, and a bus 84 that transfers data therebetween.

The CPU 81 is connected with a power supply unit 420 (see FIG. 4A) of the rolling unit 200 via an I/O interface 90. Furthermore, the CPU 81 is connected with a timer 131, which can measure time via the I/O interface 90. In addition, the CPU 81 is connected with a lamp 222 via the I/O interface 90. The lamp 222 emits various colors of light for performing various types of rendered effects, based on output signals from the CPU 81. Furthermore, the CPU 81 is connected with a speaker 221 via the I/O interface 90 and a sound output circuit 231. The speaker 221 emits various sound effects for performing various types of rendered effects, based on output signals from the sound output circuit 231. Furthermore, the I/O interface 90 is connected with the abovementioned infrared camera 15 and/or the IC tag reader 16, thereby transmitting and receiving information in relation to the number of dots of the three dice 70, which comes to rest on the playing board 3*a*, between the infrared camera 15 and/or the IC tag reader 16.

Here, the rolling unit 200, the infrared camera 15, the IC tag reader 16, the lamp 222, the sound output circuit 231, and the speaker 221 are provided within a single composite unit 220.

In addition, via a communication interface 95 connected to the I/O interface 90, the main control unit 80 transmits and receives data such as bet information, payout information, and the like to and from each station 4, as well as data such as bet start instruction images, bet start instruction signals, and the like to and from the dealer used display 210.

The bet start instruction image is displayed by the CPU 81 on the display screen 210*a* of the dealer used display 210 before the CPU 81 accepts a bet from each station 4.

This bet start instruction image instructs a dealer to touch a "bet start" button. When a touch panel 211 detects that the dealer has touched the "bet start" button, the touch panel 211 transmits a bet start instruction signal to the CPU 81 via a communication interface 95.

Furthermore, the I/O interface 90 is connected with a history display unit 91, and the main control unit 80 transmits and receives information in relation to the number of dots on the die, to and from the history display unit 90.

ROM 82 in the main control unit 80 is configured to store a program for implementing basic functions of the gaming machine 1; more specifically, a program for controlling various devices which drive the playing unit 3, a program for controlling each station 4, and the like, as well as a payout table, data indicating a predetermined time T, data indicating a specific value TT, and the like.

RAM 83 is memory, which temporarily stores various types of data calculated by CPU 81, and, for example, temporarily stores data bet information transmitted from each station 4, information on respective number of dots that appear on the dice 70 transmitted from the infrared camera 15 and/or the IC tag reader 16, data relating to the results of processing executed by CPU 81, and the like. A jackpot storage area is provided in the RAM 83. In the jackpot storage area, the data indicating the number of playing media stored cumulatively is stored so as to correspond to each number of dots of matching dice. The data is provided to the station 4 at a predetermined timing, and a jackpot image is displayed.

The CPU 81 controls the rolling unit 200, which oscillates the playing unit 3, based on data and a program stored in the ROM 82 and the RAM 83, and oscillates the playing board 3*a* of the playing unit 3. Furthermore, after oscillation of the playing board 3*a* ceases, a control processing associated with game progression, such as confirmation processing for confirming the number of dots on each of the dice 70 resting on the playing board 3*a*.

In addition to the control processing described above, the CPU 81 has a function of executing a game by transmitting and receiving data to and from each station 4 so as to control each station 4. More specifically, the CPU 81 accepts bet information transmitted from each station 4. Furthermore, the CPU 81 performs win determination processing based on the number of dots on the dice 70 and the bet information transmitted from each station 4, and calculates the amount of an award paid out in each station 4 with reference to the payout table stored in the ROM 82.

Figure 9A:
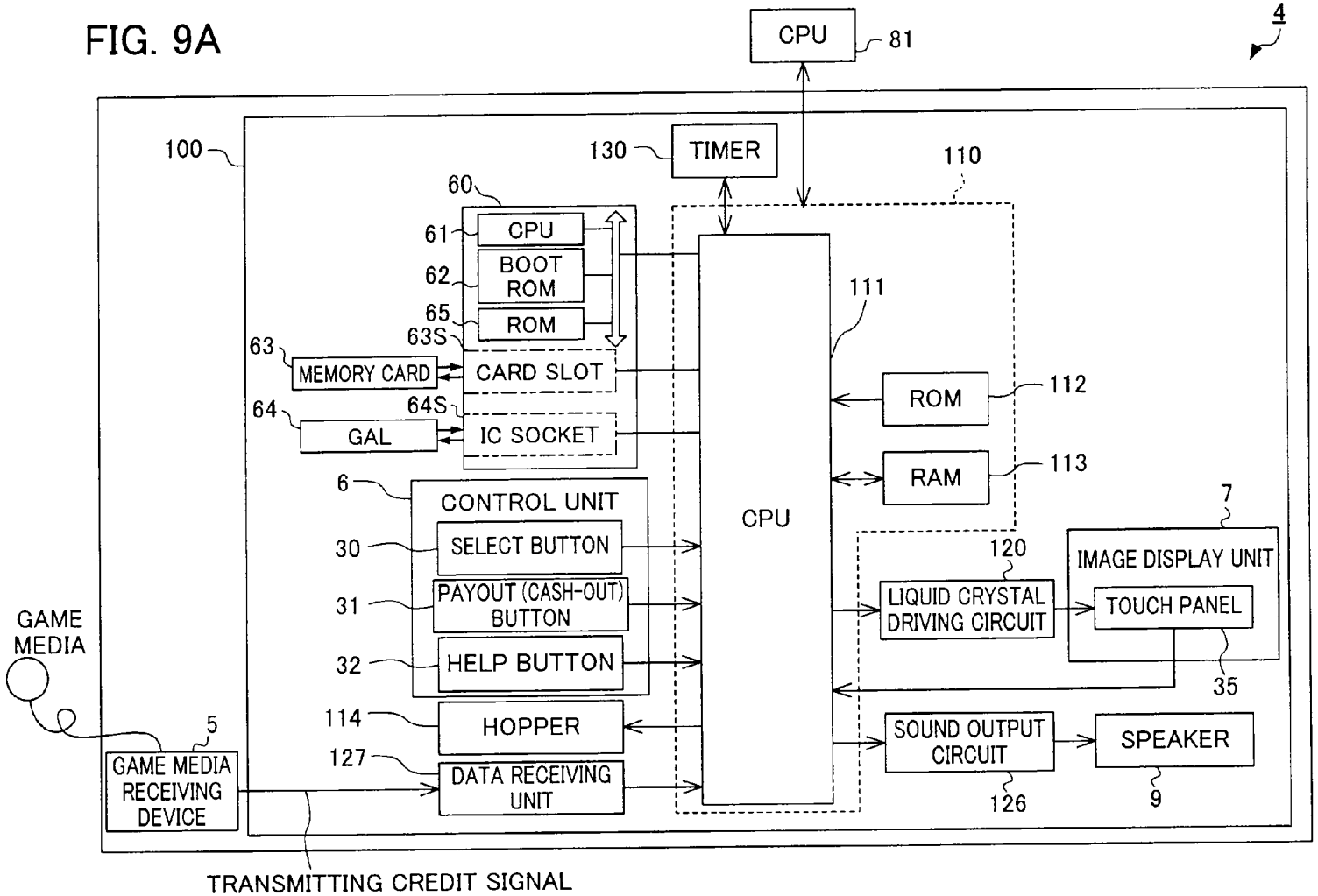
FIG. 9A is a block diagram showing an internal configuration of a station shown in FIG. 2A.

FIG. 9A is a block diagram showing an internal configuration of a station shown in FIG. 2A. The station 4 includes a main body 100 in which an image display unit 7 and the like are provided, and a game media receiving device 5, which is attached to the main body 100. The main body 100 further includes a station control unit 110 and several peripheral devices.

The station control unit 110 includes a CPU 111, ROM 112, and RAM 113.

ROM 112 stores a program for implementing basic functions of the station 4, other various programs needed to control the station 4, a data table, and the like.

Moreover, a decision button 30, a payout button 31, and a help button 32 provided in the control unit 6 are connected to the CPU 111, respectively. The CPU 111 controls the execution of various corresponding operations in accordance with manipulation signals, which are generated in response to each button pressed by a player. More specifically, the CPU 111 executes various processing, based on input signals transmitted from the control unit 6 in response to a player's operation which has been inputted, and the data and programs stored in the ROM 112 and RAM 113. Subsequently, the CPU 111 transmits the results to the CPU 81 in the main control unit 80.

In addition, the CPU 111 in the main control unit 80 receives instruction signals from the CPU 81, and controls peripheral devices which configure the station 4. The CPU 111 performs various kinds of processing based upon the input signals supplied from the control unit 6 and the touch panel 35, and the data and the programs stored in the ROM 112 and the RAM 113. Then, the CPU 111 controls the peripheral devices which configure the station 4 based on the results of the processing. It should be noted that the mode whereby processing is performed is set for each processing depending on the content of the processing. For example, the former approach is applied to payout processing of game media for respective numbers of dots appearing on the dice, and the latter approach is applied to bet operation processing by a player.

Furthermore, a hopper 114, which is connected to the CPU 111, pays out a predetermined amount of game media through the payout opening 8, receiving the instruction signals from the CPU 111.

Moreover, the image display unit 7 is connected to the CPU 111 via a liquid crystal driving circuit 120. The liquid crystal driving circuit 120 includes program ROM, image ROM, an image control CPU, work RAM, a video display processor (VDP), video RAM, and the like. Here, the program ROM stores an image control program with respect to the display functions of the image display unit 7, and various kinds of selection tables. The image ROM stores dot data for creating an image to be displayed on the image display unit 7, and dot data for displaying a jackpot image, for example. In addition, the image control CPU determines an image to be displayed on the image display unit 7, selected from the dot data previously stored in the image ROM according to the image control program previously stored in the program ROM based on parameters specified by the CPU 111. The work RAM is configured as a temporary storage means when executing the image control program by the image control CPU. The VDP forms an image corresponding to the display contents determined by the image control CPU and outputs the resulting image on the image display unit 7. It should be noted that the video RAM is configured as a temporary storage device used by the VDP for creating an image.

As mentioned above, the touch panel 35 is attached to the front side of the image display unit 7, and the information related to operation on the touch panel 35 is transmitted to the CPU 111. The touch panel 35 detects an input operation by the player on a bet screen 40 and the like. More specifically, selection of the normal bet area 41 and the side bet area 42 in the bet screen 40, manipulation of the bet button unit 43 and the like, are performed by touching the touch panel 35, and the information thereof is transmitted to the CPU 111. Then, a player's bet information is stored in the RAM 113 based on the information stored. Furthermore, the bet information is transmitted to the CPU 81 in the main control unit 80, and stored in a bet information storage area in the RAM 83.

Moreover, a sound output circuit 126 and a speaker 9 are connected to the CPU 111. The speaker 9 emits various sound effects for performing various kinds of rendered effects, based on output signals from the sound output circuit 126. In addition, the game media receiving device 5, into which game media such as coins or medals are inserted, is connected to the CPU 111 via a data receiving unit 127. The data receiving unit 127 receives credit signals transmitted from the game media receiving device 5, and the CPU 111 increases a player's credit amount stored in the RAM 113 based on the credit signals transmitted.

A timer 130, which can measure time, is connected to the CPU 111.

A gaming board 60 includes a CPU (Central Processing Unit) 61, ROM 65 and boot ROM 62, a card slot 63S compatible with a memory card 63, and an IC socket 64S compatible with a GAL (Generic Array Logic) 64, which are connected to one another via an internal bus.

The memory card 63 comprises nonvolatile memory such as compact flash (trademark) or the like, which stores a game program and a game system program.

Furthermore, the card slot 63S has a configuration that allows the memory card 63 to be detachably inserted, and is connected to the CPU 111 via an IDE bus. Such an arrangement allows the kinds or content of the game provided by the station 4 to be changed by performing the following operation. More specifically, the memory card 63 is first extracted from the card slot 63S, and another game program and another game system program are written to the memory card 63. Then, the memory card 63 thus rewritten is inserted into the card slot 63S. In addition, the kinds or content of the games provided by the station 4 can be changed by replacing the memory card 63 storing a game program and a game system program with another memory card 63 storing another game program and game system program. The game program includes a program for advancing a game and the like. The game program also includes a program related to image data and sound data outputted during a game.

The GAL 64 is one type of PLD that has a fixed OR array structure. The GAL 64 includes multiple input ports and output ports and, upon receiving predetermined data via each input port, outputs output data that corresponds to the input data via the corresponding output port. In addition, an IC socket 64S has a structure that allows the GAL 64 to be detachably mounted, and is connected to the CPU 111 via the PCI bus.

The CPU 61, the ROM 65, and the boot ROM 62, which are connected to one another via the internal bus, are connected to the CPU 111 via the PCI bus. The PCI bus performs signal transmission between the CPU 111 and the gaming board 60, as well as supplying electric power from the CPU 111 to the gaming board 60. The ROM 65 stores country identification information and an authentication program. The boot ROM 62 stores a preliminary authentication program, a program (boot code) which instructs the CPU 61 to start up the preliminary authentication program, etc.

The authentication program is a program (forgery check program) for authenticating the game program and the game system program. The authentication program is defined to follow the procedure (authentication procedure) for confirming and authenticating that the game program and the game system program, which are to be acquired after the authentication, have not been forged, i.e. the procedure for authenticating the game program and the game system program. The preliminary authentication program is a program for authenticating the aforementioned authentication program. The preliminary authentication program is defined to follow the procedure for verifying that the authentication program has not been forged, i.e. the procedure for authenticating the authentication program (authentication procedure).

According to the present embodiment as described above, since the spring 300 is provided between the base 3*c* and the circular table 3*a* for rolling the dice, the circular table 3*a* is biased toward an upper side, a result of which a load applied to the linear cylinder 400 through the shaft 3*b* from the circular table 3*a* is reduced. Furthermore, since the spring 300 is provided, when the circular table 3*a* is moved up and down, a certain level of biasing force from the spring 300 is added with respect to the vertical movement of the circular table 3*a*, whereby the linear cylinder 400 allows the shaft 3*b* to be moved quickly as well as efficiently, resulting in it being possible to reduce electric power consumption of the linear cylinder 400. Thus, it is possible to provide a gaming machine having a function that rolls and makes dice come to rest by moving the table 3*a* up and down efficiently as well as quickly.

Furthermore, current is applied to the coil 404 such as by switching the coils 404 to be excited among the coils 404 which are arranged side by side. Thus, it is easily possible to control the position of the shaft 3*b* such as by moving the shaft 3*b* greatly or subtly.

Furthermore, by switching the amplitude of vertical movement of the table in a stepwise manner, it is possible to change roll of the dice 70 in a variety of ways such as by moving the dice 70 on the circular table 3*a* by initially moving the circular table 3*a* up and down with large oscillation and then minimizing the vertical movement. Thus, it is possible to increase the enjoyment factor of rolling mode of the dice 70, and moreover, to provide to players information indicating that it is about time the dice 70 comes to rest, when the vertical movement of the dice 70 becomes smaller.

Furthermore, the vertical movement of the circular table 3*a* is finally minimized with subtle oscillation so as to minimize the height of hopping of the dice 70, and then is ceased. As a result, even if the dice 70 are overlapping each other on the circular table 3*a*, the overlapping state can be broken up by small vertical movement. Thus, it is possible to provide a gaming machine having a function of rolling and making the dice 70 come to rest so that the dice 70 are not overlapping each other.

Although a case has been described in which the number of dice 70 is three according to the present embodiment, the number of in the present invention is not limited to three and, for example, the number of the dice may be five.

In the present embodiment, although the controller of the present invention is described for a case of being configured from a CPU 81 which the main controller 80 includes and a CPU 111 which the station 4 includes, the controller of the present invention may be configured by only a single CPU.

Although embodiments of the present invention are described above, they are merely exemplified specific examples, and the present invention is not particularly limited thereto. Specific configurations such as each means can modified appropriately. Moreover, it should be understood that the advantages described in association with the embodiments are merely a listing of most preferred advantages, and that the advantages of the present invention are by no means restricted to those described in connection with the embodiments.

In addition, characteristic portions are mainly explained in the abovementioned detailed description for the purpose of facilitating understanding of the present invention. For a better understanding of the present invention, the abovementioned description consists mainly of the characteristic features of the invention. The invention is not limited to the following preferred embodiment, and is applicable to other embodiments in a wide variety of uses. The terms and the uses thereof are for accurately explaining the invention, not for limiting the interpretation of the invention. It seems to be easy for those skilled in the art to think of other configurations, systems, and methods contained in the concept of the invention, from the concept of the invention described in the present specification. Consequently, the description of the appended claims should be regarded as containing an equal configuration without departing from the scope of the technical idea of the invention. The appended abstract is for enabling engineers or the like in the art, who are not familiar with the patent office, general public institution, patents, law terms, or technical terms, to easily understand the technical contents and the substance of the present application by a simple investigation. Hence, the abstract is not intended for limiting the scope of the invention that should be evaluated by the appended claims. It is desirable to sufficiently review literatures and documents that are already disclosed, in order to understand the object of the invention and the novel effect of the invention.

Figure 1B:
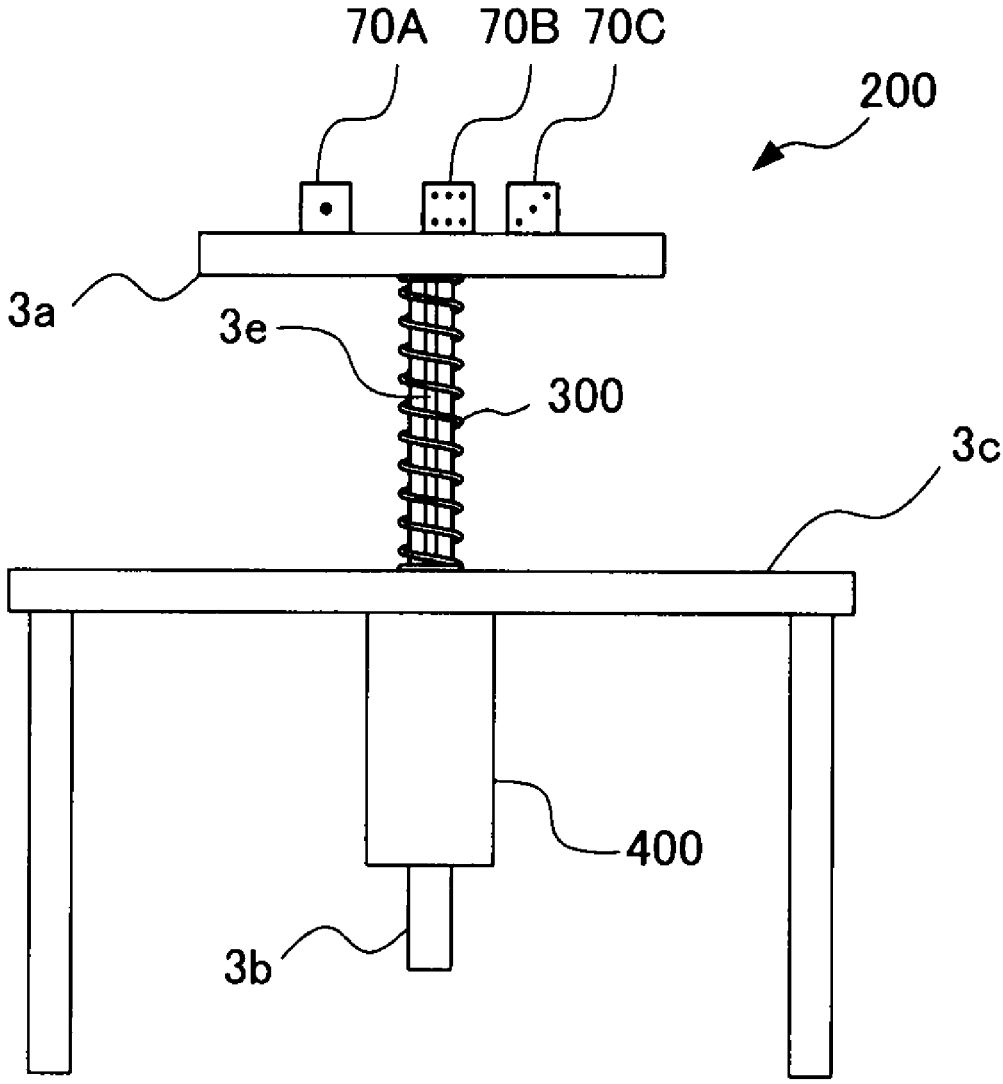
FIG. 1B is a schematic view illustrating a substantial part of a rolling unit according to an embodiment.

First of all, a general outline of the present embodiment is explained using FIG. 1B. FIG. 1B is a diagram showing a substantial part of a rolling unit 200 that rolls dice. In a gaming machine 1 (see FIG. 2B) according to the present embodiment, a dice game (SIC BO) is performed using three dice. A player predicts a number of dots to appear on a dice and can place a bet on it (see FIG. 7B). Then, the rolling unit 200 is driven and dice are rolled after a bet is performed, and gaming media may be paid out according to the number of dots on the dice coming to rest.

As shown in FIG. 1B, the rolling unit 200 includes a circular table 3*a* on which three dice 70 (die 70*a*, die 70*b*, and die 70*c*) are placed and a linear cylinder 400 for oscillating the circular table 3*a*. A shaft 3*b* is installed upright at the center of the circular table 3*a*, and this shaft 3*b* is inserted into the linear cylinder 400 which is fixed on a base 3*c*. Furthermore, a coil-shaped spring 300 is loosely fit with the shaft 3*b*, and the spring 300 is disposed between the circular table 3*a* and the base 3*c*. Then, in a state in which the linear cylinder 400 is not energized, the weight of the circular table 3*a* itself is proportional to biasing of the spring 300, as a result of which the circular table 3*a* is maintained at a predetermined location above the base 3*c*.

A concave portion 3*e* extending in a vertical direction is formed in the shaft 3*b*, and a convex portion 408 (see FIG. 5B) extending in a vertical direction is formed in an inner side surface of an opening 406 (see FIG. 5B) into which the shaft of the linear cylinder 400 is inserted. When the shaft 3*b* is inserted into the linear cylinder 400, the convex portion 408 is positioned in the concave portion 3*e*.

The linear cylinder 400 moves the shaft 3*b* back and forth in a vertical direction by applying thrust in a vertical direction to the shaft 3*b*. When the linear cylinder 400 moves up and down the shaft 3*b*, the circular table 3*a* along with the shaft 3*b* moves in a vertical direction. Consequently, dice are rolled on the circular table 3*a*, and furthermore, the circular table 3*a* is ceased by turning off electricity to the linear cylinder 400, as a result of which the dice come to rest on the circular table 3*a* in a state in which a certain numbers of dots appear thereon. Even if an inertia force in a rotating direction acts on the circular table 3*a*, since the convex portion 408 is engaged with the concave portion 3*e*, the rotation of the circular table 3*a* is regulated. These are the general outline of the present embodiment. More explanations are described in the following.

Figure 2B:
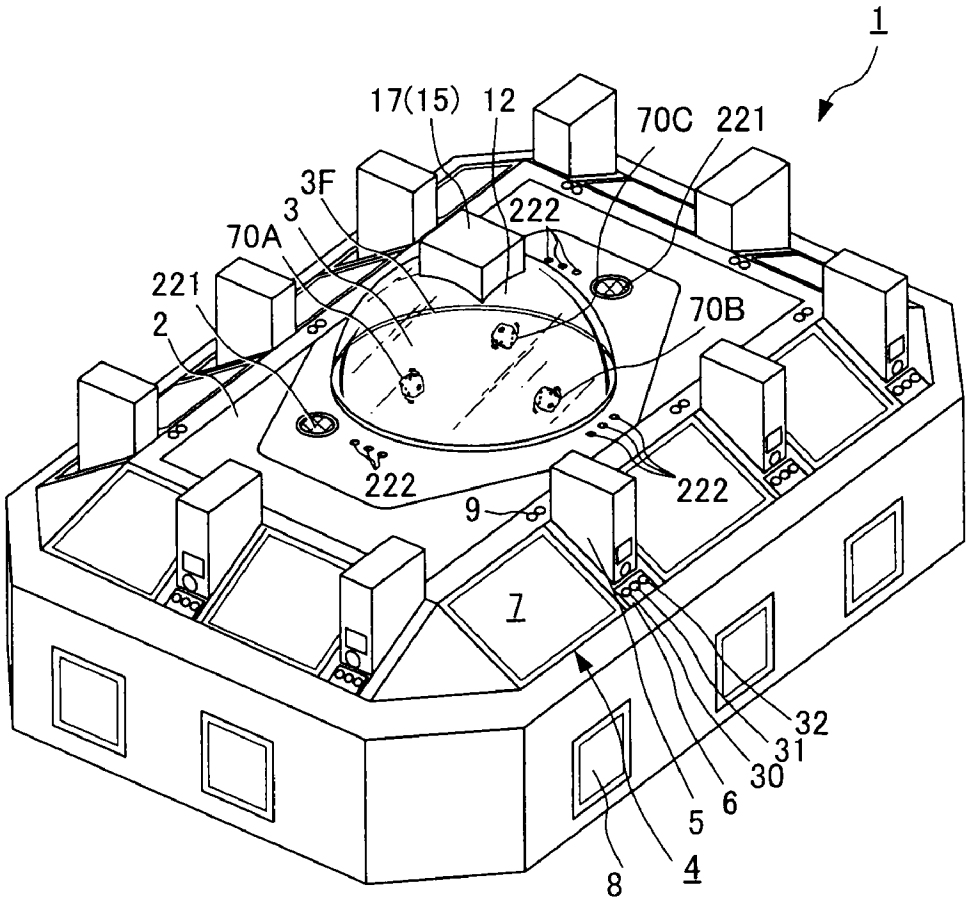
FIG. 2B is a perspective view schematically showing an example of a gaming machine according to an embodiment.

FIG. 2B is a perspective view schematically showing an example of a gaming machine according to the embodiment of this invention.

Figure 3B:
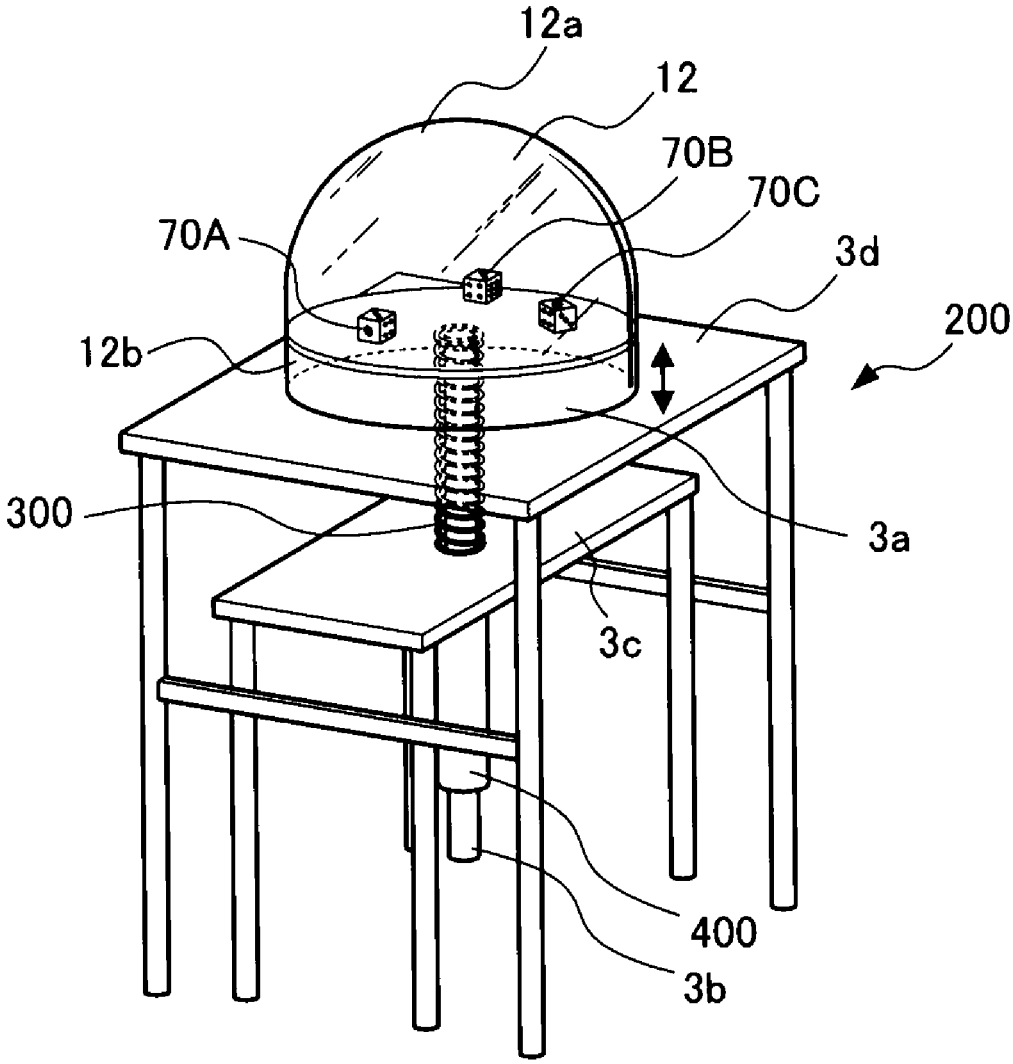
FIG. 3B is a perspective view schematically showing an example of a rolling unit provided at a gaming machine according to an embodiment.

FIG. 3B is a view schematically showing a configuration of a rolling unit for rolling dice, and constitutes a playing unit of the gaming machine shown in FIG. 2B.

Figure 4B:
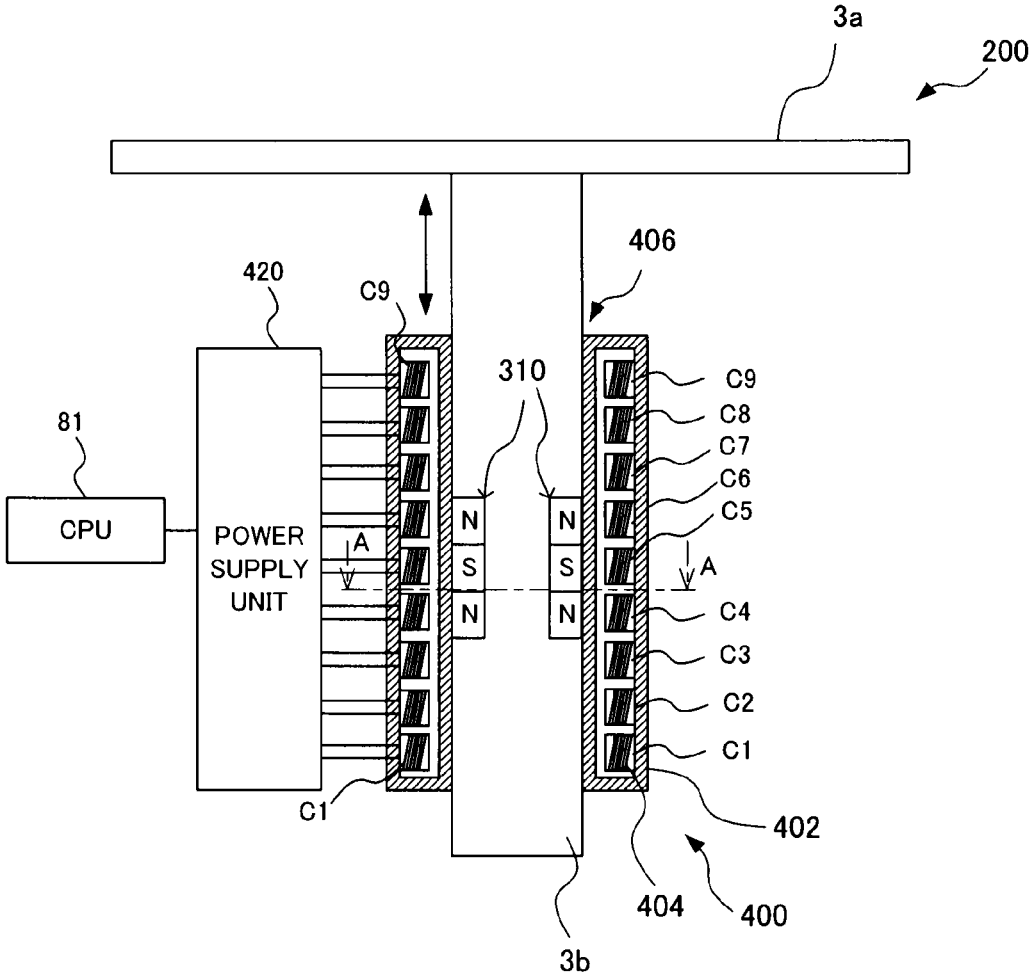
FIG. 4B is a perspective view schematically showing a driving mechanism of a rolling unit provided at a gaming machine according to an embodiment.

FIG. 4B is a diagram showing a driving mechanism of a rolling unit for rolling dice.

Figure 5B:
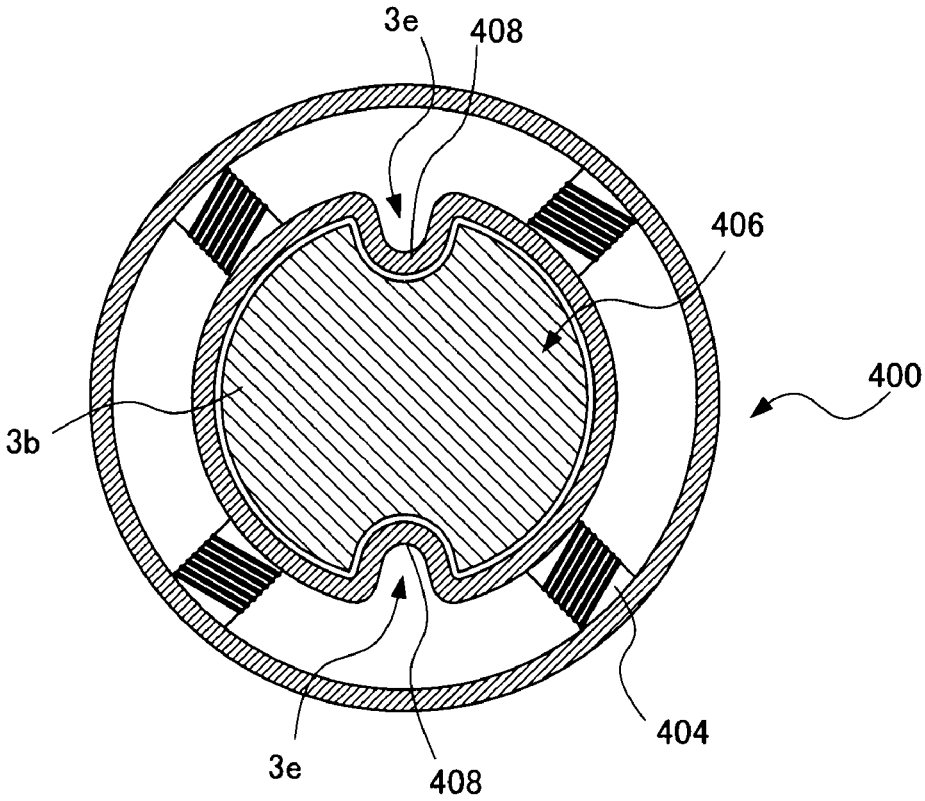
FIG. 5B is a diagram illustrating A-A cross-section of FIG. 4B.

FIG. 5B is a diagram illustrating a cross-section of the line A-A of FIG. 4B.

As shown in FIG. 2B, the gaming machine 1 according to the present embodiment includes a housing 2 as a main body portion, a playing unit 3 that is provided substantially at the center of the top face of the housing 2 and in which a plurality of dice 70 (70A, 70B, 70C) are rolled and come to rest, and a plurality of stations 4 disposed so as to surround the playing unit 3. The station 4 includes an image display unit 7. The player seated at each station 4 can participate in a game by predicting numbers of dots on the dice 70 and performing a normal bet input and a side bet input.

The gaming machine 1 includes a housing 2 as a main body portion, a playing unit 3 that is provided substantially at the center of the top face of the housing 2 and in which a plurality of dice 70 are rolled and come to rest, a plurality of stations 4 (ten in the present embodiment) disposed so as to surround the playing unit 3, and a dealer used display 210 that is positioned so as not to be visually recognizable by a player seated at each station 4.

The station 4 include a game media receiving device 5 into which game media such as medals to be used for playing the game are inserted, a control unit 6, which is configured with multiple control buttons by which a player enters predetermined instructions, and an image display unit 7, which displays images relating to a bet table. The player may participate in a game by operating the control unit 6 or the like while viewing the image displayed on the image display unit 7.

A payout opening 8, from which a player's game media are paid out, are provided on the sides of the housing 2 on which each station 4 is provided. In addition, a speaker 9, which can output sound, is disposed on the upper right of the image display unit 7 on each of the stations 4.

A control unit 6 is provided on the side part of the image display unit 7 on each of the stations 4. As viewed from a position facing the station 4, in order from the left side are provided a select button 30, a payout (cash-out) button 31, and a help button 32.

The select button 30 is a button that is pressed when confirming a bet operation after the bet operation is complete. Furthermore, in a case other than the bet operation, the button is pressed when a player confirms an input performed.

The payout button 31 is a button which is usually pressed at the end of a game, and when the payout button 31 is pressed, game media corresponding to credits that the player has acquired is paid out from the payout opening 8.

The help button 32 is a button that is pressed in a case where a method of operating the game is unclear, and upon the help button 32 being pressed, a help screen showing various kinds of operation information is displayed immediately thereafter on the image display unit 7.

The top of the game unit 3 is entirely covered with a cover member 12 of hemispheric transparent acryl to control the rolling range of dice. In the present embodiment, a dot detecting unit 15, which detects a number of dots on the dice 70, is provided at the top of the cover member 12. The rolling unit 200 is provided below the cover member 12, and a plurality of the dice 70 is rolled and come to rest by way of the rolling unit 200. The present embodiment is configured to use three dice 70 (die 70A, 70B, and 70C) in the playing unit 3.

The rolling unit 200 includes the circular table 3*a* on the top surface of which three dice 70 (die 70A, die 70B, and die 70C) are placed. The circular table 3*a* is provided in the cover member 12. Here, as shown in FIG. 3B, the cover member 12 is fixed with a supporting table 3*d* having a circular opening to which a cylindrical portion 12*b* is adapted. The circular table 3*a* is loosely fit internally with the cylindrical portion 12*b* of the cover member 12. At this time, the cylindrical portion 12*b* functions as a guiding member in that the circular table 3*a* can be moved in vertical direction but is restricted to move in a horizontal direction. Thus, the circular table 3*a* is an example of a table on which the dice (die 70A, die 70B, and die 70C) are placed.

A cylindrical shaft 3*b* made of an iron core is installed upright at the center of the lower surface of the circular table 3*a*. A coil-shaped spring 300 is loosely inserted to the shaft 3*b*. The base 3*c* supporting the shaft 3*b* is provided below the circular table 3*a*. An opening is formed in the base 3*c* so as to loosely accommodate the shaft 3*b*. Furthermore, the linear cylinder 400 is fixed at the lower surface of the base 3*c*. The linear cylinder 400 includes a cylindrical opening 406, and the linear cylinder 400 is disposed at the lower surface of the base 3*c* so that the opening 406 of the linear cylinder 400 is in communication with an opening of the base 3*c*. As a result, based on a biasing force of the spring 300 disposed between the circular table 3*a* and the base 3*c* by loosely accommodating the shaft 3*b* to the opening of the base 3*c*, the circular table 3*a* is positioned in place and the state thereof in which the shaft 3*b* is inserted to the linear cylinder 400 is maintained. Thus, the shaft 3*b* is an example of a shaft installed upright at the lower surface of a table (the circular table 3*a*). Furthermore, the linear cylinder 400 is an example of a cylindrical linear actuator which is fixed below a table (the circular table 3*a*), has an opening (the opening 406) into which a shaft (the shaft 3*b*) is inserted, and applies a thrust force to drive a shaft (the shaft 3*b*) in a vertical direction in an opening (the opening 406).

Then, when the linear cylinder 400 applies thrust in a vertical direction to the shaft 3*b*, the shaft 3*b* moves in a vertical direction, and the circular table 3*a* which is communicatively connected with the shaft 3*b* moves up and down in the cover member 12.

FIG. 4B is a diagram illustrating a structure of the linear cylinder 400, and FIG. 5B is a view illustrating a cross-section A-A of FIG. 4B. The linear cylinder 400 includes a configuration in which a plurality of coils 404 is arranged side by side in a vertical direction in a cylindrical case 402, the inside of which is hollow. In FIG. 4B, although nine coils 404 (coils C1 to C9) are arranged in parallel, this arrangement is merely an example for illustrating a principle for driving a shaft, and, regarding the number or size of the coils 404, it is possible to be set appropriately according to the weight of the circular table 3*a* and the shaft 3*b*. Thus, the coils 404 (coils C1 to C9) are an example of coils arranged side by side in a vertical direction.

Furthermore, as shown in FIG. 4B, since a plurality of the coils 404 forms a plurality of columns of the coils 404 in the case 402, and each column of the coils 404 adjacent each other with respect to a central axis of the case 402 is arranged equiangularly. In the present embodiment, as shown in FIG. 5B, four columns are arranged at 90-degree intervals each other. Furthermore, each of the coils 404 is arranged so that a central axis of the coil 404 directs to a central axis of the case 402. Each of the coils 404 is connected to a power supply unit 420 and is wired so that four coils 404 positioned at the identical circumference of a circle as a single set are energized. Therefore, in a case in which a set of the coils 404 is energized, the coils 404 are excited so that a set of the coils 404 becomes identical magnetic poles.

Figure 6B:
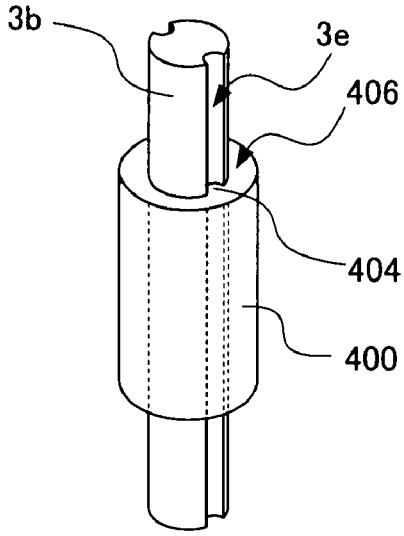
FIG. 6B is a perspective view showing an outer appearance proximal to a linear cylinder.

As shown in FIG. 5B, two convex portions 408 extending in a vertical direction are formed at an inner side face of the case 402 and disposed at a symmetrical position to each other with respect to the central axis of the case 402. Furthermore, concave portions 3*e* extending in a vertical direction are formed at a side face of the shaft 3*b*. The two concave portions 3*e* are disposed at symmetrical positions to each other with respect to the central axis of the shaft 3*b*. Thus, the shaft 3*b* can be loosely fitted into the opening of the base 3*c* by adapting the concave portion 3*e* to the convex portion 408. Then, in a case in which the shaft 3*b* is inserted into the linear cylinder 400, as shown in FIG. 6B, the shaft 3*b* can be moved in a vertical direction, but the rotation thereof is regulated. Therefore, the circular table 3*a* can be moved up and down but cannot be rotated. Thus, the convex portion 408 is an example of a convex portion which is formed in either one of a linear actuator (the linear cylinder 400) or a shaft (the shaft 3*b*), and the concave portion 3*e* is an example of a groove formed in the other. Furthermore, adaptation of the shaft 3*b* to the opening 408 of the linear cylinder 400 is an example of positioning a convex portion (the convex portion 408) inside a groove (the concave portion 3e) when a shaft (the shaft 3b) is inserted into an opening (the opening 408).

Furthermore, in some regions facing some coils 404 around the shaft 3b, a magnetizing region 310 is formed so that adjacent magnetic poles are opposite each other. In the present embodiment, in a state in which the circular table 3a is positioned in place, a region facing the coil C4 is magnetized as a N pole, a region facing the coil C5 is magnetized as a S pole, and a region facing the coil C6 is magnetized as a N pole. That is, in the present embodiment, four magnetizing regions 310 are formed on the side surface of the shaft 3b. Then, by energizing the coil 404 and then generating attracting and repelling force based on the magnetic force between the magnetic pole of the coil 404 and the magnetic pole of the magnetizing region 310 of the shaft 3b, a thrust force is applied to the shaft 3b. Furthermore, by changing the magnetic poles of each of the coils 404 excited in each of the columns of the coils 404, the shaft 3b can be driven in a vertical direction. At this time, since the attracting and repelling force of the magnetic force acts on the shaft 3b from four directions, the shaft 3b is moved up and down while the shaft 3b and the linear cylinder 400 are maintained in a state which is as non-contacting as possible. Thus, the magnetizing region 310 is an example of a magnetizing region which is formed to be arranged in a vertical direction on the surface of a shaft (the shaft 3b) and adjacent magnetic poles are magnetized so as to be opposite each other.

More specifically, in a state in which each of the coils 404 is not energized, the biasing force by the spring 300 is proportional to the table 3a's own weight, which makes the shaft 3b to be in a resting state. In this state thereof, by making the coils C4, C5, and C6 to be a S pole, N pole, and S pole in this order by energizing them only, subsequently making the coils C5, C6, and C7 to be a S pole, N pole, and S pole in this order, and subsequently making the coils C6, C7, and C8 to be a S pole, N pole, and S pole in this order, the shaft 3b is moved toward an upper side. Conversely, by making the coils C4, C5, and C6 to be a S pole, N pole, and S pole in this order, subsequently making the coils C3, C4, and C5 to be a S pole, N pole, and S pole in this order, and subsequently making the coils C2, C3, and C4 to be a S pole, N pole, and S pole in this order, the shaft 3b is moved toward a lower side. Thus, the linear cylinder 400 is an example of a linear actuator in that, when a shaft (the shaft 3b) is inserted into an opening (the opening 406), a linear actuator (the linear cylinder 400) allows a coil (the coil 404) and a magnetizing region (the magnetizing region 310) to face each other, and then, by applying current to a coil (the coil 404) to excite thereof and then generating an attracting and repelling force based on a magnetic force between a coil (the coil 404) and a magnetizing region (the magnetizing region 310), a thrust force is generated on a shaft (the shaft 3b).

Control of the supply of power applied to the coils C1 to C9 is performed by the CPU 81 controlling the power supply unit 420. That is, by the CPU 81 switching the coils 404 to be excited, vertical movement of the shaft 3b can be achieved, as a result of which, dice on the table 3a can be rolled by moving the table 3a up and down in conjunction with the shaft 3b.

At this time, an amplitude of the vertical movement of the shaft 3b is determined by determining a range in a vertical direction of the coil 404 to be excited. In the present embodiment, for example, with the coils C4 to C6 as a basis, it is possible to render oscillation of the table 3a to be a large oscillation by performing power switching periodically in the order of the coils C5 to C7, C6 to C8, C7 to C9, C6 to C8, C5 to C7, C4 to C6, C3 to C5, C2 to C4, C1 to C3, C2 to C4, C3 to C5, and C4 to C6. Similarly, with the coils C4 to C6 as a basis, it is possible to make oscillation of the table 3a to be an intermediate oscillation by performing power switching periodically in the order of the coils C5 to C7, C6 to C8, C5 to C7, C4 to C6, C3 to C5, C2 to C4, C3 to C5, and C4 to C6. Furthermore, with the coils C4 to C6 as a basis, it is possible to make oscillation of the table 3a to be a subtle oscillation by performing power switching periodically in the order of the coils C5 to C7, C4 to C6, C3 to C5, and C4 to C6. In other words, it is possible to switch the amplitude of oscillation of the table 3a in three steps (large oscillation, intermediate oscillation, and subtle oscillation). Thus, the CPU 81 is an example of a control device which controls a linear actuator (the linear cylinder 400) so as to move up and down a table (the circular table 3a), to roll dice (the dice 70) on a table (the circular table 3a), and to cease vertical movement of a table (the circular table 3a). Furthermore, the CPU 81 is an example of a control device which controls a linear actuator (the linear cylinder 400) to switch the amplitude of a vertical movement of a table (the circular table 3a) in a stepwise manner. Furthermore, the CPU 81 is an example of a control device which controls a linear actuator (the linear cylinder 400) to minimize the amplitude of a vertical movement of a table (the circular table 3a) and then to cease oscillation thereof.

In the present embodiment, a number of dots to appear on the dice 70 on the table 3a is determined by setting the intermediate oscillation to lightly roll the dice on the table initially, setting the large oscillation to greatly roll the dice on the table secondly, and setting the subtle oscillation and then ceasing the table 3a finally.

The dot detection unit 15 in the present embodiment includes an imaging device (CCD camera) for shooting the dice 70 as an object of shooting, and detects the number of dots to appear on the dice 70 based on an imaging signal from the imaging device. Therefore, it is not possible to detect the number of dots to appear on the dice 70 accurately in a state in which a plurality of the dice 70 are overlapping each other. However, in the present embodiment, by moving the table 3a with subtle oscillation and then ceasing the table 3a, even if a plurality of the dice 70 is overlapping each other, it is possible to make the dice come to rest after breaking up the overlapping state of the dice. As a result of this, it is possible to detect the number of dots to appear on the dice 70 accurately.

Furthermore, an IC tag is embedded on each face of the dice 70. Therefore, the number of dots on the dice 70 is detected by reading information stored in the IC tag using an IC tag reader 16 (see FIG. 8B) provided at the lower surface of the table.

The IC tag reader 16 is a non-contact type IC tag reader. For example, it is possible to read information stored in the IC tag by RFID (Radio Frequency Identification). The RFID system performs near field communication that reads and writes data stored in semi-conductor devices by an induction field or radio waves in a non-contact manner. In addition, since this technology is known conventionally and is described in Japanese Unexamined Patent Application Publication No. H8-21875, an explanation thereof is abbreviated.

In the present embodiment, a plurality of IC tags is read by a single IC tag reader 16. Under the abovementioned RFID system, an anti-collision function can be employed which can read a plurality of IC tags by a single reader. The anti-collision function includes FIFO (first in first out) type, multi-access type, and selective type, and communicates with a plurality of the IC tags sequentially. The FIFO type is a mode to communicate with a plurality of the IC tags sequentially in the order that each IC tag enters an area in which an antenna can communicate therewith. The multi-access type is a mode that is able to communicate with all the IC tags, even if there is a plurality of the IC tags simultaneously in the area in which an antenna can communicate with the IC tags. The selective type is a mode that is able to communicate with a specific IC tag among a plurality of the IC tags in the area in which an antenna can communicate therewith. By employing the abovementioned modes, it is possible to read a plurality of the IC tags with a single IC tag reader. Thus, in the present embodiment, accurate detections of a number of the dots can be achieved by using both the dots detection unit 15 and the IC tag reader 16.

Figure 7B:
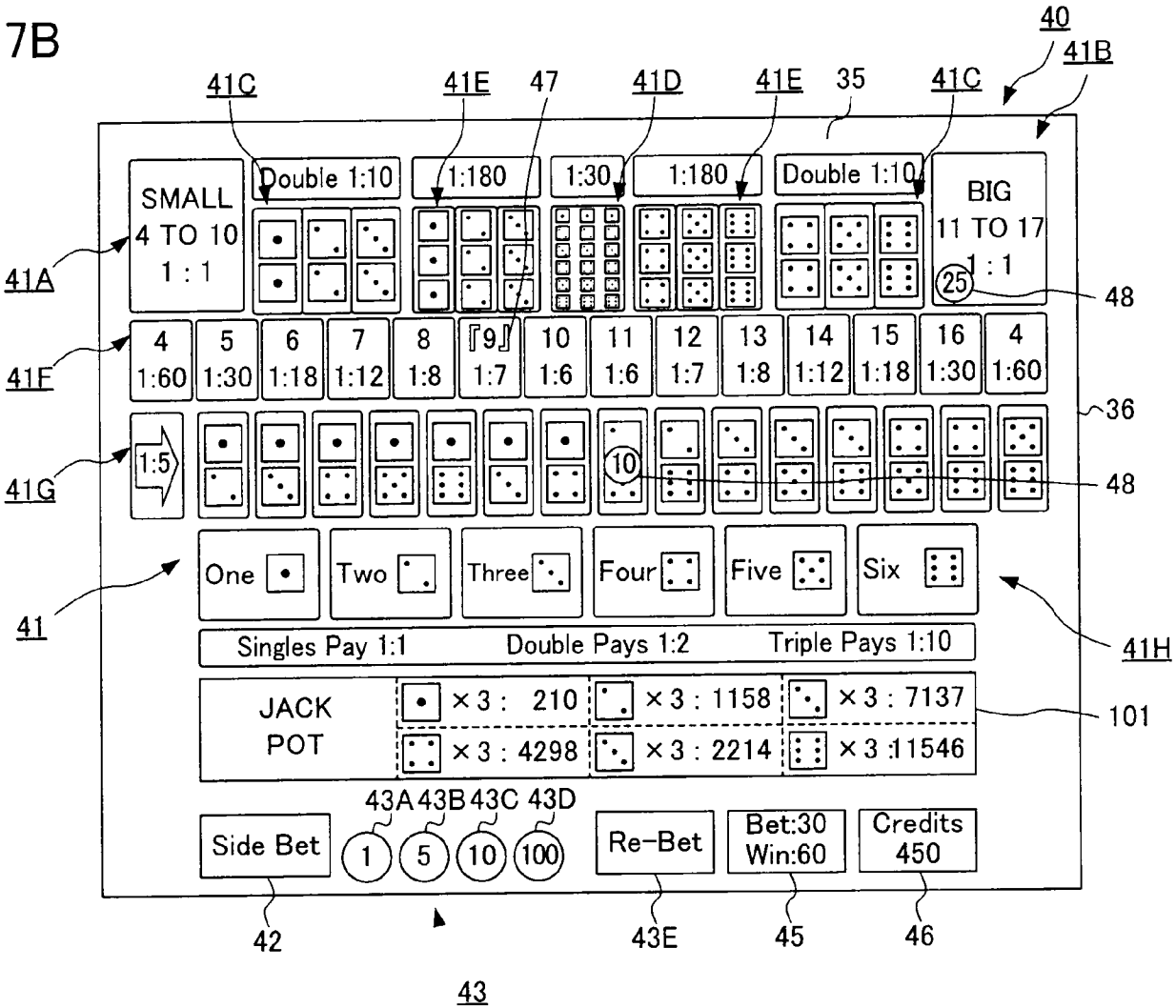
FIG. 7B shows an example of a display screen displayed on an image display unit.

FIG. 7B shows an example of a display screen displayed on an image display unit. As shown in FIG. 7B, an image display unit 7 is a touch-panel type of liquid crystal display, on the front surface of which a touch panel 35 is attached, allowing a player to perform selection such as of icons displayed on a liquid crystal screen 36 by contacting the touch panel 35, e.g., with a finger.

A table-type betting board (a bet screen) 40 for predicting the number of dots of the dice 70 is displayed in a game at a predetermined timing on the image display unit 7.

A detailed description is now provided regarding the bet screen 40. On the bet screen 40 are displayed a plurality of normal bet areas 41 and a side bet area 42. The plurality of normal bet areas 41 includes a normal bet area 41A, a normal bet area 41B, a normal bet area 41C, a normal bet area 41D, a normal bet area 41E, a normal bet area 41F, a normal bet area 41G, and a normal bet area 41H. By contacting the touch panel 35, e.g., with a finger, the normal bet area 41 is designated, and by displaying chips in the normal bet area 41 thus designated, a normal bet operation is performed. Furthermore, by contacting the touch panel 35, e.g., with a finger, the side bet area 42 is designated, and by displaying chips in the side bet area 42 thus designated, a side bet operation is performed.

A unit bet button 43, a re-bet button 43E, a payout result display unit 45, and a credit amount display unit 46 are displayed at the right side of the side bet area 42 in order from the left side.

The unit bet button unit 43 is a group of buttons that are used by a player to bet chips on the normal bet area 41 and the side bet area 42 designated by the player. The unit bet button unit 43 is configured with four types of buttons including a 1 bet button 43A, a 5 bet button 43B, a 10 bet button 43C, and a 100 bet button 43D. It should be noted that in the case of an incorrect bet operation, the player can start a bet operation again by touching a re-bet button 43E.

Firstly, the player designates the normal bet area 41 or the side bet area 42 using a cursor 47 by way of contacting the touch panel 35, e.g., with a finger. At this time, contacting the 1 bet button 43A, e.g., with a finger, allows for betting one chip at a time (number of chips to be bet increases one by one in the order of 1, 2, 3, every time the 1 bet button 43A is contacted, e.g., by a finger). Similarly, when contacting the 5 bet button 43B, e.g., with a finger, five chips at a time can be bet (number of chips to be bet increases five by five in the order of 5, 10, 15, every time the 5 bet button 43B is contacted, e.g., by a finger). Similarly, when contacting the 10 bet button 43C, e.g., with a finger, ten chips at a time can be bet (number of chips to be bet increases ten by ten in the order of 10, 20, 30, every time the 10 bet button 43C is contacted, e.g., by a finger). Similarly, when contacting the 100 bet button 43D, e.g., with a finger, a hundred chips at a time can be bet (number of chips to be bet increases hundred by hundred in the order of 100, 200, 300, . . . every time the 100 bet button 43D is contacted, e.g. by a finger). The number of chips bet up to the current time is displayed as a chip mark 48, and the number displayed on the chip mark 48 indicates the number of bet chips.

The number of bet chips and payout credit amount for a player in a previous game are displayed in the payout result display unit 45. The number calculated by subtracting the number of bet chips from the payout credit amount is a newly acquired credit amount for the player in the previous game.

The credit amount display unit 46 displays the credit amount which the player possesses. The credit amount decreases according to the number of bet chips (1 credit amount for 1 chip) when the player bets chips. If the bet chips are entitled to an award and credits are paid out, the credit amount increases in accordance with the number of paid out chips. It should be noted that the game is over when the player's credit amount becomes zero.

The normal bet area 41 in the bet screen 40 is described next. The normal bet areas 41A and 41B are portions where the player places a bet on a predicted sum of dots to appear on the dice 70A to 70C. In other words, the player selects the normal bet area 41A if the predicted sum falls in a range of 4 to 10, or the normal bet area 41B if the predicted sum falls in a range of 11 to 17. Odds are set to 1:1 (2 chips are paid out for 1 chip bet).

The normal bet area 41C is a portion where the player places a bet, predicting that two dice 70 have the same number of dots. In other words, the player wins an award if one of the combinations occurs, such as (1, 1), (2, 2), (3, 3), (4, 4), (5, 5), and (6, 6), and the odds are set to 1:10.

The normal bet area 41D is a portion where the player places a bet, predicting that all three dice have the same number of dots. In other words, the player wins an award if one of the combinations occurs, such as (1, 1, 1), (2, 2, 2), (3, 3, 3), (4, 4, 4), (5, 5, 5), and (6, 6, 6), and the odds are set to 1:30.

The bet area 41E is a portion where the player places a bet on a predicted number of dots to appear commonly on all three dice. In other words, the player places a bet on one of the combinations of (1, 1, 1), (2, 2, 2), (3, 3, 3), (4, 4, 4), (5, 5, 5), or (6, 6, 6), and the odds are set to 1:180.

The normal bet area 41F is where the player places a bet, predicting a total, a summation of dots to appear on the three dice. Odds are set according to the occurrence frequency of the total. For example, if the total is 4 or 17, odds are set to 1:60; if the total is 5 or 16, odds are set to 1:30; if the total is 6 or 15, odds are set to 1:18; if the total is 7 or 14, odds are set to 1:12; if the total is 8 or 13, odds are set to 1:8; if the total is 9 or 12, odds are set to 1:7; and if the total is 10 or 11, odds are set to 1:6.

The bet area 41G is a portion where the player places a bet on predicted dots to appear on the two dice selected from the three, and the odds are set to 1:5. The normal bet area 41H is a region where the player places a bet on the number of dots to appear on the dice 70, and the odds are set according to the number of dots of the dice 70 matching the predicted number of dots.

Figure 8B:
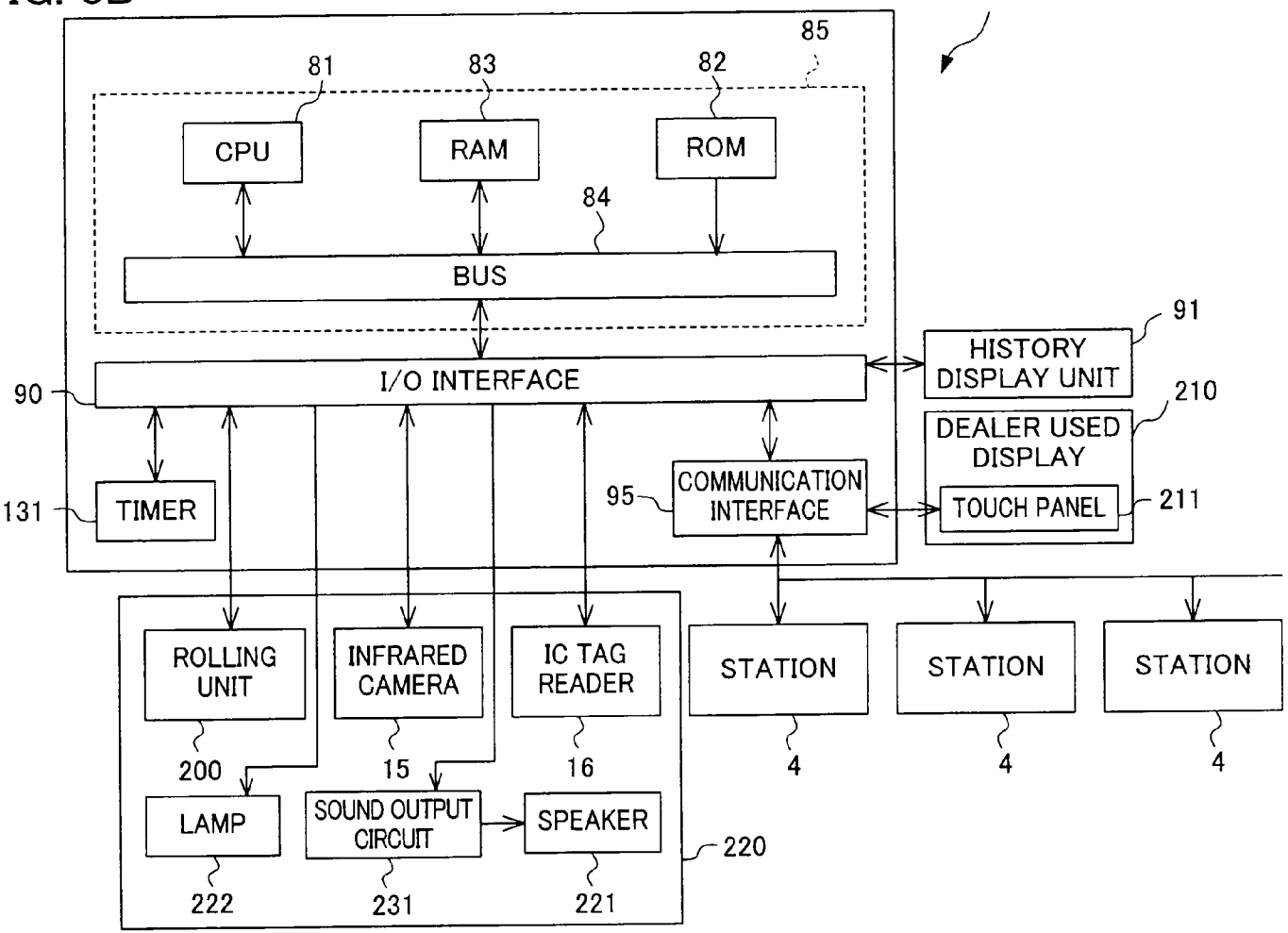

FIG. 8B is a block diagram showing an internal configuration of the gaming machine shown in FIG. 2B. A main control unit 80 of the gaming machine 1 includes a microcomputer 85, which is configured with a CPU 81, ROM 82, RAM 83, and a bus 84 that transfers data therebetween.

The CPU 81 is connected with a power supply unit 420 (see FIG. 4B) of the rolling unit 200 via an I/O interface 90. Furthermore, the CPU 81 is connected with a timer 131, which can measure time via the I/O interface 90. In addition, the CPU 81 is connected with a lamp 222 via the I/O interface 90. The lamp 222 emits various colors of light for performing various types of rendered effects, based on output signals from the CPU 81. Furthermore, the CPU 81 is connected with a speaker 221 via the I/O interface 90 and a sound output circuit 231. The speaker 221 emits various sound effects for performing various types of rendered effects, based on output signals from the sound output circuit 231. Furthermore, the I/O interface 90 is connected with the abovementioned infrared camera 15 and/or the IC tag reader 16, thereby transmitting and receiving information in relation to the number of dots of the three dice 70, which comes to rest on the playing board 3*a* , between the infrared camera 15 and/or the IC tag reader 16.

Here, the rolling unit 200, the infrared camera 15, the IC tag reader 16, the lamp 222, the sound output circuit 231, and the speaker 221 are provided within a single composite unit 220.

In addition, via a communication interface 95 connected to the I/O interface 90, the main control unit 80 transmits and receives data such as bet information, payout information, and the like to and from each station 4, as well as data such as bet start instruction images, bet start instruction signals, and the like to and from the dealer used display 210.

The bet start instruction image is displayed by the CPU 81 on the display screen 210*a* of the dealer used display 210 before the CPU 81 accepts a bet from each station 4.

This bet start instruction image instructs a dealer to touch a "bet start" button. When a touch panel 211 detects that the dealer has touched the "bet start" button, the touch panel 211 transmits a bet start instruction signal to the CPU 81 via a communication interface 95.

Furthermore, the I/O interface 90 is connected with a history display unit 91, and the main control unit 80 transmits and receives information in relation to the number of dots on the die, to and from the history display unit 90.

ROM 82 in the main control unit 80 is configured to store a program for implementing basic functions of the gaming machine 1; more specifically, a program for controlling various devices which drive the playing unit 3, a program for controlling each station 4, and the like, as well as a payout table, data indicating a predetermined time T, data indicating a specific value TT, and the like.

RAM 83 is memory, which temporarily stores various types of data calculated by CPU 81, and, for example, temporarily stores data bet information transmitted from each station 4, information on respective number of dots that appear on the dice 70 transmitted from the infrared camera 15 and/or the IC tag reader 16, data relating to the results of processing executed by CPU 81, and the like. A jackpot storage area is provided in the RAM 83. In the jackpot storage area, the data indicating the number of playing media stored cumulatively is stored so as to correspond to each number of dots of matching dice. The data is provided to the station 4 at a predetermined timing, and a jackpot image is displayed.

The CPU 81 controls the rolling unit 200, which oscillates the playing unit 3, based on data and a program stored in the ROM 82 and the RAM 83, and oscillates the playing board 3*a* of the playing unit 3. Furthermore, after oscillation of the playing board 3*a* ceases, a control processing associated with game progression, such as confirmation processing for confirming the number of dots on each of the dice 70 resting on the playing board 3*a*.

In addition to the control processing described above, the CPU 81 has a function of executing a game by transmitting and receiving data to and from each station 4 so as to control each station 4. More specifically, the CPU 81 accepts bet information transmitted from each station 4. Furthermore, the CPU 81 performs win determination processing based on the number of dots on the dice 70 and the bet information transmitted from each station 4, and calculates the amount of an award paid out in each station 4 with reference to the payout table stored in the ROM 82.

Figure 9B:
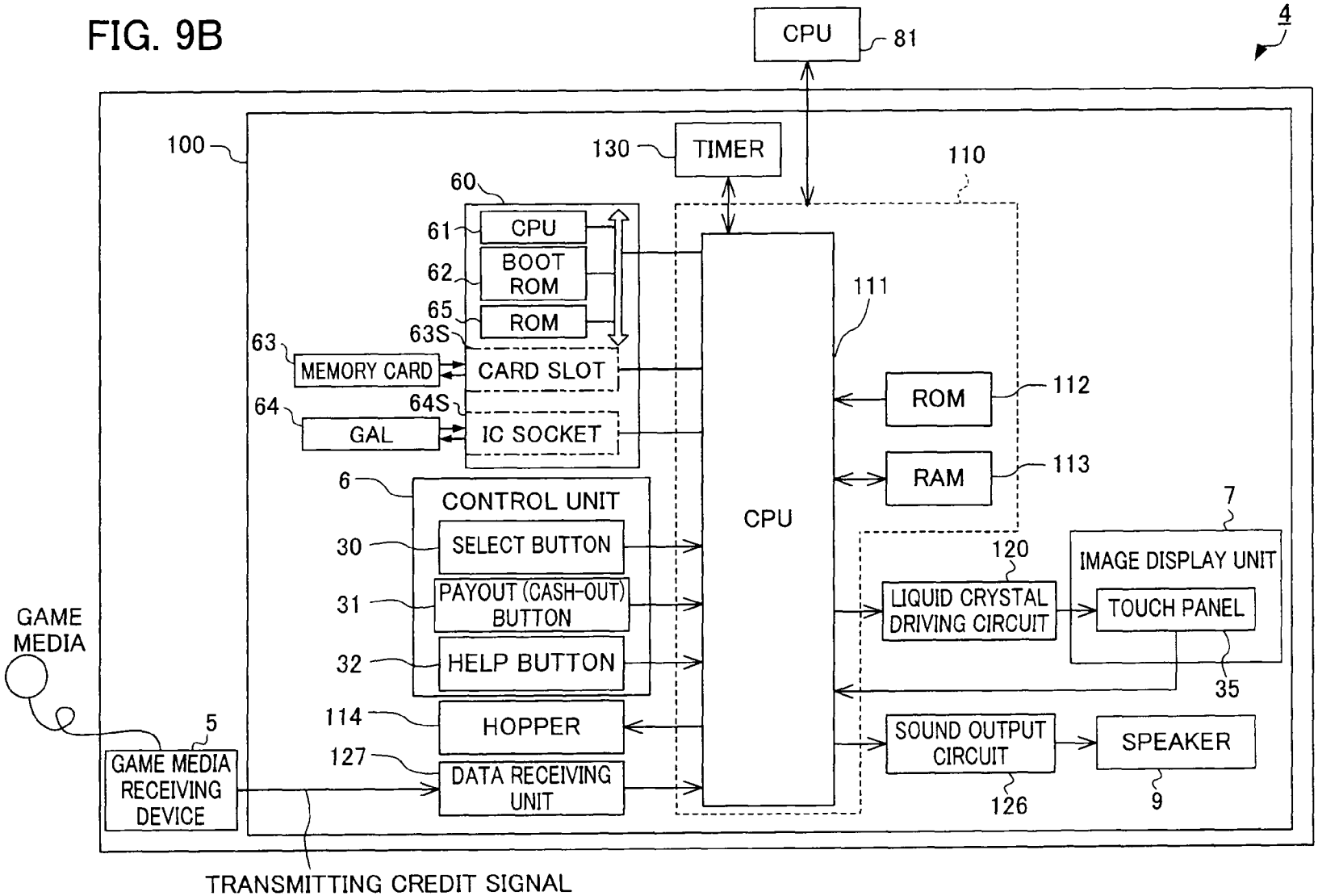
FIG. 9B is a block diagram showing an internal configuration of a station shown in FIG. 2B.

FIG. 9B is a block diagram showing an internal configuration of a station shown in FIG. 2B. The station 4 includes a main body 100 in which an image display unit 7 and the like are provided, and a game media receiving device 5, which is attached to the main body 100. The main body 100 further includes a station control unit 110 and several peripheral devices.

The station control unit 110 includes a CPU 111, ROM 112, and RAM 113.

ROM 112 stores a program for implementing basic functions of the station 4, other various programs needed to control the station 4, a data table, and the like.

Moreover, a decision button 30, a payout button 31, and a help button 32 provided in the control unit 6 are connected to the CPU 111, respectively. The CPU 111 controls the execution of various corresponding operations in accordance with manipulation signals, which are generated in response to each button pressed by a player. More specifically, the CPU 111 executes various processing, based on input signals transmitted from the control unit 6 in response to a player's operation which has been inputted, and the data and programs stored in the ROM 112 and RAM 113. Subsequently, the CPU 111 transmits the results to the CPU 81 in the main control unit 80.

In addition, the CPU 111 in the main control unit 80 receives instruction signals from the CPU 81, and controls peripheral devices which configure the station 4. The CPU 111 performs various kinds of processing based upon the input signals supplied from the control unit 6 and the touch panel 35, and the data and the programs stored in the ROM 112 and the RAM 113. Then, the CPU 111 controls the peripheral devices which configure the station 4 based on the results of the processing. It should be noted that the mode whereby processing is performed is set for each processing depending on the content of the processing. For example, the former approach is applied to payout processing of game media for respective numbers of dots to appear on the dice, and the latter approach is applied to bet operation processing by a player.

Furthermore, a hopper 114, which is connected to the CPU 111, pays out a predetermined amount of game media through the payout opening 8, receiving the instruction signals from the CPU 111.

Moreover, the image display unit 7 is connected to the CPU 111 via a liquid crystal driving circuit 120. The liquid crystal driving circuit 120 includes program ROM, image ROM, an image control CPU, work RAM, a video display processor (VDP), video RAM, and the like. Here, the program ROM stores an image control program with respect to the display functions of the image display unit 7, and various kinds of selection tables. The image ROM stores dot data for creating an image to be displayed on the image display unit 7, and dot data for displaying a jackpot image, for example. In addition, the image control CPU determines an image to be displayed on the image display unit 7, selected from the dot data previously stored in the image ROM according to the image control program previously stored in the program ROM based on parameters specified by the CPU 111. The work RAM is configured as a temporary storage means when executing the image control program by the image control CPU. The VDP forms an image corresponding to the display contents determined by the image control CPU and outputs the resulting image on the image display unit 7. It should be noted that the video RAM is configured as a temporary storage device used by the VDP for creating an image.

As mentioned above, the touch panel 35 is attached to the front side of the image display unit 7, and the information related to operation on the touch panel 35 is transmitted to the CPU 111. The touch panel 35 detects an input operation by the player on a bet screen 40 and the like. More specifically, selection of the normal bet area 41 and the side bet area 42 in the bet screen 40, manipulation of the bet button unit 43 and the like, are performed by touching the touch panel 35, and the information thereof is transmitted to the CPU 111. Then, a player's bet information is stored in the RAM 113 based on the information stored. Furthermore, the bet information is transmitted to the CPU 81 in the main control unit 80, and stored in a bet information storage area in the RAM 83.

Moreover, a sound output circuit 126 and a speaker 9 are connected to the CPU 111. The speaker 9 emits various sound effects for performing various kinds of rendered effects, based on output signals from the sound output circuit 126. In addition, the game media receiving device 5, into which game media such as coins or medals are inserted, is connected to the CPU 111 via a data receiving unit 127. The data receiving unit 127 receives credit signals transmitted from the game media receiving device 5, and the CPU 111 increases a player's credit amount stored in the RAM 113 based on the credit signals transmitted.

A timer 130, which can measure time, is connected to the CPU ill.

A gaming board 60 includes a CPU (Central Processing Unit) 61, ROM 65 and boot ROM 62, a card slot 63S compatible with a memory card 63, and an IC socket 64S compatible with a GAL (Generic Array Logic) 64, which are connected to one another via an internal bus.

The memory card 63 comprises nonvolatile memory such as compact flash (trademark) or the like, which stores a game program and a game system program.

Furthermore, the card slot 63S has a configuration that allows the memory card 63 to be detachably inserted, and is connected to the CPU 111 via an IDE bus. Such an arrangement allows the kinds or content of the game provided by the station 4 to be changed by performing the following operation. More specifically, the memory card 63 is first extracted from the card slot 63S, and another game program and another game system program are written to the memory card 63. Then, the memory card 63 thus rewritten is inserted into the card slot 63S. In addition, the kinds or content of the games provided by the station 4 can be changed by replacing the memory card 63 storing a game program and a game system program with another memory card 63 storing another game program and game system program. The game program includes a program for advancing a game and the like. The game program also includes a program related to image data and sound data outputted during a game.

The GAL 64 is one type of PLD that has a fixed OR array structure. The GAL 64 includes multiple input ports and output ports and, upon receiving predetermined data via each input port, outputs output data that corresponds to the input data via the corresponding output port. In addition, an IC socket 64S has a structure that allows the GAL 64 to be detachably mounted, and is connected to the CPU 111 via the PCI bus.

The CPU 61, the ROM 65, and the boot ROM 62, which are connected to one another via the internal bus, are connected to the CPU 111 via the PCI bus. The PCI bus performs signal transmission between the CPU 111 and the gaming board 60, as well as supplying electric power from the CPU 111 to the gaming board 60. The ROM 65 stores country identification information and an authentication program. The boot ROM 62 stores a preliminary authentication program, a program (boot code) which instructs the CPU 61 to start up the preliminary authentication program, etc.

The authentication program is a program (forgery check program) for authenticating the game program and the game system program. The authentication program is defined to follow the procedure (authentication procedure) for confirming and authenticating that the game program and the game system program, which are to be acquired after the authentication, have not been forged, i.e. the procedure for authenticating the game program and the game system program. The preliminary authentication program is a program for authenticating the aforementioned authentication program. The preliminary authentication program is defined to follow the procedure for verifying that the authentication program has not been forged, i.e. the procedure for authenticating the authentication program (authentication procedure).

According to the present embodiment as described above, since the concave portion 3*e* is formed at the shaft 3*b*, the convex portion 408 is formed at a case 402 of the linear cylinder 400, and the concave portion 3*e* is inserted into the convex portion 408 when the shaft 3*b* is inserted into the linear cylinder 400, the movement of the shaft 3*b* in a rotating direction is regulated and the shaft 3*b* is guided in a vertical direction. Thus, since the rotation of the circular table 3*a* during a stopped time is regulated, a change in the number of the dots appearing on the dice caused by rotation of the circular table 3*a* can be prevented. Thus, it is possible to roll the dice 70 by the vertical movement of the circular table 3*a*, and then cease the circular table 3*a* to reliably make the dice 70 come to rest.

Furthermore, current is applied to the coil 404 such as by switching the coils 404 to be excited among the coils 404 which are arranged side by side. Thus, it is easily possible to control the position of the shaft 3*b* such as by moving the shaft 3*b* greatly or subtly.

Furthermore, by switching the amplitude of vertical movement of the table in a stepwise manner, it is possible to change roll of the dice 70 in a variety of ways such as by moving the dice 70 on the circular table 3*a* by initially moving up and down the circular table 3*a* with large oscillation and then minimizing the vertical movement. Thus, it is possible to increase the enjoyment factor of rolling mode of the dice 70, and moreover, to provide to players information indicating that it is about time the dice 70 comes to rest, when the vertical movement of the dice 70 becomes smaller.

Furthermore, the vertical movement of the circular table 3*a* is finally minimized with subtle oscillation so as to minimize the height of hopping of the dice 70, and then is ceased. As a result, even if the dice 70 are overlapping each other on the circular table 3*a*, the overlapping state can be broken up by small vertical movement. Thus, it is possible to provide a gaming machine having a function of rolling and making the dice 70 come to rest so that the dice 70 are not overlapping each other.

Although a case has been described in which the number of dice 70 is three according to the present embodiment, the number of in the present invention is not limited to three and, for example, the number of the dice may be five.

Furthermore, in the present embodiment, although the concave portion 3*e* is formed at the shaft 3*b* and the convex portion 408 is formed at the case 402 of the linear cylinder 400, the convex portion may be formed at the shaft 3*b* and the concave portion may be formed at the case 402 conversely. In this case, it is necessary to form a notch so that the convex portion of the shaft 3*b* can be inserted into an opening of the base 3*c*. Furthermore, in the present embodiment, although two concave portions 3*e* of the shaft 3*b* and two convex portions 408 of the case 402 are formed, respectively, three or more, or a single portion may be formed, respectively.

In the present embodiment, although the controller of the present invention is described for a case of being configured from a CPU 81 which the main controller 80 includes and a CPU 111 which the station 4 includes, the controller of the present invention may be configured by only a single CPU.

Although embodiments of the present invention are described above, they are merely exemplified specific examples, and the present invention is not particularly limited thereto. Specific configurations such as each means can modified appropriately. Moreover, it should be understood that the advantages described in association with the embodiments are merely a listing of most preferred advantages, and that the advantages of the present invention are by no means restricted to those described in connection with the embodiments.

In addition, characteristic portions are mainly explained in the abovementioned detailed description for the purpose of clear understanding of the present invention. For a better understanding of the present invention, the abovementioned description consists mainly of the characteristic features of the invention. The invention is not limited to the following preferred embodiment, and is applicable to other embodiments in a wide variety of uses. The terms and the uses thereof are for accurately explaining the invention, not for limiting the interpretation of the invention. It seems to be easy for those skilled in the art to think of other configurations, systems, and methods contained in the concept of the invention, from the concept of the invention described in the present specification. Consequently, the description of the appended claims should be regarded as containing an equal configuration without departing from the scope of the technical idea of the invention. The appended abstract is for enabling engineers or the like in the art, who are not familiar with the patent office, general public institution, patents, law terms, or technical terms, to easily understand the technical contents and the substance of the present application by a simple investigation. Hence, the abstract is not intended for limiting the scope of the invention that should be evaluated by the appended claims. It is desirable to sufficiently review literatures and documents that are already disclosed, in order to understand the object of the invention and the novel effect of the invention.

Figure 1C:
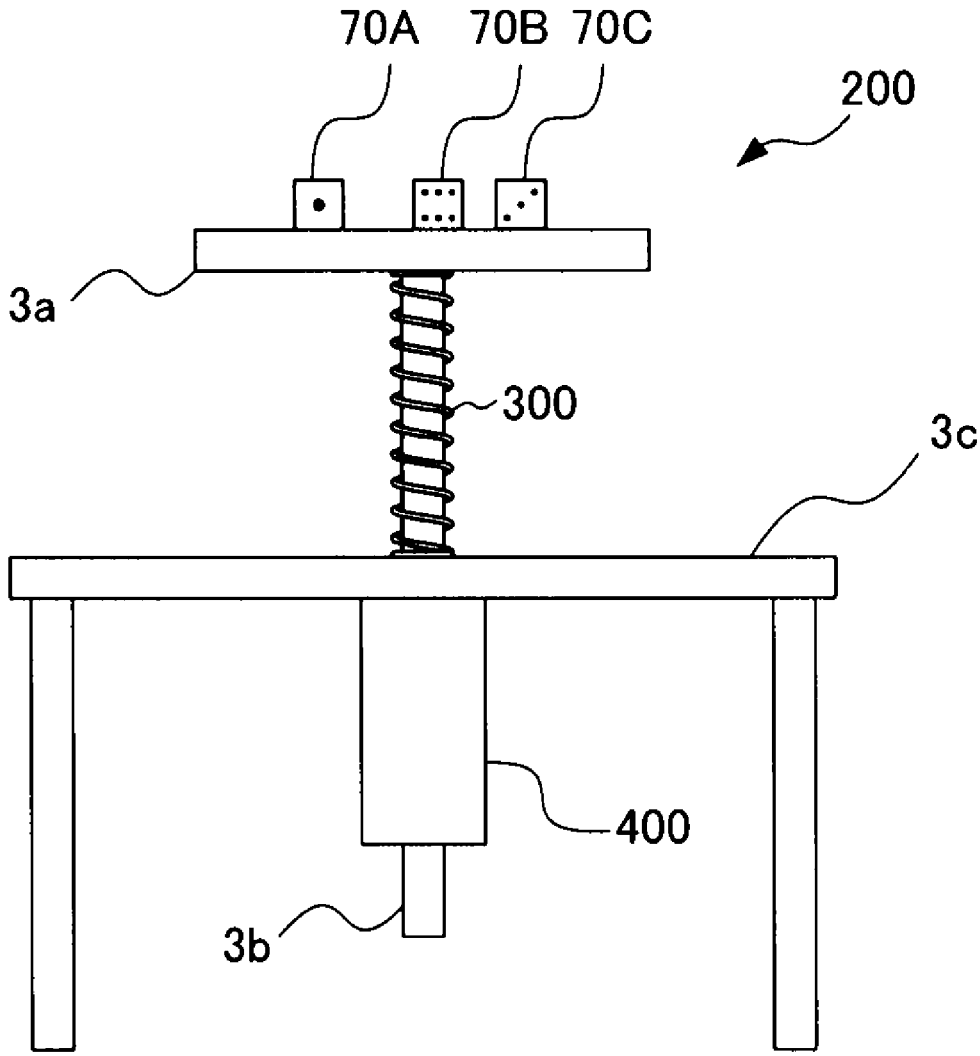
FIG. 1C is a schematic view illustrating a substantial part of a rolling unit according to an embodiment.

First, a general outline of the present embodiment is explained using FIG. 1C. FIG. 1C is a diagram showing a substantial part of a rolling unit 200 that rolls dice. In a gaming machine 1 (see FIG. 2C) according to the present embodiment, a dice game (SIC BO) is performed using three dice. A player predicts a number of dots appearing on a dice and can place a bet on it (see FIG. 7C). Then, the rolling unit 200 is driven and dice are rolled after a bet is performed, and gaming media may be paid out according to the number of dots on the dice coming to rest.

As shown in FIG. 1C, the rolling unit 200 includes a circular table 3*a* on which three dice 70 (die 70*a*, die 70*b* , and die 70*c*) are placed and a linear cylinder 400 for oscillating the circular table 3*a*. A shaft 3*b* is installed upright at the center of the circular table 3*a*, and this shaft 3*b* is inserted into the linear cylinder 400 which is fixed on a base 3*c*. Furthermore, a coil-shaped spring 300 is loosely fit with the shaft 3*b*, and the spring 300 is disposed between the circular table 3*a* and the base 3*c*. Then, in a state in which the linear cylinder 400 is not energized, the weight of the circular table 3*a* itself is proportional to biasing of the spring 300, as a result of which the circular table 3*a* is maintained at a predetermined location above the base 3*c*.

A plurality of coils 404 (see FIG. 4C) is arranged side by side in a vertical direction in the linear cylinder 400, and a magnetizing region 310, which is magnetized so that adjacent magnetic poles are different from each other, is formed in the shaft 3*b*. Then, using attracting and repelling forces based on the magnetic force of the coils excited and the magnetizing region 310 (see FIG. 4C) generated by switching the coils to be excited among the plurality of coils, a thrust force in a vertical direction is applied to the shaft 3*b*. Thus, the linear cylinder 400 moves the shaft 3*b* up and down in a vertical direction by applying the thrust force in a vertical direction to the shaft 3*b*.

When the linear cylinder 400 begins up and down movement of the shaft 3*b*, dice 70 are rolled by increasing oscillation of the circular table 3*a* by way of increasing an amount of travel of the shaft 3*b*, and the circular table 3*a* is ceased by slightly oscillating the circular table 3*a* before stopping up and down movement by way of decreasing the amount of travel of the shaft 3*b*, and then stopping current to the linear cylinder 400. Thus, the dice come to rest in a state not overlapping each other on the circular table 3*a*. These are the general outline of the present embodiment. More explanations are described in the following.

Figure 2C:
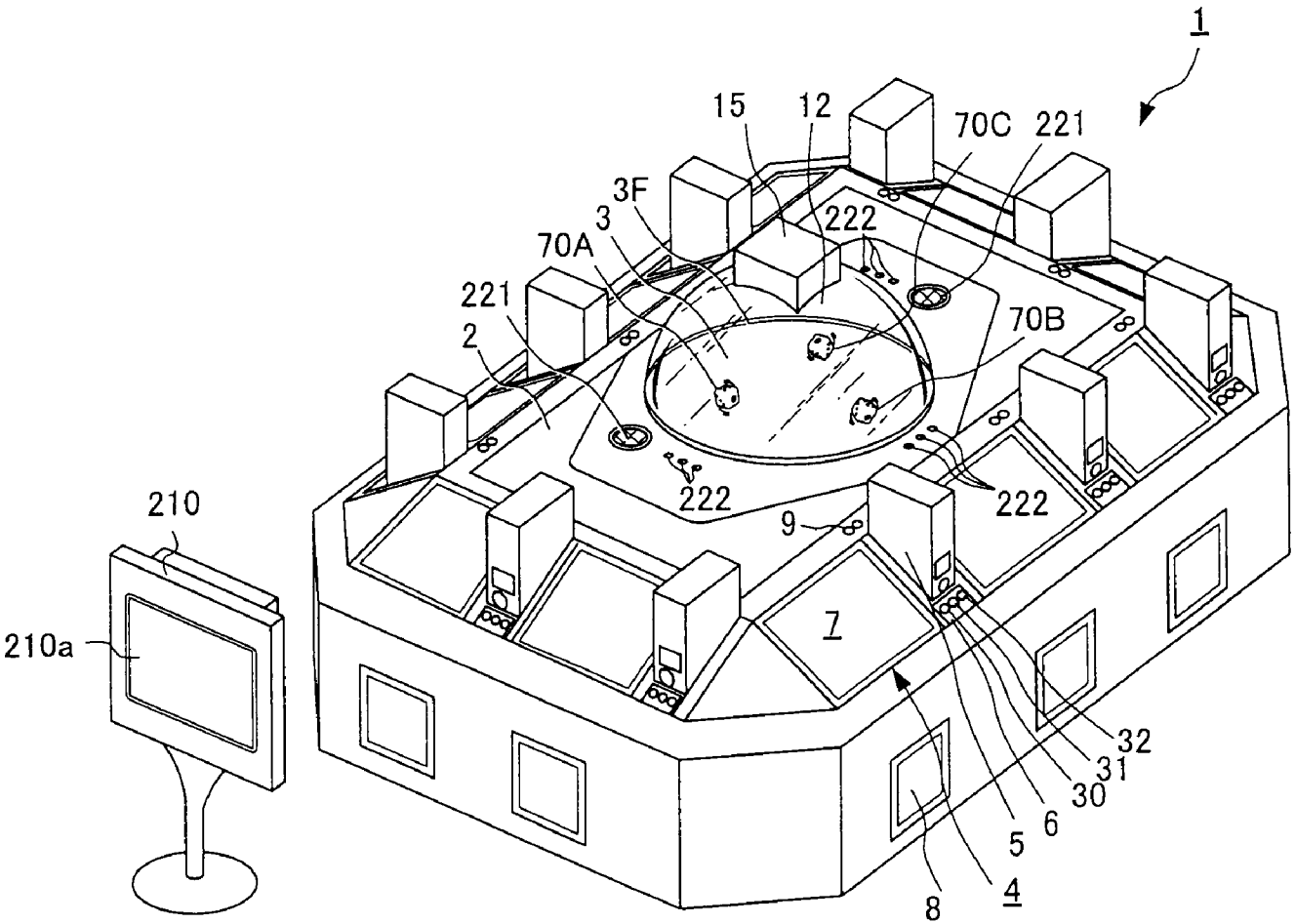
FIG. 2C is a perspective view schematically showing an example of a gaming machine according to an embodiment.

FIG. 2C is a perspective view schematically showing an example of a gaming machine according to the embodiment of this invention.

Figure 3C:
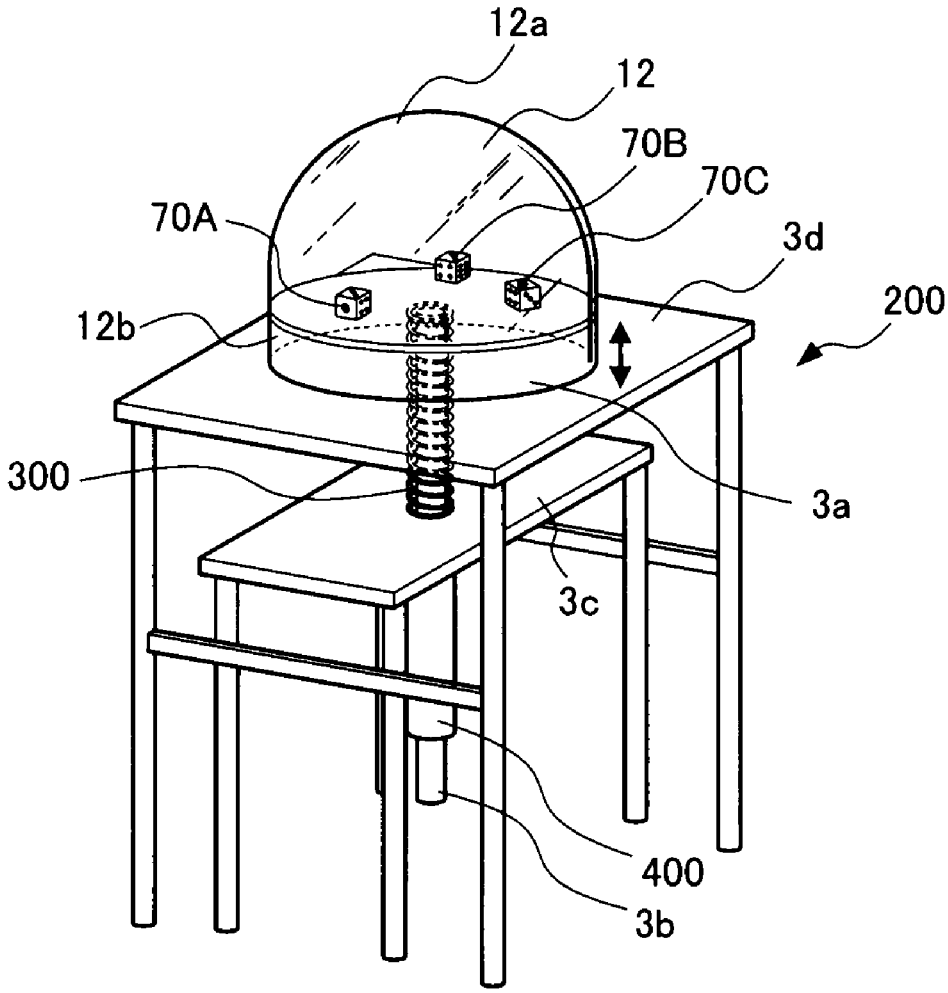
FIG. 3C is a perspective view schematically showing an example of a rolling unit provided at a gaming machine according to an embodiment.

FIG. 3C is a view schematically showing a configuration of a rolling unit for rolling dice which, and constitutes a playing unit of the gaming machine shown in FIG. 2C.

Figure 4C:
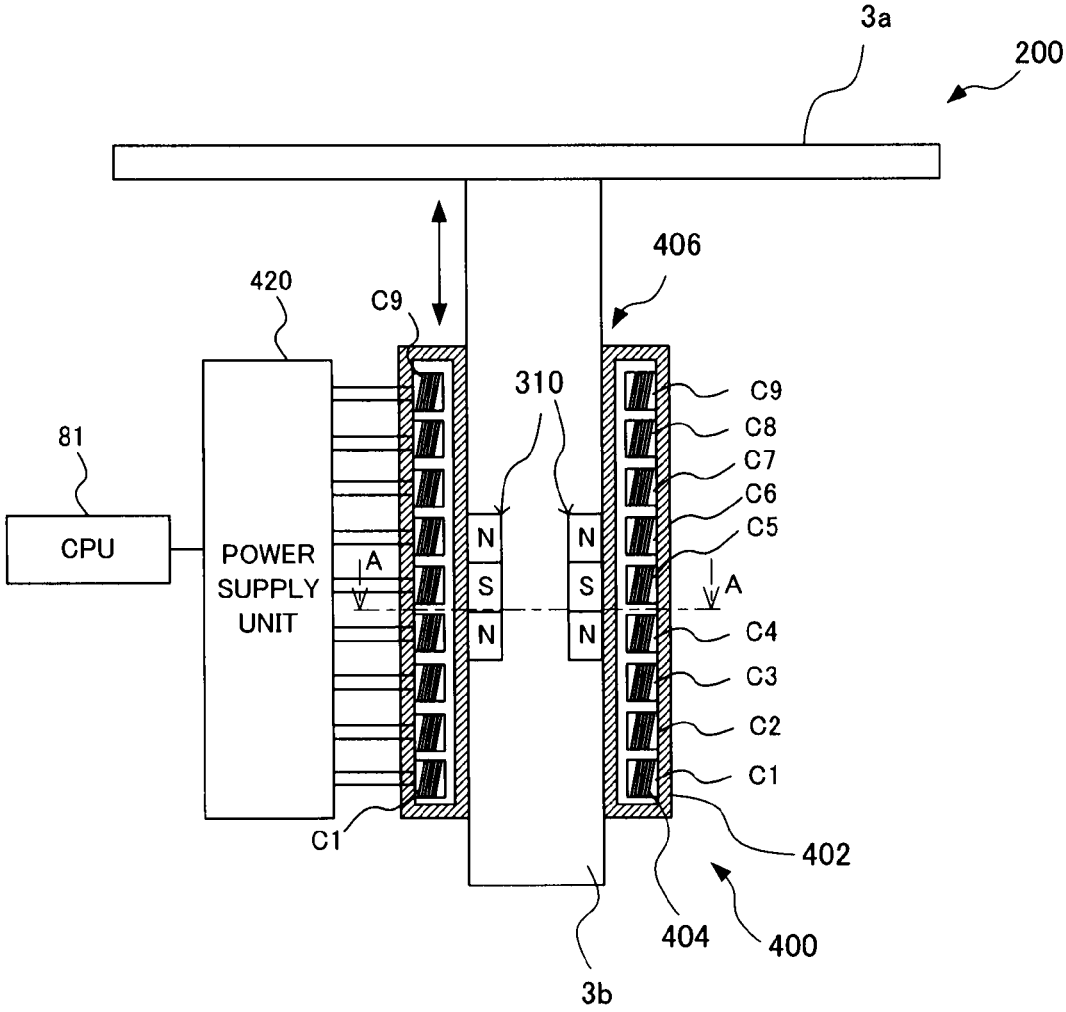
FIG. 4C is a perspective view schematically showing a driving mechanism of a rolling unit provided at a gaming machine according to an embodiment.

FIG. 4C is a diagram showing a driving mechanism of a rolling unit for rolling dice.

Figure 5C:
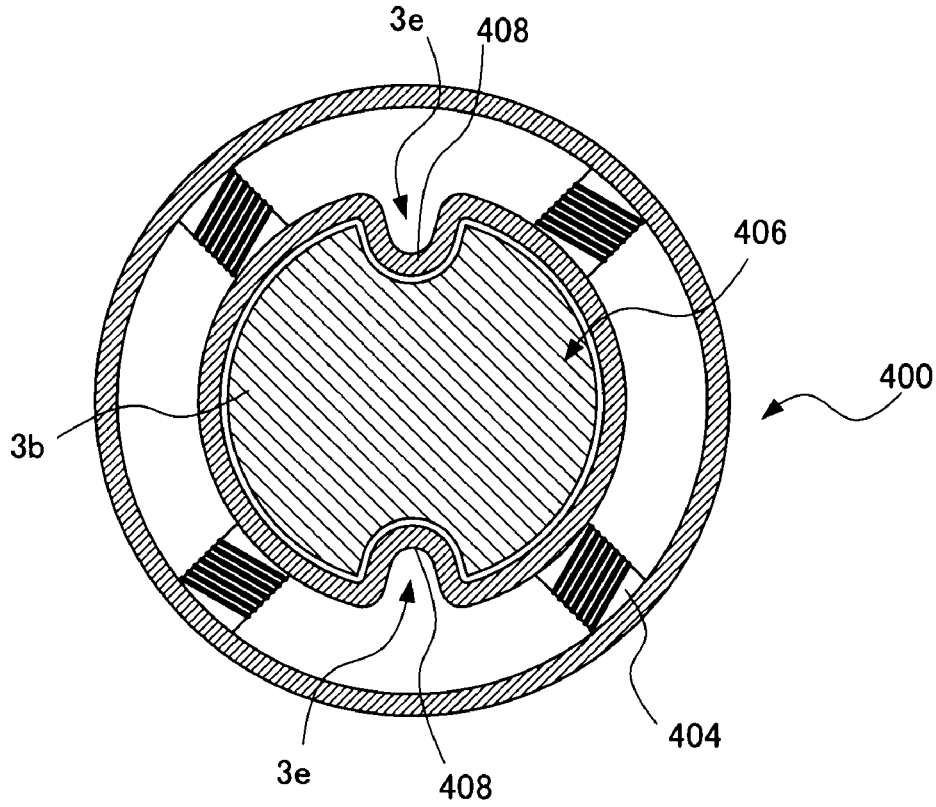
FIG. 5C is a diagram illustrating A-A cross-section of FIG. 4C.

FIG. 5C is a diagram illustrating a cross-section of the line A-A of FIG. 4C.

As shown in FIG. 2C, the gaming machine 1 according to the present embodiment includes a housing 2 as a main body portion, a playing unit 3 that is provided substantially at the center of the top face of the housing 2 and in which a plurality of dice 70 (70A, 70B, 70C) are rolled and come to rest, and a plurality of stations 4 disposed so as to surround the playing unit 3. The station 4 includes an image display unit 7. The player seated at each station 4 can participate in a game by predicting numbers of dots on the dice 70 and performing a normal bet input and a side bet input.

The gaming machine 1 includes a housing 2 as a main body portion, a playing unit 3 that is provided substantially at the center of the top face of the housing 2 and in which a plurality of dice 70 are rolled and come to rest, a plurality of stations 4 (ten in the present embodiment) disposed so as to surround the playing unit 3, and a dealer used display 210 that is positioned so as not to be visually recognizable by a player seated at each station 4.

The station 4 include a game media receiving device 5 into which game media such as medals to be used for playing the game are inserted, a control unit 6, which is configured with multiple control buttons by which a player enters predetermined instructions, and an image display unit 7, which displays images relating to a bet table. The player may participate in a game by operating the control unit 6 or the like while viewing the image displayed on the image display unit 7.

A payout opening 8, from which a player's game media are paid out, are provided on the sides of the housing 2 on which each station 4 is provided. In addition, a speaker 9, which can output sound, is disposed on the upper right of the image display unit 7 on each of the stations 4.

A control unit 6 is provided on the side part of the image display unit 7 on each of the stations 4. As viewed from a position facing the station 4, in order from the left side are provided a select button 30, a payout (cash-out) button 31, and a help button 32.

The select button 30 is a button that is pressed when confirming a bet operation after the bet operation is complete. Furthermore, in a case other than the bet operation, the button is pressed when a player confirms an input performed.

The payout button 31 is a button which is usually pressed at the end of a game, and when the payout button 31 is pressed, game media corresponding to credits that the player has acquired is paid out from the payout opening 8.

The help button 32 is a button that is pressed in a case where a method of operating the game is unclear, and upon the help button 32 being pressed, a help screen showing various kinds of operation information is displayed immediately thereafter on the image display unit 7.

The top of the game unit 3 is entirely covered with a cover member 12 of hemispheric transparent acryl to control the rolling range of dice. In the present embodiment, a dot detecting unit 15, which detects a number of dots on the dice 70, is provided at the top of the cover member 12. The rolling unit 200 is provided below the cover member 12, and a plurality of the dice 70 is rolled and come to rest by way of the rolling unit 200. The present embodiment is configured to use three dice 70 (die 70A, 70B, and 70C) in the playing unit 3.

The rolling unit 200 includes the circular table 3*a* on the top surface of which three dice 70 (die 70A, die 70B, and die 70C) are placed. The circular table 3*a* is provided in the cover member 12. Here, as shown in FIG. 3C, the cover member 12 is fixed with a supporting table 3*d* having a circular opening to which a cylindrical portion 12*b* is adapted. The circular table 3*a* is loosely fit internally with the cylindrical portion 12*b* of the cover member 12. At this time, the cylindrical portion 12*b* functions as a guiding member in that the circular table 3*a* can be moved in a vertical direction but is restricted to move in a horizontal direction. Thus, the circular table 3*a* is an example of a table on which the dice (die 70A, die 70B, and die 70C) are placed.

A cylindrical shaft 3*b* made of an iron core is installed upright at the center of the lower surface of the circular table 3*a*. A coil-shaped spring 300 is loosely inserted to the shaft 3*b*. The base 3*c* supporting the shaft 3*b* is provided below the circular table 3*a*. An opening is formed in the base 3*c* so as to loosely accommodate the shaft 3*b*. Furthermore, the linear cylinder 400 is fixed at the lower surface of the base 3*c*. The linear cylinder 400 includes a cylindrical opening 406, and the linear cylinder 400 is disposed at the lower surface of the base 3*c* so that the opening 406 of the linear cylinder 400 is in communication with an opening of the base 3*c*. As a result, based on a biasing force of the spring 300 disposed between the circular table 3*a* and the base 3*c* by loosely accommodating the shaft 3*b* to the opening of the base 3*c*, the circular table 3*a* is positioned in place and the state thereof in which the shaft 3*b* is inserted to the linear cylinder 400 is maintained. Thus, the shaft 3*b* is an example of a shaft installed upright at a table (the circular table 3*a*).

Then, when the linear cylinder 400 applies thrust in a vertical direction to the shaft 3*b*, the shaft 3*b* moves in a vertical direction, and the circular table 3*a* which is communicatively connected with the shaft 3*b* moves up and down in the cover member 12.

FIG. 4C is a diagram illustrating a structure of the linear cylinder 400, and FIG. 5C is a view illustrating a cross-section A-A of FIG. 4C. The linear cylinder 400 includes a configuration in which a plurality of coils 404 is arranged side by side in a vertical direction in a cylindrical case 402, the inside of which is hollow. In FIG. 4C, although nine coils 404 (coils C1 to C9) are arranged in parallel, this arrangement is merely an example for illustrating a principle for driving a shaft, and, regarding the number or size of the coils 404, it is possible to be set appropriately according to the weight of the circular table 3*a* and the shaft 3*b*. Thus, the coils 404 (coils C1 to C9) are an example of coils arranged side by side in a vertical direction.

Furthermore, as shown in FIG. 4C, since a plurality of the coils 404 forms a plurality of columns of the coils 404 in the case 402, and each column of the coils 404 adjacent each other with respect to a central axis of the case 402 is arranged equiangularly. In the present embodiment, as shown in FIG. 5C, four columns are arranged at 90-degree intervals each other. Furthermore, each of the coils 404 is arranged so that a central axis of the coil 404 directs to a central axis of the case 402. Each of the coils 404 is connected to a power supply unit 420 and is wired so that four coils 404 positioned at the identical circumference of a circle as a single set are energized. Therefore, in a case in which a set of the coils 404 is energized, the coils 404 are excited so that a set of the coils 404 becomes identical magnetic poles.

Figure 6C:
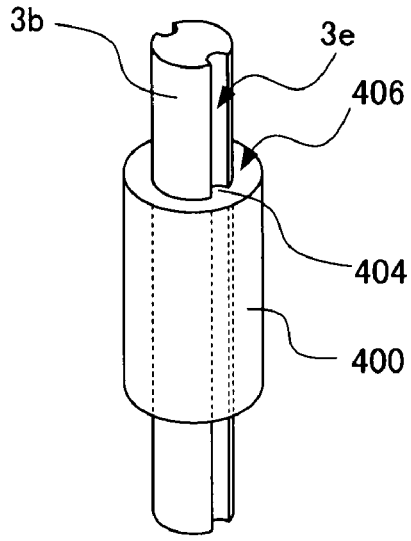
FIG. 6C is a perspective view showing an outer appearance proximal to a linear cylinder.

As shown in FIG. 5C, two convex portions 408 extending in a vertical direction are formed at an inner side face of the case 402 and disposed at a symmetrical position to each other with respect to the central axis of the case 402. Furthermore, concave portions 3*e* extending in a vertical direction are formed at a side face of the shaft 3*b*. The two concave portions 3*e* are disposed at symmetrical positions to each other with respect to the central axis of the shaft 3*b*. Thus, the shaft 3*b* can be loosely fitted into the opening of the base 3*c* by adapting the concave portion 3*e* to the convex portion 408. Then, in a case in which the shaft 3*b* is inserted into the linear cylinder 400, as shown in FIG. 6C, the shaft 3*b* can be moved in a vertical direction, but the rotation thereof is regulated. Therefore, the circular table 3*a* can be moved up and down but cannot be rotated.

Furthermore, in some regions facing some coils 404 around the shaft 3*b*, a magnetizing region 310 is formed so that adjacent magnetic poles are different from each other. In the present embodiment, in a state in which the circular table 3*a* is positioned in place, a region facing the coil C4 is magnetized as a N pole, a region facing the coil C5 is magnetized as a S pole, and a region facing the coil C6 is magnetized as a N pole. That is, in the present embodiment, four magnetizing regions 310 are formed on the side surface of the shaft 3*b*. Then, by energizing the coil 404 and then generating attracting and repelling force based on the magnetic force between the magnetic pole of the coil 404 and the magnetic pole of the magnetizing region 310 of the shaft 3*b*, a thrust force is applied to the shaft 3*b*. Furthermore, by changing the magnetic poles of each of the coils 404 excited in each of the columns of the coils 404, the shaft 3*b* can be driven in a vertical direction. At this time, since the attracting and repelling force of the magnetic force acts on the shaft 3*b* from four directions, the shaft 3*b* is moved up and down while the shaft 3*b* and the linear cylinder 400 are maintained to be in a state which is non-contacting as possible. Thus, the linear cylinder 400 is an example of a cylindrical linear actuator which is fixed below a table (the circular table 3*a*), has an opening (the opening 406) into which a shaft (the shaft 3*b*) is inserted, and applies a thrust force to drive a shaft in a vertical direction in an opening (the opening 406). Furthermore, the magnetizing region 310 is an example of a magnetizing region which is formed to be arranged in a vertical direction on the surface of a shaft (the shaft 3*b*) and adjacent magnetic poles are magnetized so as to be different from each other.

More specifically, in a state in which the shaft 3*b* is inserted into the opening 406 and each of the coils 404 is not energized, the biasing force by the spring 300 is proportional to the table 3*a*'s own weight, which makes the shaft 3*b* to be in a resting state. In this state thereof, by making the coils C4, C5, and C6 to be a S pole, N pole, and S pole in this order by energizing them only, subsequently making the coils C5, C6, and C7 to be a S pole, N pole, and S pole in this order, and subsequently making the coils C6, C7, and C8 to be a S pole, N pole, and S pole in this order, the shaft 3*b* is moved toward an upper side. Conversely, by making the coils C4, C5, and C6 to be a S pole, N pole, and S pole in this order, subsequently making the coils C3, C4, and C5 to be a S pole, N pole, and S pole in this order, and subsequently making the coils C2, C3, and C4 to be a S pole, N pole, and S pole in this order, the shaft 3*b* is moved toward a lower side. Thus, the linear cylinder 400 is an example of a linear actuator in that, when a shaft (the shaft 3*b*) is inserted into an opening (the opening 406), a linear actuator (the linear cylinder 400) allows a coil (the coil 404) and a magnetizing region (the magnetizing region 310) to face each other, and then, by applying current to a coil (the coil 404) to excite thereof and then generating an attracting and repelling force based on a magnetic force between a coil (the coil 404) and a magnetizing region (the magnetizing region 310), a thrust force is generated on a shaft (the shaft 3*b*).

Control of the supply of power applied to the coils C1 to C9 is performed by the CPU 81 controlling the power supply unit 420. That is, by the CPU 81 switching the coils 404 to be excited, vertical movement of the shaft 3*b* can be achieved, as a result of which, dice on the table 3*a* can be rolled by moving the table 3*a* up and down in conjunction with the shaft 3*b*.

At this time, an amplitude of the vertical movement of the shaft 3*b* is determined by determining a range in a vertical direction of the coil 404 to be excited. In the present embodiment, for example, with the coils C4 to C6 as a basis, it is possible to render oscillation of the table 3*a* to be a large oscillation by performing power switching periodically in the order of the coils C5 to C7, C6 to C8, C7 to C9, C6 to C8, C5 to C7, C4 to C6, C3 to C5, C2 to C4, C1 to C3, C2 to C4, C3 to C5, and C4 to C6. Similarly, with the coils C4 to C6 as a basis, it is possible to make oscillation of the table 3*a* to be an intermediate oscillation by performing power switching periodically in the order of the coils C5 to C7, C6 to C8, C5 to C7, C4 to C6, C3 to C5, C2 to C4, C3 to C5, and C4 to C6. Furthermore, with the coils C4 to C6 as a basis, it is possible to make oscillation of the table 3*a* to be a subtle oscillation by performing power switching periodically in the order of the coils C5 to C7, C4 to C6, C3 to C5, and C4 to C6. In other words, it is possible to switch the amplitude of oscillation of the table 3*a* in three steps (large oscillation, intermediate oscillation, and subtle oscillation). Thus, the CPU 81 is an example of a control device which controls a linear actuator (the linear cylinder 400) so as to move a table (the circular table 3*a*) up and down, to roll dice (the dice 70) on a table (the circular table 3*a*), and to cease vertical movement of a table (the circular table 3*a*). Furthermore, the CPU 81 is an example of a control device which controls a linear actuator (the linear cylinder 400) to switch the amplitude of a vertical movement of a table (the circular table 3*a*) in a stepwise manner. Furthermore, the CPU 81 is an example of a control device which controls a linear actuator (the linear cylinder 400) to minimize the amplitude of a vertical movement of a table (the circular table 3*a*) and then to cease oscillation thereof.

In the present embodiment, a number of dots appearing on the dice 70 on the table 3*a* is determined by setting the intermediate oscillation to lightly roll the dice on the table initially, setting the large oscillation to greatly roll the dice on the table secondly, and setting the subtle oscillation and then ceasing the table 3*a* finally.

The dot detection unit 15 in the present embodiment includes an imaging device (CCD camera) for shooting the dice 70 as an object of shooting, and detects the number of dots appearing on the dice 70 based on an imaging signal from the imaging device. Therefore, it is not possible to detect the number of dots appearing on the dice 70 accurately in a state in which a plurality of the dice 70 are overlapping each other. However, in the present embodiment, by moving the table 3*a* with subtle oscillation and then ceasing the table 3*a*, even if a plurality of the dice 70 is overlapping each other, it is possible to make the dice come to rest after breaking up the overlapping state of the dice. As a result of this, it is possible to detect the number of dots appearing on the dice 70 accurately.

Furthermore, an IC tag is embedded on each face of the dice 70. Therefore, the number of dots on the dice 70 is detected by reading information stored in the IC tag using an IC tag reader 16 (see FIG. 8C) provided at the lower surface of the table.

The IC tag reader 16 is a non-contact type IC tag reader. For example, it is possible to read information stored in the IC tag by RFID (Radio Frequency Identification). The RFID system performs near field communication that reads and writes data stored in semi-conductor devices by an induction field or radio waves in a non-contact manner. In addition, since this technology is known conventionally and is described in Japanese Unexamined Patent Application Publication No. H8-21875, an explanation thereof is abbreviated.

In the present embodiment, a plurality of IC tags is read by a single IC tag reader 16. Under the abovementioned RFID system, an anti-collision function can be employed which can read a plurality of IC tags by a single reader. The anti-collision function includes FIFO (first in first out) type, multi-access type, and selective type, and communicates with a plurality of the IC tags sequentially. The FIFO type is a mode to communicate with a plurality of the IC tags sequentially in the order that each IC tag enters an area in which an antenna can communicate therewith. The multi-access type is a mode that is able to communicate with all the IC tags, even if there is a plurality of the IC tags simultaneously in the area in which an antenna can communicate with the IC tags. The selective type is a mode that is able to communicate with a specific IC tag among a plurality of the IC tags in the area in which an antenna can communicate therewith. By employing the abovementioned modes, it is possible to read a plurality of the IC tags with a single IC tag reader. Thus, in the present embodiment, accurate detections of a number of the dots can be achieved by using both the dots detection unit 15 and the IC tag reader 16.

Figure 7C:
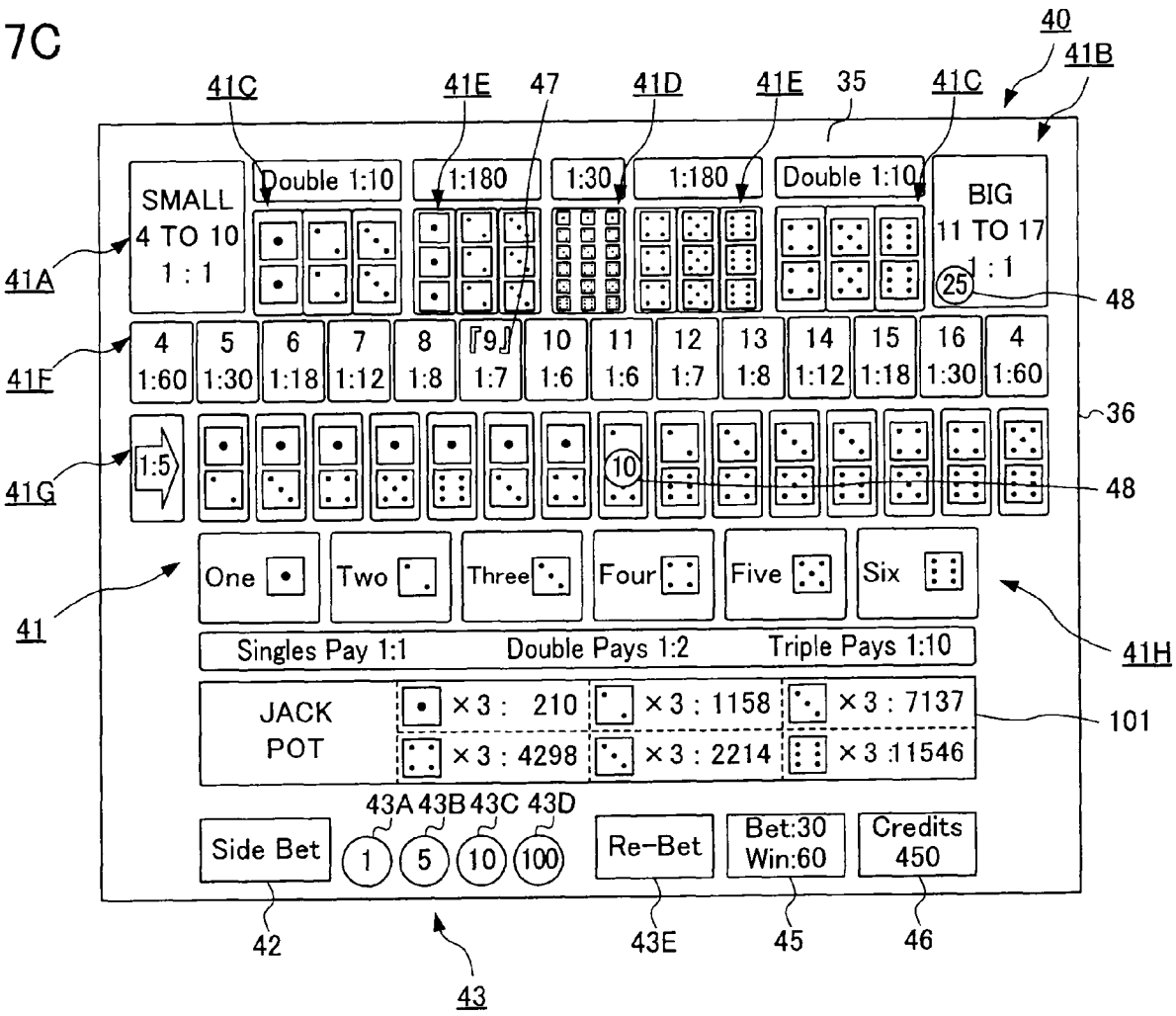
FIG. 7C shows an example of a display screen displayed on an image display unit.

FIG. 7C shows an example of a display screen displayed on an image display unit. As shown in FIG. 7C, an image display unit 7 is a touch-panel type of liquid crystal display, on the front surface of which a touch panel 35 is attached, allowing a player to perform selection such as of icons displayed on a liquid crystal screen 36 by contacting the touch panel 35, e.g., with a finger.

A table-type betting board (a bet screen) 40 for predicting the number of dots of the dice 70 is displayed in a game at a predetermined timing on the image display unit 7.

A detailed description is now provided regarding the bet screen 40. On the bet screen 40 are displayed a plurality of normal bet areas 41 and a side bet area 42. The plurality of normal bet areas 41 includes a normal bet area 41A, a normal bet area 41B, a normal bet area 41C, a normal bet area 41D, a normal bet area 41E, a normal bet area 41F, a normal bet area 41G, and a normal bet area 41H. By contacting the touch panel 35, e.g., with a finger, the normal bet area 41 is designated, and by displaying chips in the normal bet area 41 thus designated, a normal bet operation is performed. Furthermore, by contacting the touch panel 35, e.g., with a finger, the side bet area 42 is designated, and by displaying chips in the side bet area 42 thus designated, a side bet operation is performed.

A unit bet button 43, a re-bet button 43E, a payout result display unit 45, and a credit amount display unit 46 are displayed at the right side of the side bet area 42 in order from the left side.

The unit bet button unit 43 is a group of buttons that are used by a player to bet chips on the normal bet area 41 and the side bet area 42 designated by the player. The unit bet button unit 43 is configured with four types of buttons including a 1 bet button 43A, a 5 bet button 43B, a 10 bet button 43C, and a 100 bet button 43D. It should be noted that in the case of an incorrect bet operation, the player can start a bet operation again by touching a re-bet button 43E.

Firstly, the player designates the normal bet area 41 or the side bet area 42 using a cursor 47 by way of contacting the touch panel 35, e.g., with a finger. At this time, contacting the 1 bet button 43A, e.g., with a finger, allows for betting one chip at a time (number of chips to be bet increases one by one in the order of 1, 2, 3, every time the 1 bet button 43A is contacted, e.g., by a finger). Similarly, when contacting the 5 bet button 43B, e.g., with a finger, five chips at a time can be bet (number of chips to be bet increases five by five in the order of 5, 10, 15, every time the 5 bet button 43B is contacted, e.g., by a finger). Similarly, when contacting the 10 bet button 43C, e.g., with a finger, ten chips at a time can be bet (number of chips to be bet increases ten by ten in the order of 10, 20, 30, every time the 10 bet button 43C is contacted, e.g., by a finger). Similarly, when contacting the 100 bet button 43D, e.g., with a finger, a hundred chips at a time can be bet (number of chips to be bet increases hundred by hundred in the order of 100, 200, 300, . . . every time the 100 bet button 43D is contacted, e.g. by a finger). The number of chips bet up to the current time is displayed as a chip mark 48, and the number displayed on the chip mark 48 indicates the number of bet chips.

The number of bet chips and payout credit amount for a player in a previous game are displayed in the payout result display unit 45. The number calculated by subtracting the number of bet chips from the payout credit amount is a newly acquired credit amount for the player in the previous game.

The credit amount display unit 46 displays the credit amount which the player possesses. The credit amount decreases according to the number of bet chips (1 credit amount for 1 chip) when the player bets chips. If the bet chips are entitled to an award and credits are paid out, the credit amount increases in accordance with the number of paid out chips. It should be noted that the game is over when the player's credit amount becomes zero.

The normal bet area 41 in the bet screen 40 is described next. The normal bet areas 41A and 41B are portions where the player places a bet on a predicted sum of dots appearing on the dice 70A to 70C. In other words, the player selects the normal bet area 41A if the predicted sum falls in a range of 4 to 10, or the normal bet area 41B if the predicted sum falls in a range of 11 to 17. Odds are set to 1:1 (2 chips are paid out for 1 chip bet).

The normal bet area 41C is a portion where the player places a bet, predicting that two dice 70 have the same number of dots. In other words, the player wins an award if one of the combinations occurs, such as (1, 1), (2, 2), (3, 3), (4, 4), (5, 5), and (6, 6), and the odds are set to 1:10.

The normal bet area 41D is a portion where the player places a bet, predicting that all three dice have the same number of dots. In other words, the player wins an award if one of the combinations occurs, such as (1, 1, 1), (2, 2, 2), (3, 3, 3), (4, 4, 4), (5, 5, 5), and (6, 6, 6), and the odds are set to 1:30.

The bet area 41E is a portion where the player places a bet on a predicted number of dots appearing commonly on all three dice. In other words, the player places a bet on one of the combinations of (1, 1, 1), (2, 2, 2), (3, 3, 3), (4, 4, 4), (5, 5, 5), or (6, 6, 6), and the odds are set to 1:180.

The normal bet area 41F is where the player places a bet, predicting a total, a summation of dots appearing on the three dice. Odds are set according to the occurrence frequency of the total. For example, if the total is 4 or 17, odds are set to 1:60; if the total is 5 or 16, odds are set to 1:30; if the total is 6 or 15, odds are set to 1:18; if the total is 7 or 14, odds are set to 1:12; if the total is 8 or 13, odds are set to 1:8; if the total is 9 or 12, odds are set to 1:7; and if the total is 10 or 11, odds are set to 1:6.

The bet area 41G is a portion where the player places a bet on predicted dots appearing on the two dice selected from the three, and the odds are set to 1:5.

The normal bet area 41H is a region where the player places a bet on the number of dots appearing on the dice 70, and the odds are set according to the number of dots of the dice 70 matching the predicted number of dots.

Figure 8C:
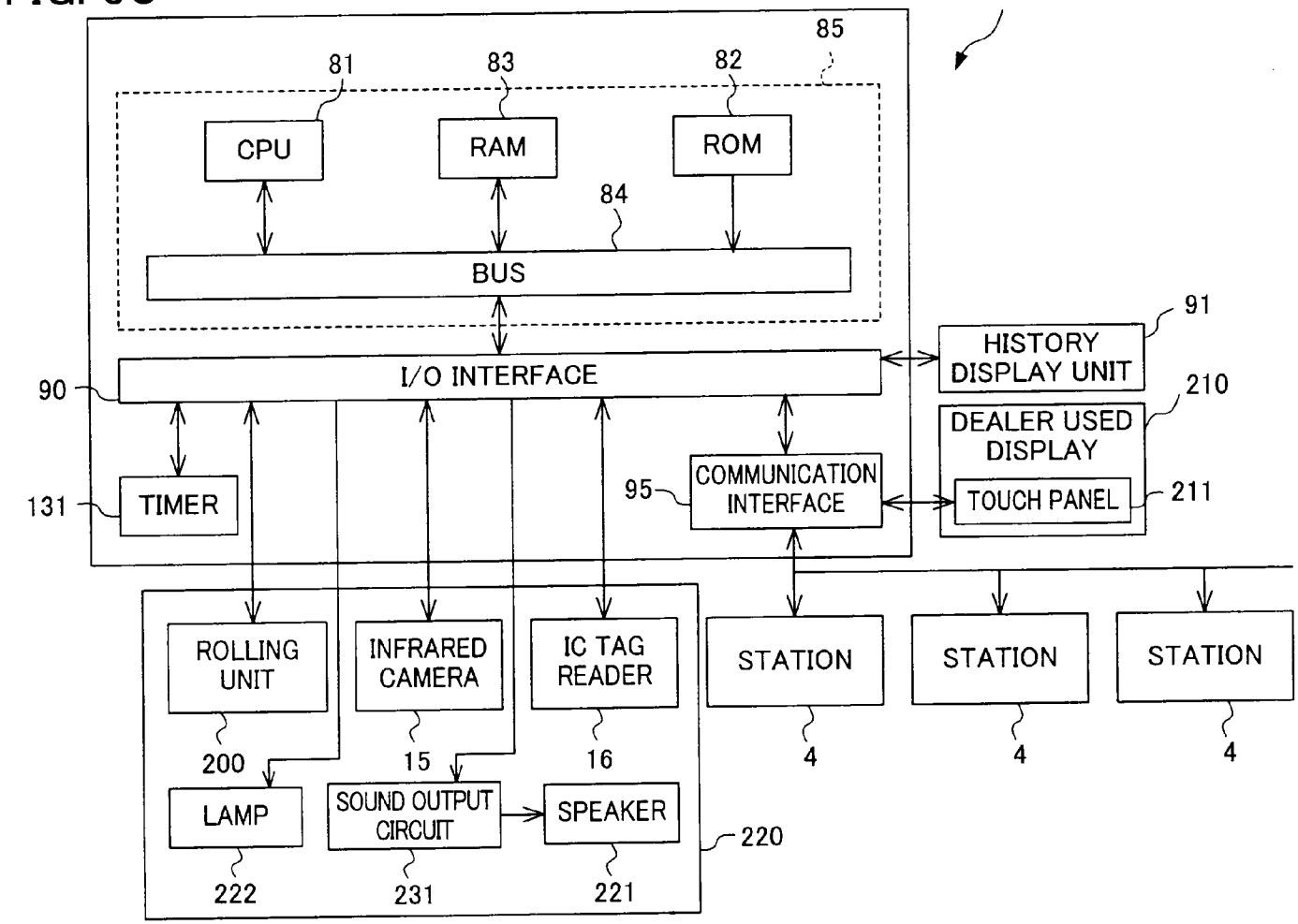

FIG. 8C is a block diagram showing an internal configuration of the gaming machine shown in FIG. 2C. A main control unit 80 of the gaming machine 1 includes a microcomputer 85, which is configured with a CPU 81, ROM 82, RAM 83, and a bus 84 that transfers data therebetween.

The CPU 81 is connected with a power supply unit 420 (see FIG. 4C) of the rolling unit 200 via an I/O interface 90. Furthermore, the CPU 81 is connected with a timer 131, which can measure time via the I/O interface 90. In addition, the CPU 81 is connected with a lamp 222 via the I/O interface 90. The lamp 222 emits various colors of light for performing various types of rendered effects, based on output signals from the CPU 81. Furthermore, the CPU 81 is connected with a speaker 221 via the I/O interface 90 and a sound output circuit 231. The speaker 221 emits various sound effects for performing various types of rendered effects, based on output signals from the sound output circuit 231. Furthermore, the I/O interface 90 is connected with the abovementioned infrared camera 15 and/or the IC tag reader 16, thereby transmitting and receiving information in relation to the number of dots of the three dice 70, which comes to rest on the playing board 3*a* , between the infrared camera 15 and/or the IC tag reader 16.

Here, the rolling unit 200, the infrared camera 15, the IC tag reader 16, the lamp 222, the sound output circuit 231, and the speaker 221 are provided within a single composite unit 220.

In addition, via a communication interface 95 connected to the I/O interface 90, the main control unit 80 transmits and receives data such as bet information, payout information, and the like to and from each station 4, as well as data such as bet start instruction images, bet start instruction signals, and the like to and from the dealer used display 210.

The bet start instruction image is displayed by the CPU 81 on the display screen 210*a* of the dealer used display 210 before the CPU 81 accepts a bet from each station 4.

This bet start instruction image instructs a dealer to touch a "bet start" button. When a touch panel 211 detects that the dealer has touched the "bet start" button, the touch panel 211 transmits a bet start instruction signal to the CPU 81 via a communication interface 95.

Furthermore, the I/O interface 90 is connected with a history display unit 91, and the main control unit 80 transmits and receives information in relation to the number of dots on the die, to and from the history display unit 90.

ROM 82 in the main control unit 80 is configured to store a program for implementing basic functions of the gaming machine 1; more specifically, a program for controlling various devices which drive the playing unit 3, a program for controlling each station 4, and the like, as well as a payout table, data indicating a predetermined time T, data indicating a specific value TT, and the like.

RAM 83 is memory, which temporarily stores various types of data calculated by CPU 81, and, for example, temporarily stores data bet information transmitted from each station 4, information on respective number of dots that appear on the dice 70 transmitted from the infrared camera 15 and/or the IC tag reader 16, data relating to the results of processing executed by CPU 81, and the like. A jackpot storage area is provided in the RAM 83. In the jackpot storage area, the data indicating the number of playing media stored cumulatively is stored so as to correspond to each number of dots of matching dice. The data is provided to the station 4 at a predetermined timing, and a jackpot image is displayed.

The CPU 81 controls the rolling unit 200, which oscillates the playing unit 3, based on data and a program stored in the ROM 82 and the RAM 83, and oscillates the playing board 3*a* of the playing unit 3. Furthermore, after oscillation of the playing board 3*a* ceases, a control processing associated with game progression, such as confirmation processing for confirming the number of dots on each of the dice 70 resting on the playing board 3*a*.

In addition to the control processing described above, the CPU 81 has a function of executing a game by transmitting and receiving data to and from each station 4 so as to control each station 4. More specifically, the CPU 81 accepts bet information transmitted from each station 4. Furthermore, the CPU 81 performs win determination processing based on the number of dots on the dice 70 and the bet information transmitted from each station 4, and calculates the amount of an award paid out in each station 4 with reference to the payout table stored in the ROM 82.

Figure 9C:
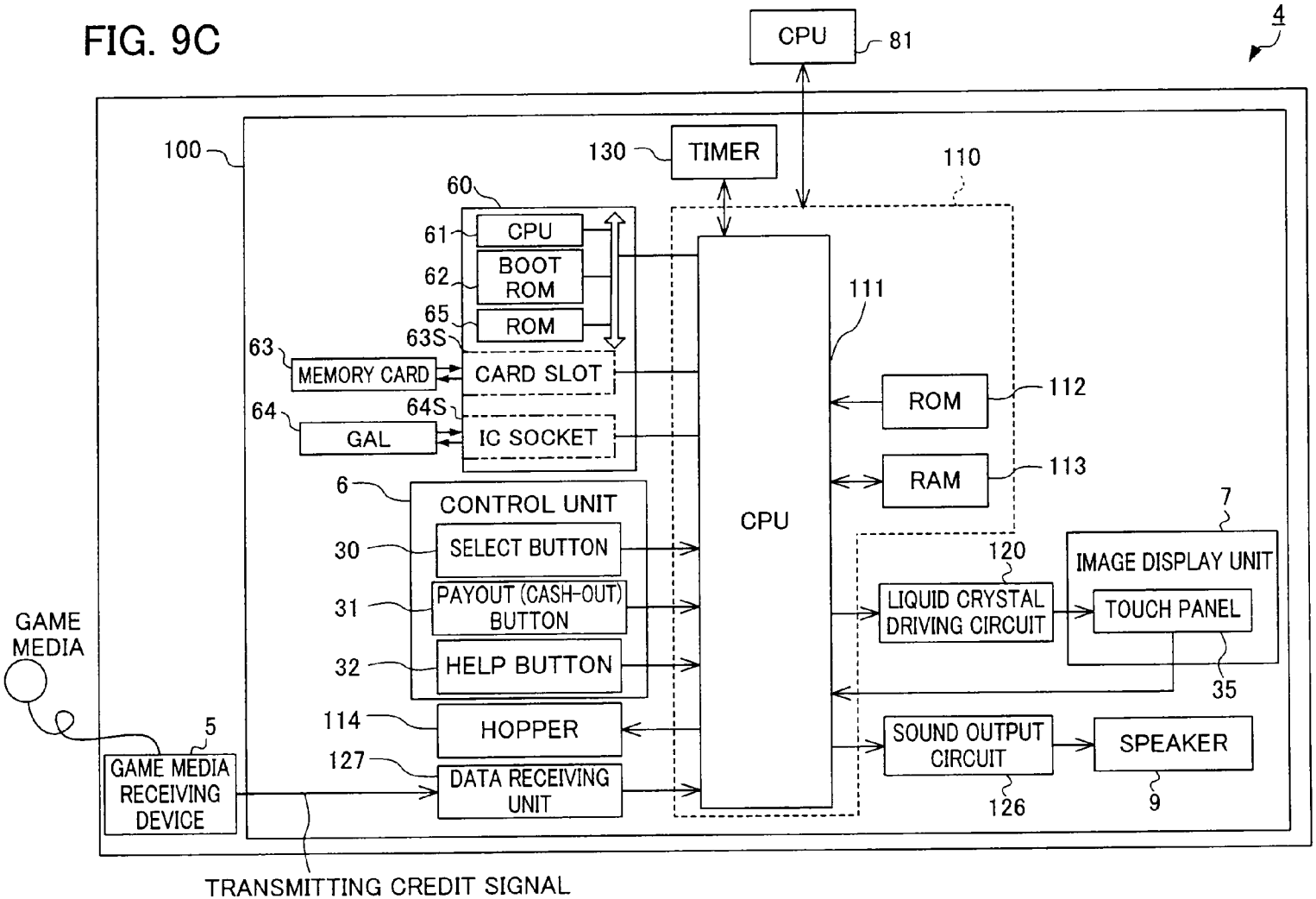
FIG. 9C is a block diagram showing an internal configuration of a station shown in FIG. 2C.

FIG. 9C is a block diagram showing an internal configuration of a station shown in FIG. 2C. The station 4 includes a main body 100 in which an image display unit 7 and the like are provided, and a game media receiving device 5, which is attached to the main body 100. The main body 100 further includes a station control unit 110 and several peripheral devices.

The station control unit 110 includes a CPU 111, ROM 112, and RAM 113.

ROM 112 stores a program for implementing basic functions of the station 4, other various programs needed to control the station 4, a data table, and the like.

Moreover, a decision button 30, a payout button 31, and a help button 32 provided in the control unit 6 are connected to the CPU 111, respectively. The CPU 111 controls the execution of various corresponding operations in accordance with manipulation signals, which are generated in response to each button pressed by a player. More specifically, the CPU 111 executes various processing, based on input signals transmitted from the control unit 6 in response to a player's operation which has been inputted, and the data and programs stored in the ROM 112 and RAM 113. Subsequently, the CPU 111 transmits the results to the CPU 81 in the main control unit 80.

In addition, the CPU 111 in the main control unit 80 receives instruction signals from the CPU 81, and controls peripheral devices which configure the station 4. The CPU 111 performs various kinds of processing based upon the input signals supplied from the control unit 6 and the touch panel 35, and the data and the programs stored in the ROM 112 and the RAM 113. Then, the CPU 111 controls the peripheral devices which configure the station 4 based on the results of the processing. It should be noted that the mode whereby processing is performed is set for each processing depending on the content of the processing. For example, the former approach is applied to payout processing of game media for respective numbers of dots appearing on the dice, and the latter approach is applied to bet operation processing by a player.

Furthermore, a hopper 114, which is connected to the CPU 111, pays out a predetermined amount of game media through the payout opening 8, receiving the instruction signals from the CPU 111.

Moreover, the image display unit 7 is connected to the CPU 111 via a liquid crystal driving circuit 120. The liquid crystal driving circuit 120 includes program ROM, image ROM, an image control CPU, work RAM, a video display processor (VDP), video RAM, and the like. Here, the program ROM stores an image control program with respect to the display functions of the image display unit 7, and various kinds of selection tables. The image ROM stores dot data for creating an image to be displayed on the image display unit 7, and dot data for displaying a jackpot image, for example. In addition, the image control CPU determines an image to be displayed on the image display unit 7, selected from the dot data previously stored in the image ROM according to the image control program previously stored in the program ROM based on parameters specified by the CPU 111. The work RAM is configured as a temporary storage means when executing the image control program by the image control CPU. The VDP forms an image corresponding to the display contents determined by the image control CPU and outputs the resulting image on the image display unit 7. It should be noted that the video RAM is configured as a temporary storage device used by the VDP for creating an image.

As mentioned above, the touch panel 35 is attached to the front side of the image display unit 7, and the information related to operation on the touch panel 35 is transmitted to the CPU 111. The touch panel 35 detects an input operation by the player on a bet screen 40 and the like. More specifically, selection of the normal bet area 41 and the side bet area 42 in the bet screen 40, manipulation of the bet button unit 43 and the like, are performed by touching the touch panel 35, and the information thereof is transmitted to the CPU 111. Then, a player's bet information is stored in the RAM 113 based on the information stored. Furthermore, the bet information is transmitted to the CPU 81 in the main control unit 80, and stored in a bet information storage area in the RAM 83.

Moreover, a sound output circuit 126 and a speaker 9 are connected to the CPU 111. The speaker 9 emits various sound effects for performing various kinds of rendered effects, based on output signals from the sound output circuit 126. In addition, the game media receiving device 5, into which game media such as coins or medals are inserted, is connected to the CPU 111 via a data receiving unit 127. The data receiving unit 127 receives credit signals transmitted from the game media receiving device 5, and the CPU 111 increases a player's credit amount stored in the RAM 113 based on the credit signals transmitted.

A timer 130, which can measure time, is connected to the CPU 111.

A gaming board 60 includes a CPU (Central Processing Unit) 61, ROM 65 and boot ROM 62, a card slot 63S compatible with a memory card 63, and an IC socket 64S compatible with a GAL (Generic Array Logic) 64, which are connected to one another via an internal bus.

The memory card 63 comprises nonvolatile memory such as compact flash (trademark) or the like, which stores a game program and a game system program.

Furthermore, the card slot 63S has a configuration that allows the memory card 63 to be detachably inserted, and is connected to the CPU 111 via an IDE bus. Such an arrangement allows the kinds or content of the game provided by the station 4 to be changed by performing the following operation. More specifically, the memory card 63 is first extracted from the card slot 63S, and another game program and another game system program are written to the memory card 63. Then, the memory card 63 thus rewritten is inserted into the card slot 63S. In addition, the kinds or content of the games provided by the station 4 can be changed by replacing the memory card 63 storing a game program and a game system program with another memory card 63 storing another game program and game system program. The game program includes a program for advancing a game and the like. The game program also includes a program related to image data and sound data outputted during a game.

The GAL 64 is one type of PLD that has a fixed OR array structure. The GAL 64 includes multiple input ports and output ports and, upon receiving predetermined data via each input port, outputs output data that corresponds to the input data via the corresponding output port. In addition, an IC socket 64S has a structure that allows the GAL 64 to be detachably mounted, and is connected to the CPU 111 via the PCI bus.

The CPU 61, the ROM 65, and the boot ROM 62, which are connected to one another via the internal bus, are connected to the CPU 111 via the PCI bus. The PCI bus performs signal transmission between the CPU 111 and the gaming board 60, as well as supplying electric power from the CPU 111 to the gaming board 60. The ROM 65 stores country identification information and an authentication program. The boot ROM 62 stores a preliminary authentication program, a program (boot code) which instructs the CPU 61 to start up the preliminary authentication program, etc.

The authentication program is a program (forgery check program) for authenticating the game program and the game system program. The authentication program is defined to follow the procedure (authentication procedure) for confirming and authenticating that the game program and the game system program, which are to be acquired after the authentication, have not been forged, i.e. the procedure for authenticating the game program and the game system program. The preliminary authentication program is a program for authenticating the aforementioned authentication program. The preliminary authentication program is defined to follow the procedure for verifying that the authentication program has not been forged, i.e. the procedure for authenticating the authentication program (authentication procedure).

According to the present embodiment as described above, it is easily possible to control the position of the shaft 3*b* such as by moving the shaft 3*b* greatly or subtly by way of controlling the electric current applied to the coil 404. Thus, by moving the circular table 3*a* up and down with a large oscillation initially, the dice 70 on the circular table 3*a* are greatly rolled, then by decreasing the movement, the height at which the dice 70 hop is decreased and then the dice 70 come to rest, and even if the dice 70 are temporarily overlapping on the circular table 3*a*, a state in which the dice are overlapping is broken up by subtle vertical movement. Thus, it is possible to provide a gaming machine having a function that causes dice 70 to roll and come to rest so that the dice 70 are not overlapping each other.

Furthermore, by switching amplitude of a vertical movement of the table in a stepwise manner, it is possible to change roll of the dice 70 variously such as by moving the dice 70 on the circular table 3*a* by initially moving the circular table 3*a* up and down with large oscillation and then minimizing the vertical movement. Thus, it is possible to increase the enjoyment factor of rolling mode of the dice 70, and moreover, to provide to players information indicating that it is about time the dice 70 cease, when the vertical movement of the dice 70 becomes smaller.

Furthermore, the vertical movement of the circular table 3*a* is finally minimized with subtle oscillation so as to minimize the height of the dice 70 jumping, and then, is ceased. Thus, even if the dice 70 are overlapped each other on the circular table 3*a*, the overlapping state can be released by small vertical movement. Thus, it is possible to provide a gaming machine having a function that rolls and ceases the dice 70 so that the dice 70 are not overlapped each other.

Although a case has been described in which the number of dice 70 is three according to the present embodiment, the number of in the present invention is not limited to three and, for example, the number of the dice may be five.

In the present embodiment, although the controller of the present invention is described for a case of being configured from a CPU 81 which the main controller 80 includes and a CPU 111 which the station 4 includes, the controller of the present invention may be configured by only a single CPU.

Although embodiments of the present invention are described above, they are merely exemplified specific examples, and the present invention is not particularly limited thereto. Specific configurations such as each means can be modified appropriately. Moreover, it should be understood that the advantages described in association with the embodiments are merely a listing of most preferred advantages, and that the advantages of the present invention are by no means restricted to those described in connection with the embodiments.

In addition, characteristic portions are mainly explained in the abovementioned detailed description for the purpose of clear understanding of the present invention. For a better understanding of the present invention, the abovementioned description consists mainly of the characteristic features of the invention. The invention is not limited to the following preferred embodiment, and is applicable to other embodiments in a wide variety of uses. The terms and the uses thereof are for accurately explaining the invention, not for limiting the interpretation of the invention. It seems to be easy for those skilled in the art to think of other configurations, systems, and methods contained in the concept of the invention, from the concept of the invention described in the present specification. Consequently, the description of the appended claims should be regarded as containing an equal configuration without departing from the scope of the technical idea of the invention. The appended abstract is for enabling engineers or the like in the art, who are not familiar with the patent office, general public institution, patents, law terms, or technical terms, to easily understand the technical contents and the substance of the present application by a simple investigation. Hence, the abstract is not intended for limiting the scope of the invention that should be evaluated by the appended claims. It is desirable to sufficiently review literatures and documents that are already disclosed, in order to understand the object of the invention and the novel effect of the invention.

Embodiments of the present invention will be described below with reference to the accompanying drawings.

Figure 1D:
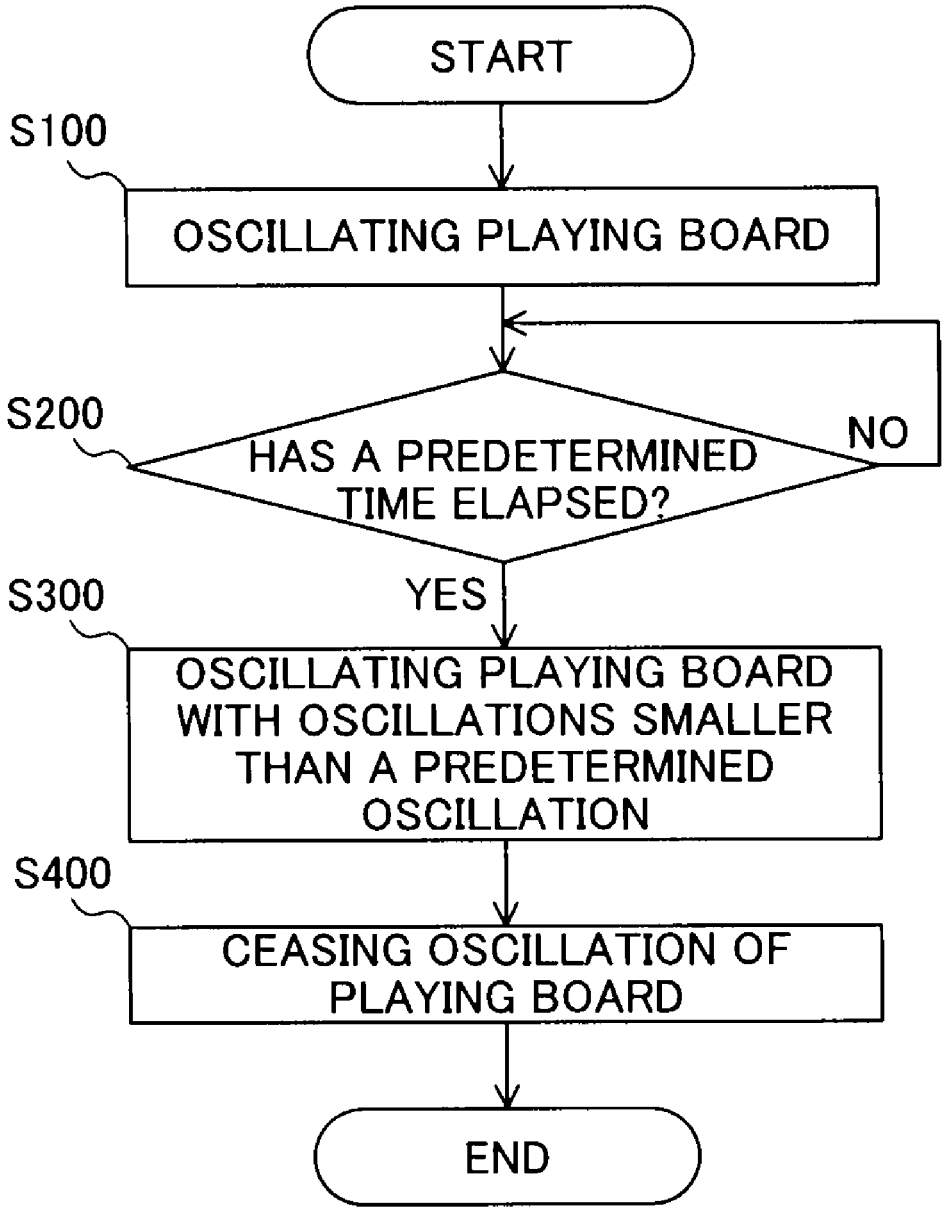
FIG. 1D is a flowchart schematically showing a processing sequence of a gaming machine according to an embodiment of the present invention.

Although described later in detail, as shown in FIG. 1D, when a unit game is started, the CPU 81 performs controls that causes the playing unit to oscillate for a predetermined time with a combination of oscillations larger than a predetermined oscillation and oscillations smaller than the predetermined oscillation (Step S100), after the elapse of the predetermined time (Step S200), performs controls that causes the playing unit to oscillate with oscillations smaller than the predetermined oscillation (Step S300), and performs control that ceases the oscillation of the playing unit (Step S400).

Figure 2D:
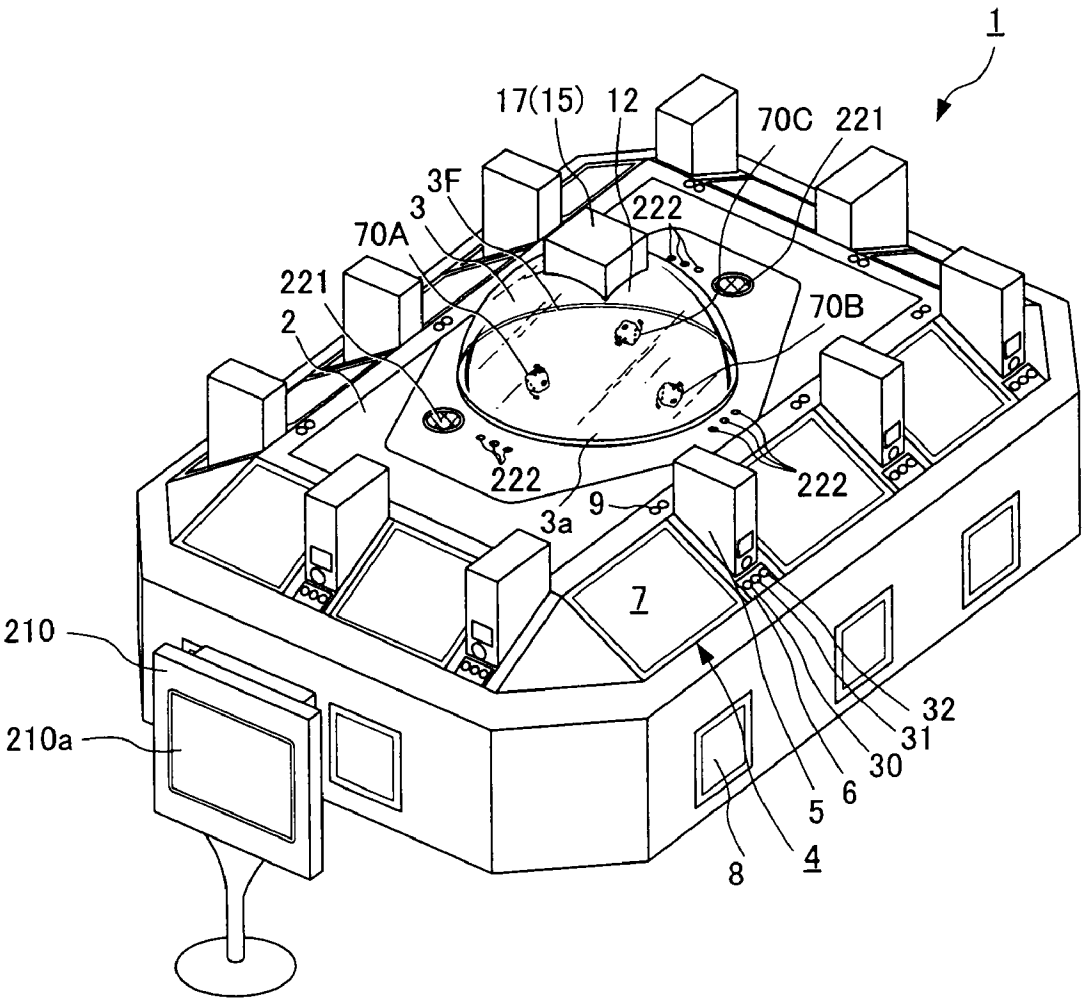
FIG. 2D is a perspective view of a gaming machine according to the embodiment of the present invention.
Figure 3D:
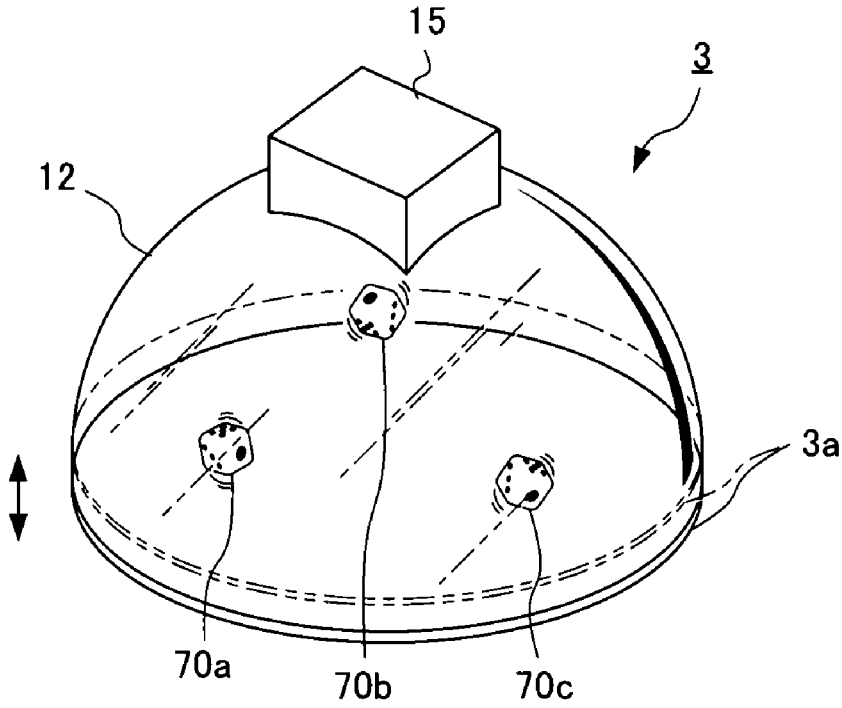
FIG. 3D is an enlarged view of a playing unit of the gaming machine shown in FIG. 2D.

FIG. 2D is a perspective view schematically showing an example of a gaming machine according to the embodiment of this invention. FIG. 3D is an enlarged view of a playing unit of the gaming machine shown in FIG. 2D. As shown in FIG. 2D, a gaming machine 1 according to the present embodiment includes a housing 2 as a main body portion, a playing unit 3 that is provided substantially at the center of the top face of the housing 2 and in which a plurality of dice 70 are rolled and stopped, a plurality of stations 4 disposed so as to surround the playing unit 3, and a dealer used display 210 that is positioned so as not to be visually recognizable by a player seated at each station 4. The station 4 includes an image display unit 7. The player seated at each station 4 can participate in a game by predicting numbers of dots on the dice 70 and performing a normal bet input and a side bet input.

The gaming machine 1 includes a housing 2 as a main body portion, a playing unit 3 that is provided substantially at the center of the top face of the housing 2 and in which a plurality of dice 70 are rolled and stopped, and a plurality of stations 4 (ten in this embodiment) disposed so as to surround the playing unit 3.

The station 4 include a game media receiving device 5 into which game media such as medals to be used for playing the game are inserted, a control unit 6, which is configured with multiple control buttons by which a player enters predetermined instructions, and an image display unit 7, which displays images relating to a bet table. The player may participate in a game by operating the control unit 6 or the like while viewing the image displayed on the image display unit 7.

A payout opening 8, from which a player's game media are paid out, are provided on the sides of the housing 2 on which each station 4 is provided. In addition, a speaker 9, which can output sound, is disposed on the upper right of the image display unit 7 on each of the stations 4.

A control unit 6 is provided on the side part of the image display unit 7 on each of the stations 4. As viewed from a position facing the station 4, in order from the left side are provided a select button 30, a payout (cash-out) button 31, and a help button 32.

The select button 30 is a button that is pressed when confirming a bet operation after the bet operation is complete. Furthermore, in a case other than the bet operation, the button is pressed when a player confirms an input performed.

The payout button 31 is a button which is usually pressed at the end of a game, and when the payout button 31 is pressed, game media corresponding to credits that the player has acquired is paid out from the payout opening 8.

The help button 32 is a button that is pressed in a case where a method of operating the game is unclear, and upon the help button 32 being pressed, a help screen showing various kinds of operation information is displayed immediately thereafter on the image display unit 7.

The playing unit 3 is configured so as to allow a plurality of dice to roll and stop. The present embodiment is configured to use three dice 70 (dice 70*a*, 70*b*, and 70*c*) at the playing unit 3.

A speaker 221 and a lamp 222 are disposed around the playing unit 3. The speaker 221 performs rendered effects by outputting sounds while the dice 70 are being rolled. The lamp 222 performs rendered effects by emitting lights while the dice 70 are being rolled.

The playing unit 3 includes a playing board 3*a*, which is formed to be a circular shape, to roll and then stop the dice 70. An IC tag reader 16, which is described later in FIGS. 6D to 9D, are provided below the playing board 3*a*.

Since the playing board 3*a* is formed to be substantially planar, as shown in FIG. 3D, the dice 70 are rolled by oscillating the playing board 3*a* substantially in the vertical direction with respect to the horizontal direction of the playing board 3*a*. Then, the dice 70 are stopped after the oscillation of the playing board 3*a* ceases. The playing board 3*a* is oscillated by a CPU 81 (described later) driving an oscillating motor 300.

Furthermore, as shown in FIG. 3D, the playing unit 3 is covered with a cover member 12 of which the entire upper area is made of a transparent acrylic material formed in a hemispherical shape, and regulates the rolling area of the dice 70. In the present embodiment, an infrared camera 15 is provided at the top of the cover member 12 to detect numbers of dots and the like (such as positions of the dice 70 on the playing board 3*a*, types of the dice 70, and numbers of dots of the dice 70) of the dice 70. Furthermore, the cover member 12 is covered with a special film (not shown) which blocks infrared radiation. In this way when the numbers of dots of the dice 70 on which an infrared absorption ink has been applied is detected with the infrared camera 15, false detection can be prevented that arises, for example, in a case where a blink rate of a light irradiated from a circumference of the playing unit 3 is fast.

FIG. 4D is an external perspective view of a die 70. As shown in FIG. 4D, the die 70 is a cube of which the length of a side is 100 mm.

Figure 5D:
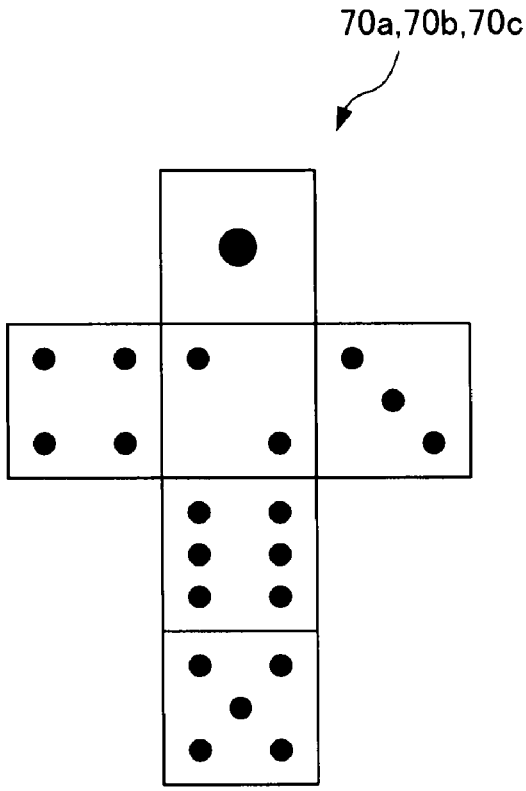
FIG. 5D is a development view of a die according to the embodiment of the present invention.

FIG. 5D is a development view of the die 70. As shown in FIG.5D, the combinations of two faces opposing each other are "1 and 6", "2 and 5", and "3 and 4".

FIGS. 6D to 9D show IC tag readable areas by an IC tag reader 16 disposed below the playing board 3*a*.

Here, a way of reading information stored in the IC tag by the IC tag reader 16 is described below.

The IC tag reader 16 is a non-contact type IC tag reader. For example, it is possible to read information stored in the IC tag by RFID (Radio Frequency Identification). The RFID system performs near field communication that reads and writes data stored in semi-conductor devices by an induction field or radio waves in a non-contact manner. In addition, since this technology is known conventionally and is described in Japanese Unexamined Patent Application Publication No. H8-21875, an explanation thereof is abbreviated.

In the present embodiment, a plurality of IC tags is read by a single IC tag reader 16. Under the abovementioned RFID system, an anti-collision function can be employed which can read a plurality of IC tags by a single reader. The anti-collision function includes FIFO (first in first out) type, multi-access type, and selective type, and communicates with a plurality of the IC tags sequentially. The FIFO type is a mode to communicate with a plurality of the IC tags sequentially in the order that each IC tag enters an area in which an antenna can communicate therewith. The multi-access type is a mode that is able to communicate with all the IC tags, even if there is a plurality of the IC tags simultaneously in the area in which an antenna can communicate with the IC tags. The selective type is a mode that is able to communicate with a specific IC tag among a plurality of the IC tags in the area in which an antenna can communicate therewith. By employing the abovementioned modes, it is possible to read a plurality of the IC tags with a single IC tag reader. In addition, reading the IC tags may not only be done by the non-contact type, but also a contact type. In addition, the IC tag reader is not limited thereto, and anything that is appropriately designed with the object of being read may be employed.

In the present embodiment, a readable area of the IC tag reader 16 is 10 mm in substantially a vertical direction from substantially an entire horizontal face on the playing board 3*a*.

Figure 6D:
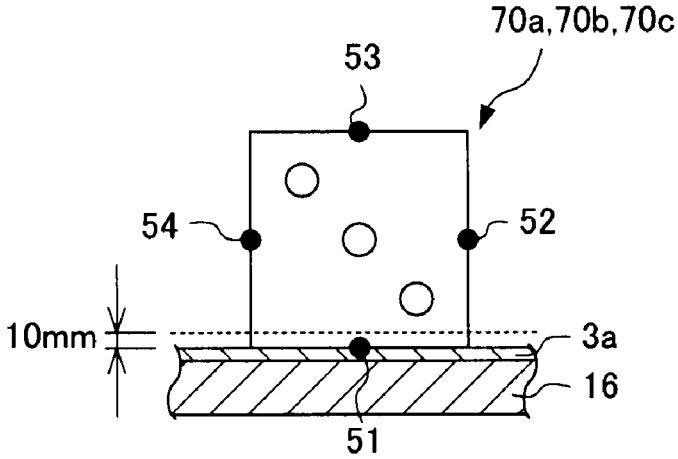

With reference to FIG. 6D, a face of the die 70 (for example, a face of which the number of dots is six) is in contact with the playing board 3*a*. Furthermore, the IC tag is embedded substantially at the center of each face of the die 70 (the IC tags for the faces on which the numbers of dots are "3" and "4" are not shown). An IC tag 51 is embedded substantially at the center of a face on which the number of dots is six. An IC tag 52 is embedded substantially at the center of a face on which the number of dots are five. An IC tag 53 is embedded substantially at the center of a face on which the number of dots is one. An IC tag 54 is embedded substantially at the center of a face on which the number of dots is two.

Here, only the IC tag 51 exists in the readable area of the IC tag reader 16. Therefore, the number of dots (in this case, "one") of a face, opposing the face on which the IC tag 51 is embedded, is determined as the number of dots of the die 70.

Furthermore, since the number of dots of a face, opposing a face on which an IC tag is embedded, is determined as the number of dots of the die 70, "one" is stored, as data of the number of dots, in the IC tag 51 on the face of which the number of dots is "six". "Two" is stored, as data of the number of dots, in the IC tag 52 on the face of which the number of dots is "five". "Six" is stored, as data of the number of dots, in the IC tag 53 on the face of which the number of dots is "one". "Five" is stored, as data of the number of dots, in the IC tag 54 on the face of which the number of dots is "two". "Three" is stored, as data of the number of dots, in the IC tag (not shown) on the face of which the number of dots is "four". Finally, "four" is stored, as data of the number of dots, in the IC tag (not shown) on the face of which the number of dots is "three".

Furthermore, as described above, since a side of the die 70 is 10 mm, it is not physically possible for an IC tag reader 16 to detect more than one IC tag with respect to one die.

Figure 7D:
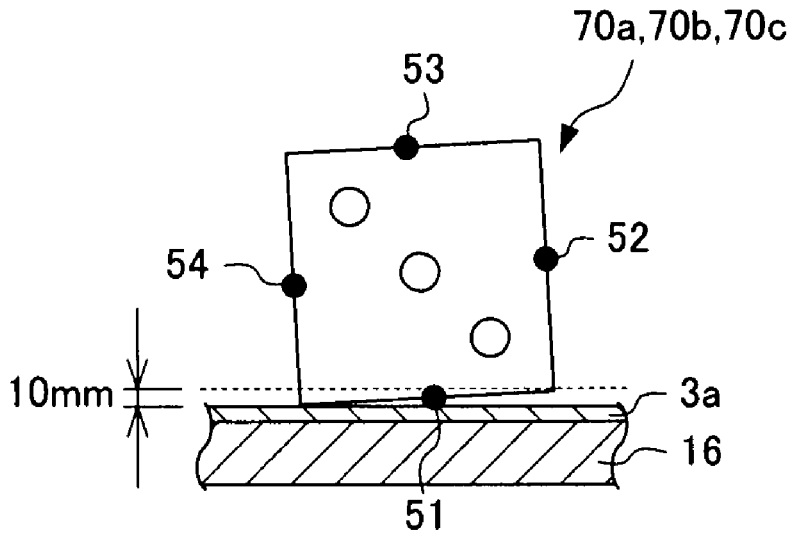

With reference to FIG. 7D, a die 70 is inclined. However, since the IC tag 51 still exists in the readable area of the IC tag reader 16, the number of dots of the die 70 is determined as "one".

With respect to FIG. 8D, the die 70 is inclined at a greater angle than the case shown in FIG. 7D. Then, since there is no IC tag which exists in the readable area of the IC tag reader 16, the IC tag reader 16 cannot detect the number of dots of the die 70.

Figure 9D:
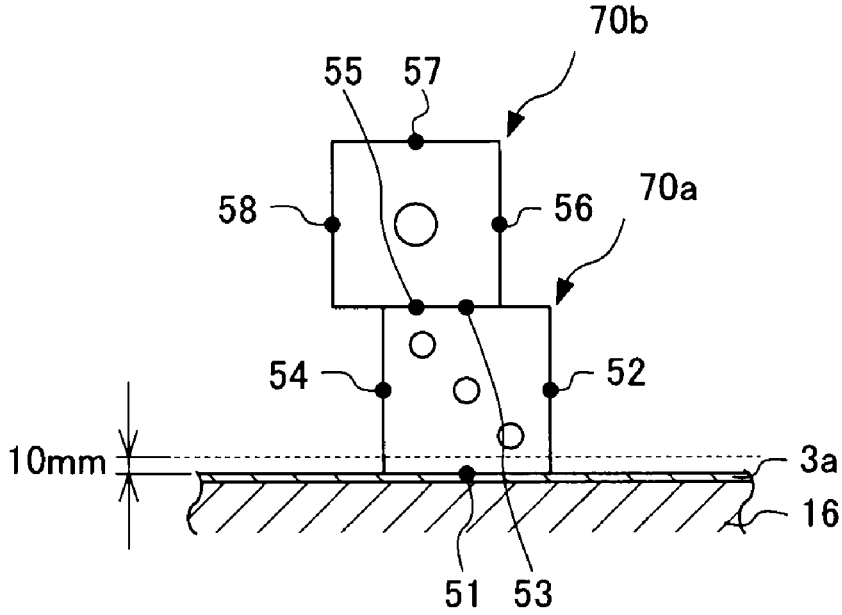

With reference to FIG. 9D, the die 70*b* is superimposed on the die 70*a*. In this case, neither of the IC tags 55, 56, 57, and 58, which are embedded in the die 70*b*, exists in the readable area of the IC tag reader 16. Therefore, in this case, the IC tag reader 16 cannot detect the number of dots of the die 70*b*.

Figure 10D:
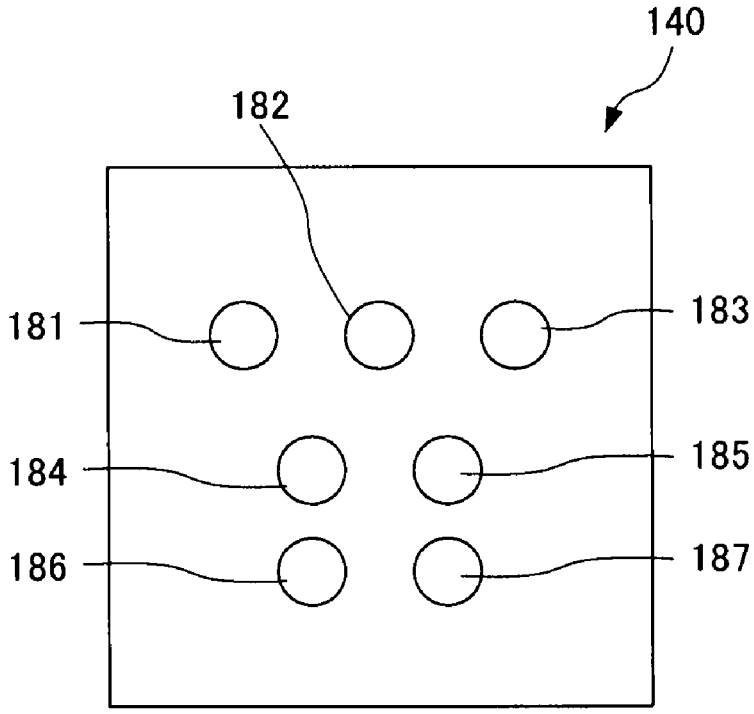
FIG. 10D shows a sheet attached to each face of a die according the embodiment of the present invention.

FIG. 10D shows a sheet 140 attached to each face of the die 70.

As shown in FIG. 10D, on each face of the die 70, the sheet 140, to which infrared absorption ink is applied to identify the number of dots and the type of the die 70, is provided so as to be covered by a sheet on which the number of dots is printed. According to FIG. 10D, the infrared absorption ink can be applied to dots 181, 182, 183, 184, 185, 186, and 187.

The number of dots of the die 70 can be identified by a combination of the dots to which the infrared absorption ink is applied among the dots 184, 185, 186, and 187. In addition, the type of the die 70 can be identified by a combination of the dots to which the infrared absorption ink is applied among the dots 181, 182, and 183.

Figure 11D:
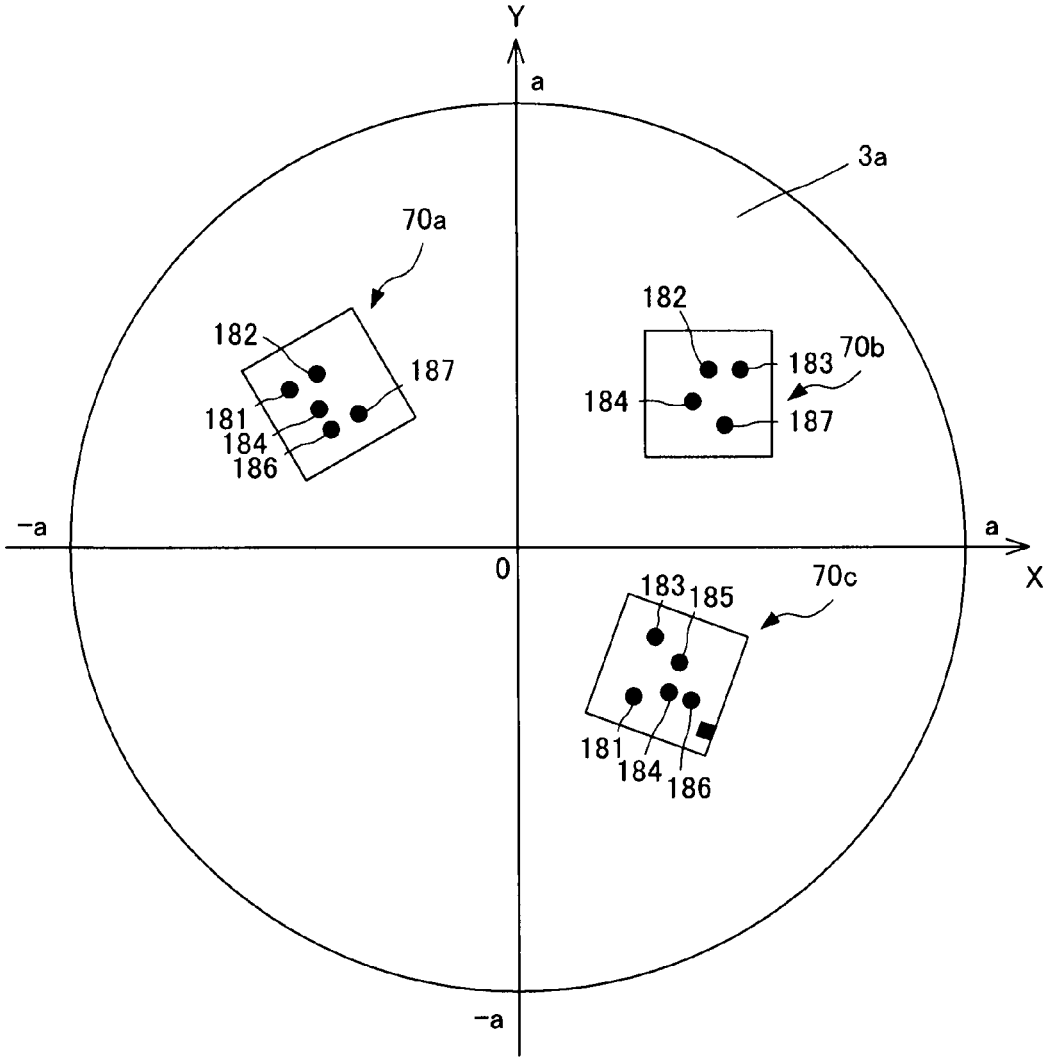
FIG. 11D is an image showing a state in which a die according to the embodiment of the present invention is captured substantially in the vertically upward direction by an infrared camera.

FIG. 11D shows an image in which the dice 70, which comes to rest on the playing board 3*a*, are captured substantially in the vertically upward direction using an infrared camera 15.

With reference to FIG. 11D, dots to which the infrared absorption ink is applied on each of the dice 70*a*, 70*b*, and 70*c* are captured in black. The type and the number of dots for each of the dice 70*a*, 70*b*, and 70*c* are determined based on a combination of the dots to which the ink is applied. In addition, the playing board 3*a* is formed in a disc shape having a radius a, and each position of the dice 70*a*, 70*b*, and 70*c* is detected as an x component and y component on an x-y coordinate.

Figure 12D:
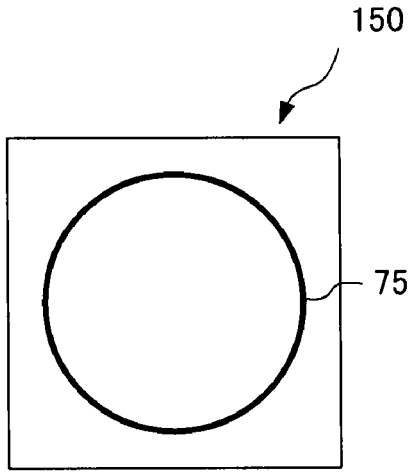
FIG. 12D shows a sheet attached to each face of a die according the embodiment of the present invention.

FIG. 12D shows a sheet 150 which is attached to each face of the dice 70.

As shown in FIG. 12D, a circular profile 75 having a certain area on each face of the dice 70 in common is depicted by way of applying the infrared absorption ink on each face of the dice 70. The sheet 150 on which the circular profile 75 is depicted is provided so as to be covered by the abovementioned sheet 140.

Figure 13D:
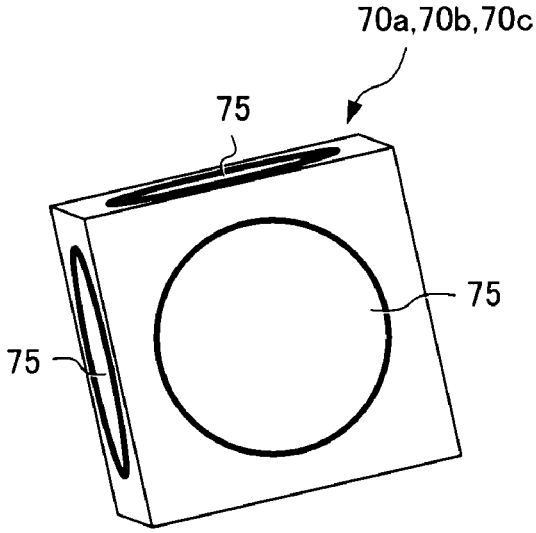
FIG. 13D shows an image in which a die according to the embodiment of the present invention that has come to rest at a tilt on a playing board, is captured substantially in the vertically upward direction by an infrared camera.

FIG. 13D shows an image in which the die 70, which comes to rest at a tilt on a playing board 3*a*, is captured substantially in the vertically upward direction using the infrared camera 15.

With reference to FIG. 13D, three faces of the die 70 are captured. Therefore, it is necessary to distinguish the number of dots of which face is correct. Consequently, the number of dots having the largest area among the three faces is determined as the face that should be read. In a case of this distinction, the CPU (not shown) in the infrared camera 15 calculates the areas of the circular profiles 75 thus captured, and distinguishes the number of dots of the face on which the circular profile 75 having the largest area among the areas thus calculated is printed as the correct number of dots.

Figure 14D:
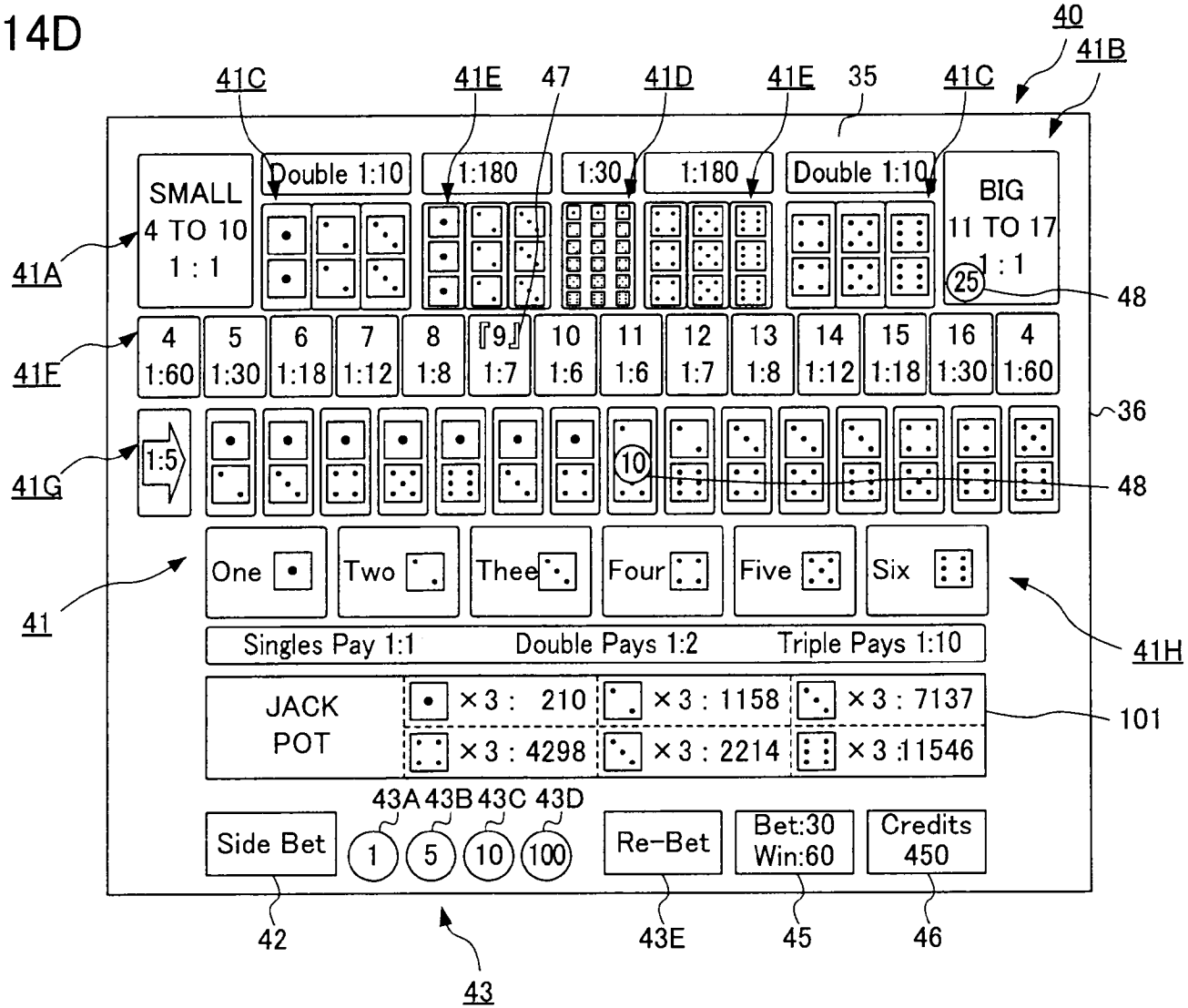
FIG. 14D shows an example of a display screen according to the embodiment of the present invention.

FIG. 14D shows an example of a display screen displayed on an image display unit. As shown in FIG. 14D, an image display unit 7 is a touch-panel type of liquid crystal display, on the front surface of which a touch panel 35 is attached, allowing a player to perform selection such as of icons displayed on a liquid crystal screen 36 by contacting the touch panel 35, e.g., with a finger.

A table-type betting board (a bet screen) 40 for predicting the number of dots of the dice 70 is displayed in a game at a predetermined timing on the image display unit 7.

A detailed description is now provided regarding the bet screen 40. On the bet screen 40 are displayed a plurality of normal bet areas 41 and a side bet area 42. The plurality of normal bet areas 41 includes a normal bet area 41A, a normal bet area 41B, a normal bet area 41C, a normal bet area 41D, a normal bet area 41E, a normal bet area 41F, a normal bet area 41G, and a normal bet area 41H. By contacting the touch panel 35, e.g., with a finger, the normal bet area 41 is designated, and by displaying chips in the normal bet area 41 thus designated, a normal bet operation is performed. Furthermore, by contacting the touch panel 35, e.g., with a finger, the side bet area 42 is designated, and by displaying chips in the side bet area 42 thus designated, a side bet operation is performed.

A unit bet button 43, a re-bet button 43E, a payout result display unit 45, and a credit amount display unit 46 are displayed at the right side of the side bet area 42 in order from the left side.

The unit bet button unit 43 is a group of buttons that are used by a player to bet chips on the normal bet area 41 and the side bet area 42 designated by the player. The unit bet button unit 43 is configured with four types of buttons including a 1 bet button 43A, a 5 bet button 43B, a 10 bet button 43C, and a 100 bet button 43D. It should be noted that in the case of an incorrect bet operation, the player can start a bet operation again by touching a re-bet button 43E.

Firstly, the player designates the normal bet area 41 or the side bet area 42 using a cursor 47 by way of contacting the touch panel 35, e.g., with a finger. At this time, contacting the 1 bet button 43A, e.g., with a finger, allows for betting one chip at a time (number of chips to be bet increases one by one in the order of 1, 2, 3, every time the 1 bet button 43A is contacted, e.g., by a finger). Similarly, when contacting the 5 bet button 43B, e.g., with a finger, five chips at a time can be bet (number of chips to be bet increases five by five in the order of 5, 10, 15, every time the 5 bet button 43B is contacted, e.g., by a finger). Similarly, when contacting the 10 bet button 43C, e.g., with a finger, ten chips at a time can be bet (number of chips to be bet increases ten by ten in the order of 10, 20, 30, every time the 10 bet button 43C is contacted, e.g., by a finger). Similarly, when contacting the 100 bet button 43D, e.g., with a finger, a hundred chips at a time can be bet (number of chips to be bet increases hundred by hundred in the order of 100, 200, 300, . . . every time the 100 bet button 43D is contacted, e.g. by a finger). The number of chips bet up to the current time is displayed as a chip mark 48, and the number displayed on the chip mark 48 indicates the number of bet chips.

The number of bet chips and payout credit amount for a player in a previous game are displayed in the payout result display unit 45. The number calculated by subtracting the number of bet chips from the payout credit amount is a newly acquired credit amount for the player in the previous game.

The credit amount display unit 46 displays the credit amount which the player possesses. The credit amount decreases according to the number of bet chips (1 credit amount for 1 chip) when the player bets chips. If the bet chips are entitled to an award and credits are paid out, the credit amount increases in accordance with the number of paid out chips. It should be noted that the game is over when the player's credit amount becomes zero.

The normal bet area 41 in the bet screen 40 is described next. The normal bet areas 41A and 41B are portions where the player places a bet on a predicted sum of dots to appear on the dice 70A to 70C. In other words, the player selects the normal bet area 41A if the predicted sum falls in a range of 4 to 10, or the normal bet area 41B if the predicted sum falls in a range of 11 to 17. Odds are set to 1:1 (2 chips are paid out for 1 chip bet).

The normal bet area 41C is a portion where the player places a bet, predicting that two dice 70 have the same number of dots. In other words, the player wins an award if one of the combinations occurs, such as (1, 1), (2, 2), (3, 3), (4, 4), (5, 5), and (6, 6), and the odds are set to 1:10.

The normal bet area 41D is a portion where the player places a bet, predicting that all three dice have the same number of dots. In other words, the player wins an award if one of the combinations occurs, such as (1, 1, 1), (2, 2, 2), (3, 3, 3), (4, 4, 4), (5, 5, 5), and (6, 6, 6), and the odds are set to 1:30.

The bet area 41E is a portion where the player places a bet on a predicted number of dots to appear commonly on all three dice. In other words, the player places a bet on one of the combinations of (1, 1, 1), (2, 2, 2), (3, 3, 3), (4, 4, 4), (5, 5, 5), or (6, 6, 6), and the odds are set to 1:180.

The normal bet area 41F is where the player places a bet, predicting a total, a summation of dots to appear on the three dice. Odds are set according to the occurrence frequency of the total. For example, if the total is 4 or 17, odds are set to 1:60; if the total is 5 or 16, odds are set to 1:30; if the total is 6 or 15, odds are set to 1:18; if the total is 7 or 14, odds are set to 1:12; if the total is 8 or 13, odds are set to 1:8; if the total is 9 or 12, odds are set to 1:7; and if the total is 10 or 11, odds are set to 1:6.

The bet area 41G is a portion where the player places a bet on predicted dots to appear on the two dice selected from the three, and the odds are set to 1:5.

The normal bet area 41H is a region where the player places a bet on the number of dots to appear on the dice 70, and the odds are set according to the number of dots of the dice 70 matching the predicted number of dots.

Figure 15D:
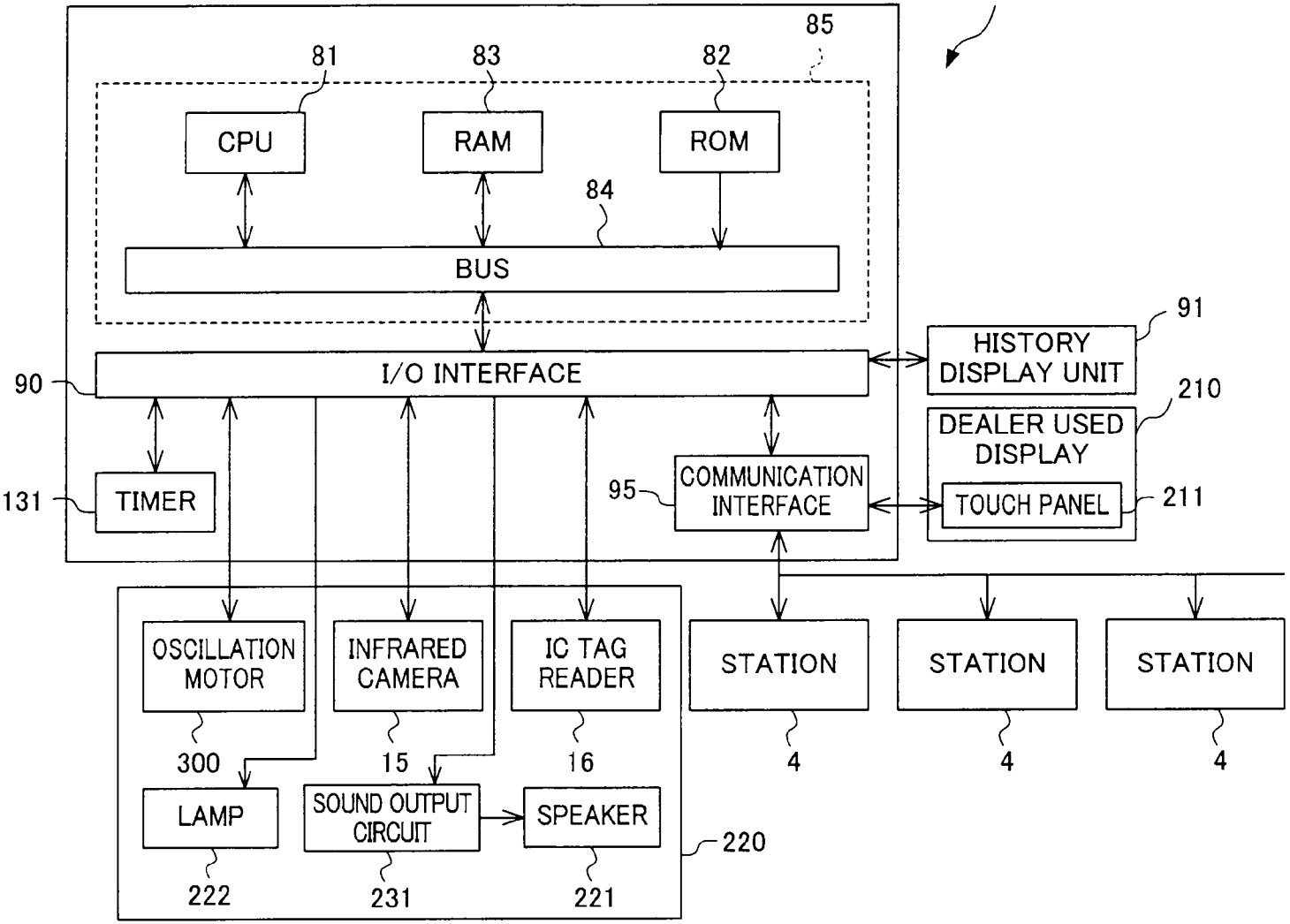
FIG. 15D is a block diagram showing the internal configuration of the gaming machine shown in FIG. 2D.

FIG. 15D is a block diagram showing the internal configuration of the gaming machine shown in FIG. 2D. A main control unit 80 of the gaming machine 1 includes a microcomputer 85, which is configured with a CPU 81, ROM 82, RAM 83, and a bus 84 that transfers data therebetween.

The CPU 81 is connected with an oscillating motor 300 via an I/O interface 90. Furthermore, the CPU 81 is connected with a timer 131, which can measure time via the I/O interface 90. In addition, the CPU 81 is connected with a lamp 222 via the I/O interface 90. The lamp 222 emits various colors of light for performing various types of rendered effects, based on output signals from the CPU 81. Furthermore, the CPU 81 is connected with a speaker 221 via the I/O interface 90 and a sound output circuit 231. The speaker 221 emits various sound effects for performing various types of rendered effects, based on output signals from the sound output circuit 231. Furthermore, the I/O interface 90 is connected with the abovementioned infrared camera 15 and/or the IC tag reader 16, thereby transmitting and receiving information in relation to the number of dots of the three dice 70, which comes to rest on the playing board 3*a*, between the infrared camera 15 and/or the IC tag reader 16.

Here, the oscillating motor 300, the infrared camera 15, the IC tag reader 16, the lamp 222, the sound output circuit 231, and the speaker 221 are provided within a single composite unit 220.

In addition, via a communication interface 95 connected to the I/O interface 90, the main control unit 80 transmits and receives data such as bet information, payout information, and the like to and from each station 4, as well as data such as bet start instruction images, bet start instruction signals, and the like to and from the dealer used display 210.

Furthermore, the I/O interface 90 is connected with a history display unit 91, and the main control unit 80 transmits and receives information in relation to the number of dots on the die, to and from the history display unit 90.

ROM 82 in the main control unit 80 is configured to store a program for implementing basic functions of the gaming machine 1; more specifically, a program for controlling various devices which drive the playing unit 3, a program for controlling each station 4, and the like, as well as a payout table, data indicating a predetermined time T, data indicating a specific value TT, and the like.

RAM 83 is memory, which temporarily stores various types of data calculated by CPU 81, and, for example, temporarily stores data bet information transmitted from each station 4, information on respective number of dots that appear on the dice 70 transmitted from the infrared camera 15 and/or the IC tag reader 16, data relating to the results of processing executed by CPU 81, and the like. A jackpot storage area is provided in the RAM 83. In the jackpot storage area, the data indicating the number of playing media stored cumulatively is stored so as to correspond to each number of dots of matching dice. The data is provided to the station 4 at a predetermined timing, and a jackpot image is displayed.

The CPU 81 controls the oscillating motor 300, which oscillates the playing unit 3, based on data and a program stored in the ROM 82 and the RAM 83, and oscillates the playing board 3*a* of the playing unit 3. Furthermore, after oscillation of the playing board 3*a* ceases, a control processing associated with game progression, such as confirmation processing for confirming the number of dots on each of the dice 70 resting on the playing board 3*a*.

In addition to the control processing described above, the CPU 81 has a function of executing a game by transmitting and receiving data to and from each station 4 so as to control each station 4. More specifically, the CPU 81 accepts bet information transmitted from each station 4. Furthermore, the CPU 81 performs win determination processing based on the number of dots on the dice 70 and the bet information transmitted from each station 4, and calculates the amount of an award paid out in each station 4 with reference to the payout table stored in the ROM 82.

Figure 16D:
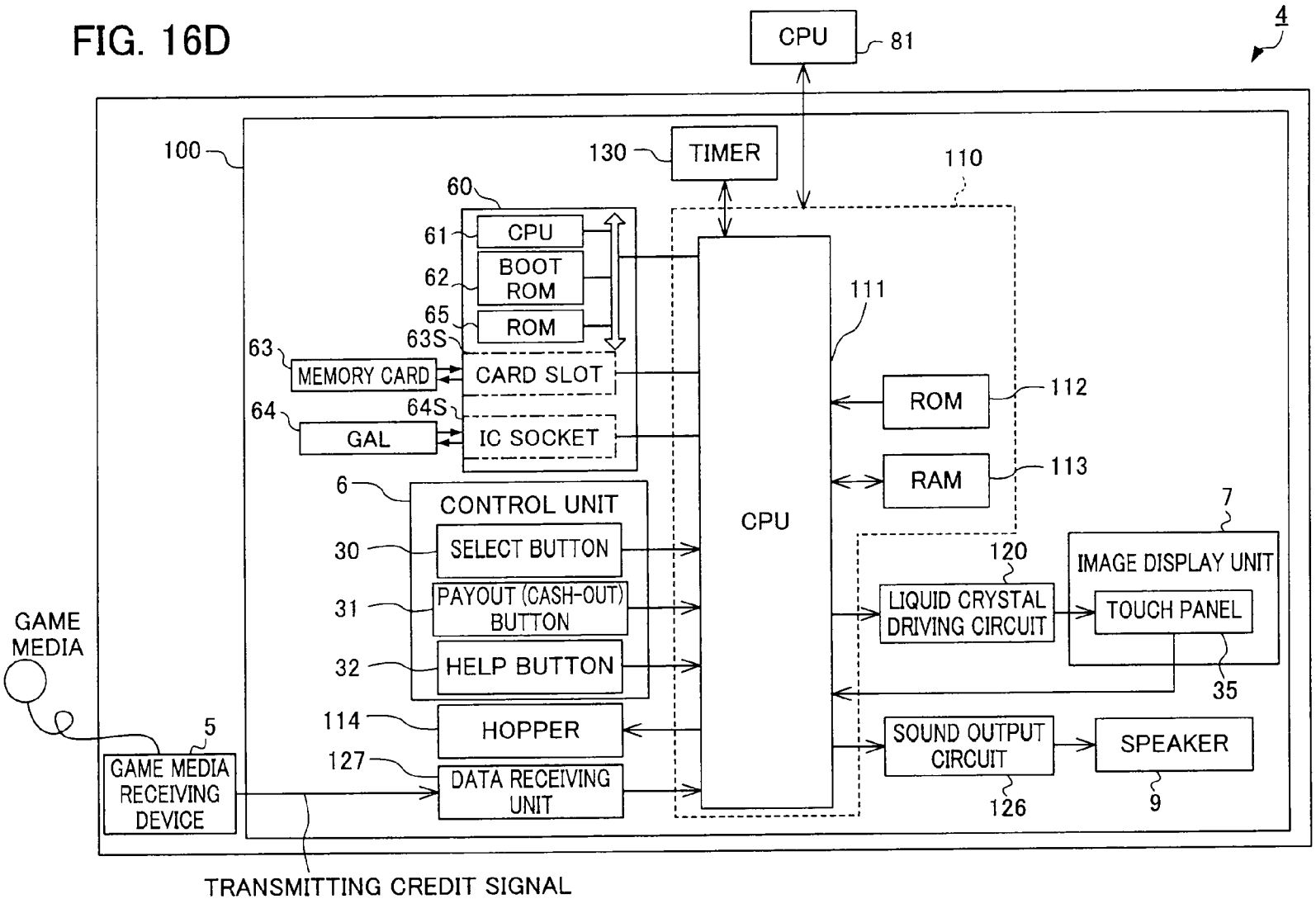
FIG. 16D is a block diagram showing the internal configuration of the station shown in FIG. 2D.

FIG. 16D is a block diagram showing the internal configuration of the station shown in FIG. 2D. The station 4 includes a main body 100 in which an image display unit 7 and the like are provided, and a game media receiving device 5, which is attached to the main body 100. The main body 100 further includes a station control unit 110 and several peripheral devices.

The station control unit 110 includes a CPU 111, ROM 112, and RAM 113.

ROM 112 stores a program for implementing basic functions of the station 4, other various programs needed to control the station 4, a data table, and the like.

Moreover, a decision button 30, a payout button 31, and a help button 32 provided in the control unit 6 are connected to the CPU 111, respectively. The CPU 111 controls the execution of various corresponding operations in accordance with manipulation signals, which are generated in response to each button pressed by a player. More specifically, the CPU 111 executes various processing, based on input signals transmitted from the control unit 6 in response to a player's operation which has been inputted, and the data and programs stored in the ROM 112 and RAM 113. Subsequently, the CPU 111 transmits the results to the CPU 81 in the main control unit 80.

In addition, the CPU 111 in the main control unit 80 receives instruction signals from the CPU 81, and controls peripheral devices which configure the station 4. The CPU 111 performs various kinds of processing based upon the input signals supplied from the control unit 6 and the touch panel 35, and the data and the programs stored in the ROM 112 and the RAM 113. Then, the CPU 111 controls the peripheral devices which configure the station 4 based on the results of the processing. It should be noted that the mode whereby processing is performed is set for each processing depending on the content of the processing. For example, the former approach is applied to payout processing of game media for respective numbers of dots to appear on the dice, and the latter approach is applied to bet operation processing by a player.

Furthermore, a hopper 114, which is connected to the CPU 111, pays out a predetermined amount of game media through the payout opening 8, receiving the instruction signals from the CPU 111.

Moreover, the image display unit 7 is connected to the CPU 111 via a liquid crystal driving circuit 120. The liquid crystal driving circuit 120 includes program ROM, image ROM, an image control CPU, work RAM, a video display processor (VDP), video RAM, and the like. Here, the program ROM stores an image control program with respect to the display functions of the image display unit 7, and various kinds of selection tables. The image ROM stores dot data for creating an image to be displayed on the image display unit 7, and dot data for displaying a jackpot image, for example. In addition, the image control CPU determines an image to be displayed on the image display unit 7, selected from the dot data previously stored in the image ROM according to the image control program previously stored in the program ROM based on parameters specified by the CPU 111. The work RAM is configured as a temporary storage means when executing the image control program by the image control CPU. The VDP forms an image corresponding to the display contents determined by the image control CPU and outputs the resulting image on the image display unit 7. It should be noted that the video RAM is configured as a temporary storage device used by the VDP for creating an image.

As mentioned above, the touch panel 35 is attached to the front side of the image display unit 7, and the information related to operation on the touch panel 35 is transmitted to the CPU 111. The touch panel 35 detects an input operation by the player on a bet screen 40 and the like. More specifically, selection of the normal bet area 41 and the side bet area 42 in the bet screen 40, manipulation of the bet button unit 43 and the like, are performed by touching the touch panel 35, and the information thereof is transmitted to the CPU 111. Then, a player's bet information is stored in the RAM 113 based on the information stored. Furthermore, the bet information is transmitted to the CPU 81 in the main control unit 80, and stored in a bet information storage area in the RAM 83.

Moreover, a sound output circuit 126 and a speaker 9 are connected to the CPU 111. The speaker 9 emits various sound effects for performing various kinds of rendered effects, based on output signals from the sound output circuit 126. In addition, the game media receiving device 5, into which game media such as coins or medals are inserted, is connected to the CPU 111 via a data receiving unit 127. The data receiving unit 127 receives credit signals transmitted from the game media receiving device 5, and the CPU 111 increases a player's credit amount stored in the RAM 113 based on the credit signals transmitted.

A timer 130, which can measure time, is connected to the CPU 111.

A gaming board 60 includes a CPU (Central Processing Unit) 61, ROM 65 and boot ROM 62, a card slot 63S compatible with a memory card 63, and an IC socket 64S compatible with a GAL (Generic Array Logic) 64, which are connected to one another via an internal bus.

The memory card 63 comprises nonvolatile memory such as compact flash (trademark) or the like, which stores a game program and a game system program.

Furthermore, the card slot 63S has a configuration that allows the memory card 63 to be detachably inserted, and is connected to the CPU 111 via an IDE bus. Such an arrangement allows the kinds or content of the game provided by the station 4 to be changed by performing the following operation. More specifically, the memory card 63 is first extracted from the card slot 63S, and another game program and another game system program are written to the memory card 63. Then, the memory card 63 thus rewritten is inserted into the card slot 63S. In addition, the kinds or content of the games provided by the station 4 can be changed by replacing the memory card 63 storing a game program and a game system program with another memory card 63 storing another game program and game system program. The game program includes a program for advancing a game and the like. The game program also includes a program related to image data and sound data outputted during a game.

The GAL 64 is one type of PLD that has a fixed OR array structure. The GAL 64 includes multiple input ports and output ports and, upon receiving predetermined data via each input port, outputs output data that corresponds to the input data via the corresponding output port. In addition, an IC socket 64S has a structure that allows the GAL 64 to be detachably mounted, and is connected to the CPU 111 via the PCI bus.

The CPU 61, the ROM 65, and the boot ROM 62, which are connected to one another via the internal bus, are connected to the CPU 111 via the PCI bus. The PCI bus performs signal transmission between the CPU 111 and the gaming board 60, as well as supplying electric power from the CPU 111 to the gaming board 60. The ROM 65 stores country identification information and an authentication program. The boot ROM 62 stores a preliminary authentication program, a program (boot code) which instructs the CPU 61 to start up the preliminary authentication program, etc.

The authentication program is a program (forgery check program) for authenticating the game program and the game system program. The authentication program is defined to follow the procedure (authentication procedure) for confirming and authenticating that the game program and the game system program, which are to be acquired after the authentication, have not been forged, i.e. the procedure for authenticating the game program and the game system program. The preliminary authentication program is a program for authenticating the aforementioned authentication program. The preliminary authentication program is defined to follow the procedure for verifying that the authentication program has not been forged, i.e. the procedure for authenticating the authentication program (authentication procedure).

An instruction image display determination table is described with reference to FIG. 17D.

Figure 31D:
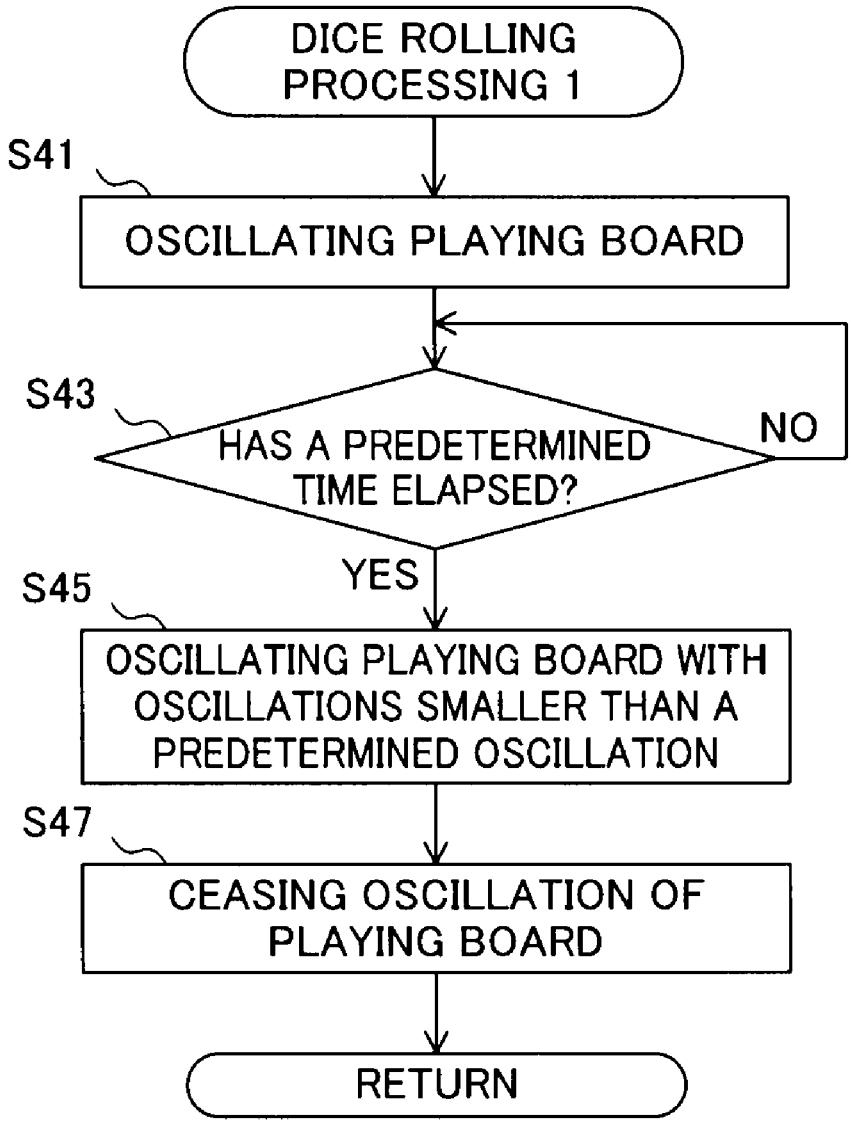
FIG. 31D is a flowchart showing dice rolling processing 1 executed in a gaming machine according to the embodiment of the present invention.

In Steps S11 and S19 of FIG. 31D, the instruction image display determination table is referred to by the CPU 81 upon determining whether a bet start instruction image or a bet end instruction image is displayed on the display screen 210*a* of the dealer used display 210.

According to this table, "X" is data for indicating that the bet start instruction image and the like is not displayed on the display screen 210*a*, and "O" is data for indicating that the bet start instruction image and the like is displayed on the display screen 210*a*. For example, in a case in which a dealer belongs to an intermediate level, the bet start instruction image is not displayed on the display screen 210*a* , but the bet end instruction image is displayed on the display screen 210*a*. In addition, this table is stored in the ROM 82.

The bet existence determination table is described with reference to FIG. 18D.

Figure 30D:
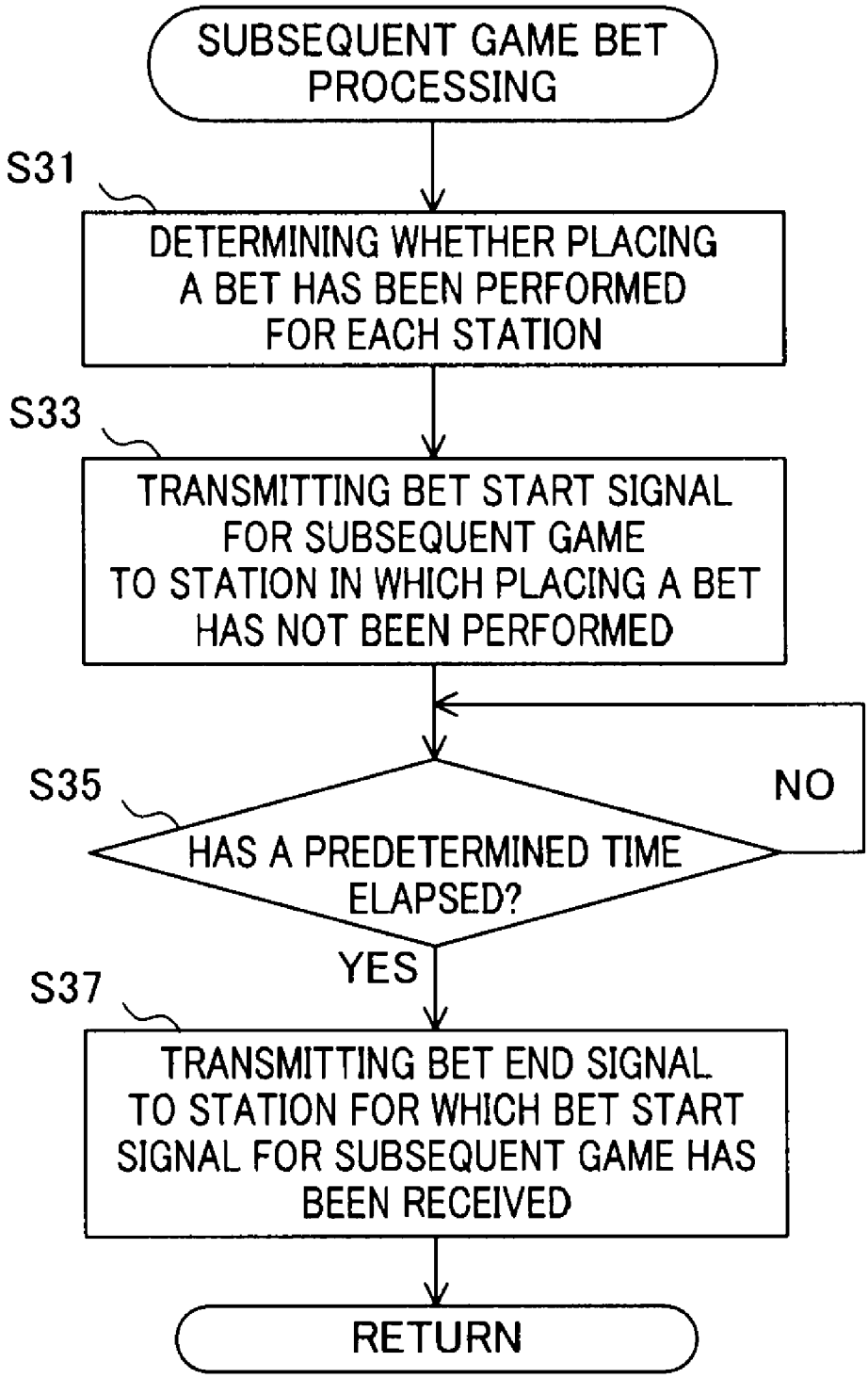
FIG. 30D is a flowchart showing subsequent game bet processing executed in a gaming machine according to the embodiment of the present invention.

The CPU 81 refers to this bet existence determination table upon determining for each station 4 whether a bet operation is performed at each station 4 in Step S31 of FIG. 30D.

Data indicating whether the bet operation has been performed or not at each station number is stored in this table. "P" is data indicating that a bet operation was performed, and "A" is data indicating that a bet operation was not performed. In addition, this table is updated in every game, and stored in the RAM 83.

An IC tag data table is described with reference to FIG. 19D.

The IC tag data table is a table showing data as identification data 1 to 3 which is created by the CPU 81 based on the results of the type of dice and the number of dots on the dice, when information stored in IC tags embedded in the dice 70*a*, 70*b*, and 70*c* is detected by the IC tag reader 16.

According to this table, for example, when an IC tag embedded in each die is detected in the order of 70*c*, 70*a*, and 70*b*, by the IC tag reader 16, the die 70*c* is associated with identification data 1 of which the type is "red" and the number of dots is "six", the die 70*a* is associated with identification data 2 of which the type is "white" and the number of dots is "three", and the die 70*b* is associated with identification data 3 of which the type is "black" and the number of dots is "five".

On the other hand, when three dice are not detected, for example, in a case where only two dice are detected, identification data is created for only 2 sets, identification data 1 and 2.

In addition, the data table is transmitted from the IC tag reader 16 to the CPU 81, and then the CPU 81 receives it to analyze the number of dots on a die and the like.

An infrared camera capturing data table is described with reference to FIG. 20D.

The infrared camera capturing data table is a data table showing dot patterns of the infrared absorption inks applied to the dice 70 and location data of the dice 70 on the playing board 3*a*.

For example, regarding the die 70*a* shown in FIG. 11D, in the infrared camera capturing data table, the CPU (not shown) inside the infrared camera 15 stores −50 for X and 55 for Y as location data, stores "O" for 181, 182, 184, 186, and 187, to which the infrared absorption inks are being applied, and stores "X" for 183 and 185, which are not being applied. The same is true of the dice 70*b* and 70*c*.

On the other hand, as shown in FIG. 13D, in a case where a plurality of faces of the dice 70 is captured, the number of dots cannot be specified uniquely. In this case, the CPU (not shown) inside the infrared camera 15 calculates the area of the profiles 75 on the plurality of faces thus captured, and generates the infrared camera capturing data table based on the dot patterns on the face that has a maximum area.

Therefore, even if the dice 70 come to rest at a tilt and a plurality of faces of the dice 70 is captured, the number of dots can be specified uniquely.

In addition, this data table is transmitted from the infrared camera 15 to the CPU 81, and then the CPU 81 receives it to analyze the number of dots on a die and the like.

A dot pattern data classification table is described with reference to FIG. 21D.

According to this table, colors as the classification for the dice 70 are set so as to correspond to dot combinations to which the infrared absorption ink is applied, among the abovementioned dots 181 to 183 in FIG. 10D. "O" indicates that the infrared absorption ink is applied to the dot, and "X" indicates that the infrared absorption ink is not applied to the dot.

For example, in a case where the infrared camera capturing data table described in FIG. 20D is transmitted to the CPU 81, the CPU 81 determines the classification of the dice 70 as "red" by comparing the infrared camera capturing data table with the dot pattern data classification table.

A number of dots-dot pattern data table is described with reference to FIG. 22D.

According to this table, numbers as the number of dots on the dice 70 are set so as to correspond to dot combinations to which the infrared absorption ink is applied, among the abovementioned dots 184 to 187 in FIG. 10D. "O" indicates that the infrared absorption ink is applied to the dot, and "X" indicates that the infrared absorption ink is not applied to the dot.

For example, in a case where the infrared camera capturing data table shown in FIG. 20D is transmitted from the infrared camera 15 to the CPU 81, the CPU 81 determines the number of dots on the dice 70 as "five" by comparing the infrared camera capturing data table thus received with the dot pattern data classification table.

Figure 23D:
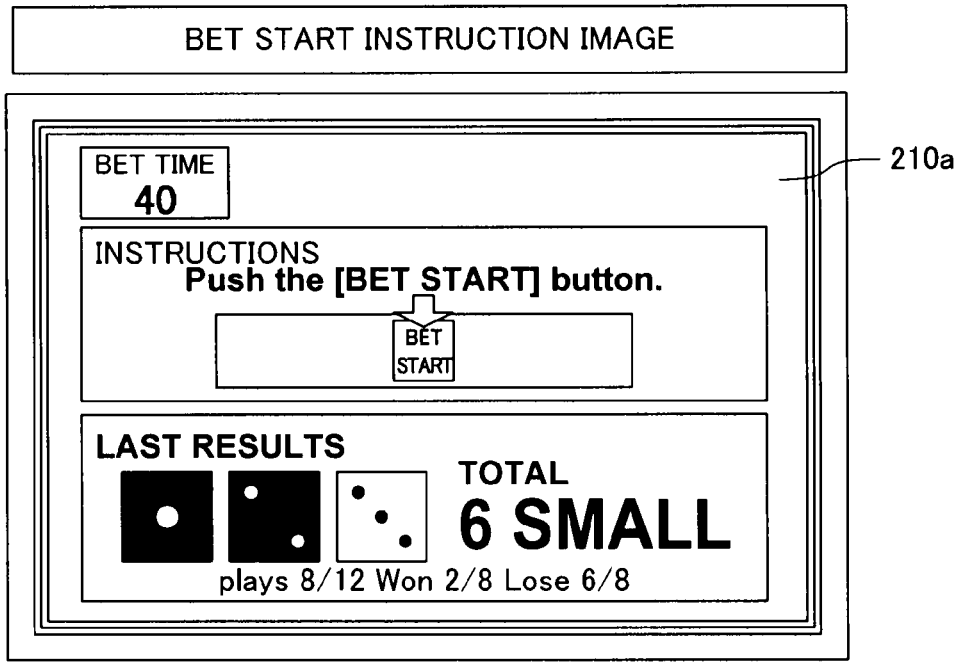

A bet start instruction image is described with reference to FIG. 23D.

The bet start instruction image is displayed by the CPU 81 on the display screen 210*a* of the dealer used display 210 before the CPU 81 accepts a bet from each station 4.

This bet start instruction image instructs a dealer to touch a "bet start" button. When a touch panel 211 detects that the dealer has touched the "bet start" button, the touch panel 211 transmits a bet start instruction signal to the CPU 81 via a communication interface 95.

Figure 24D:
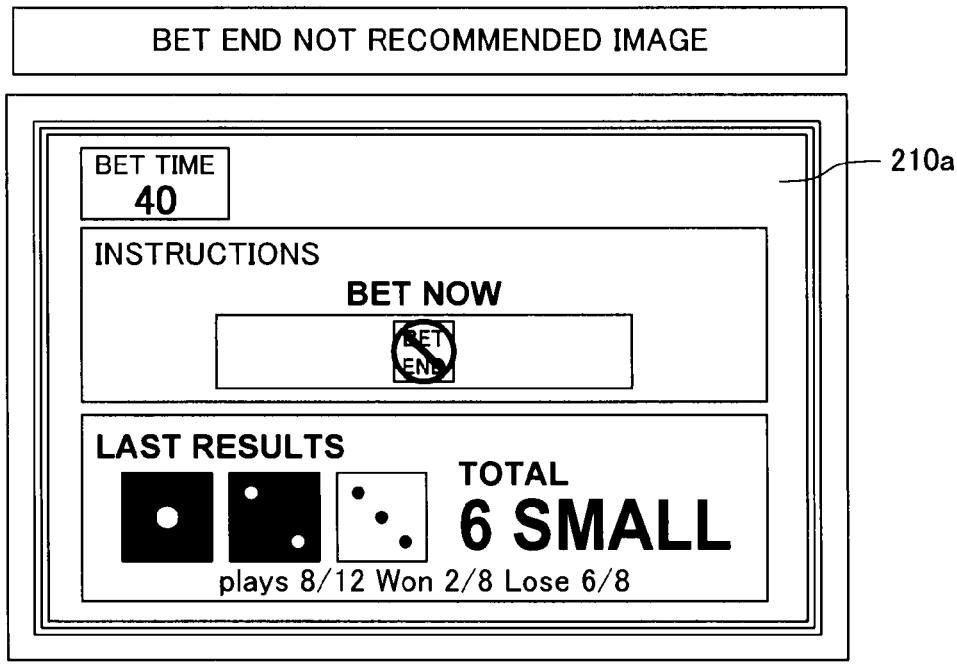
FIG. 24 is a number of dots-dot pattern data table according to the embodiment of the present invention.

A bet end not recommended image is described with reference to FIG. 24D.

This bet end not recommended image is displayed by the CPU 81 on the display screen 210*a* of the dealer used display 210 while the CPU 81 accepts a bet from each station 4.

This bet end not recommended image instructs the dealer not to touch a "bet end" button.

Figure 25D:
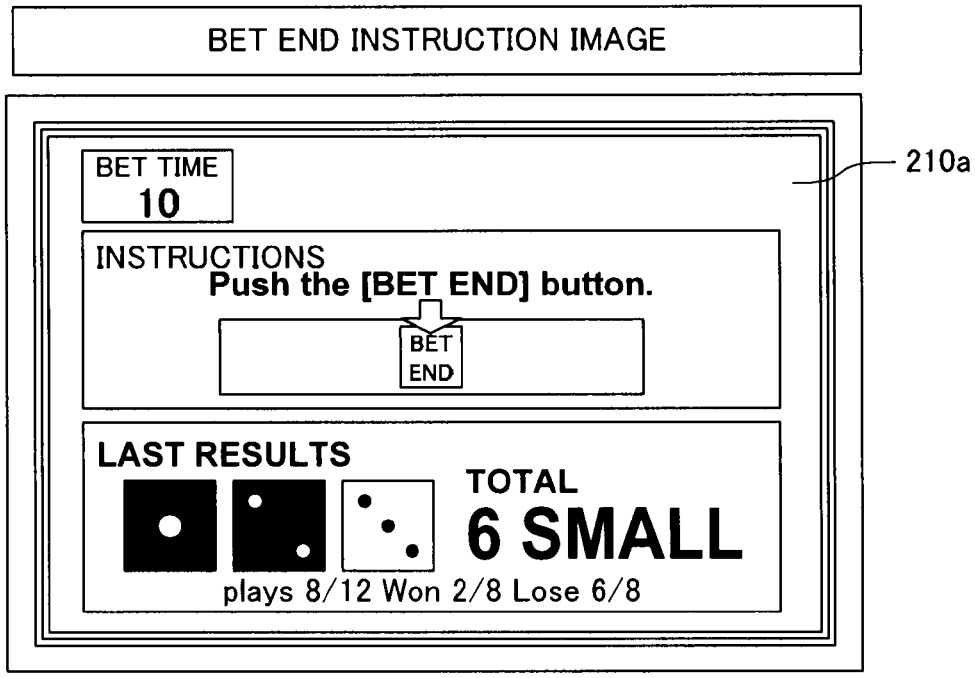

A bet end instruction image is described with reference to FIG. 25D.

The bet end instruction image is displayed by the CPU 81 on the display screen 210*a* of the dealer used display 210 after elapse of a predetermined time from when the CPU 81 starts accepting a bet from each station 4.

This bet end instruction image instructs the dealer to touch the "bet end" button. When the touch panel 211 detects that the dealer has touched the "bet end" button, the touch panel 211 transmits a bet end instruction signal to the CPU 81 via the communication interface 95.

A display example on the image display unit 7 of each station 4 is described with reference to FIG. 26D.

Figure 26D:
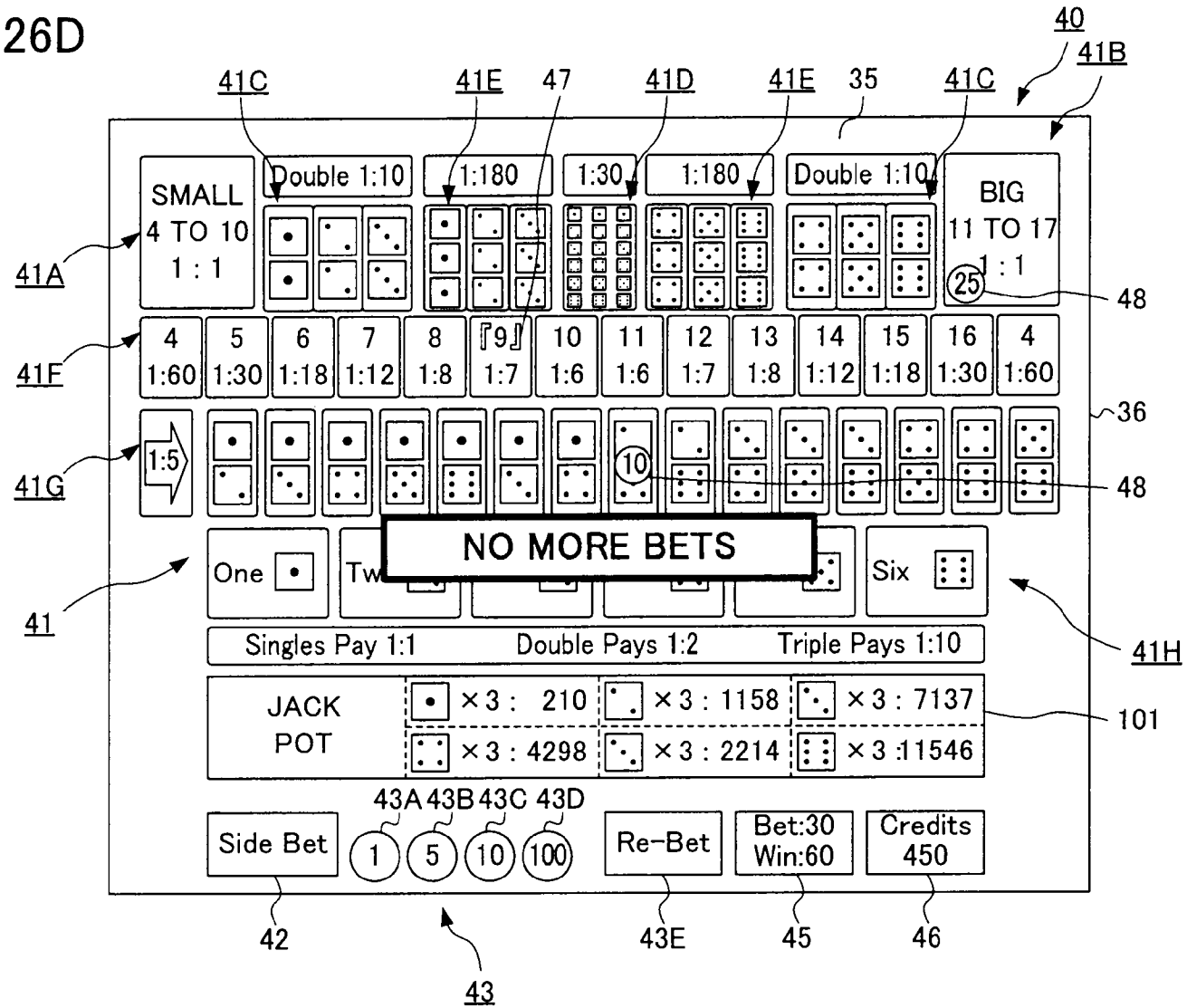

An image shown in FIG. 26D is configured to report to each station 4 that accepting of bets has ended. A player can recognize that the accepting of bets has ended by confirming that a message "NO MORE BETS" is displayed.

A display example on the image display unit 7 of each station 4 is described with reference to FIG. 27D.

Figure 27D:
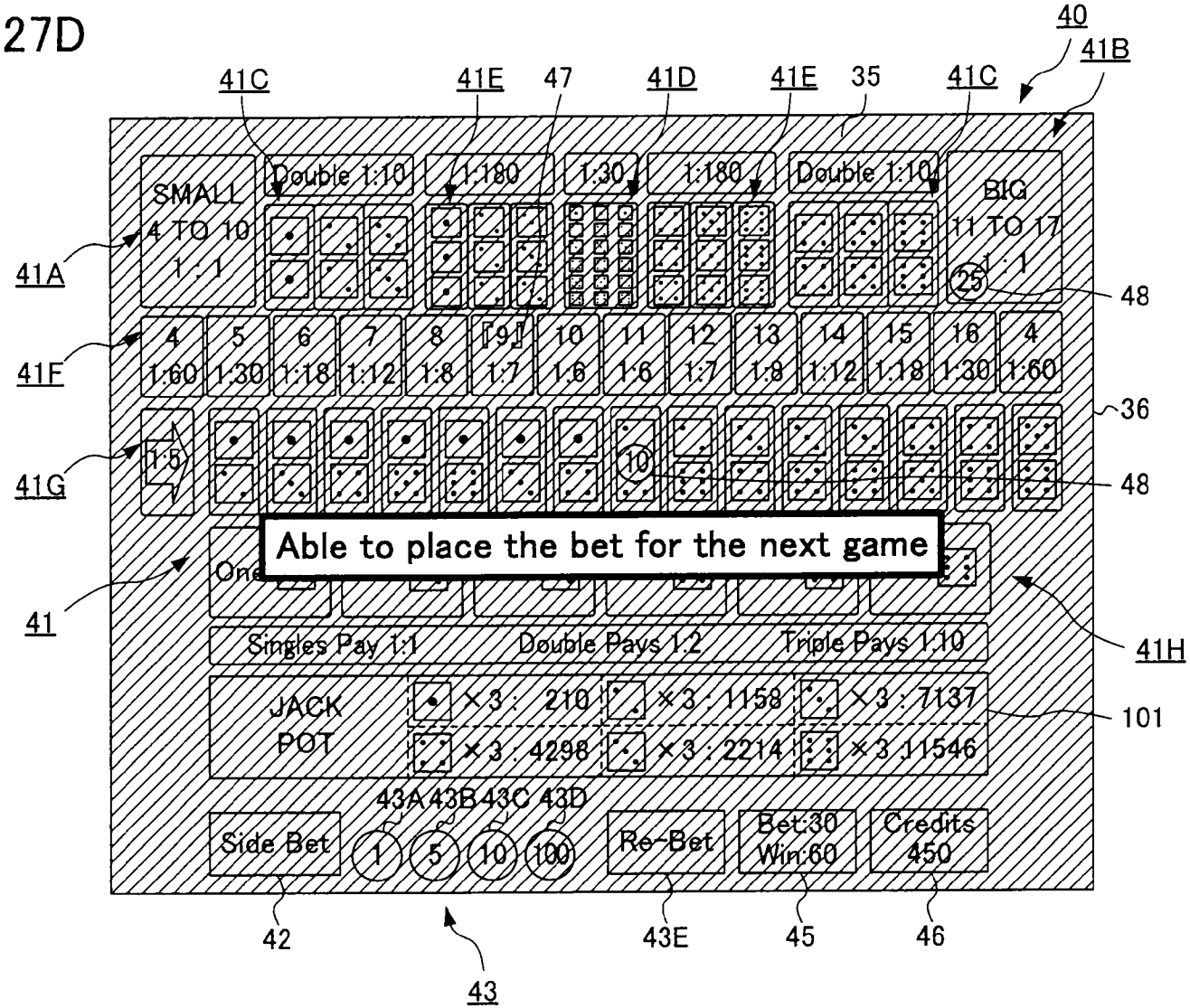

The image shown in FIG. 27D is configured to report to the station 4 in which a bet was not placed that a bet can be placed on a subsequent game. A player can recognize that a bet on the subsequent game is possible by confirming that a message "ABLE TO PLACE THE BET FOR THE NEXT GAME" is displayed.

Subsequently, with reference to FIGS. 28D to 33D, processing performed in the main control unit of a gaming machine according to the present embodiment is described.

Figure 28D:
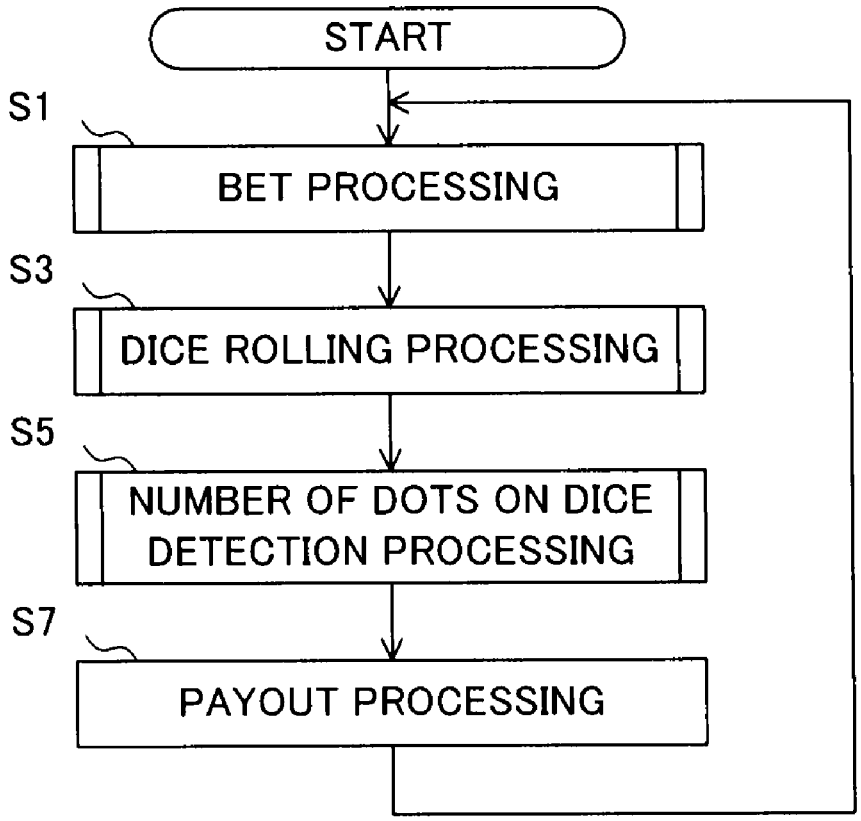
FIG. 28D is a flowchart showing dice game processing executed in a gaming machine according to the embodiment of the present invention.

FIG. 28D is a flowchart showing dice game execution processing. Initially, in Step S1, the CPU 81 executes bet processing, which is described later in FIG. 29D, and in Step S3, the CPU 81 executes dice rolling processing, which is described later in FIG. 31D. In Step S5, the CPU 81 executes number of dots on dice detection processing, which is described later in FIG. 33D and, in Step 7, executes payout processing corresponding to the number of dots, and then the flow returns to Step 1.

Figure 29D:
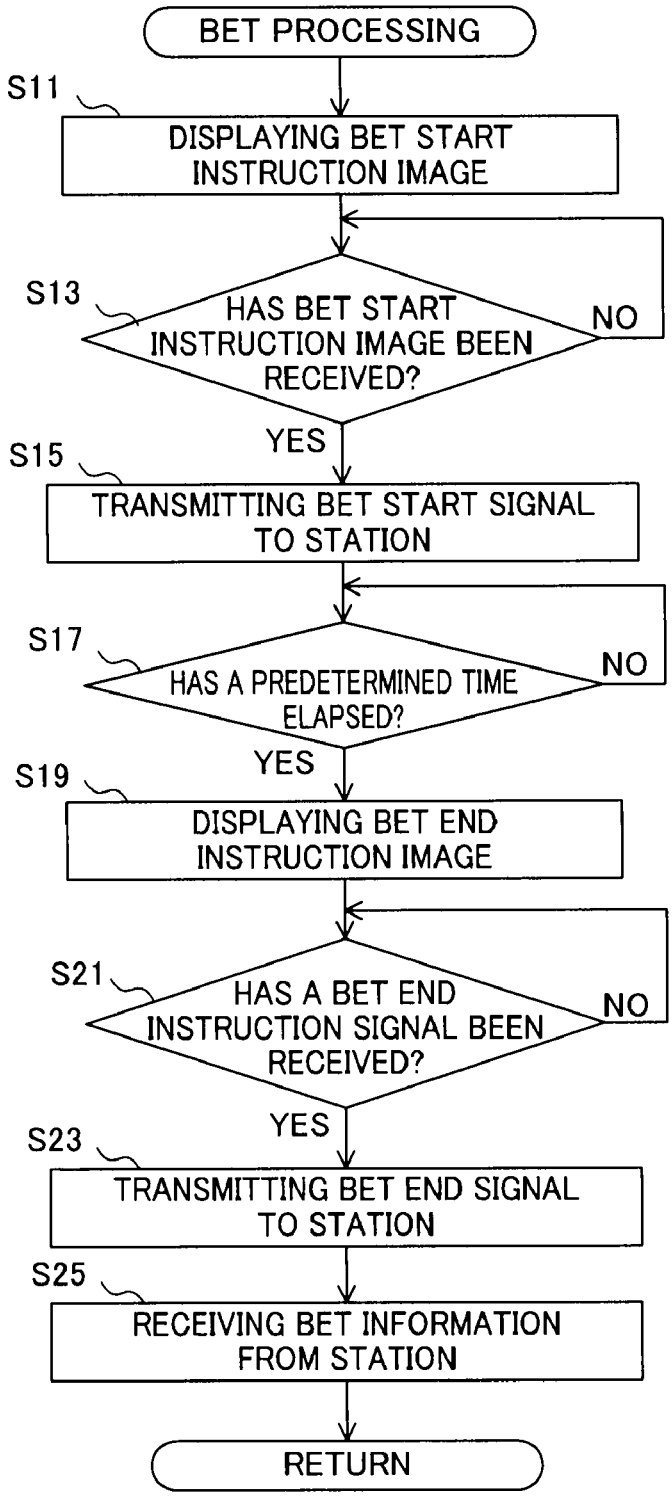
FIG. 29D is a flowchart showing bet processing executed in a gaming machine according to the embodiment of the present invention.

FIG. 29D is a flowchart showing bet processing.

In Step S11, the CPU 81 displays the bet start instruction image (see FIG. 23D) on the display screen 210*a* of the dealer used display 210. It should be noted that, whether or not the bet start instruction image is displayed may be determined according to a dealer's level with reference to the instruction image display determination (see FIG. 17D).

Thus, according to the dealer's level, it becomes possible to determine whether the bet start instruction image is displayed on the display screen 210*a* of the dealer used display 210.

In Step S13, the CPU 81 determines whether the bet start instruction signal has been received from the touch panel 211 disposed on the dealer used display 210. In the case of a NO determination, the CPU 81 returns the processing to Step S13, and in the case of a YES determination, the CPU 81 advances the processing to Step S15.

In Step S15, the CPU 81 transmits the bet start signal to each of the stations 4. When the bet start signal is received, bet placement can be performed at each station 4.

In Step S17, the CPU 106 determines whether or not a predetermined time has elapsed. More specifically, the CPU 81 starts to measure a predetermined lapse of time t by the timer 131, compares the predetermined lapse of time t with a predetermined time T1 stored in the ROM 82, and determines whether the predetermined lapse of time t measured by the timer 131 has reached the predetermined time T1. In the case of a NO determination, the CPU 81 returns the processing to Step S17, and in the case of a YES determination, the CPU 81 advances the processing to Step S19.

In Step S19, the CPU 81 displays the bet end instruction image (see FIG. 25D) on the display screen 210*a* of the dealer used display 210. It should be noted that, whether or not the bet end instruction image is displayed may be determined according to a dealer's level with reference to the instruction image display determination (see FIG. 17D).

In Step S21, the CPU 81 determines whether the bet end instruction signal has been received from the touch panel 211 disposed on the dealer used display 210. In the case of a NO determination, the CPU 81 returns the processing to Step S21, and in the case of a YES determination, the CPU 81 advances the processing to Step S23.

In Step S23, the CPU 81 transmits the bet end signal to each station 4. When the bet end signal is received, bet placement cannot be accepted at each station 4, and then the CPU 111 inside the station control unit 110 displays an image which reports on the image display unit 7that an accepting of bet placement has been terminated (FIG. 26D).

In Step S25, the CPU 81 receives bet information from each station 4. The bet information relates to a normal bet input and a side bet input performed at each station 4. In addition, the bet information includes information indicating whether bet placement has been performed or not which is included in the bet existence determination table (FIG. 18D). Upon terminating the processing of Step S25, the CPU 81 terminates the bet processing.

With the bet processing of the present embodiment, even an inexperienced dealer can perform start operations for bet placement and end operations according to instructional images.

FIG. 30D is a flowchart showing subsequent game bet processing.

Figure 32D:
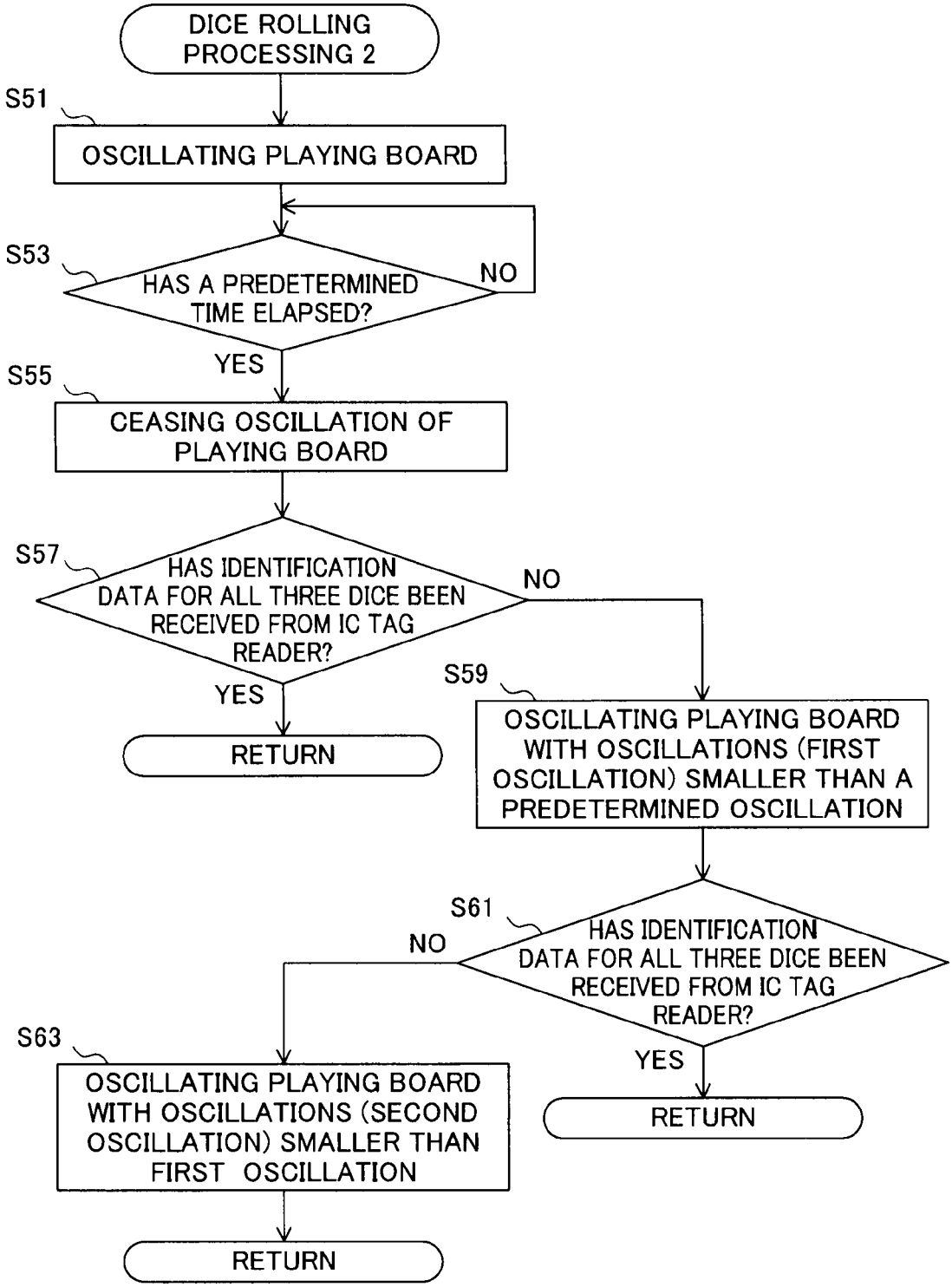
FIG. 32D is a flowchart showing dice rolling processing 2 executed in a gaming machine according to the embodiment of the present invention.

The subsequent game bet processing is started by the CPU 81 and executed parallel to the dice rolling processing 1 in FIG. 31D or the dice rolling processing 2 in FIG. 32D when the bet processing described in FIG. 29D is terminated. Therefore, placing a bet on the subsequent game becomes possible even during the dice rolling after termination of the bet processing.

In Step S31, the CPU 81 determines whether bet placement has been performed for each station 4. More specifically, the CPU 81 distinguishes stations at which bet placement has been performed from stations at which bet placement has not been performed with reference to the bet existence determination table (FIG. 18D).

In Step S33, the CPU 81 transmits a bet start signal for a subsequent game to the stations 4 at which bet placement has not been performed. When the station 4 receives the bet start signal for a subsequent game, the CPU 111 inside the station control unit 110 displays an image which reports that bet placement for a subsequent game is possible (FIG. 27D) on the image display unit 7.

Thus, even during a game, a player who has not participated in the game can place a bet on a subsequent game.

In Step S35, the CPU 81 determines whether or not a predetermined time has elapsed. More specifically, the CPU 81 starts to measure a predetermined lapse of time t by the timer 131, compares the predetermined lapse of time t with a predetermined time T2 stored in the ROM 82, and determines whether the predetermined lapse of time t measured by the timer 131 has reached the predetermined time T2. In the case of a NO determination, the CPU 81 returns the processing to Step S35, and in the case of a YES determination, the CPU 81 advances the processing to Step S37.

In Step S37, the CPU 81 transmits a bet end signal to the station 4 at which the bet start signal for a subsequent game has been received. When the station 4 receives the bet end signal, the player cannot place a bet on a subsequent game, and the CPU 81 terminates acceptance of bet placement for a subsequent game. Upon terminating the process in Step S37, the CPU 81 terminates the subsequent game bet processing.

FIG. 31D is a flowchart showing dice rolling processing 1.

In Step S41, the CPU 81 causes the playing board to oscillate. More specifically, the CPU 81 causes the playing board 3*a* to oscillate by controlling the oscillation motor 300. In this Step S41, the CPU 81 causes the playing board 3*a* to oscillate with a combination of oscillations larger than a predetermined oscillation A and oscillations smaller than the predetermined oscillation A.

In Step S43, the CPU 81 determines whether or not a predetermined time has elapsed. More specifically, the CPU 81 starts to measure a predetermined lapse of time t by the timer 131, compares the predetermined lapse of time t with a predetermined time T3 stored in the ROM 82, and determines whether the predetermined lapse of time t measured by the timer 131 has reached the predetermined time T3. In the case of a NO determination, the CPU 81 returns the processing to Step S43, and in the case of a YES determination, the CPU 81 advances the processing to Step S45.

In Step S45, the CPU 81 causes the playing board to oscillate with oscillations smaller than a predetermined oscillation A. More specifically, the CPU 81 causes the playing board 3*a* to oscillate with oscillations smaller than a predetermined oscillation A by controlling the oscillation motor 300.

In this way, for example, it is possible to prevent dice coming to rest leaning on a side wall, a plurality of dice coming to rest superimposing each other, and the like.

In Step S47, the CPU 81 causes oscillation of the playing board 3*a* to stop. More specifically, the CPU 81 causes the oscillation of the playing board 3*a* to cease by stopping the oscillation motor 300. Upon terminating the processing in Step S47, the CPU 81 terminates the dice rolling processing.

FIG. 32D is a flowchart showing dice rolling processing 2.

In Step S51, the CPU 81 causes the playing board to oscillate. More specifically, the CPU 81 causes the playing board 3*a* to oscillate by controlling the oscillation motor 300. In this Step 51, the CPU 81 causes the playing board 3*a* to oscillate with a combination of oscillations larger than a predetermined oscillation A and oscillations smaller than the predetermined oscillation A.

In Step S53, the CPU 81 determines whether or not a predetermined time has elapsed. More specifically, the CPU 81 starts to measure a predetermined lapse of time t by the timer 131, compares the predetermined lapse of time t with a predetermined time T4 stored in the ROM 82, and determines whether the predetermined lapse of time t measured by the timer 131 has reached the predetermined time T4. In the case of a NO determination, the CPU 81 returns the processing to Step S53, and in the case of a YES determination, the CPU 81 advances the processing to Step S55.

In Step S55, the CPU 81 causes oscillation of the playing board 3*a* to stop. More specifically, the CPU 81 causes the oscillation of the playing board 3*a* to cease by stopping the oscillation motor 300.

In Step S57, the CPU 81 determines whether identification data of the three dice has been received from the IC tag reader 16. In the case of a YES determination, the CPU 81 terminates the dice rolling processing 2, and in the case of a NO determination, the CPU 81 advances the processing to Step S59. More specifically, the CPU 81 determines whether there are three sets of identification data, which are identification data 1 to 3, in the IC tag data table (see FIG. 19D), received from the IC tag reader 16.

In Step S59, the CPU 81 causes the playing board to oscillate with oscillations (first oscillation) smaller than a predetermined oscillation A. More specifically, the CPU 81 causes the playing board 3*a* to oscillate with oscillations (first oscillation) smaller than a predetermined oscillation A by controlling the oscillation motor 300. Then, the CPU 81 causes the oscillation to stop after the elapse of a predetermined time T5.

Accordingly, for example, even in a case in which all of the number of dots of the three dice cannot be identified, after the playing board 3*a* is ceased, because of dice coming to rest leaning on a side wall, due to a plurality of dice superimposing each other, and the like, leaning and superimposing of the dice can be corrected.

In Step S61, the CPU 81 determines whether identification data of the three dice has been received from the IC tag reader 16. In the case of a YES determination, the CPU 81 terminates the dice rolling processing 2, and in the case of a NO determination, the CPU 81 advances the processing to Step S63. More specifically, the CPU 81 determines whether there are three sets of identification data, which are identification data 1 to 3, in the IC tag data table (see FIG. 19D), received from the IC tag reader 16.

In Step S63, the CPU 81 causes the playing board to oscillate with oscillations (second oscillation) larger than the first oscillation. More specifically, the CPU 81 causes the playing board 3*a* to oscillate with oscillations (second oscillation) larger than the first oscillation by controlling the oscillation motor 300. Then, the oscillation is ceased after the elapse of a predetermined time T6.

Accordingly, even in a case in which, after the playing board 3*a* is oscillated with the first oscillation during the predetermined time T5 in Step S59, all of the number of dots of the three dice cannot be identified because of a plurality of dice coming to rest superimposing each other, leaning and superimposing of the dice can be corrected.

Figure 33D:
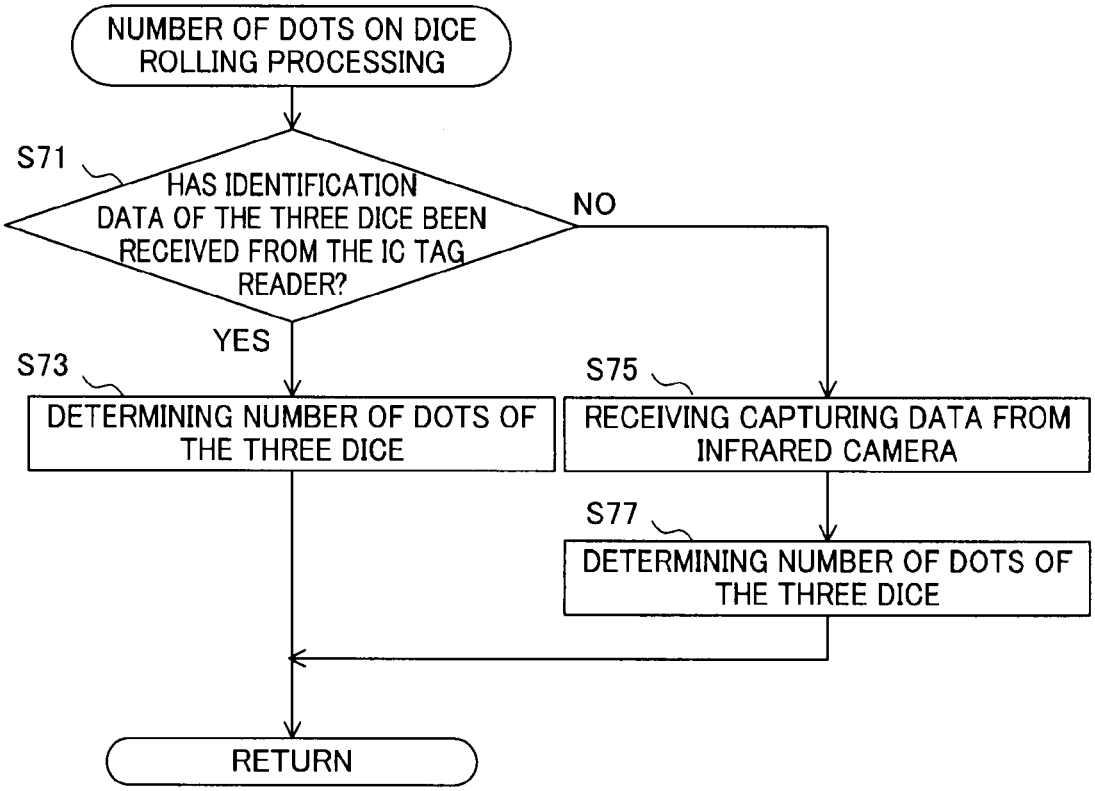
FIG. 33D is a flowchart showing dot detection processing executed in a gaming machine according to the embodiment of the present invention.

FIG. 33D is a flowchart showing number of dots on dice detection processing.

In Step S71, the CPU 81 determines whether identification data of the three dice has been received from the IC tag reader 16. In the case of a YES determination, the CPU 81 advances the processing to Step S73, and in the case of a NO determination, the CPU 81 advances the processing to Step S75. More specifically, the CPU 81 determines whether there are three sets of identification data, which are identification data 1 to 3, in the IC tag data table (see FIG. 19D) received from the IC tag reader 16.

In Step S73, the CPU 81 determines the number of dots on the three dice. More specifically, the CPU 81 determines the number of dots of the three dice by analyzing the identification data 1 to 3. For example, in a case where the identification data is data as shown in FIG. 19D, the number of dice of which type is red is "six", the number of dice of which type is white is "three", and the number of dice of which type is black is "five". Upon finishing the processing in Step S73, the CPU 81 terminates the number of dots detection processing.

In Step S75, the CPU 81 receives capturing data from the infrared camera. More specifically, the CPU 81 receives the infrared camera capturing data table (see FIG. 20D) for each of the dice 70*a*, 70*b*, and 70*c*, from the infrared camera 15.

In Step S77, the CPU 81 determines numbers of dots on the dice. More specifically, the CPU 81 determines positions of the dice on the playing board 3*a* based on the infrared camera capturing data table (see FIG. 20D), determines types (colors) of the dice based on the infrared camera capturing data table (see FIG. 20D) and the dot pattern data classification table (see FIG. 21D), and determines numbers of the dice based on the infrared camera capturing data table (see FIG. 20D) and the number of dots-dot pattern data table (see FIG. 22D). This processing is executed for the three dice 70*a*, 70*b*, and 70*c*. Upon terminating the processing in Step S77, the CPU 81 terminates the number of dots detection processing.

Thus, even in a case where, for example, a die is inclined and the number of dots thereof cannot be identified by the IC tag reader 16, since the number of dots can be determined using the infrared camera 15, the accuracy of detection and identification of numbers of dots can be improved. Descriptions regarding the present embodiment have been provided above. Although a case has been described in which the number of dice 70 is three according to the present embodiment, the number of in the present invention is not limited to three and, for example, the number of the dice may be five.

In the present embodiment, although the controller of the present invention is described for a case of being configured from a CPU 81 which the main controller 80 includes and a CPU 111 which the station 4 includes, the controller of the present invention may be configured by only a single CPU.

Although embodiments of the present invention are described above, they are merely exemplified specific examples, and the present invention is not particularly limited thereto. Specific configurations such as each means can be modified appropriately. Moreover, it should be understood that the advantages described in association with the embodiments are merely a listing of most preferred advantages, and that the advantages of the present invention are by no means restricted to those described in connection with the embodiments.

What is claimed is:

1. A gaming machine comprising:

a playing unit in which a plurality of dice rolls and comes to rest;

an oscillation device that oscillates the playing unit;

memory that stores a plurality of sets of oscillation pattern data corresponding to each of a plurality of oscillation patterns based on which the playing unit is oscillated by the oscillation device; and a controller that executes processing for:

(a) starting a unit game;

(b) extracting one set of the oscillation pattern data from the memory at random when the unit game is started; and (c) performing control to oscillate the playing unit based on the one set of the oscillation pattern data thus extracted.

2. The gaming machine according of claim 1, wherein the oscillation pattern is configured with a combination of types of oscillation modes.

3. The gaming machine according to claim 2, wherein the playing unit is formed to be substantially planar, and the combination of types of oscillation modes are a combination of various amplitudes of oscillation at which the playing unit oscillates substantially in the vertical direction with respect to the playing unit.

4. A gaming machine comprising:

a table on which a die is placed on an upper surface;

a shaft installed to be upright at a lower surface of the table;

a linear actuator that drives the shaft in a vertical direction;

a base, provided below the table, for supporting the linear actuator; and a control device to control the linear actuator so as to move the table up and down, to roll the dice on the table, and to cease the vertical movement of the table, wherein a spring member for biasing the table to an upper side is provided between the table and the base, wherein the control device controls the linear actuator so as to switch an amplitude of vertical movement of the table in a stepwise manner.

5. The gaming machine according to claim 4, wherein the control device controls the linear actuator to minimize an amplitude of a vertical movement of the table and then to cease the vertical movement thereof.

6. A gaming machine comprising:

a table on which a die is placed;

a shaft installed to be upright to the table in a vertical direction;

a cylindrical linear actuator that is fixed below the table, has an opening into which the shaft is inserted, and applies a thrust force to drive the shaft in a vertical direction; and a control device that controls the linear actuator so as to move the table up and down, rolls the dice on the table, and ceases the vertical movement of the table, wherein a groove in a vertical direction is formed in any one of the linear actuator and the shaft, a convex portion is formed in the other, and the convex portion is positioned inside the groove when the shaft is inserted into the opening.

7. The gaming machine according to claim 6, wherein:

the shaft includes magnetizing regions that are formed to be arranged in a vertical direction on a surface of the shaft and are magnetized so that adjacent magnetic poles are different from each other, the linear actuator includes coils that are arranged side by side in a vertical direction, and when the shaft is inserted into the opening, the coils and the magnetizing regions are facing, and by applying electrical current to the coils to excite the coils and then generating attracting and repelling force based on magnetic force between the coils and the magnetizing regions, a thrust force is generated on the shaft.

8. The gaming machine according to claim 6, wherein the control device controls the linear actuator so as to switch an amplitude of a vertical movement of the table in a stepwise manner.

9. The gaming machine according to claim 8, wherein the control device controls the linear actuator to minimize an amplitude of a vertical movement of the table and then to cease the vertical movement thereof.

10. A gaming machine comprising:

a table on which a die is placed;

a shaft installed upright to the table in a vertical direction;

a cylindrical linear actuator that is fixed below the table, has an opening into which the shaft is inserted, and applies a thrust force to drive the shaft in a vertical direction; and a control device that controls the linear actuator so as to move the table UP and down, roll the dice on the table, and cease the vertical movement of the table, wherein:

the shaft includes magnetizing regions that are formed to be aligned in a vertical direction on a surface thereof and are magnetized so that adjacent magnetic poles are different from each other, the linear actuator includes coils that are arranged side by side in an vertical direction, when the shaft is inserted into the opening, the coils and the magnetizing regions are facing, and a thrust force is generated on the shaft according to attraction and repulsion by magnetic force of the coil and magnetic force of the magnetizing regions, which is generated by applying electrical current to the coils to excite the coils, and the control device controls a vertical position of the table, wherein the control device controls the linear actuator so as to switch an amplitude of vertical movement of the table in a stepwise manner.

11. The gaming machine according to claim 10, wherein the control device controls the linear actuator to minimize an amplitude of vertical movement of the table and then to cease vertical movement thereof.

12. A gaming machine comprising:

a playing unit that is substantially horizontal and on which a plurality of dice rolls and comes to rest;

an oscillation device that causes the playing unit to oscillate substantially in a vertical direction with respect to the playing unit; and a controller that executes processing of:

(a) starting a unit game;

(b) when the unit game is started, performing control that causes the playing unit to oscillate for a predetermined time with a combination of oscillations larger than a predetermined oscillation and oscillations smaller than the predetermined oscillation;

(c) after elapse of the predetermined time, performing control that causes the playing unit to oscillate with oscillations smaller than the predetermined oscillation; and (d) performing control that ceases the oscillation of the playing unit.

* * * * *